US007292236B2

(12) United States Patent
Abe et al.

(10) Patent No.: US 7,292,236 B2
(45) **Date of Patent: *Nov. 6, 2007**

(54) DISPLAY DRIVING METHOD AND DISPLAY APPARATUS UTILIZING THE SAME

(75) Inventors: Naoto Abe, Tokyo (JP); Osamu Sagano, Tokyo (JP); Muneki Ando, Kanagawa (JP); Hiroshi Saito, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 28 days.

This patent is subject to a terminal disclaimer.

(21) Appl. No.: 11/141,383

(22) Filed: Jun. 1, 2005

(65) Prior Publication Data

US 2005/0231498 A1 Oct. 20, 2005

Related U.S. Application Data

(62) Division of application No. 10/184,905, filed on Jul. 1, 2002, now Pat. No. 6,985,141.

(30) Foreign Application Priority Data

| | | | |
|---|---|---|---|
| Jul. 10, 2001 | (JP) | ..... | 2001-210066 |
| Jul. 31, 2001 | (JP) | ..... | 2001-232591 |
| Nov. 29, 2001 | (JP) | ..... | 2001-364562 |

(51) Int. Cl.
*G09G 5/00* (2006.01)

(52) U.S. Cl. ..... 345/204; 345/1.1; 345/8

(58) Field of Classification Search ..... 345/84–89, 345/94, 95, 204, 100–102, 108, 75.2, 55, 345/691, 75.1, 1.1, 694; 349/8, 33; 348/489
See application file for complete search history.

(56) References Cited

U.S. PATENT DOCUMENTS

| | | | | |
|---|---|---|---|---|
| 4,939,572 | A | 7/1990 | Kosaka et al. | 348/489 |
| 5,066,883 | A | 11/1991 | Yoshioka et al. | 313/309 |
| 5,191,450 | A | 3/1993 | Yajima et al. | 349/8 |
| 5,682,085 | A | 10/1997 | Suzuki et al. | 315/169.1 |
| 5,790,089 | A | 8/1998 | Ono et al. | 345/94 |
| 6,072,457 | A | 6/2000 | Hashimoto et al. | 345/100 |
| 6,229,583 | B1 | 5/2001 | Yasunishi | 349/33 |

(Continued)

FOREIGN PATENT DOCUMENTS

| | | |
|---|---|---|
| EP | 0 686 993 A1 | 12/1995 |
| EP | 0 936 596 A1 | 8/1999 |
| JP | 8-248920 | 9/1927 |
| JP | 64-073390 | 3/1989 |
| JP | 2-257551 | 10/1990 |

(Continued)

*Primary Examiner*—Prabodh Dharia
(74) *Attorney, Agent, or Firm*—Fitzpatrick, Cella, Harper & Scinto

(57) ABSTRACT

In order to obtain a satisfactory image by making a peak luminance of an image to be displayed large and suppressing an occurrence of unnecessary period, there is provided a display driving method for driving a display with a plurality of scanning wirings and a plurality of modulation wirings, comprising: a step of supplying a scan selection signal to a scanning wiring selected out of the plural scanning wirings for each horizontal scanning period; and a step of supplying a modulation signal modulated in accordance with image data to the plural modulation wirings for each horizontal scanning period, in which the selection period of the scan selection signal varies between at least two horizontal scanning periods in a vertical scanning period.

42 Claims, 76 Drawing Sheets

U.S. PATENT DOCUMENTS

| | | | | |
|---|---|---|---|---|
| 6,266,039 | B1 | 7/2001 | Aoki | 345/94 |
| 6,313,571 | B1 | 11/2001 | Hasegawa et al. | 313/309 |
| 6,549,187 | B1 | 4/2003 | Matsubara et al. | 345/96 |
| 6,690,344 | B1 | 2/2004 | Takeuchi et al. | 345/85 |
| 6,870,522 | B2 * | 3/2005 | Sagano et al. | 345/75.2 |
| 6,972,741 | B1 * | 12/2005 | Isono et al. | 345/75.2 |
| 2001/0003446 | A1 | 6/2001 | Takafuji | 345/98 |
| 2001/0043205 | A1 | 11/2001 | Huang et al. | 345/204 |
| 2003/0016195 | A1 * | 1/2003 | Sagano et al. | 345/75.2 |
| 2003/0063110 | A1 * | 4/2003 | Sagano et al. | 345/694 |
| 2004/0001039 | A1 * | 1/2004 | Shino et al. | 345/100 |
| 2006/0007069 | A1 * | 1/2006 | Isono et al. | 345/75.1 |
| 2006/0227078 | A1 * | 10/2006 | Shino et al. | 345/75.2 |

FOREIGN PATENT DOCUMENTS

| | | |
|---|---|---|
| JP | 4-28137 | 1/1992 |
| JP | 7-235256 | 9/1995 |
| JP | 8-45415 | 2/1996 |
| JP | 09-218672 | 8/1997 |
| JP | 10-39825 | 2/1998 |
| JP | 11-161223 | 6/1999 |
| JP | 2000-29425 | 1/2000 |
| JP | 2000-250458 | 9/2000 |
| JP | 2000-250461 | 9/2000 |
| JP | 2001-331143 | 11/2001 |

* cited by examiner $$CA=((Xn+1-x)*CData[k][n]+(x-Xn)*CData[k][n+1])/(Xn+1-Xn)$$

$$CB=((Xn+1-x)*CData[k+1][n]+(x-Xn)*CData[k+1][n+1])/(Xn+1-Xn)$$

$$CD=CA*(Dk+1-data)+CB*(data-Dk)/(Dk+1-Dk)$$

EMISSION CURRENT PULSE AT NO VOLTAGE DROP

ACTUAL EMISSION CURRENT PULSE

EMISSION CURRENT PULSE AFTER ADJUSTMENT

NOTE : IE IS EMISSION CURRENT AT NO VOLTAGE DROP

NOTE: IE IS EMISSION CURRENT AT NO VOLTAGE DROP

EMISSION CURRENT PULSE AT NO VOLTAGE DROP

ACTUAL EMISSION CURRENT PULSE

EMISSION CURRENT PULSE
AFTER ADJUSTMENT

141
CPU ADDRESS BUS
CPU DATA BUS
CData[i][j]
REGISTER GROUP
106
PROGRAM MEMORY
105
CPU
102
TIMING SIGNAL CPU CLOCK
TEMPORARY REGISTER
104
TABLE MEMORY 2
111
TABLE MEMORY
103
REGISTER GROUP A
101a
REGISTER GROUP B
101b
REGISTER GROUP C
101c
REGISTER GROUP D
101d
COUNT FOR THE NUMBER OF TURN-ON DEVICES
100a
100b
100c
100d
Cval
0
64
128
192
Ra
Ga
Ba COUNT FOR THE NUMBER OF TURN-ON DEVICES
A
B
Comp
?A>B
107a
107b
107c
1
2
108
109
110
Ra
Ga
Ba
Cval

FIG. 29

| HORIZONTAL SCAN LINE No. | MINIMUM DISPLAY HORIZONTAL SCANNING PERIOD (KHDmin) (Pwmclk NUMBER) | maxDi (Pwmclk NUMBER) | NON-DRIVE PERIOD (Pwmclk NUMBER) | DISPLAY HORIZONTAL SCANNING PERIOD (Pwmclk NUMBER) | DISPLAY HORIZONTAL SCANNING PERIOD (MCLK NUMBER) |
|---|---|---|---|---|---|
| 1 | 89 | 120 | 24 | 144 | 848 |
| 2 | 89 | 60 | 24 | 89 | 524 |
| 3 | 89 | 120 | 24 | 144 | 848 |
| 4 | 89 | 250 | 24 | 274 | 1613 |
| 5 | 89 | 350 | 24 | 374 | 2202 |
| 6 | 89 | 200 | 24 | 224 | 1319 |
| 7 | 89 | 320 | 24 | 344 | 2025 |
| : | : | : | : | : | : |
| 715 | 89 | 320 | 24 | 344 | 2025 |
| 716 | 89 | 300 | 24 | 324 | 1907 |
| 717 | 89 | 120 | 24 | 144 | 848 |
| 718 | 89 | 80 | 24 | 104 | 613 |
| 719 | 89 | 30 | 24 | 89 | 524 |
| 720 | 89 | 20 | 24 | 89 | 524 |
| 721 | 89 | 0 | 0 | 89 | 524 |
| 722 | 89 | 0 | 0 | 89 | 524 |
| 723 | 89 | 0 | 0 | 89 | 524 |
| 724 | 89 | 0 | 0 | 89 | 524 |
| 725 | 89 | 0 | 0 | 89 | 524 |
| 726 | 89 | 0 | 0 | 89 | 524 |
| 727 | 89 | 0 | 0 | 89 | 524 |
| 728 | 89 | 0 | 0 | 89 | 524 |
| TOTAL | | | | 210000 | 1236000 |

FIG. 41

| HORIZONTAL SCAN LINE No. | MINIMUM DISPLAY HORIZONTAL SCAN PERIOD (KHDmin) (Pwmclk NUMBER) | maxDi (Pwmclk NUMBER) | NON-DRIVING PERIOD (Pwmclk NUMBER) | DISPLAY HORIZONTAL SCAN PERIOD (Pwmclk NUMBER) | DISPLAY HORIZONTAL SCAN PERIOD (MCLK NUMBER) |
|---|---|---|---|---|---|
| 1 | 520 | 480 | 74 | 554 | 1108 |
| 2 | 520 | 320 | 74 | 520 | 1040 |
| 3 | 520 | 480 | 74 | 554 | 1108 |
| 4 | 520 | 768 | 74 | 842 | 1684 |
| 5 | 520 | 192 | 74 | 520 | 1040 |
| 6 | 520 | 512 | 74 | 586 | 1172 |
| 7 | 520 | 768 | 74 | 842 | 1684 |
| : | : | : | : | : | : |
| 715 | 520 | 896 | 74 | 970 | 1940 |
| 716 | 520 | 768 | 74 | 842 | 1684 |
| 717 | 520 | 832 | 74 | 906 | 1812 |
| 718 | 520 | 768 | 74 | 842 | 1684 |
| 719 | 520 | 640 | 74 | 714 | 1428 |
| 720 | 520 | 480 | 74 | 554 | 1108 |
| 721 | 520 | 0 | 0 | 520 | 1040 |
| 722 | 520 | 0 | 0 | 520 | 1040 |
| 723 | 520 | 0 | 0 | 520 | 1040 |
| 724 | 520 | 0 | 0 | 520 | 1040 |
| 725 | 520 | 0 | 0 | 520 | 1040 |
| 726 | 520 | 0 | 0 | 520 | 1040 |
| ⋮ | ⋮ | ⋮ | ⋮ | ⋮ | ⋮ |
| 748 | 520 | 0 | 0 | 520 | 1040 |
| 749 | 520 | 0 | 0 | 520 | 1040 |
| 750 | 520 | 0 | 0 | 520 | 1040 |
| TOTAL | | | | 618000 | 1236000 |

| SCAN WIRING NUMBER | 1H MCLK NUMBER | SCLK NUMBER (Pwmclk NUMBER) | MAXpwm |
|---|---|---|---|
| 1-60 | 1328 | 664 | 590 |
| 61-120 | 1328 | 664 | 590 |
| 121-180 | 1536 | 768 | 694 |
| 181-240 | 1816 | 908 | 834 |
| 241-300 | 1984 | 992 | 918 |
| 301-360 | 2048 | 1024 | 950 |
| 361-420 | 2048 | 1024 | 950 |
| 421-480 | 1984 | 992 | 918 |
| 481-540 | 1816 | 908 | 834 |
| 541-600 | 1536 | 768 | 694 |
| 601-660 | 1328 | 664 | 590 |
| 661-720 | 1328 | 664 | 590 |
| 721-744 | 1328 | 664 | 590 |

FIG. 61

| SCAN WIRING NUMBER | 1H MCLK NUMBER | SCLK NUMBER (Pwmclk NUMBER) | MAXpwm | GAIN |
|---|---|---|---|---|
| 1-60 | 1328 | 664 | 590 | 0.577 |
| 61-120 | 1328 | 664 | 590 | 0.577 |
| 121-180 | 1536 | 768 | 694 | 0.678 |
| 181-240 | 1816 | 908 | 834 | 0.815 |
| 241-300 | 1984 | 992 | 918 | 0.897 |
| 301-360 | 2048 | 1024 | 950 | 0.929 |
| 361-420 | 2048 | 1024 | 950 | 0.929 |
| 421-480 | 1984 | 992 | 918 | 0.897 |
| 481-540 | 1816 | 908 | 834 | 0.815 |
| 541-600 | 1536 | 768 | 694 | 0.678 |
| 601-660 | 1328 | 664 | 590 | 0.577 |
| 661-720 | 1328 | 664 | 590 | 0.577 |
| 721-744 | 1328 | 664 | 590 | 0.577 |

| |
|---|
| FIG. 62A |
| FIG. 62B |
| FIG. 62C |

DISPLAY DRIVING METHOD AND DISPLAY APPARATUS UTILIZING THE SAME

This application is a division of U.S. application Ser. No. 10/184,905, filed Jul. 1, 2002, now U.S. Pat. No. 6,985,141, the entire content of which is incorporated herein by reference.

BACKGROUND OF THE INVENTION

1. Field of the Invention

The present invention relates to display apparatus for displaying an image with a display device such as an electron-emitting device, an electroluminescent (EL) device, an LED device, a plasma light-emitting device, and a liquid crystal device, and to a method of driving the display apparatus.

Specifically, the invention relates to a multiplexing drive method for a matrix display with a plurality of self-luminous display devices arranged to form a matrix pattern.

2. Related Background Art

The above plural display devices control, to display images, signals that are to be supplied to a matrix wiring consisting of a plurality of row-directional wirings (scanning wirings) and a plurality of column-directional wirings (modulation wirings).

Hereinafter matrix displays are described taking as an example a self-luminous display that uses light emitted from a phosphor to form an image.

In this type of displays, energy of particles emitted from an electron-emitting device or the like is utilized to excite a phosphor. The brightness of the obtained light varies depending on to what degree the phosphor is excited and/or how long it is excited.

Such display apparatus is disclosed in, for example, Japanese Patent Application Laid-Open No. 07-235256 (U.S. Pat. No. 6,313,571), Japanese Patent Application Laid-Open No. 08-45415, Japanese Patent Application Laid-Open No. 2000-29425 (European Patent No. 936,596), and Japanese Patent Application Laid-Open No. 08-248920.

FIG. 76A shows an example of drive signals for driving a conventional display and FIG. 76B shows a display state of a 3 rows×3 columns matrix display using these drive signals.

Here, one vertical scanning period for displaying one frame of image consists of three horizontal scanning periods, and Sy1, Sy2, and Sy3 each represents a scan signal supplied to a scanning wiring. Here, a horizontal scanning period is a selection period in which a negative voltage is applied in each scanning wiring, and all the scanning wirings have the same length of selection period.

Sx1, Sx2, and Sx3 each represents a modulation signal (data signal) supplied to a modulation wiring. In the example shown here, the modulation signals are of pulse width modulation system in which the pulse width is modulated in accordance with the luminance level (gradation) of a pixel. The modulation signal Sx1 represents signals with which the luminance levels to be obtained are 1, 1, and 3, and which are supplied in time series to a modulation wiring. Similarly, the modulation signal Sx2 represents signals with which the luminance levels to be obtained are 1, 2, and 2, and the modulation signal Sx3 represents signals with which the luminance levels to be obtained are 1, 1, and 1.

In this way, the scanning wirings are selected one at a time to set the luminance for each of the three pixels on the selected row in each horizontal scanning period. Here, the pixel on Low 3, Column 1 is given a luminance level of 3 and emits the brightest light.

Generally speaking, display apparatus with bright screens are preferred to those with less bright ones. When an overall dark image includes some bright spots, in particular, it is desirable if display apparatus can give the bright spots a far higher luminance (peak luminance) compared to the luminance of the dark part of the image in order to display the details of the dark part with good image quality.

However, in display apparatus of so-called line sequential scanning that employs time division to select scanning wirings one at a time as described above, the maximum light emission time of each pixel generally cannot exceed the length of selection period within a horizontal scanning period and the display luminance of the display apparatus is accordingly limited.

Furthermore, a period in which a scan selection signal is applied but a modulation signal is not applied is wasteful, except a blanking period necessary for other processing, since a voltage is applied to a scanning wiring in this period yet it does not contribute to light emission of pixels.

SUMMARY OF THE INVENTION

An object of the present invention is to provide a display driving method capable of obtaining a quality image by increasing the peak luminance of an image displayed, and to provide a display apparatus utilizing the driving method.

Another object of the present invention is to provide a display driving method capable of obtaining a quality image by avoiding a wasteful period, and to provide a display apparatus utilizing the driving method.

According to the main point of present invention, there is provided a display driving method for driving a display with a plurality of scanning wirings and a plurality of modulation wirings, characterized by comprising: a step of supplying a scan selection signal to a scanning wiring selected out of the plural scanning wirings for each horizontal scanning period; and a step of supplying a modulation signal modulated in accordance with image data to the plural modulation wirings for each horizontal scanning period, in which the selection period of the scan selection signal varies between at least two horizontal scanning periods in a vertical scanning period.

In the present invention, it is preferable that the following structures are adopted if necessary.

The selection period of the scan selection signal supplied to the scanning wiring in a horizontal scan period is determined so as to have a length according to the maximum duration of a modulation signal supplied to the respective modulation wirings in the horizontal scanning period.

The selection period of the scan selection signal supplied to the scanning wiring is set and the duration of a modulation signal supplied to the modulation wirings in a horizontal scanning period is determined in accordance with the set selection period.

A horizontal scanning period is set, and the selection period of the scan selection signal supplied to the scanning wiring in the horizontal scanning period as well as the duration of a modulation signal supplied to the modulation wirings in the horizontal scanning period are determined in accordance with the set horizontal scanning period.

The selection period of the scan selection signal supplied to a scanning wiring is determined in accordance with the maximum value of display luminance or adjusted image data of pixels on the selected scanning wirings.

An upper limit value or lower limit value, or both, are set for a horizontal scanning period and the horizontal scanning period is changed within a variable range set by the limit value(s).

The frame scanning period of a display image, which is determined by the sum of the horizontal scanning periods, is kept constant at least for over several frame scanning periods.

A lower limit value is set for the horizontal scanning period and, when the maximum duration of a modulation signal supplied to the modulation wirings in the horizontal scanning period does not reach the lower limit value, a blanking period is added to the modulation signal.

A lower limit value is set for the horizontal scanning period and, when the selection period of the scan selection signal supplied in the horizontal scanning period does not reach the lower limit value, a blanking period is added to the scan selection signal.

An upper limit value is set for the horizontal scanning period and the duration of a modulation signal is determined such that the maximum duration of the modulation signal supplied to the modulation wirings in the horizontal scanning period does not exceed the upper limit value.

The upper limit value is a value obtained by subtracting a given blanking period from the horizontal scanning period.

The length of the horizontal scanning period is controlled with the clock number as reference;

The image data includes luminance data of an image signal inputted and at least the duration of the modulation signal is modulated in accordance with the luminance data.

The image data includes luminance data and correction data of an image signal inputted and at least the duration of the modulation signal is determined in accordance with the luminance data and with the correction data.

The correction data is correction data for compensating the difference between a desired luminance and display luminance.

The correction data is correction data for compensating a change in voltage applied to a display device due to voltage drop taking place in the scanning wiring.

Each horizontal scanning period set in accordance with luminance data and correction data of an image signal inputted receives gain adjustment and/or upper limit value adjustment.

Gain adjustment is made on each horizontal scanning period set in accordance with luminance data and correction data of an image signal inputted so that a vertical scanning period of a display image, which is determined by the sum of the horizontal scanning periods, does not exceed a given value.

A horizontal scanning period of a pixel on a scanning wiring at the center of a screen of display apparatus is longer than at least a horizontal scanning period of a pixel on another scanning wiring around the top or bottom of the screen.

The image data receives gain adjustment at a magnification set in accordance with each horizontal scanning period, and then is supplied to a modulation drive circuit.

According to another main point of the present invention, there is provided a display apparatus, characterized by comprising: a display having a plurality of scanning wirings and a plurality of modulation wirings; a scan drive circuit for supplying a scan selection signal to a scanning wiring selected out of the plural scanning wirings for each horizontal scanning period; and a modulation drive circuit for supplying a modulation signal modulated in accordance with image data to the plural modulation wirings for each horizontal scanning period, in which the apparatus further comprises a drive control circuit for controlling the scan drive circuit such that the selection period of the scan selection signal varies between at least two horizontal scanning periods in a vertical scanning period.

According to the present invention, it is preferable that the following structures are adopted if necessary.

The drive control circuit detects from an image signal inputted the maximum value of luminance data in each horizontal scanning period, and sets the selection period of the scan selection signal in accordance with the maximum value.

The drive control circuit detects from an image signal inputted the maximum value of adjusted image data obtained by correcting luminance data in each horizontal scanning period, and sets the selection period of the scan selection signal in accordance with the maximum value.

The drive control circuit determines the selection period of the scan selection signal and the duration of the modulation signal in accordance with a horizontal scanning period set within a variable range in which a horizontal scanning period is allowed to change.

The drive control circuit detects from an image signal inputted the maximum value of adjusted image data obtained by correcting luminance data in each horizontal scanning period, and sets the selection period of the scan selection signal in accordance with the maximum value, and at least one horizontal scanning period is adjusted such that a vertical scanning period of a display image, which is determined by the sum of the horizontal scanning periods, reaches a given value.

The apparatus further comprises a gain adjuster and/or a limiter for the adjustment of at least one horizontal scanning period.

The drive control circuit is provided with a frame memory for storing one frame of adjusted image data obtained from an inputted image signal by correcting luminance data in each horizontal scanning period in order to adjust horizontal scanning periods.

The frame memory has two frame memories and is controlled such that data is read out of one of the frame memories while data is written in the other;

Adjusted image data of one horizontal scanning period are read out of the frame memory in layers in parallel, and the layers of adjusted image data are inputted to a plurality of shift registers provided for each layer.

The drive control circuit determines the selection period of the scan selection signal and the duration of the modulation signal in accordance with each of set horizontal scanning periods.

The vertical scanning period of a display image, which is determined by the sum of the horizontal scanning periods, is kept constant at least for over several vertical scanning periods.

A horizontal scanning period of a pixel on a scanning wiring at the center of a screen of the display is longer than at least a horizontal scanning period of a pixel on another scanning wiring around the top or bottom of the screen.

The drive control circuit adjusts the image data in accordance with a set horizontal scanning period.

After the image data is adjusted, the modulation drive circuit generates the modulation signal from the image data.

The display is a self-luminous display.

The display has a plurality of display devices including an electron-emitting device.

According to still another main point of the present invention, there is provided the drive control method for use in the above-described display apparatus, characterized in that a timing signal for determining the horizontal scanning period is generated.

In the present invention, it is preferable that the following structures are adopted if necessary.

The timing signal is generated in accordance with the maximum image data in a given scanning period.

The image data includes luminance data and correction data.

The horizontal scanning period is determined in accordance with the maximum image data and average image data of pixels of each row.

Image data is corrected in accordance with at least the maximum image data of each row or column, and image data stored in the memory is replaced by the adjusted image data.

A horizontal luminance level coefficient (Ah) is obtained from the maximum image data and average image data of pixels of each row, a minimum value (Am) of the luminance level coefficient is obtained from the horizontal luminance level coefficient (Ah) and an upper limit value (Al) of the coefficient, and image data of each pixel is corrected based on the minimum value (Am) of the luminance level coefficient.

A horizontal luminance level coefficient (Ah) is obtained from the maximum image data and average image data of pixels of each row, a vertical luminance level coefficient (Av) is obtained from the maximum image data and average image data of pixels of each column, a minimum value (Am) of the luminance level coefficient is obtained from the horizontal luminance level coefficient (Ah), the vertical luminance level coefficient (Av), and an upper limit value (Al) of the coefficient, and image data of each pixel is corrected based on the minimum value (Am) of the luminance level coefficient.

Also, image data is preferably adjusted in accordance with a clock for adjustment determined on the basis of the minimum value (Am).

The above-described drive control method is carried out by a program.

A drive control method is carried out by an integrated circuit.

There is provided a design property for designing an integrated circuit to carry out a drive control method.

BRIEF DESCRIPTION OF THE DRAWINGS

FIG. 29 is a table showing an example of a scanning period for each scanning wiring which is obtained by the arithmetic processing of FIG. 28.

FIG. 41 is a table showing an example of a horizontal scanning period of each scanning wiring in accordance with Embodiment 2 of the present invention.

FIG. 61 is a table showing an example of the gain table.

DESCRIPTION OF THE PREFERRED EMBODIMENTS

Figure 76A:
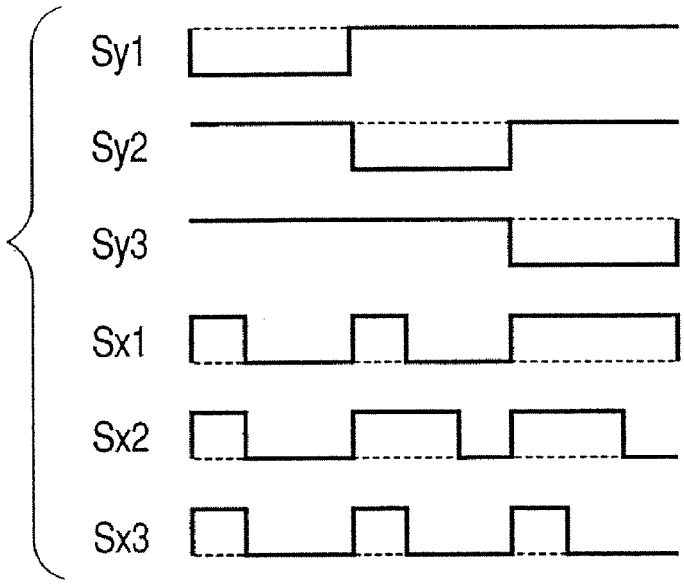
FIG. 76A PRIOR ART
FIG. 76A is a diagram showing drive signal waveform of a conventional display apparatus.
Figure 76B:
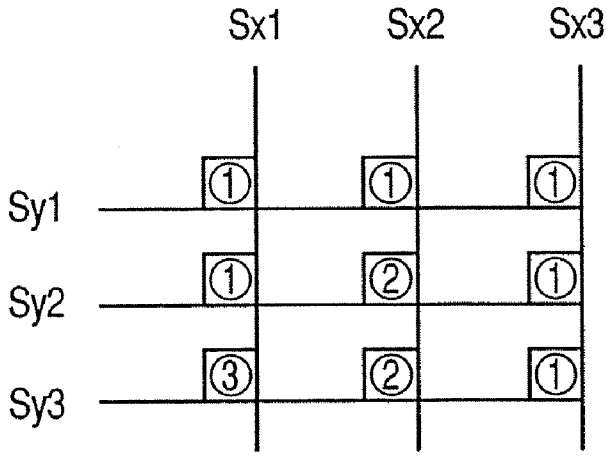
FIG. 76B PRIOR ART
FIG. 76B is a schematic diagram showing a matrix display.

FIGS. 1A, 1B, 1C, 1D, 1E and 1F show modes of drive signals used in a display apparatus and each of them shows drive signals to bring the apparatus to a display state similar to FIG. 76B.

Figure 2:
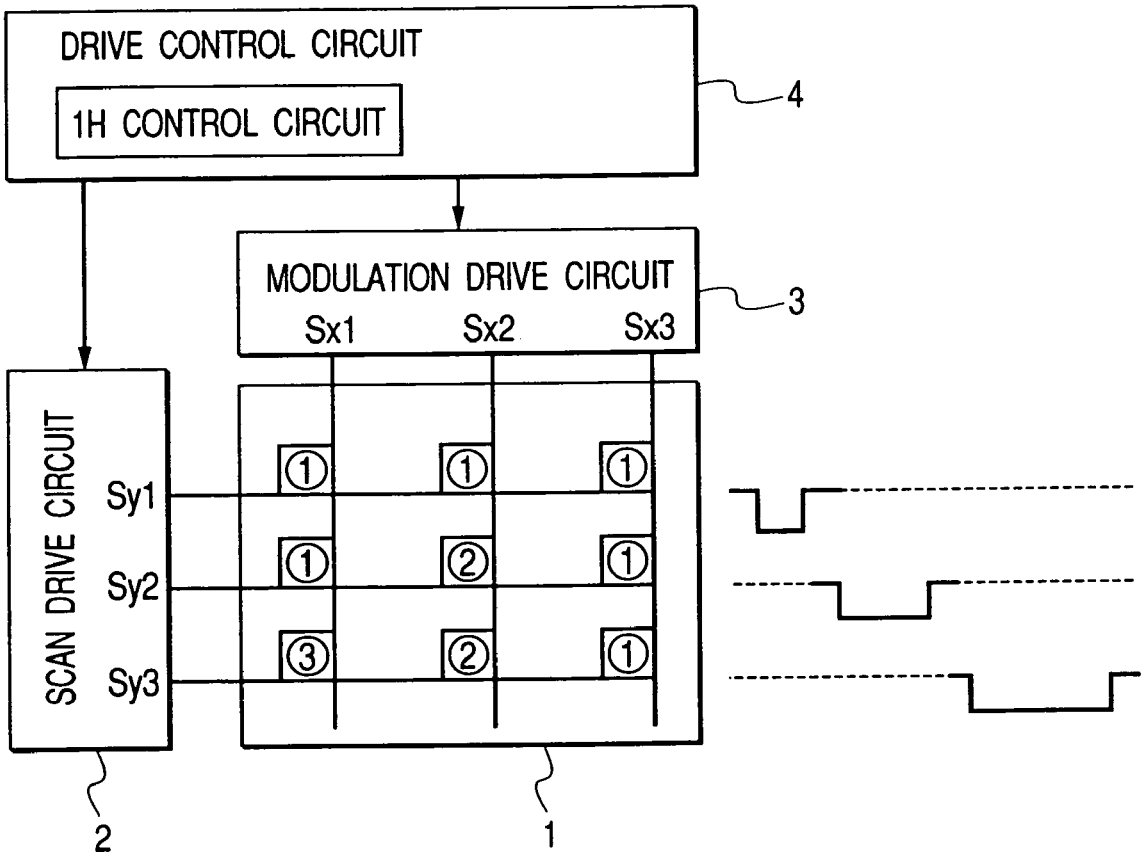
FIG. 2 is a block diagram of a display apparatus of the present invention.

FIG. 2 shows the display apparatus of the present invention. Reference symbol 1 denotes a display, 2 denotes a scan drive circuit for supplying scan signals Sy1, Sy2, and Sy3 to the display 1, and 3 denotes a modulation drive circuit for supplying modulation signals Sx1, Sx2, and Sx3 to the display 1. The drive circuits are controlled by a drive control circuit 4 that has a 1H control circuit for controlling the selection period of a horizontal scanning period 1H.

To summarize, the display apparatus shown in FIG. 2 has the display 1 with a plurality of scanning wirings and a plurality of modulation wirings, the scan drive circuit 2 for supplying a scan selection signal to a scanning wiring selected out of the plural scanning wirings for each horizontal scanning period 1H, and the modulation drive circuit 3 for supplying a modulation signal modulated based on image data to the plural modulation wirings for each horizontal scanning period, and the apparatus is characterized by having the drive control circuit 4 for controlling the scan drive circuit such that the selection period of the scan selection signal varies between at least two horizontal scanning periods in a vertical scanning period 1V.

Figure 1A:
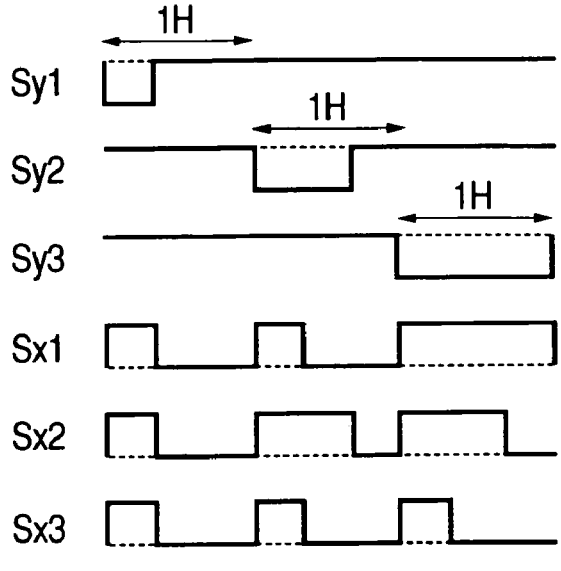
FIGS. 1A, 1B, 1C, 1D, 1E and 1F are timing charts of drive signals.

According to the mode of FIG. 1A, the selection periods in which scanning wirings associated with the scan signals Sy1, Sy2, and Sy3 are selected (here, low level periods) in each horizontal scanning period 1H have different lengths, and a low level scan selection signal is applied only during the period in which a high level modulation signal is applied to one of the modulation wirings. In the example shown here, the modulation signals are of pulse width modulation system in which the pulse width is modulated in accordance with the luminance level of a pixel. The modulation signal Sx1 represents signals with luminance levels of 1, 1, and 3, the modulation signal Sx2 represents signals with luminance levels of 1, 2, and 2, and the modulation signal Sx3 represents signals with luminance levels of 1, 1, and 1. In one horizontal scanning period 1H, a period in which a scan selection signal is not applied is a blanking period.

In each horizontal scanning period 1H, selection periods of scan selection signals have different lengths set in accordance with a modulation signal that has the maximum pulse width (duration) out of modulation signals supplied to the three modulation wirings. Further, it is preferable that each of the horizontal scanning periods 1H is variable.

Figure 1B:
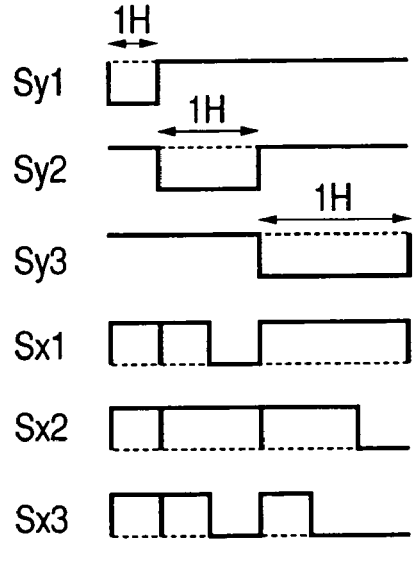

In the mode of FIG. 1B, the low level selection period of the scan signal Sy1 in which a scan selection signal is supplied is one horizontal scanning period 1H, and the same applies to the scan signals Sy2 and Sy3. The length of the horizontal scanning period 1H for the scan signal Sy1, the length of 1H for Sy2, and the length of 1H for Sy3 are different from one another, and are ⅓, ⅔, and ⅔ of the lengths of the horizontal scanning periods in FIG. 1A, respectively. A scan selection signal is applied only during the period in which the in accordance with their luminance levels.

Figure 1C:
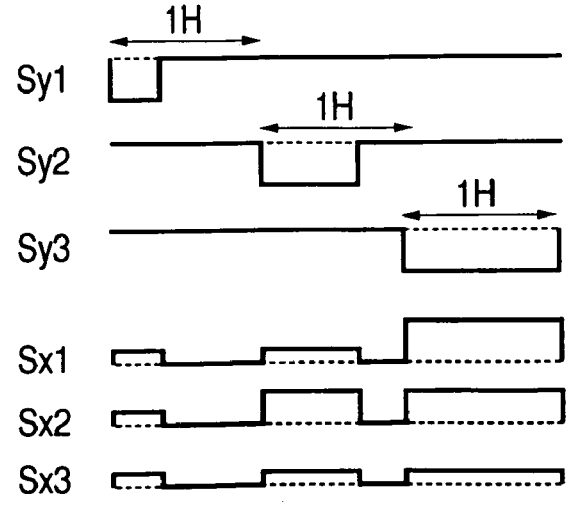
Figure 1D:
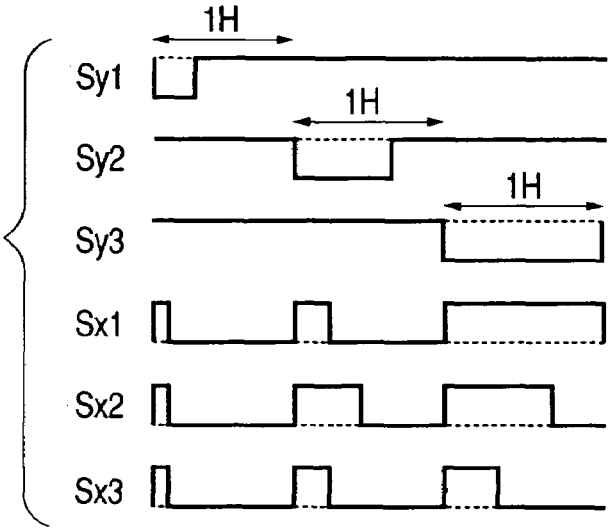

The mode of FIG. 1D employs the signals of FIG. 1C as the scan signals Sy1, Sy2, and Sy3, and the modulation signals Sx1, Sx2, and Sx3 in the example shown here are of pulse width modulation system in which the pulse width is modulated in accordance with the luminance level of a pixel. The modulation signal Sx1 represents signals with luminance levels of 1, 1, and 3, the modulation signal Sx2 represents signals with luminance levels of 1, 2, and 2, and the modulation signal Sx3 represents signals with luminance levels of 1, 1, and 1. However, the selection periods have different lengths and therefore the difference in luminance is larger. In the mode of FIGS. 1C and 1D, each of the selection periods or horizontal scanning periods is variable in accordance with a luminance data. Each period is also variable for non-uniform display on user's demand.

Figure 1E:
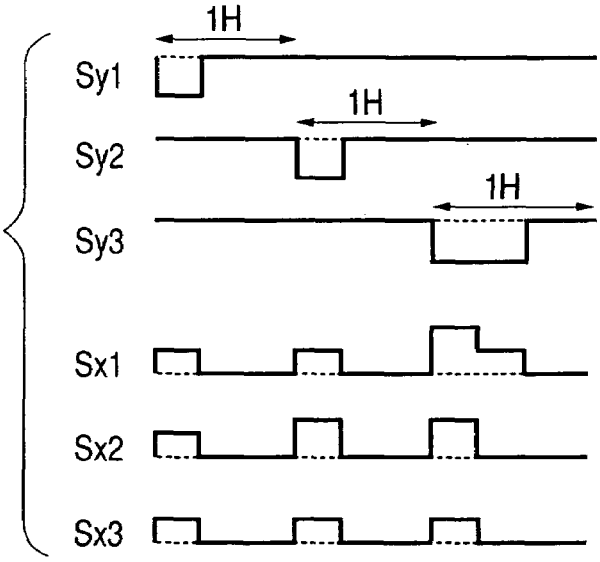

The mode of FIG. 1E shows an example of employing modulation signals Sx1, Sx2, and Sx3 of modulation system in which the pulse width and voltage amplitude are both modulated in accordance with the luminance level of a pixel. The modulation signal Sx1 represents signals with luminance levels of 1, 1, and 3, the modulation signal Sx2 represents signals with luminance levels of 1, 2, and 2, and the modulation signal Sx1, Sx2, or Sx3 is applied to one of the modulation wirings.

A period in which a scan selection signal is not applied is thus shortened and one vertical scanning period, namely, one frame period is cut short in the mode of FIG. 1B, thereby raising the frame frequency and improving the luminance even more. It is also preferable to adjust the horizontal scanning periods so as to obtain the original length of one frame period by prolonging the horizontal scanning periods by an arbitrary amplification.

The mode of FIG. 1C employs the signals of FIG. 1A as the scan signals Sy1, Sy2, and Sy3, and the modulation signals Sx1, Sx2, and Sx3 in the example shown here are of pulse width modulation system in which the pulse width is modulated in accordance with the luminance level of a pixel. The modulation signal Sx1 represents signals with luminance levels of 1, 1, and 3, the modulation signal Sx2 represents signals with luminance levels of 1, 2, and 2, and the modulation signal Sx3 represents signals with luminance levels of 1, 1, and 1. However, the selection periods have different lengths and therefore the difference in luminance is larger. The high level voltage amplitude of the modulation signals Sx1, Sx2, and Sx3 synchronized with the selection periods is chosen from three voltage values modulation signal Sx3 represents signals with luminance levels of 1, 1, and 1. The modulation signals Sx1, Sx2, and Sx3 are signals for bringing the display apparatus to the display state shown in FIG. 76B. As the luminance level is raised, the voltage amplitude thereof is increased by slot unit. After the voltage amplitude reaches a given amplitude value, the pulse width is increased by slot unit until the pulse width reaches a given number of slots. On the other hand, selection periods for the scan signals Sy1, Sy2, and Sy3 are set in accordance with the pulse width of the modulation signal in each horizontal scanning period 1H.

Figure 1F:
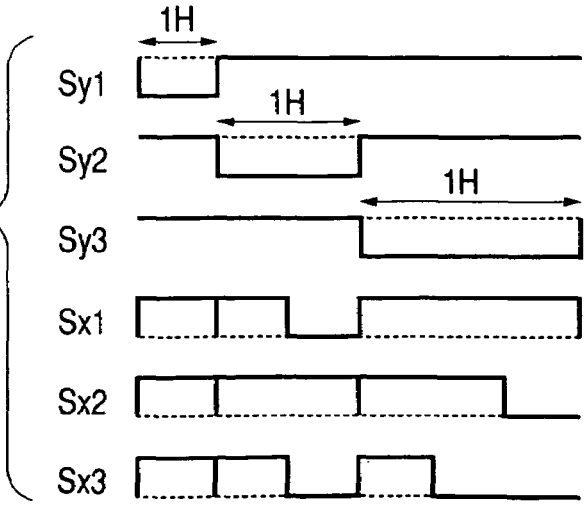

If necessary it is also preferable to modify the modes of FIGS. 1C, 1D and 1E so as to shorten a blanking period in which a scan selection voltage is not applied, thereby shortening the horizontal scanning periods and cutting the length of one frame period as in FIG. 1B. Furthermore, it is also preferable to give each horizontal scanning period the same length of blanking period. It is also preferable to remove or cut short the blanking period and then prolong the horizontal scanning periods until the original length of one frame period is obtained. The horizontal scanning periods are prolonged by being multiplied by gains or by changing the frequency of the reference clock signal. The waveform obtained by changing FIG. 1B using this method is shown in FIG. 1F. The length of one frame period in the mode of FIG. 1F is the same as the length of one frame period in FIG. 1A, and is longer than that of FIG. 1B.

As described above, according to the present invention, a display driving method for driving a display 1 with a plurality of scanning wirings and a plurality of modulation wirings includes a step of supplying a scan selection signal to a scanning wiring selected out of the plural scanning wirings for each horizontal scanning period 1H and a step of supplying a modulation signal modulated based on image data to the plural modulation wirings for each horizontal scanning period 1H, and the method is characterized in that the selection period of the scan selection signal varies between at least two horizontal scanning periods in a vertical scanning period 1V.

In any of the modes of FIGS. 1A, 1B, 1C, 1D, 1E and 1F, the length of the horizontal scanning period is set in accordance with the luminance level at which a pixel emits light and the length of selection period of a scan selection signal and the pulse width as the longest continuation period of a modulation signal are determined accordingly. The modes of FIGS. 1A, 1B, 1C, 1D, 1E and 1F are particularly preferable in the case where the longest continuation period (pulse width) of a modulation signal supplied to a modulation wiring in one horizontal scanning period is used to determine the length of selection period of a scan selection signal supplied to a scanning wiring in the one horizontal scanning period.

The modes of FIGS. 1C, 1D, 1E and 1F are particularly preferable in the case where the length of selection period of a scan selection signal supplied to a scanning wiring is set in advance and the longest continuation period of a modulation signal supplied to a modulation wiring in a horizontal scanning period is determined so as to accommodate the set selection period.

A display device that is preferable for a display of the present invention is a surface conduction electron-emitting device, or field emission electron-emitting device, combined with a phosphor. Other display devices that can be used in the present invention are a plasma display device, an inorganic EL display device, an organic EL display device, an LED display device, a liquid crystal display device, a plasma address liquid crystal display device, a micro mirror device, and the like.

Examples of the electron-emitting device used in the present invention include surface conduction electron-emitting devices disclosed in U.S. Pat. No. 5,066,883, Japanese Patent Application Laid-Open No. 02-257551, and Japanese Patent Application Laid-Open No. 04-28137, BSD electron-emitting devices, Spindt electron-emitting devices, MIS electron-emitting devices, MIM electron-emitting devices, diamond particle electron-emitting devices, and carbon fiber electron-emitting devices such as carbon nanotube and graphite nanofiber.

Scan signals for use in the present invention are not limited to ones having the waveform shown in FIGS. 1A, 1B, 1C, 1D, 1E and 1F or waveform in embodiments described later, and any signal can be used as long as it can cooperate with a modulation signal to apply a scan selection voltage and scan non-selection voltage set in accordance with a display device to be driven.

Modulation signals used in the present invention are pulse width modulation signals that extend a continuation period (pulse width) in which a voltage level for display is applied as the pixel luminance to be obtained is increased. Alternatively, the present invention may employ amplitude modulation signals that raise the voltage amplitude (wave crest value) as the pixel luminance to be obtained is increased. It is also preferable to employ a modulation signal obtained by combining a pulse width modulation signal with an amplitude modulation signal. The modulation system in which a pulse width modulation signal is combined with an amplitude modulation signal is disclosed in, for example, Japanese Patent Application Laid-Open No. 10-39825.

The present invention can also employ a current modulation signal that increases a current flowing into a display device as the pixel luminance to be obtained is increased.

In the present invention, the length of selection period in which a scan selection signal is supplied in a horizontal scanning period can be set in accordance with an image signal inputted. Alternatively, the length of the selection period may be set in accordance with a display characteristic independently of the image signal inputted. In the former case, a change of images leads to a change in selection period for a scanning wiring related to the image change and, if necessary, the horizontal scanning period is also changed. In the latter case, the length of selection period and, if necessary, horizontal scanning period is set for each scanning wiring in advance and therefore a modulation signal is appropriately modulated within a limit of the set selection period.

When the length of selection period of a horizontal scanning period for each scanning wiring is to be set in accordance with an image signal inputted, it may be set by conducting separate optimizations for each scanning wiring or the optimization may be based on the luminance of all pixels. In these cases, the selection period or horizontal scanning period is set in accordance with a modulation signal that has the maximum pulse width among modulation signals to be supplied to pixels on a selected scanning wiring. However, horizontal scanning periods and luminance levels (gradation) do not need to be on one-on-one basis, and one horizontal scanning period may be allotted to some consecutive luminance levels.

It is also preferable to set in advance one or both of upper limit and lower limit for a selection period or horizontal scanning period and then change the length of the selection period or horizontal scanning period within the set range so as not to step over the limit(s).

If the length of one vertical scanning period is constant, gain adjustment is also preferable in which a selection period for each scanning wiring is prolonged or shortened by a given amplification. It is also preferable to adjust the length of one vertical scanning period through adjustment of a horizontal scanning period by prolonging or shortening the length of blanking period in which a pixel does not emit light.

In actual signal processing, data of luminance at which pixels of the display should emit light are extracted directly from an image signal inputted or after the inputted image signal is converted, and a modulation signal is generated based on the luminance data.

A modulation signal for use in the present invention is not limited to one modulated solely on the basis of image data, namely, luminance data, but may be one modulated based on image data to which correction data or like other data is added (adjusted image data).

If the display luminance of a pixel fails to meet the intended luminance, it is preferable to correct the modulation signal so as to compensate the difference between the display luminance and the intended luminance. For instance, when the effect drive voltage applied to a device that constitutes a pixel is reduced because of the resistance of scanning wiring and/or modulation wiring and voltage drop due to a current flowing in the wirings, it is preferable to correct in advance the modulation signal so as to compensate the reduction. The amount of this reduction depends on display state of pixels on the same scanning wiring regarding whether the pixels emit light. If the compensation is made by increasing the pulse width of the modulation signal, it is preferable to set the length of the selection period of the horizontal scanning period in accordance with the adjusted modulation signal. Specifically, the image data is corrected before modulation and modulation is conducted based on the adjusted image data.

More specific embodiments will be described below.

Embodiment 1

A structure provided with a multi-electron source is known in which N rows of cold cathode devices (display devices) and M columns of cold cathode devices, N×M in total, are arranged two-dimensionally to form a matrix pattern, and the cold cathode devices are wired by passive matrix wiring using M row-directional wirings (scanning wirings) placed in the row direction and N column-directional wirings (modulation wirings) placed in the column direction.

For multiplexing driving of a large number of cold cathode devices that are wired by matrix wiring, one row of devices of the matrix (devices of one row are connected to one row-directional wiring) are driven simultaneously.

To elaborate, a given selection voltage is applied to one row-directional wiring while applying a given modulation voltage to column-directional wirings that are connected to the cold cathode devices to be driven among the N cold cathode devices connected to the one row-directional wiring. The difference between the row-directional wiring electric potential and the column-directional wiring electric potential is used to drive the one row of devices simultaneously. All of the rows are scanned by switching from one row-directional wiring to another row-directional wiring to form a two-dimensional image utilizing a phenomenon known as persistence of vision.

This method has an advantage over a method of selecting one device at a time in that a drive time allotted to each device is N times longer and therefore the luminance of the image display apparatus is enhanced.

In the above structure, one row of N cold cathode devices are connected to one row-directional wiring and the devices have different connection positions. Accordingly, when one row of devices are driven simultaneously, the luminance fluctuates among the devices by the influence of voltage drop due to the wiring resistance. To be specific, if a selection voltage is to be applied from both ends of a row-directional wiring, voltage drop increases as the center of the row-directional wiring approaches and is reduced as the distance from the center is increased toward each end of the row-directional wiring. Therefore the luminance is lower around the center than in the vicinity of each end even if the modulation voltages applied to the N column-directional wirings have the same level of electric potential.

For that reason, Japanese Patent Application Laid-Open No. 08-248920, for example, discloses a structure in which correction data is calculated by statistical computation and input image data is synthesized with the correction data in order to compensate lowering of luminance caused by voltage drop due to the wiring resistance of row-directional wiring. In this publication, as shown in FIG. 3, image data is multiplied by correction data outputted from memory means 207 at a multiplier 208 that is provided for each column-directional wiring, and the adjusted image data is transferred to a modulation circuit 209.

Figure 3:
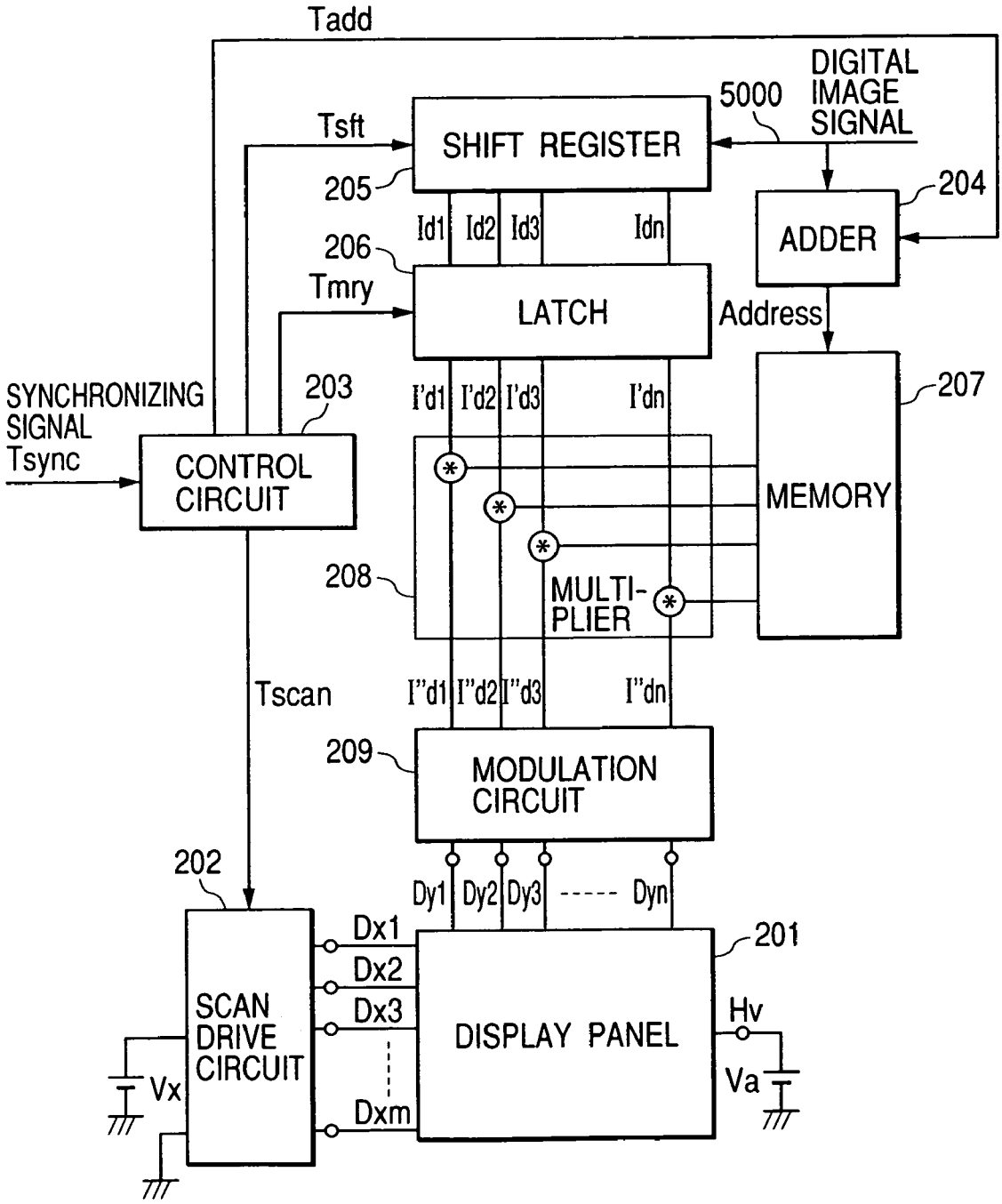
FIG. 3 is a block diagram showing the display apparatus.

In FIG. 3, reference symbol 201 denotes a display, 202, a scan drive circuit, 203, a control circuit, 204, an adder, 205, a shift register, and 206, a latch circuit.

In the correction made to compensate lowered luminance caused by voltage drop of row-directional wiring, inputted image data is multiplied by correction data as in the above publication, or correction data is added to inputted image data as disclosed in Japanese Patent Application Laid-Open No. 08-248920. During the correction, a problem of overflow unique to digital circuits rises in some cases.

The overflow is a problem in that bit turn back takes place and a display image is inverted when adjusted image data obtained by multiplying image data by correction data or by adding correction data to image data is inputted as it is to a conventional modulation signal generator and exceeds the data width the modulation signal generator can handle.

To give a specific example, when a circuit is designed to have a data width of 8-bit in one horizontal scanning period, the maximum data value the circuit can handle is "255 (decadal system)". If "250" is inputted here as image data and correction data to be added to the image data is "33", then the adjusted image data is "283". However, the pulse width outputted from the modulation signal generator is not "283" but instead "27" because of bit turn back. In this way, sometimes an area intended to have high luminance is displayed as a dark area to disturb the displayed image when adjusted image data is inputted to a modulation signal generator.

The overflow can be prevented by providing a limiter for limiting the maximum value of image data, or by reducing the data value in advance through multiplication of image data by uniform gain and through correction using look-up table (LUT). Alternatively, the overflow is avoided by multiplying adjusted data by uniform gain.

The elementary problem of display image being inverted or disturbed in other ways due to bit turn back have become solvable as a result of investigation conducted by the present inventors and it has become possible to display with good image quality by making correction of voltage drop. However, when a displayed image obtained by the method using a limiter or by LUT correction is closely observed, the image may be unnatural due to loss of tone reproduction. This unnatural image reproduction is due to the fact that every image data that exceeds the maximum value is given the same luminance in the method using a limiter and in LUT correction. On the other hand, the luminance of some image may be diminished in the method of multiplying image data by gain.

In short, to correct voltage drop in a scanning wiring is no other than to compensate the lowered luminance due to the voltage drop by increasing the drive time. However, to correct voltage drop by extending the drive time while keeping it under the maximum drive time that is determined by the established horizontal scanning period inevitably results in lowering of luminance.

This embodiment provides, as a solution to the problem described above, display apparatus that is driven by controlling a horizontal scanning period.

The display apparatus of this embodiment is comprised of: a display having a plurality of display devices wired with a plurality of scanning wirings and a plurality of modulation wirings to form a matrix pattern; an adjusted image data calculator for calculating adjusted image data by correcting the influence of voltage drop on inputted image data, the voltage drop taking place due to the resistance of the scanning wirings; a detector of line maximum value for detecting the maximum value of the adjusted image data for each scanning wiring; a selection period controller for determining the selection period for each scanning wiring in accordance with the maximum value of the adjusted image data which has been detected by the detector of line maximum value; a scan drive circuit for scanning the scanning wirings following the selection period that has been determined by the selection period controller for each scanning wiring; and a modulation drive circuit for applying to each modulation wiring a modulation signal that is obtained by modulating the pulse width in accordance with the adjusted image data.

Further, the driving method of the display apparatus of this embodiment, which includes a display having a plurality of display devices wired with a plurality of scanning wirings and a plurality of modulation wirings to form a matrix pattern, is comprised of: a step of calculating adjusted image data by correcting the influence of voltage drop on inputted image data, the voltage drop taking place due to the resistance of the scanning wirings; a step of detecting the maximum value of the adjusted image data for each scanning wiring; a step of determining the selection period for each scanning wiring in accordance with the maximum value of the adjusted image data which has been detected; and a step of scanning the scanning wirings following the selection period that has been determined for each scanning wiring, and applying to each modulation wiring a modulation signal that is obtained by modulating the pulse width in accordance with the adjusted image data.

A correction circuit of this embodiment calculates from inputted image data a reduction in quality of a displayed image due to voltage drop, obtains correction data for compensating the reduction, and corrects the inputted image data. Furthermore, the correction circuit detects, for each horizontal scanning line, the maximum value of image data on which correction is made (adjusted image data) and allots a selection period to each scanning wiring in accordance with the maximum value.

Hereinafter an overview of a display panel in image display apparatus according to this embodiment will be described as well as electric connections of the display panel, characteristics of surface conduction electron-emitting device, a method of driving the display panel, and the mechanism of lowering of drive voltage due to the electric resistance of scanning wirings when an image is displayed on this display panel. The descriptions are followed by detailed explanations on a method and apparatus for correcting the influence of voltage drop, which are features of this embodiment.

(Overview of Image Display Apparatus)

Figure 4:
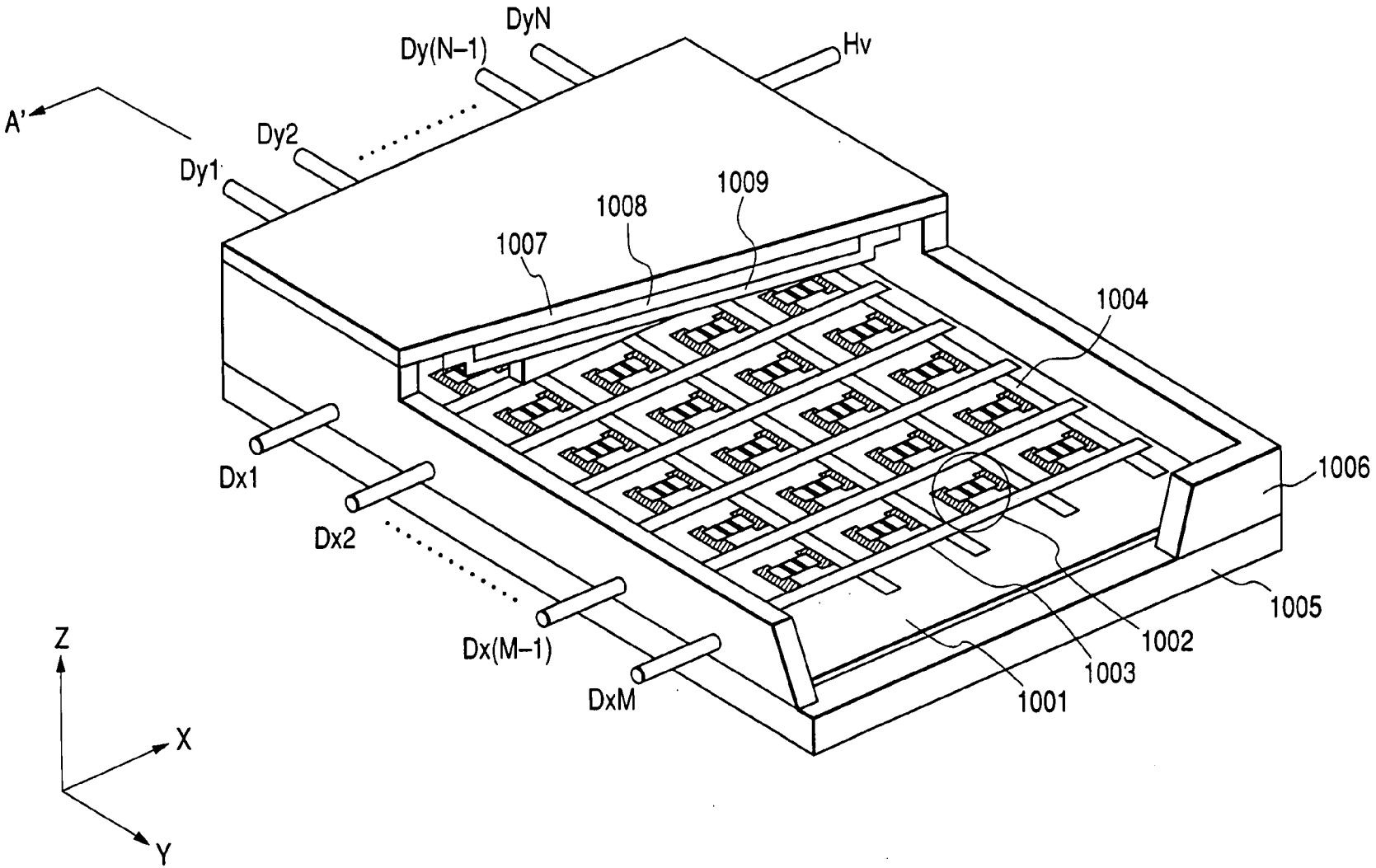
FIG. 4 is a diagram showing the overview of the display apparatus used in the present invention.

FIG. 4 is a perspective view of a display panel used in this embodiment, and shows the internal structure of the panel by partially cutting its top off. In FIG. 4, reference symbol 1005 denotes a rear plate, 1006, side walls, and 1007, a face plate. 1005 through 1007 constitute an airtight container for keeping the interior of the display panel vacuum.

Figure 5:
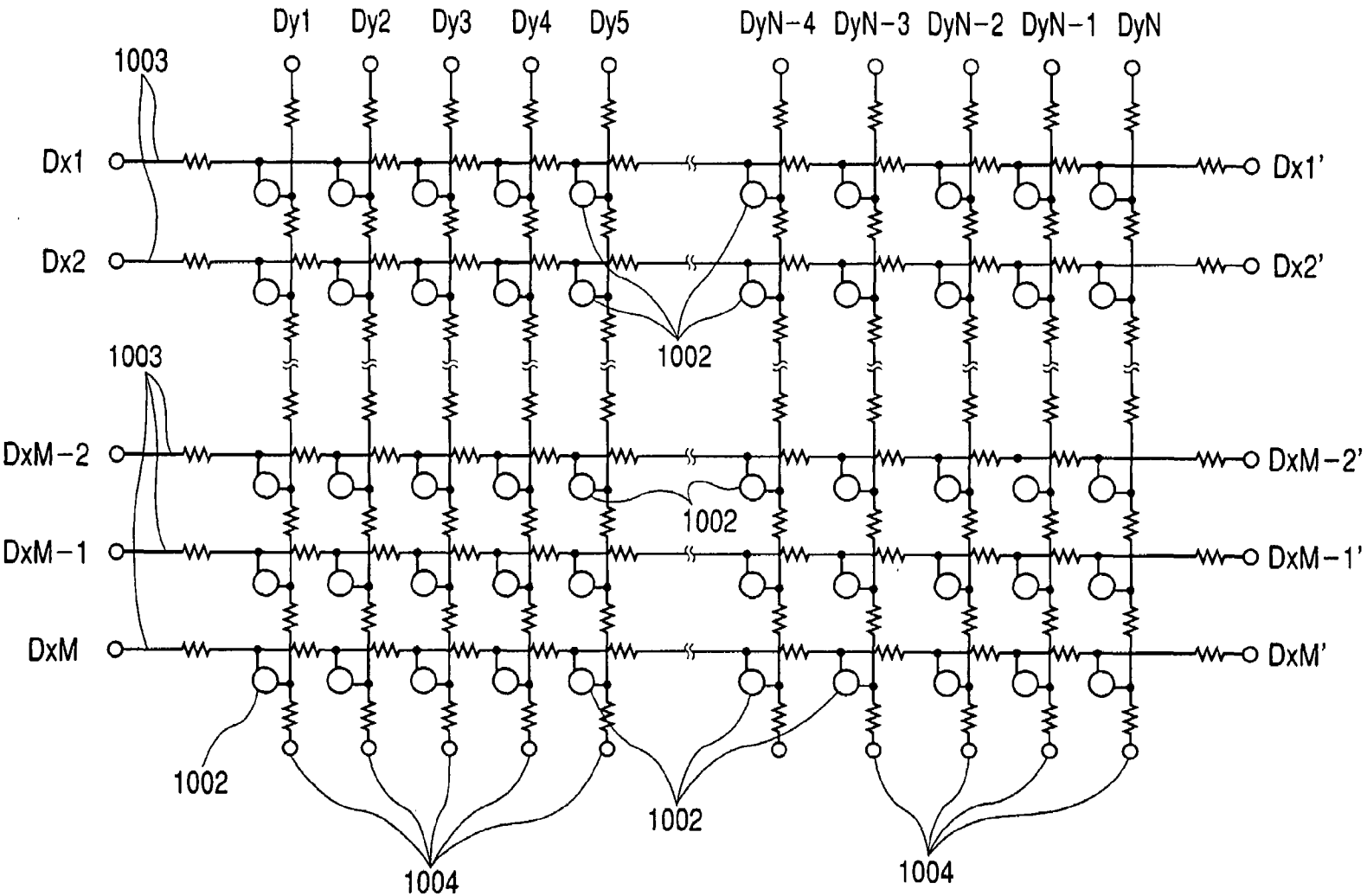
FIG. 5 is a schematic diagram illustrating the resistance of wirings in a display panel.

The rear plate 1005 has a substrate 1001 fixed thereto, and N×M cold cathode devices 1002 are formed on the substrate. The cold cathode devices are connected to row-directional wirings (scanning wirings) 1003 and column-directional wirings (modulation wirings) 1004 as shown in FIG. 5.

A fluorescent film 1008 is formed on the under side of the face plate 1007. Since the image display apparatus according to this embodiment displays images in color, phosphors of three primary colors, namely, red, green, and blue, used in the CRT field are applied to different areas of the fluorescent film 1008. The phosphors are positioned in relation to pixels (sub-pixels) on the rear plate so that the phosphors can receive electron emission (emission current) from the cold cathode devices forming a matrix pattern.

A metal back 1009 is formed on the under side of the fluorescent film 1008.

Hv denotes a high voltage terminal electrically connected to the metal back. High voltage is applied between the rear plate and the face plate by applying high voltage to the Hv terminal.

This embodiment employs a structure in which pixels have as cold cathode devices surface conduction electron-emitting devices.

(Characteristics of Surface Conduction Electron-emitting Device)

Figure 6:
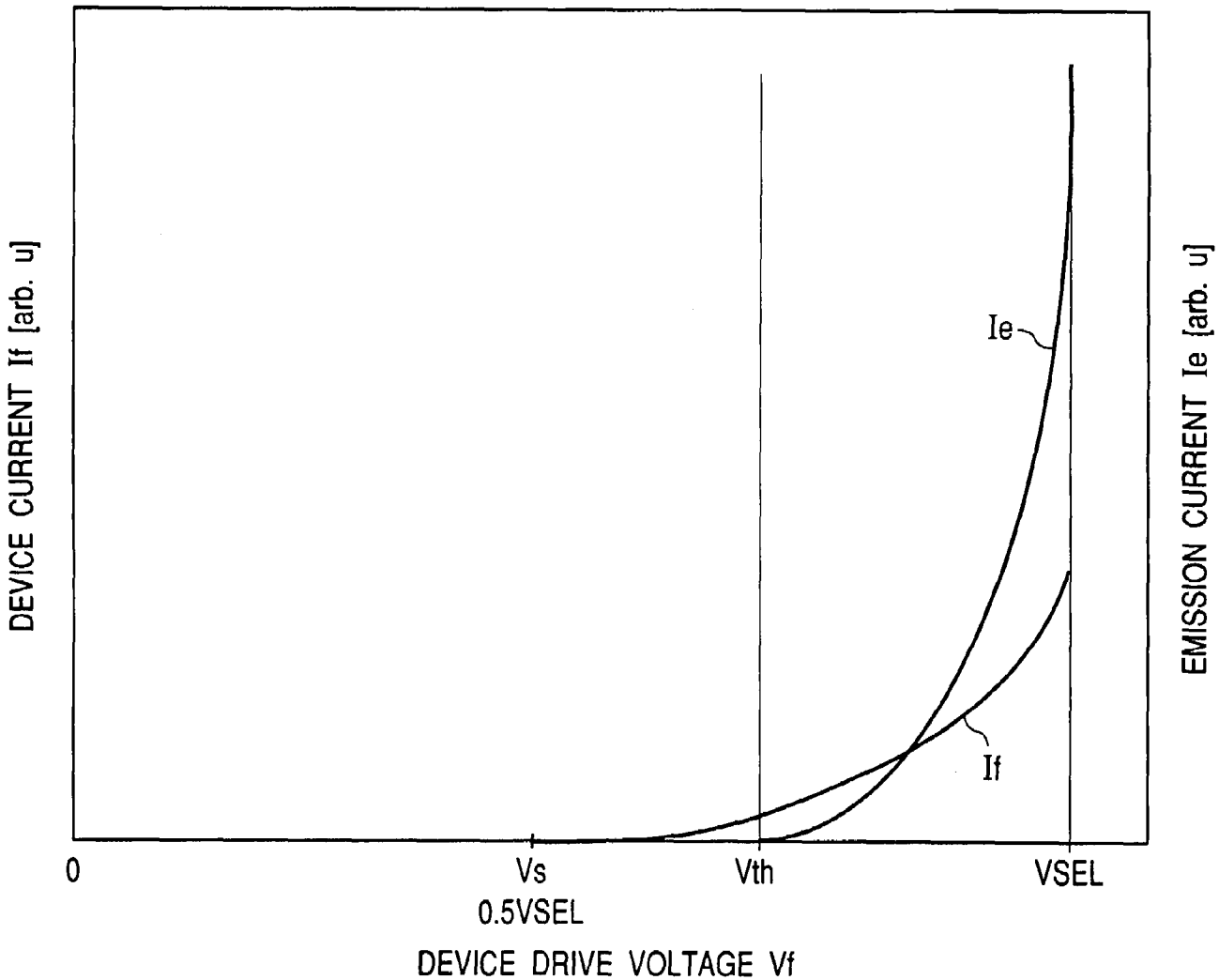
FIG. 6 is a diagram showing a characteristic of an electron-emitting device.

A surface conduction electron-emitting device has an emission current Ie-device application voltage Vf characteristic and a device current If-device application voltage Vf characteristic as shown in FIG. 6. Note that the graphs of emission current Ie and device current If have different scales since emission current Ie is much smaller than device current If and it is difficult to show them on the same scale.

The surface conduction electron-emitting device has the following three characteristics regarding emission current Ie.

Emission current Ie is rapidly increased when a voltage equal to or higher than a certain level of voltage (referred to as threshold voltage Vth) is applied to the device. On the other hand, almost no emission current Ie is detected when a voltage lower than the threshold voltage Vth is applied to the device. The first characteristic of the device is therefore that it is a non-linear device having a definite threshold voltage Vth with respect to emission current Ie.

The second characteristic of the device is that the amount of emission current Ie can be controlled by varying the voltage Vf since emission current Ie changes depending on the voltage Vf applied to the device.

The third characteristic of the device is that the emission period of emission current Ie can be controlled by adjusting the time during which the voltage Vf is applied since every cold cathode device has fast response.

If the first characteristic is utilized in display apparatus that has the display panel shown in FIG. 4, an image can be displayed by scanning the display screen sequentially. To elaborate, varying levels of voltage equal to or higher than the threshold voltage Vth is applied to devices being driven in accordance with desired luminance levels of light emission while a voltage lower than the threshold voltage Vth is applied to devices that are not selected. The display screen is sequentially scanned for display by switching devices to be driven from one group of devices to another.

If the second characteristic is utilized, the display apparatus can display an image while controlling the luminance of light emitted from phosphors by the voltage Vf applied to devices.

If the third characteristic is utilized, the display apparatus can display an image while controlling the light emission period of phosphors by adjusting the time during which the voltage Vf is applied to devices.

In the display apparatus of this embodiment, the amount of electron beam of the display panel is modulated utilizing the third characteristic.

(Method of Driving the Display Panel)

Specifics of a method of driving the display panel according to this embodiment are described with reference to FIG. 7.

Figure 7:
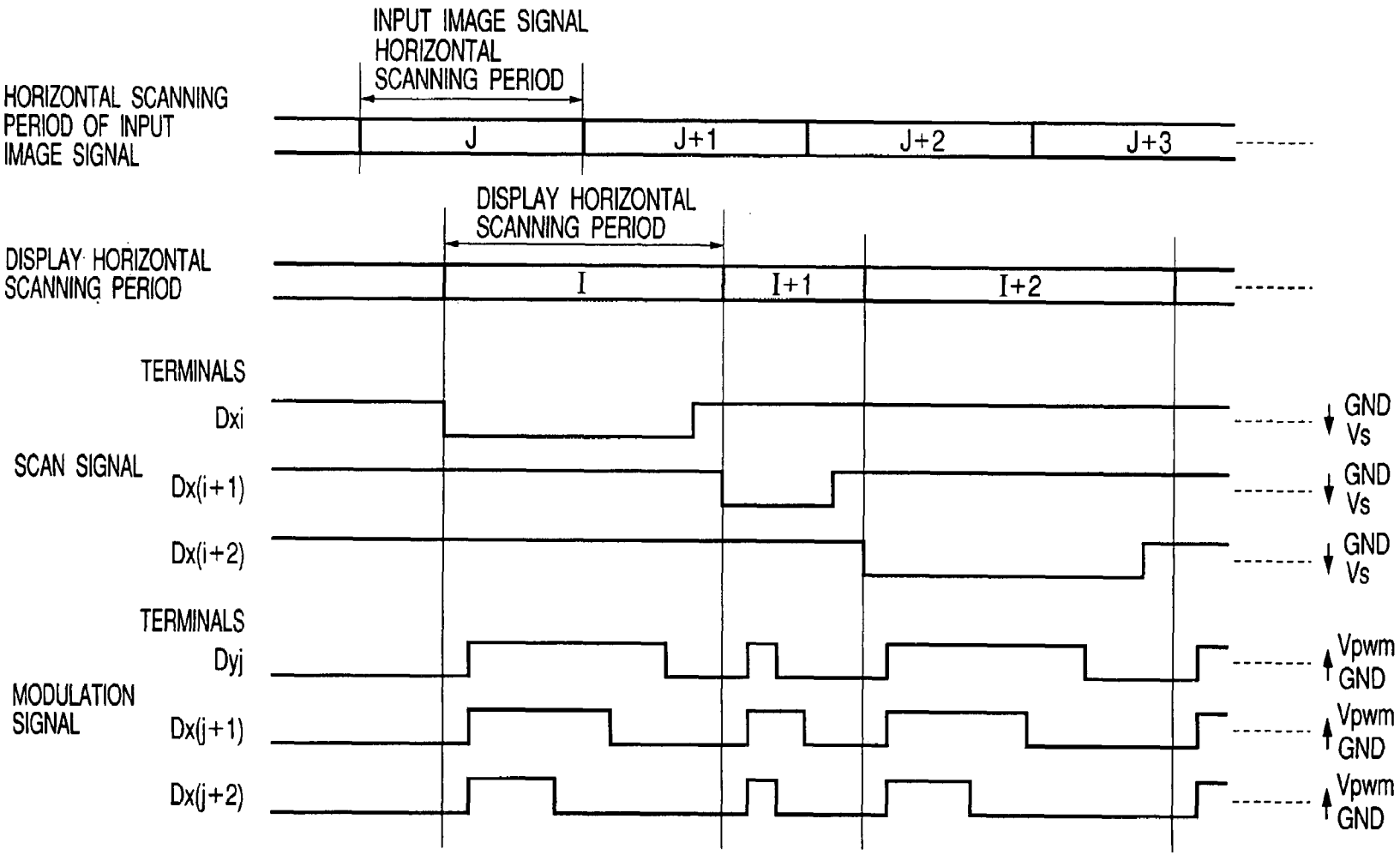
FIG. 7 is a timing chart for driving a display in accordance with an embodiment of the present invention.

FIG. 7 is a timing chart of driving signals for driving the display panel according to this embodiment.

J, J+1, J+2, and J+3 represent horizontal scanning periods of input image signals inputted from the outside of the display apparatus. A display horizontal scanning period I is a selection period for pixels on the i-th row of the display apparatus to emit light.

The length allotted to each display horizontal scanning period is determined such that it exceeds the duration of the maximum pulse width of a modulation signal on its associated scanning wiring. Details thereof will be described later.

In order to make pixels on the i-th row to emit light, a pulse having a scan selection voltage Vs is applied to a voltage supply terminal Dxi of the scanning wiring of the i-th row so that the pixels on the i-th row are selected. A voltage supply terminal Dxk (k=1, 2, . . . M, k≠i) of other scanning wiring than the i-th row scanning wiring receives a pulse having a non-selection voltage Vns so that pixels connected to the scanning wiring are not selected.

In the example here, the selection voltage Vs is set to −0.5 VSEL that is half the voltage VSEL of FIG. 6. The electric potential of the non-selection voltage Vns is set to ground electric potential GND.

A voltage supply terminal of a modulation wiring is supplied with a pulse width modulation signal having a voltage amplitude Vpwm. The pulse width of a pulse width modulation signal to be supplied to the j-th modulation wiring is determined in accordance with the size (luminance level) of image data for the pixel on Row i, Column j of the image to be displayed. In this way, every modulation wiring is supplied with a pulse width modulation signal having a pulse width suitable for the size of image data of its associated pixel.

In this embodiment, the voltage Vpwm is set to +0.5 VSEL.

A surface conduction electron-emitting device emits electrons when the voltage VSEL is applied to each end of the device as shown in FIG. 6. When the application voltage is smaller than the emission threshold voltage Vth, the device does not emit electron at all.

The voltage Vth is characterized by being larger than 0.5 VSEL as shown in FIG. 6.

Accordingly, no electrons are emitted from a surface conduction electron-emitting device that is connected to a scanning wiring to which non-selection voltage Vns is applied.

Similarly, no electrons are emitted during a period in which the output of the pulse width modulator is ground electric potential (hereinafter referred to as period in which the output is "L") because the voltage pulse applied to each end of surface conduction electron-emitting devices on a selected scanning wiring has a voltage of Vs in this period.

Surface conduction electron-emitting devices on a scanning wiring to which the selection voltage Vs is applied emit electrons during a period in which the output of the pulse width modulator is Vpwm (hereinafter referred to as period in which the output is "H"). When the electrons are emitted, the phosphors described above emit light in accordance with the amount of electron beam emitted. It is thus possible to make pixels emit light at a luminance according to the length of time during which the electron beam is emitted.

Line sequential scanning in which rows of a display panel are sequentially selected as this is conducted and the pulse width is modulated to display an image.

In a display horizontal scanning period, the length of selection period in which the selection voltage Vs is applied varies depending on modulation signals, and a period in which the selection voltage Vs is not applied serves, if necessary, as a blanking period having a fixed length.

Accordingly, the display horizontal scanning period I is dependent on the maximum value of the pulse width of modulation signals supplied to the terminals Dy1 to DyN during this period. A display horizontal scanning period I+1 is a short period that is dependent on the maximum value of the pulse width of modulation signals supplied to the terminals Dy1 to DyN in this period. A display horizontal scanning period I+2 is a long period that is dependent on the maximum value of the pulse width of modulation signals supplied to the terminals Dy1 to DyN in this period.

The luminance in the display horizontal scanning period I+2 is therefore improved.

(About Voltage Drop in Scanning Wirings)

As described above, in some cases, voltage drop in a scanning wiring of a display panel raises the electric potential of the scanning wiring to lower the voltage applied to a surface conduction electron-emitting device and reduce emission current from the surface conduction electron-emitting device.

Though it varies depending on the design specification and manufacture process, one surface conduction electron-emitting device has a device current of several hundred μA when the voltage VSEL is applied.

Therefore, when only one pixel on a scanning wiring selected in a horizontal scanning period is to emit light and other pixels on the scanning wiring do not emit light, merely a device current for one pixel (namely, several hundred μA mentioned above) flows from a modulation wiring to the scanning wiring of the selected row. Accordingly voltage drop hardly takes place and the luminance is not lowered.

However, if all of pixels on a selected row are to emit light in a horizontal scanning period, a current for all pixels flows into the selected scanning wiring from all of the modulation wirings. The total current in this case reaches several hundred mA to several A and a large voltage drop takes place in the scanning wiring due to the wiring resistance of the scanning wiring.

When a voltage drop takes place in a scanning wiring, the voltage applied to each end of a surface conduction electron-emitting device is lowered. Therefore the emission current from the surface conduction electron-emitting device is reduced, resulting in lowering in luminance of emitted light.

Figure 8A:
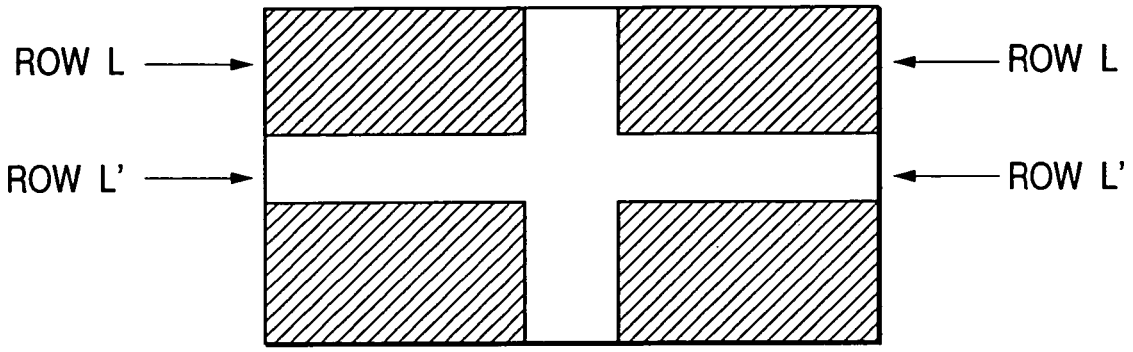
FIGS. 8A and 8B are diagrams illustrating influence of voltage drop on a display state.

To give a specific example, when an image to be displayed is a white cross pattern against black background as shown in FIG. 8A and Row L is selected, the number of pixels that emit light is small and therefore almost no voltage drop takes place in the scanning wiring of Row L. As a result, a surface conduction electron-emitting device of each pixel emits current in a desired amount and the pixel can emit light at a desired luminance.

On the other hand, when Row L' is to be driven, all of the pixels on Row L' emit light to cause a voltage drop in the scanning wiring and the emission current from a surface conduction electron-emitting device of each pixel is reduced in amount. As a result, the luminance of the pixels on Row L' is lowered.

Figure 8B:
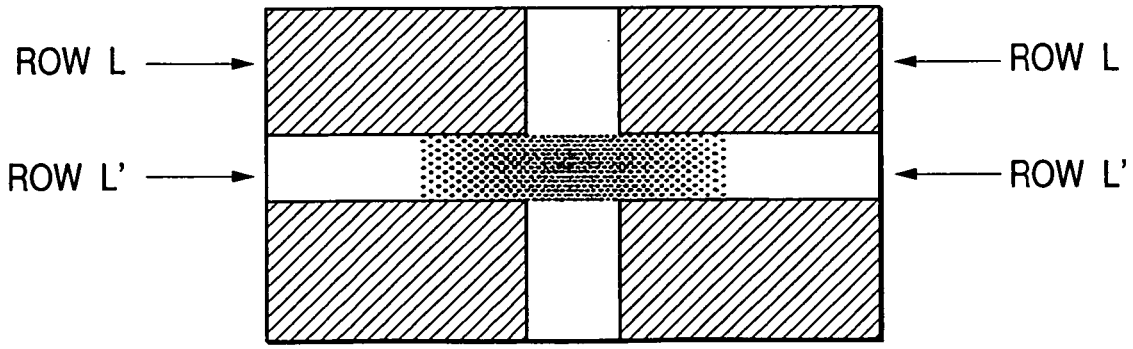

As has been described, voltage drop has different influences over different scanning wirings because image data of one scanning wiring differs from image data of another scanning wiring. Therefore, an image shown in FIG. 8B is displayed when the intended image is the cross pattern of FIG. 8A.

This phenomenon is not limited to a cross pattern but it happens also when the intended image is, for example, a window pattern or a natural image.

To complicate the matter more, voltage drop by nature varies in amount during one same horizontal scanning period due to pulse width modulation.

If a pulse width modulation signal outputted to be supplied to each column has a pulse width according to the size of data inputted as shown in FIG. 7 and is synchronized in its rising period, more pixels emit light immediately after the rise of the pulse than later in the same horizontal scanning period. This may vary depending on image data inputted but, generally, the pixel of the lowest luminance stops emitting light first, followed by the pixel of the second lowest luminance. In this way, the number of pixels that emit light are reduced with time in one horizontal scanning period.

Accordingly, the amount of voltage drop in a scanning wiring is the largest at the start of one horizontal scanning period and then gradually reduced.

The output of pulse modulation signal changes at intervals corresponding to one scale of modulation. Therefore a change in amount of voltage drop with time also takes place with a period corresponding to one scale of pulse width modulation signal as unit time.

(Method of Calculating Voltage Drop)

Voltage drop has the following characteristics.

i) At a certain point of time in one horizontal scanning period, a voltage drop taking place in a scanning wiring is a spatially continuous amount along the scanning wiring and is a very smooth curve.

ii) Although it varies from one display image to another display image, the amount of voltage drop changes at intervals corresponding to one scale of pulse width modulation and, generally, is the largest at the start of rise of a pulse. As the time passes, the amount of voltage drop is gradually reduced or kept constant. In short, voltage drop is never increased in amount in one horizontal scanning period in the driving method of FIG. 7 or in a similar driving method because modulation signals supplied to modulation wirings rise simultaneously.

The present inventors have therefore made an attempt to lighten the load of calculations by simplifying the calculations using an approximation model below.

First, from the characteristic i), calculation of the amount of voltage drop at a certain point of time is simplified by approximation using a degeneracy model in which several thousands of modulation wirings are condensed into a few modulation wirings to several tens of modulation wirings.

From the characteristic ii), a change of voltage drop with time is roughly estimated by setting a plurality of reference time points in one horizontal scanning period and calculating a voltage drop at each reference time point.

Specifically, a change of voltage drop with time is roughly estimated by conducting the voltage drop calculation using the degeneracy model described below at each of the plural reference time points.

(Voltage Drop Calculation Using the Degeneracy Model)

Figure 9A:
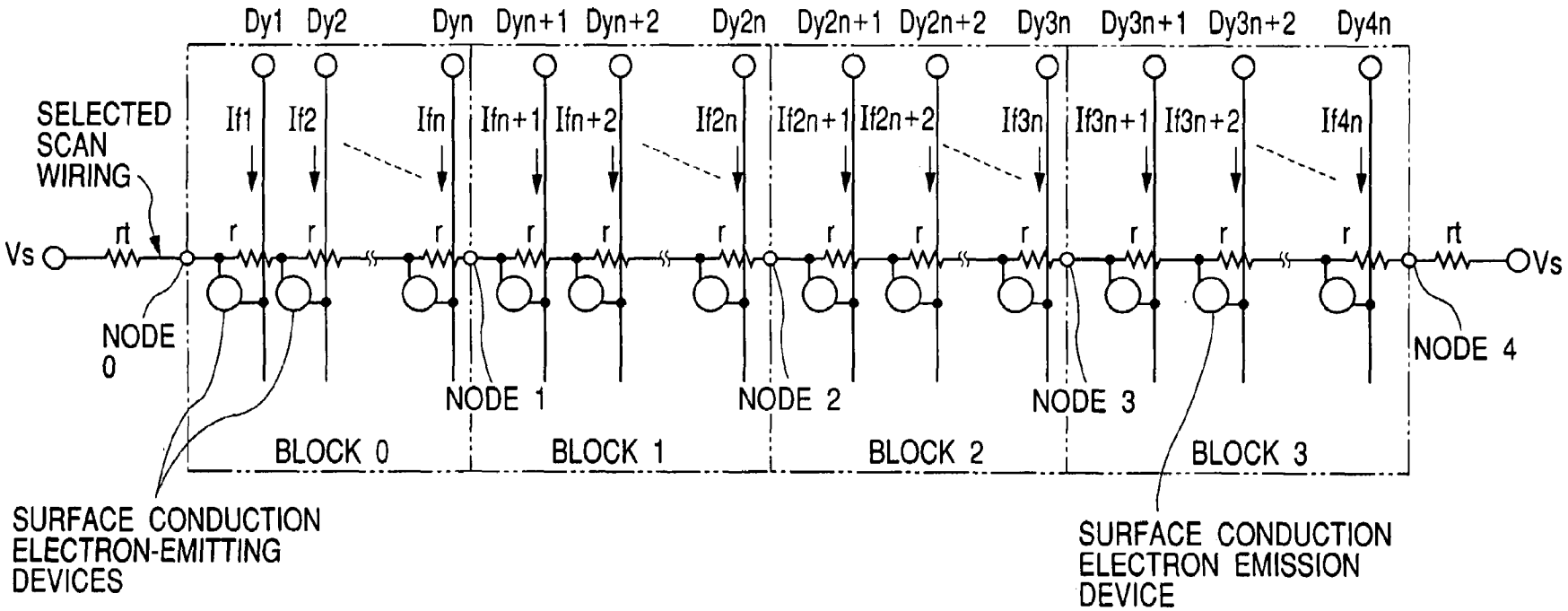
FIGS. 9A, 9B and 9C are diagrams illustrating a degeneracy model of voltage drop.

FIG. 9A is a diagram illustrating blocks and nodes for degeneracy according to the present invention.

For simplification, FIG. 9A shows a selected scanning wiring, modulation wirings, and surface conduction electron-emitting devices connected to intersections of the wirings while omitting the others.

Now, one point of time in one horizontal scanning period has arrived and whether light is emitted or not (in other words, whether the output of the modulator is "H" or "L") from a pixel is known for each of the pixels on the selected scanning wiring.

In this state, a device current flowing into the selected scanning wiring from each modulation wiring is denoted by Ifi (i is a column number ranging from 1 to N).

As shown in FIG. 9A, n modulation wirings, portions of the selected scanning wiring that intersect the n modulation wirings, and surface conduction electron-emitting devices placed at the intersections of the wirings are grouped together to form one block. The apparatus of FIG. 9A is broken into four blocks in this manner.

A node is positioned in each boundary between adjacent blocks. The node is a horizontal position (reference point) for discrete computation of the amount of voltage drop taking place in a scanning wiring in the degeneracy model.

This example has five nodes, Node 0 to Node 4, at the boundaries between the blocks.

Figure 9B:
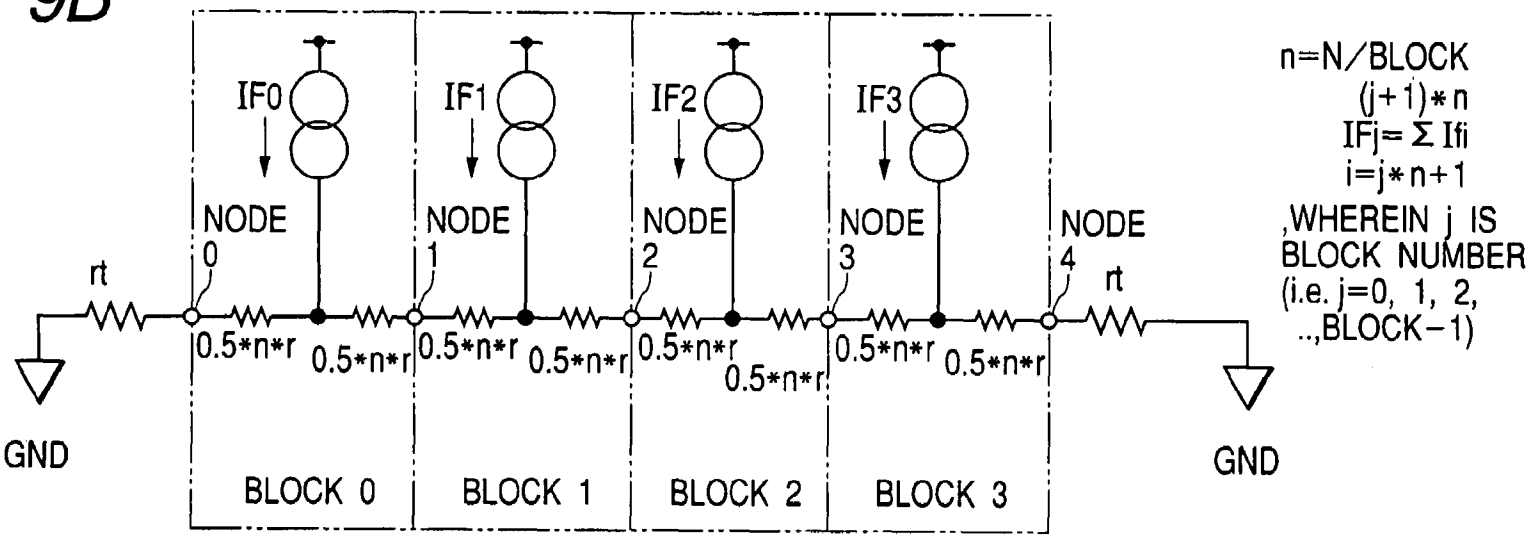

FIG. 9B is a diagram illustrating the degeneracy model.

In the degeneracy model, n modulation wirings included in one block of FIG. 9A are degenerated into one modulation wiring and the degenerated one modulation wiring is positioned at the center of the block of the scanning wiring.

Degenerated modulation wirings of the blocks are each connected to a current source. Total currents in Blocks 0 to 3 are denoted by IF0 to IF3, respectively, and are supplied by the respective current sources.

IFj (j=0, 1, . . . 3) is a current expressed by FORMULA 1 of Mathematical Expression 1.

[Mathematical Expression 1]

$$IFj = \sum_{i=j\times n+1}^{(j+1)\times n} Ifi \qquad \text{(FORMULA 1)}$$

The electric potential of each end of the scanning wiring is at the same level as the output voltage Vs of a row drive circuit in the example of FIG. 9A whereas it is GND electric potential in FIG. 9B. This is because, in the degeneracy model, currents flowing into the selected scanning wiring from the modulation wirings are modeled by the above current sources, thereby making it possible to obtain the amount of voltage drop at each point along the scanning wiring from calculation of the voltage (electric potential difference) at each point along the scanning wiring with the current feeding points set as the reference electric potential (GND). In short, FIG. 9B sets the electric potential at each end of the scanning wiring as the reference electric potential for calculating voltage drop.

The surface conduction electron-emitting devices are omitted in FIG. 9B because the presence or absence of surface conduction electron-emitting devices does not affect the amount of voltage drop taking place and does not matter for the selected scanning wiring as long as the selected scanning wiring can receive an equal amount of current from the modulation wirings. Accordingly, the surface conduction electron-emitting devices are ignored here by setting the values of current flowing from the current sources of the blocks to the total current values (FORMULA 1) of device current in the blocks.

The scanning wiring resistance in each block is n times the scanning wiring resistance r of one section. Here, one section refers to a section of a scanning wiring between an intersection where the scanning wiring intersects one modulation wiring and an intersection where the scanning wiring line intersects a modulation wiring adjacent to the former modulation wiring. In this example, every section of the scanning wiring has the same wiring resistance.

In the degeneracy model as this, the amount of voltage drop taking place at the nodes along the scanning wiring, DV0 to DV4, can be calculated easily by a sum-of-products expression as the one shown in Mathematical Expression 2.

[Mathematical Expression 2]

$$DV0=a00\times IF0+a01\times IF1+a02\times IF2+a03\times IF3$$

$$DV1=a10\times IF0+a11\times IF1+a12\times IF2+a13\times IF3$$

$$DV2=a20\times IF0+a21\times IF1+a22\times IF2+a23\times IF3$$

$$DV3=a30\times IF0+a31\times IF1+a32\times IF2+a33\times IF3$$

$$DV4=a40\times IF0+a41\times IF1+a42\times IF2+a43\times IF3$$

Mathematical Expression 2 can be changed into FORMULA 2 of Mathematical Expression 3.

[Mathematical Expression 3]

$$DVi = \sum_{j=0}^{3} aij \times IFj \qquad \text{(FORMULA 2)}$$

In FORMULA 2, aij represents the voltage generated in the i-th node when a unit current is injected to the j-th block alone in the degeneracy model (this definition of aij is true in descriptions that follow). From Kirchhoff's law, aij can easily be derived as described below.

In FIG. 9B, the wiring resistance of a portion of the scanning wiring which ends at the left feeding terminal viewed from the current source of Block i is given as rli (i=0, 1, 2, 3, 4) whereas the wiring resistance of a portion ending at the right feeding terminal is given as rri (i=0, 1, 2, 3, 4). The wiring resistance of a portion of the scanning wiring between Block 0 and the left feeding terminal and the wiring resistance of a portion of the scanning wiring between Block 4 and the right feeding terminal are each given as rt. Then Mathematical Expression 4 is obtained.

[Mathematical Expression 4]

$$rl0=rt+0.5\times n\times r$$

$$rr0=rt+3.5\times n\times r$$

$$rl1=rt+1.5\times n\times r$$

$$rr1=rt+2.5\times n\times r$$

$$rl2=rt+2.5\times n\times r$$

$$rr2=rt+1.5\times n\times r$$

$$rl3=rt+3.5\times n\times r$$

$$rr3=rt+0.5\times n\times r$$

Mathematical Expression 4 is changed into Mathematical Expression 5 and aij can easily be derived as shown in FORMULA 3 of Mathematical Expression 6. In Mathematical Expression 5, A//B is a symbol representing the parallel resistance value of Resistance A and Resistance B, and satisfies A//B=A×B/(A+B).

[Mathematical Expression 5]

$$a=rl0//rr0=rl0\times rr0/(rl0+rr0)$$

$$b=rl1//rr1=rl1\times rr1/(rl1+rr1)$$

$$c=rl2//rr2=rl2\times rr2/(rl2+rr2)$$

$$d=rl3//rr3=rl3\times rr3/(rl3+rr3)$$

[Mathematical Expression 6]

$$a00=a\times rt/rl0$$

$$a10=a\times(rt+3\times n\times r)/rr0$$

$$a20=a\times(rt+2\times n\times r)/rr0$$

$$a30=a\times(rt+1\times n\times r)/rr0$$

$$a40=a\times rt/rr0$$

$$a01=b\times rt/rl1$$

$$a11=b\times(rt+n\times r)/rl1$$

$$a21=b\times(rt+2\times n\times r)/rr1$$

$$a31=b\times(rt+n\times r)/rr1$$

$$a41=b\times rt/rr1$$

$$a02=c\times rt/rl2$$

$$a12=c\times(rt+n\times r)/rl2$$

$$a22=c\times(rt+2\times n\times r)/rl2$$

$$a32=c\times(rt+n\times r)/rr2$$

$$a42=c\times rt/rr2$$

$$a03=d\times rt/rl3$$

$$a13=d\times(rt+n\times r)/rl3$$

$$a23=d\times(rt+2\times n\times r)/rl3$$

$$a33=d\times(rt+3\times n\times r)/rl3$$

$$a43\ d\times rt/rr3 \qquad \text{(FORMULA 3)}$$

Consulting the definition of aij, calculation of FORMULA 2 is easy from Kirchhoff's law also when the number of blocks is not 4. The feeding terminal may be provided only on one side of the scanning wiring instead of providing it on each side as in this example. In this case also, it is easily calculated by following the definition of aij.

It is not necessary to newly obtain the parameter aij defined by FORMULA 3 each time the calculation is made. Once the parameter is calculated, it is stored as a table.

Approximation of FORMULA 4 in Mathematical Expression 7 is performed on the total currents IF0 to IF3 of the blocks which are obtained by FORMULA 1.

[Mathematical Expression 7]

$$IFj=\sum_{i=j\times n+1}^{(j+1)\times n} Ifi = IFS\times\sum_{i=j\times n+1}^{(j+1)\times n}\text{Count } i \qquad \text{(FORMULA 4)}$$

In FORMULA 4, Count i is a variable that is 1 when the i-th pixel on a selected scanning wiring emits light and is 0 when the pixel does not emit light. IFS is an amount obtained by multiplying device current IF that flows upon application of the voltage VSEL to both ends of one surface conduction electron-emitting device by a coefficient α ranging between 0 and 1.

IFS is defined by FORMULA 5 in Mathematical Expression 8.

[Mathematical Expression 8]

$$IFS=\alpha\times IF \qquad \text{(FORMULA 5)}$$

FORMULA 4 is based on the premise that the amount of device current flowing to the selected scanning wiring from modulation wirings of a block is in proportion to the number of devices that are turned ON in the block. Here, IFS, which is obtained by multiplying the device current IF of one device by the coefficient α, is set as the device current of one device, taking into consideration a reduction in amount of device current due to voltage drop and resulting rise in voltage of the scanning wiring.

Figure 9C:
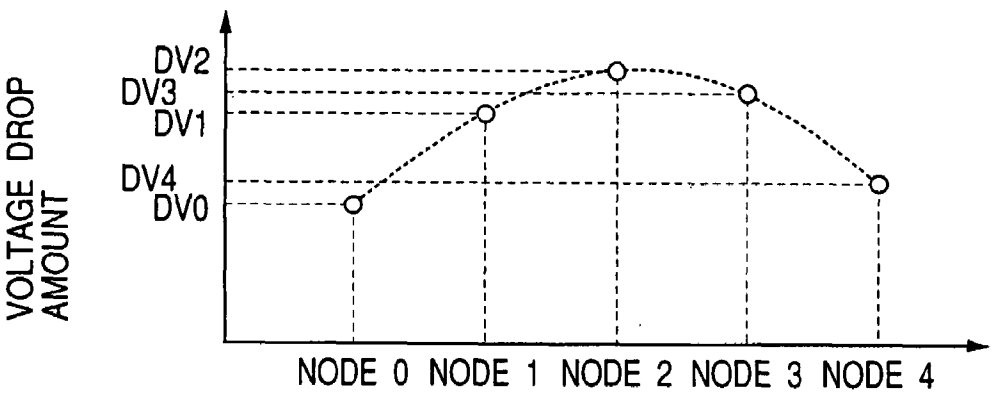

FIG. 9C shows an example of results of calculating the voltage drop amount DV0 to DV4 at the nodes by the degeneracy model in a certain light emission state where some pixels emit light and others don't.

Since voltage drop draws a very smooth curve, it is expected that voltage drop between nodes is as indicated by the dotted line in FIG. 9C in approximation.

Thus voltage drop at a node at a desired point of time can be calculated from inputted image data by using this degeneracy model.

Described above is a simple calculation of the amount of voltage drop in a certain light emission state using the degeneracy model.

The amount of voltage drop taking place in a selected scanning wiring changes with time in one horizontal scanning period. This change is estimated, as has already been described, by obtaining light emission states at some points of time in one horizontal scanning period and calculating voltage drop for each of the obtained light emission states using the degeneracy model.

The number of pixels that emit light in a block at one point of time in one horizontal scanning period can easily be obtained by referring to image data of the block.

As an example, assume that the bit number of data inputted to the pulse width modulation circuit is 8-bit and that the pulse width modulation circuit outputs linear pulse width with respect to the size of the input data.

To elaborate, the output is "L" when the input data is 0, and the output is "H" during one horizontal scanning period when the input data is 255. If the input data is 128, the output is "H" for the former half of one horizontal scanning period whereas "L" is outputted for the latter half of the one horizontal scanning period.

In this case, the number of turned-on devices at the start time of a pulse modulation signal (rising time for the modulation signal of this example) can readily be detected by counting the number of data inputted to the pulse width modulation circuit that are larger than 0 in data size.

Similarly, the number of turned-on devices in the middle of one horizontal scanning period can readily be detected by counting the number of data inputted to the pulse width modulation circuit that are larger than 128 in data size.

In this way, by comparing image data to a certain threshold and counting the number of outputs of the comparator that are true, the number of turned-on devices in a time frame of one's choice can be calculated easily.

Now, a time quantity called a time slot is defined to simplify the following explanations.

A time slot refers to a passage of time from the start time of a pulse width modulation signal (rising of a pulse in the example above) in one horizontal scanning period, and "time slot=0" represents the time point immediately after the start time of a pulse width modulation signal.

"Time slot=64" represents a time point at which a time period corresponding to 64 scales has passed since the start time of a pulse width modulation signal.

Similarly, "time slot=128" represents a time point at which a time period corresponding to 128 scales has passed since the start time of a pulse width modulation signal.

The pulse width modulation in this embodiment sets the rising time as reference and the pulse width from then on is modulated. It can similarly be applied to a case where the pulse width is modulated with the pulse falling time as reference, although the forward direction of the time axis as well as the forward direction of the time slot are reversed in this case.

(Calculating Correction Data from Voltage Drop Amount)

As described above, approximate and discrete computation of a change of voltage drop with time in one horizontal scanning period is achieved by repeated calculations using the degeneracy model.

Figure 10:
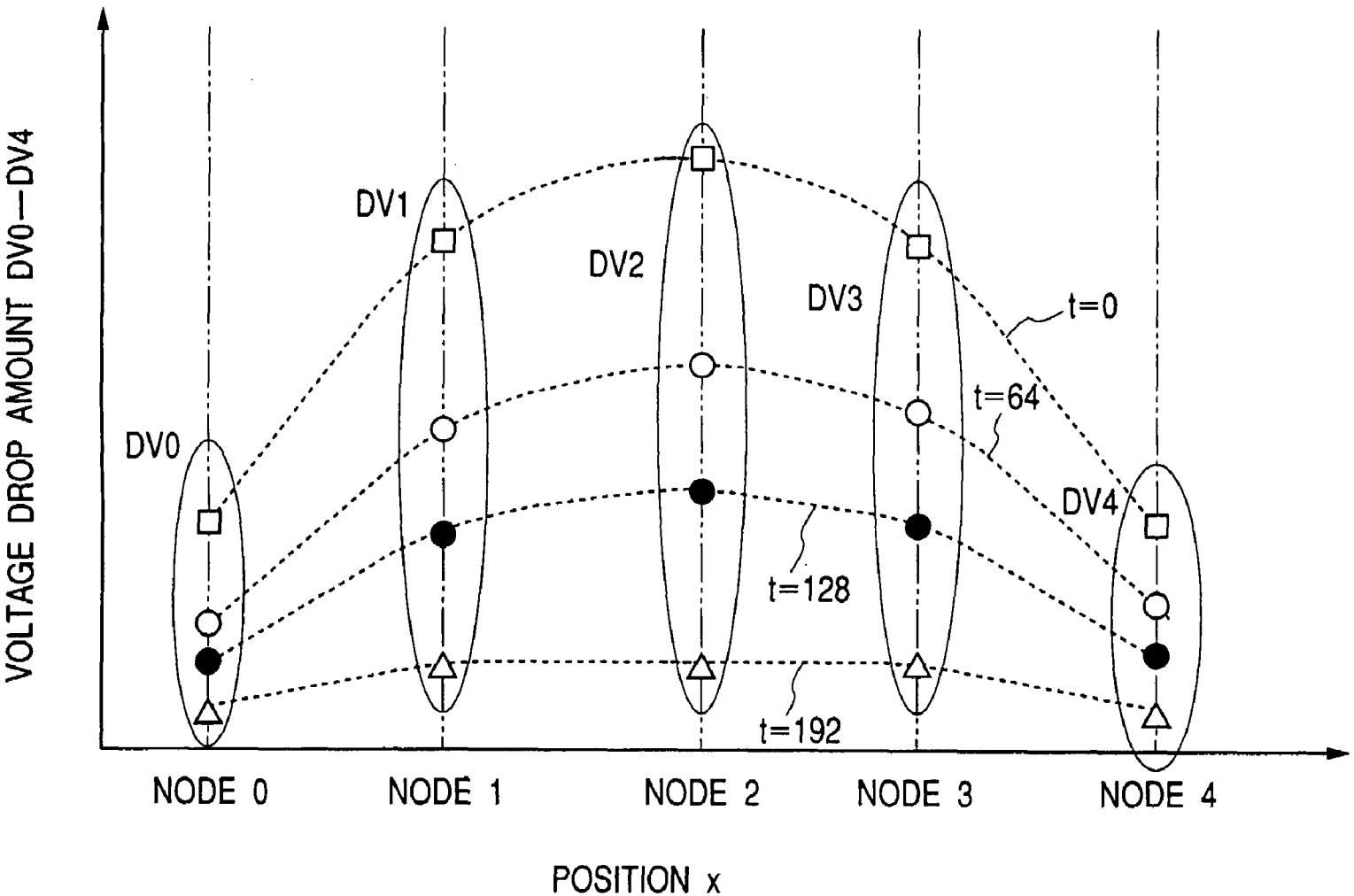
FIG. 10 is a diagram showing the voltage drop amount obtained by discrete computation.

FIG. 10 shows an example of calculating a change of voltage drop with time in a scanning wiring through repeated calculations of voltage drop on certain image data (Note that the voltage drop and its change with time in FIG. 10 are merely an example with one image data as subject, and that voltage drop for different image data changes differently from the one in FIG. 10).

In FIG. 10, calculations using the degeneracy model are conducted at four times points, time slot=0, 64, 128, and 192, to make discrete computation of voltage drop at each of the time points.

The voltage drop amount at a node is connected to the voltage drop amount at another node by a dotted line in FIG. 10. However, the dotted line is to make the drawing easier to view and the voltage drop calculated by this degeneracy model is obtained at the node positions indicated by □, ○, and Δ through discrete computation.

Now that the magnitude of voltage drop and its change with time can be obtained by calculation, the present inventors have tried as a next step a method of calculating correction data for correcting image data from the voltage drop amount obtained.

Figure 11:
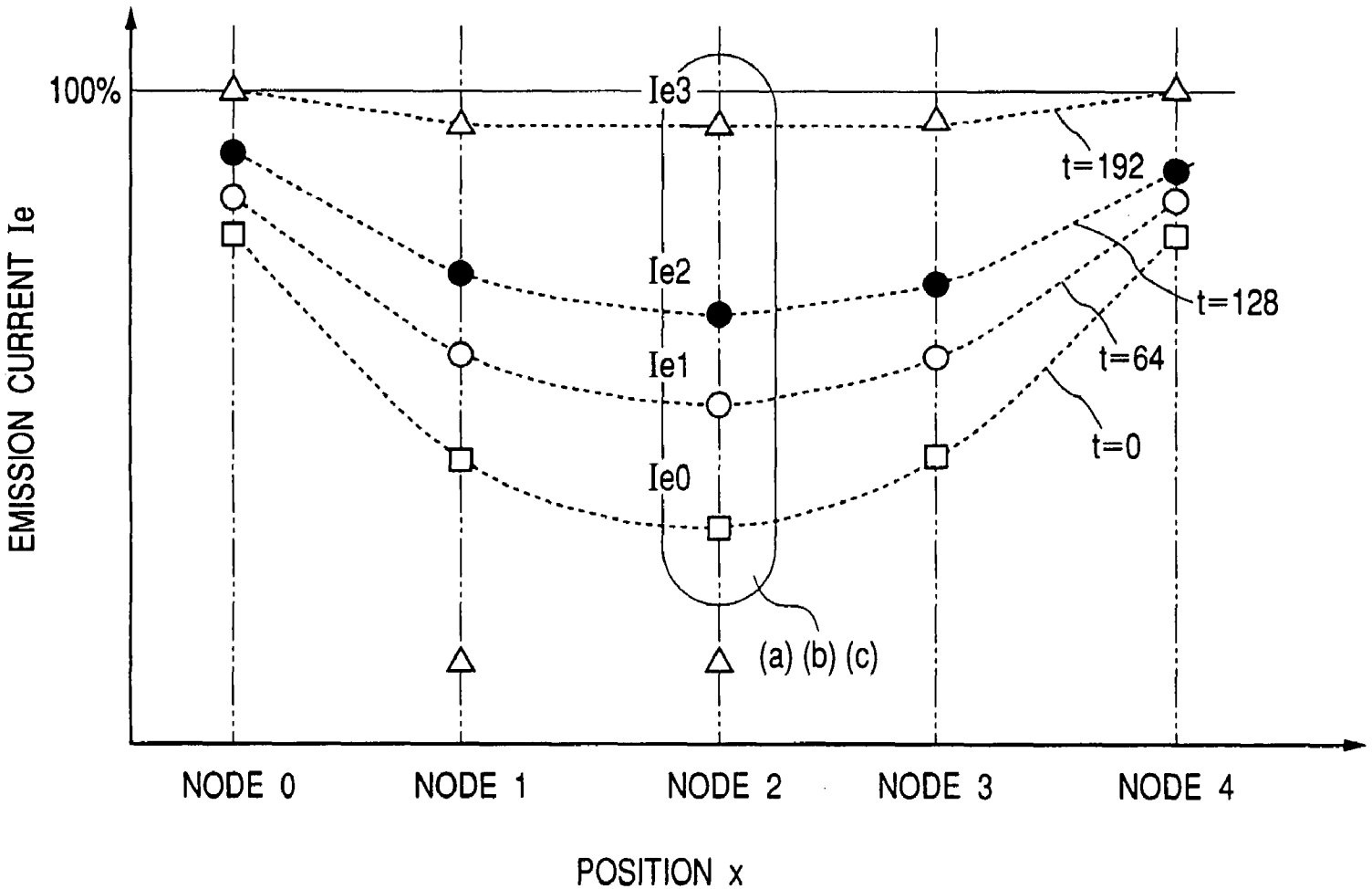
FIG. 11 is a diagram showing a change in amount of current emission which is obtained by discrete computation.

FIG. 11 is a graph of estimation of emission current emitted from a surface conduction electron-emitting device that is turned ON when the voltage drop shown in FIG. 7 takes place in a selected scanning wiring.

The axis of ordinate shows in percentage the amount of emission current at each time point at each position with the magnitude of emission current when there is no voltage drop as 100%. The axis of abscissa shows a horizontal position.

As shown in FIG. 11, at the horizontal position of Node 2 (reference point), the emission current when time slot is 0 is given as Ie0, the emission current when time slot is 64 is given as Ie1, the emission current when time slot is 128 is given as Ie2, and the emission current when time slot is 192 is given as Ie3.

FIG. 11 is calculated from the voltage drop amount of FIG. 10 and from the "drive voltage-emission current" graph of FIG. 6. Specifically, emission current values of when a voltage obtained by subtracting the voltage drop amount from the voltage VSEL are mechanically plotted.

Accordingly, shown in FIG. 11 is a current emitted from a surface conduction electron-emitting device while it is turned ON, and surface conduction electron-emitting device that is turned OFF does not emit current.

Described below are two methods for calculating correction data to correct image data from voltage drop amount.

I) The First Method of Calculating Correction Data

Figure 12A:
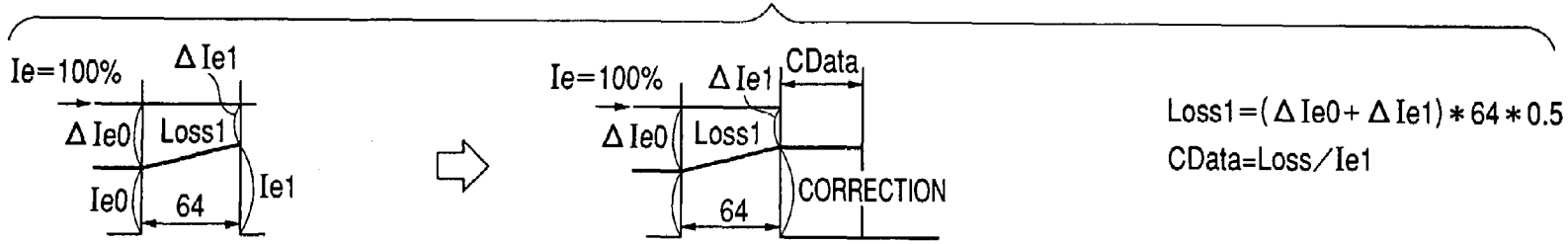
FIGS. 12A, 12B and 12C are diagrams illustrating a method of calculating correction data.
Figure 12B:
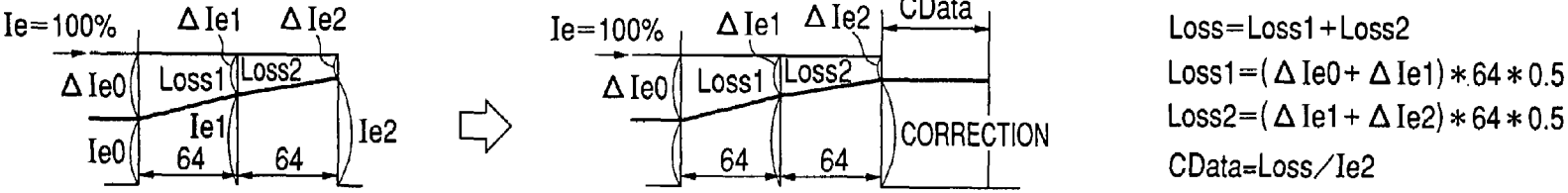
Figure 12C:
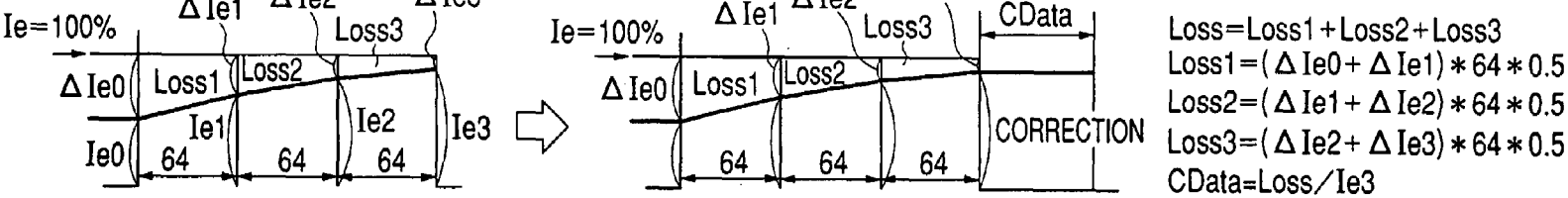

FIGS. 12A, 12B and 12C are diagrams illustrating the first method of calculating correction data for voltage drop amount from the change of emission current with time in FIG. 11.

FIG. 12A is a diagram illustrating a method of calculating correction data for correcting image data of size 64 at the position of Node 2. FIG. 12A schematically shows pulse waveform of emission current after the pulse width is modulated. The wave crest of the pulse waveform represents the amount of emission current, and the pulse width of the pulse waveform shows a length of time in which emission current is emitted. The pulse width of the pulse waveform equals to a time corresponding to 64 scales. To simplify the explanation, abbreviation is used and a length corresponding to 64 scales of a pulse width modulation signal, for instance, may be expressed as a pulse width of 64.

Here, when a pulse width modulation signal having a pulse width of 64 is outputted at the position of Node 2, a reduction Loss in emission current due to voltage drop is approximated as the area of a trapezoid denoted by Loss 1 in FIG. 12A. A calculation formula of this FORMULA 6 is shown in Mathematical Expression 9.

[Mathematical Expression 9]

$$Loss=Loss1=(\Delta Ie0+\Delta Ie1)\times 64\times \Delta t\times 0.5 \quad \text{(FORMULA 6)}$$

wherein, $$\Delta Ie0=IE-Ie0$$

$$\Delta Ie1=IE-Ie1$$

IE: a current of electron emitted from a surface conduction electron-emitting device at turned on state of non-voltage drop;

Δt: a time period corresponding to one gradation level of pulse width modulation;

Then a pulse width to be added to a modulation signal to extend the pulse width of the modulation signal and compensate the sum of loss of emission current, namely, correction data CData to be added to the image data is calculated approximately by FORMULA 7 of Mathematical Expression 10.

[Mathematical Expression 10]

$$CData=Loss/Ie1/\Delta t \quad \text{(FORMULA 7)}$$

In FORMULA 7, the loss is divided by Ie1 because the current emission when time slot is 64 is Ie1, and approximation is made so that the amount of emission current during a period in which the pulse width is extended by correction equals to Ie1.

Similarly, when a pulse width modulation signal having a pulse width of 128 is outputted at the position of Node 2, a reduction Loss in amount of emission current due to voltage drop is approximated as the sum of the area of two trapezoids denoted by Loss 1 and Loss 2 in FIG. 12B. This is calculated by FORMULA 8 of Mathematical Expression 11.

[Mathematical Expression 11]

$$Loss=Loss1+Loss2$$

$$Loss1=(\Delta Ie0+\Delta Ie1)\times 64\times \Delta t\times 0.5$$

$$Loss2=(\Delta Ie1+\Delta Ie2)\times 64\times \Delta t\times 0.5 \quad \text{(FORMULA 8)}$$

wherein, $$\Delta Ie2=IE-Ie2$$

Then a pulse width to be added, namely, correction data CData to be added to the image data of size 128 is calculated approximately by FORMULA 9 of Mathematical Expression 12.

[Mathematical Expression 12]

$$CData=Loss/Ie2/\Delta t \quad \text{(FORMULA 9)}$$

Similarly, when a pulse width modulation signal having a pulse width of 192 is outputted at the position of Node 2, a reduction Loss in amount of emission current due to voltage drop is approximated as the sum of the area of three trapezoids denoted by Loss 1, Loss 2, and Loss 3 in FIG. 12C. This is calculated by FORMULA 10 of Mathematical Expression 13.

[Mathematical Expression 13]

$$Loss=Loss1+Loss2+Loss3$$

$$Loss1=(\Delta Ie0+\Delta Ie1)\times 64\times \Delta t\times 0.5$$

$$Loss2=(\Delta Ie1+\Delta Ie2)\times 64\times \Delta t\times 0.5$$

$$Loss3=(\Delta Ie2+\Delta Ie3)\times 64\times \Delta t\times 0.5 \quad \text{(FORMULA 10)}$$

wherein, $$\Delta Ie3=IE-Ie3$$

Then correction data CData for correcting the image data of size 192 is calculated approximately by FORMULA 11 of Mathematical Expression 14.

[Mathematical Expression 14]

$$CData=Loss/Ie3/\Delta t \quad \text{(FORMULA 11)}$$

When the pulse width of a modulation signal is 0, there is no voltage drop to influence the emission current and therefore correction data is set to 0 and the correction data to be added to image data is also set to 0.

By repeating such operations, discrete computation of correction data for modulation signals having pulse widths of 0, 64, 128, and 192 at all the nodes is completed.

In this example, the voltage drop amount at four time points, time slot=0, 64, 128, and 192, is calculated by applying the degeneracy model for each of the four points. Therefore, correction data can be obtained also at the four time points, 0, 64, 128, and 192.

Preferably, voltage drop calculation by the degeneracy model is conducted at short intervals to track a change of voltage drop with time more closely and make the approximation computation more accurate.

In this case, FORMULA 6 to FORMULA 11 are modified based on the same idea.

Figure 13B:
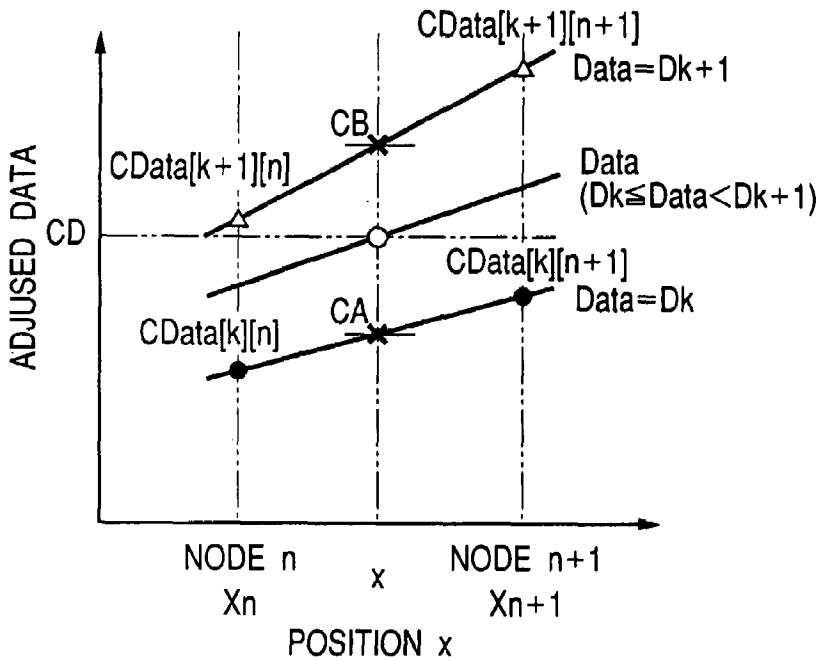
FIGS. 13A and 13B are diagrams illustrating a method of interpolating correction data.
Figure 13A:
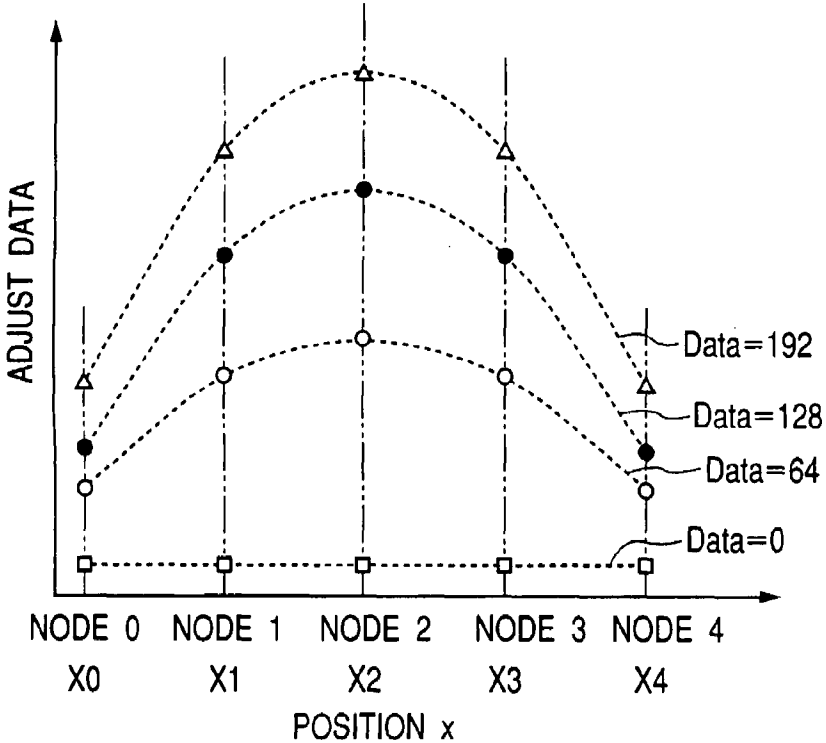

FIG. 13A shows an example of results of discrete computation by the above method to obtain correction data for a certain input data at the respective nodes when the size of image data is 0, 64, 128, and 192.

In FIG. 13A, discrete correction data for the same image data are connected to one another by dotted curves in order to make the graph easier to view.

II) The Second Method of Calculating Correction Data

Figure 14A:
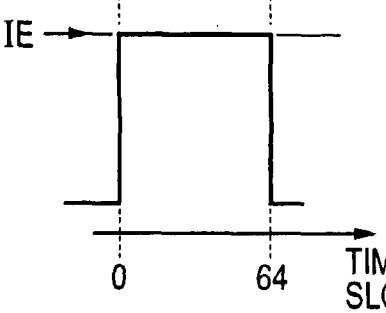
FIGS. 14A, 14B and 14C are diagrams illustrating another method of calculating correction data.
Figure 14B:
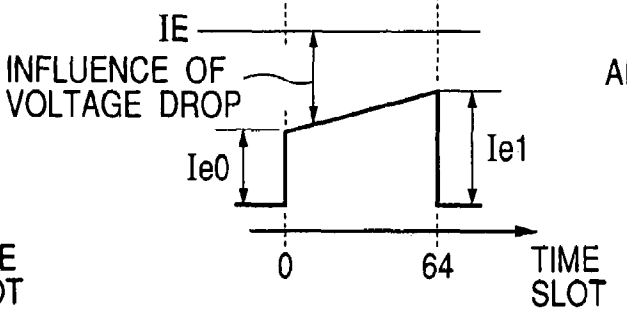
Figure 14C:
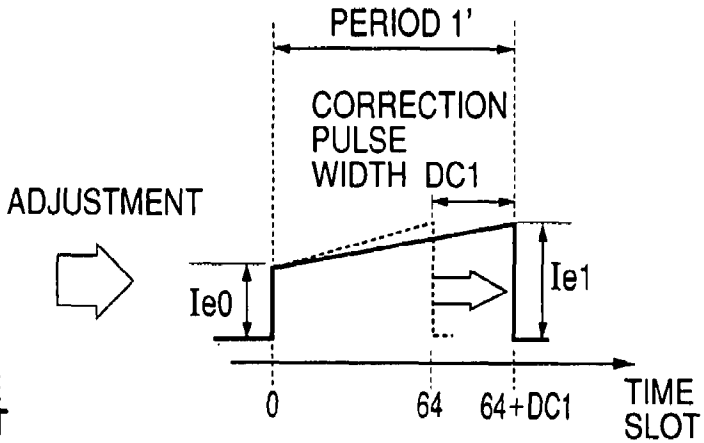

FIGS. 14A, 14B and 14C are diagrams illustrating the second method of calculating correction data for voltage drop amount from the change of emission current with time in FIG. 11. Shown in FIGS. 14A, 14B and 14C are an example of calculating correction data for image data of size 64.

The luminance of emitted light corresponds to the amount of electric discharge, which is obtained by integration of emission current from emission current pulses by time. Accordingly, a change in amount of electric discharge will be used below to explain a change in luminance due to voltage drop.

The emission current of when there is no voltage drop to influence is given as IE, and a length of time corresponding to one scale of pulse width modulation is given as Δt. Then an electric discharge amount Q0 to be emitted from an emission current pulse when the size of image data is 64 can be obtained by multiplying the amplitude IE of the emission current pulse by the pulse width (64×Δt), and is expressed as FORMULA 12 of Mathematical Expression 15 by.

[Mathematical Expression 15]

$$Q0=IE\times 64\times \Delta t \quad \text{(FORMULA 12)}$$

However, in practice, the emission current is lowered by voltage drop in a scanning wiring.

The amount of electric discharge from an emission current pulse after counting the influence of voltage drop in is calculated approximately as follows. Emission currents at Node 2 when time slot is 0 and 64 are given as Ie0 and Ie1, respectively, and a change of emission current when time slot is 0 to 64 is approximated as linear change between Ie0 and Ie1. Then an electric discharge amount Q1 between 0 and 64 corresponds to the area of a trapezoid in FIG. 14B and is calculated by FORMULA 13 of Mathematical Expression 16.

[Mathematical Expression 16]

$$Q1=(Ie0+Ie1)\times 64\times \Delta t\times 0.5 \quad \text{(FORMULA 13)}$$

Next, as shown in FIG. 14C, it is assumed that the influence of voltage drop is removed by extending the pulse width by DC1 and compensating the reduction of emission current due to voltage drop.

When the voltage drop is compensated and the pulse width is extended, the amount of emission current at each time slot is considered to be changed. However, it is assumed here for simplification that the emission current is Ie0 when time slot is 0 and the emission current is Ie1 when time slot is (64+DC1) as shown in FIG. 14C.

An emission current between a point at which time slot is 0 and a point at which time slot is (64+DC1) is approximated as a value on the straight line connecting the emission currents of the two points. Then an electric discharge amount Q2 from the adjusted emission current pulse is calculated by FORMULA 14 of Mathematical Expression 17.

[Mathematical Expression 17]

$$Q2=(Ie0+Ie1)\times(64+DC1)\times \Delta t\times 0.5 \quad \text{(FORMULA 14)}$$

If Q2 is equal to Q0 mentioned above, Mathematical Expression 18 is obtained. Mathematical Expression 18 is solved for DC1 to obtain FORMULA 15 of Mathematical Expression 19.

[Mathematical Expression 18]

$$IE\times 64\times \Delta t=(Ie0+Ie1)\times(64+DC1)\times \Delta t\times 0.5$$

[Mathematical Expression 19]

$$DC1=((2\times IE-Ie0-Ie1)/(Ie0+Ie1))\times 64 \quad \text{(FORMULA 15)}$$

The correction data for image data of size 64 is calculated in this way.

To summarize, as shown in FORMULA 15, CData=DC1 is added as a compensation to image data having a data size of 64 at the position of Node 2.

Figure 15A:
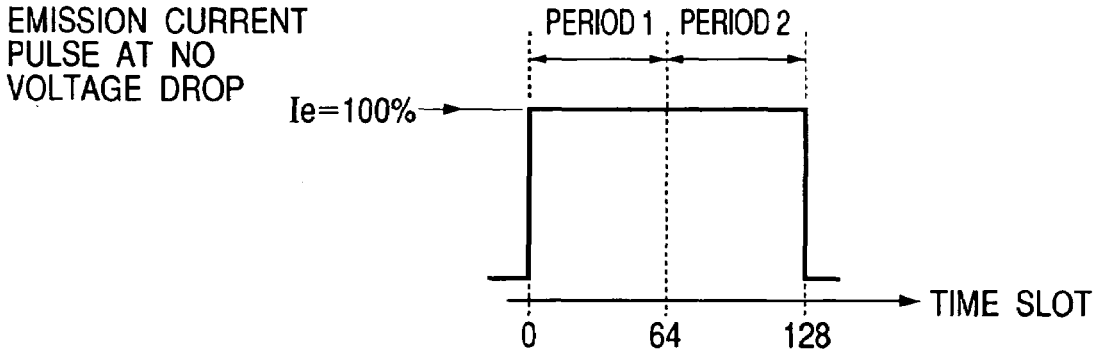
FIGS. 15A, 15B and 15C are diagrams showing an example of calculating correction data when the image data size is 128.
Figure 15B:
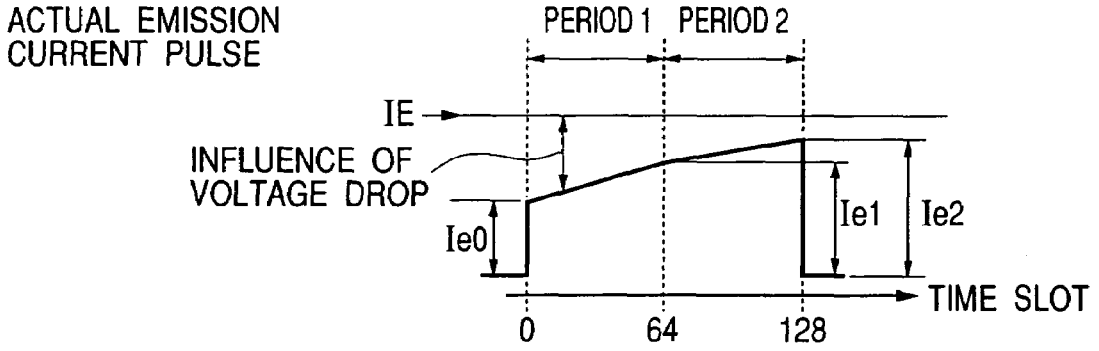
Figure 15C:
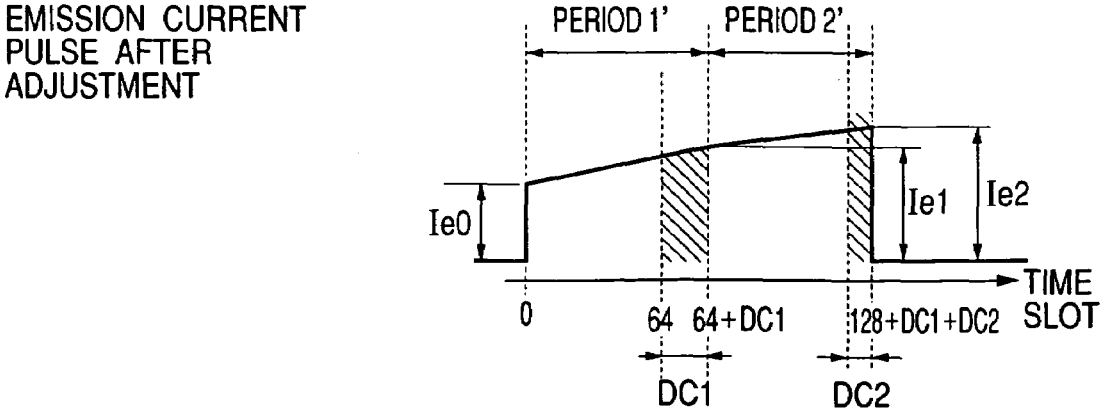

FIGS. 15A, 15B and 15C show an example of obtaining correction data for image data of size 128 from a voltage drop amount calculated.

If there is no affection of the voltage drop, an electric discharge amount Q3 to be discharged from an emission current pulse when image data has a data size of 128 is obtained by FORMULA 16 of Mathematical Expression 20.

[Mathematical Expression 20]

$$Q3=IE\times 128\times \Delta t=2\times Q0 \quad \text{(FORMULA 16)}$$

On the other hand, an actual electric discharge amount from an emission current pulse under the influence of voltage drop is approximated by the following calculation.

At Node 2, emission currents when time slot is 0, 64 and 128 are given as Ie0, Ie1 and Ie2, respectively. If a change of emission current when time slot is 0 to 64 is approximated as a linear change between Ie0 and Ie1, a change of emission current when time slot is 64 to 128 is approximated as a linear change between Ie1 and Ie2, then an electric discharge amount Q4 when time slot is 0 to 128 equals to the area of three trapezoids in FIG. 15B, and is calculated by FORMULA 17 of Mathematical Expression 21.

[Mathematical Expression 21]

$$Q4 = (Ie0+Ie1)\times 64\times \Delta t\times 0.5+(Ie1+Ie2)\times 64\times \Delta t\times 0.5 \quad \text{(FORMULA 17)}$$

The correction amount of voltage drop is calculated as follows.

A period from Time Slot 0 to Time Slot 64 is defined as a period 1, and a period from Time Slot 64 to Time Slot 128 as a period 2.

When the correction is made, the period 1 is extended by DC1 into a period 1', and the period 2 is extended by DC2 into a period 2'.

In each of the periods, the correction makes the electric discharge amount equal to Q0 described above.

Also it is assumed that the initial emission current and closing emission current of each period are not altered for simplification, not to mention that they are altered by the correction.

To elaborate, the initial emission current of the period 1' is Ie0 and the closing emission current of the period 1' is Ie1. The initial emission current of the period 2' is Ie1 and the closing emission current of the period 2' is Ie2.

Then DC1 can be calculated by FORMULA 15.

DC2 is calculated by FORMULA 18 of Mathematical Expression 22 similarly.

[Mathematical Expression 22]

$$DC2=((2\times IE-Ie1-Ie2)/(Ie1+Ie2))\times 64 \quad \text{(FORMULA 18)}$$

In conclusion, correction data CData to be added to image data having a data size of 128 at the position of Node 2 is obtained by FORMULA 19 of Mathematical Expression 23.

[Mathematical Expression 23]

$$CData=DC1+DC2 \quad \text{(FORMULA 19)}$$

Figure 16A:
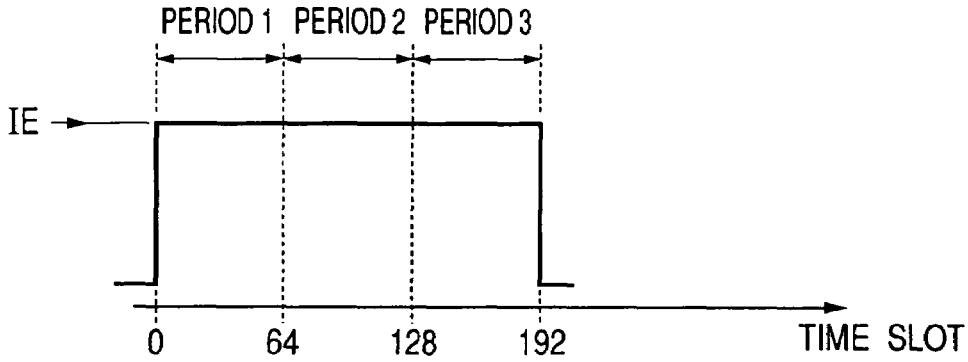
FIGS. 16A, 16B and 16C are diagrams showing an example of calculating correction data when the image data size is 192.
Figure 16B:
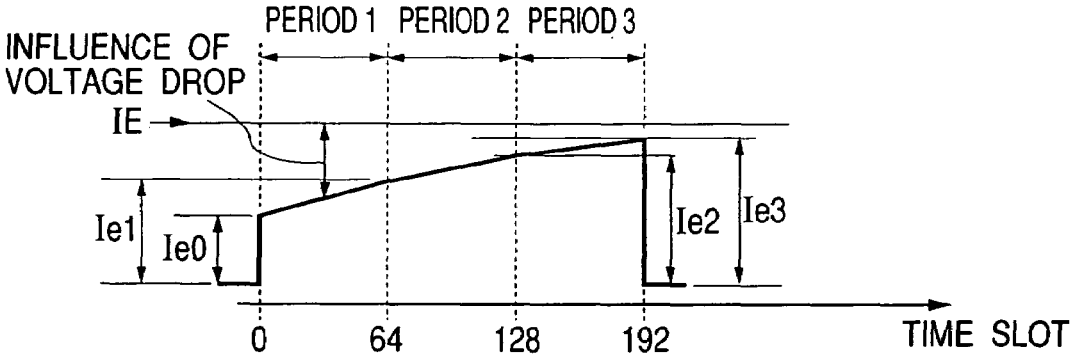
Figure 16C:
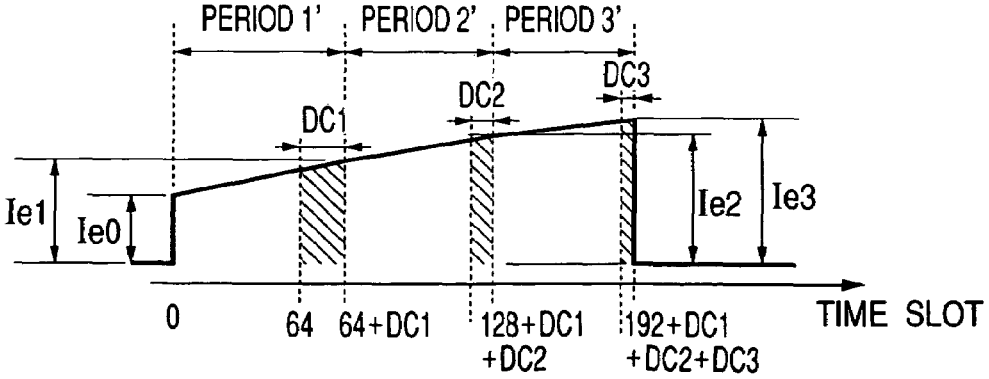

FIGS. 16A, 16B and 16C show an example of obtaining correction data for image data of size 192 from a voltage drop amount calculated.

An electric discharge amount Q5 expected from an emission current pulse when image data has a data size of 192 is obtained by Mathematical Expression 24.

[Mathematical Expression 24]

$$Q5=IE\times 192\times \Delta t=3\times Q0$$

On the other hand, an actual electric discharge amount from an emission current pulse under the influence of voltage drop is approximated by the following calculation.

At Node 2, an emission current when time slot is 0 is given as Ie0, an emission current when time slot is 64 is given as Ie1, an emission current when time slot is 128 is given as Ie2, and an emission current when time slot is 192 is given as Ie3. A change of emission current when time slot is 0 to 64 is approximated as a linear change between Ie0 and Ie1, a change of emission current when time slot is 64 to 128 is approximated as a linear change between Ie1 and Ie2, and a change of emission current when time slot is 128 to 192 is approximated as a linear change between Ie2 and Ie3. Then an input charge amount Q6 when time slot is 0 to 192 equals to the area of three trapezoids in FIG. 16C, and is calculated by FORMULA 20 of Mathematical Expression 25.

[Mathematical Expression 25]

$$Q6 = (Ie0 + Ie1) \times 64 \times \Delta t \times 0.5 + (Ie1 + Ie2) \times 64 \times \Delta t \times 0.5 + (Ie2 + Ie3) \times 64 \times \Delta t \times 0.5 \quad \text{(FORMULA 20)}$$

The correction amount of voltage drop is calculated as follows.

A period from Time Slot 0 to Time Slot 64 is defined as a period 1, a period from Time Slot 64 to Time Slot 128 as a period 2, and a period from Time Slot 128 to Time Slot 192 as a period 3.

Similar to the case above, once the correction is made, the period 1 is extended by DC1 into a period 1', the period 2 is extended by DC2 into a period 2', and the period 3 is extended by DC3 into a period 3'.

In each of the periods, the correction makes the electric discharge amount equal to Q0 described above.

Also it is assumed that the initial emission current and closing emission current of each period are not altered by the correction.

To elaborate, the initial emission current of the period 1' is Ie0 and the closing emission current of the period 1' is Ie1. The initial emission current of the period 2' is Ie1 and the closing emission current of the period 2' is Ie2. The initial emission current of the period 3' is Ie3 and the closing emission current of the period 3' is Ie4.

Then DC1 and DC2 can be calculated by FORMULA 15 and FORMULA 18, respectively.

DC3 is calculated by FORMULA 21 of Mathematical Expression 26.

[Mathematical Expression 26]

$$DC3=((2\times IE-Ie2-Ie3)/(Ie2+Ie3))\times 64 \quad \text{(FORMULA 21)}$$

In conclusion, correction data CData to be added to image data having a data size of 192 at the position of Node 2 is calculated by FORMULA 22 of Mathematical Expression 27.

[Mathematical Expression 27]

$$CData=DC1+DC2+DC3 \quad \text{(FORMULA 22)}$$

The correction data CData for image data of size 64, 128, and 192 at the position of Node 2 are calculated in the manner described above.

When the pulse width is 0, there is no voltage drop to influence the emission current and therefore correction data is set to 0 and the correction data CData of 0 is added to image data.

Described above are the two methods of calculating correction data for discrete image data sizes at discrete horizontal positions (nodes).

In either method, correction data are obtained for non-contiguous image data, 0, 64, 128, and 192. This is intended to lighten the calculation load.

If the same calculation is conducted for all of image data, the calculation load is very large and hardware of very large size is required for the calculation.

At the position of one node, the size of correction data is increased as the image data is increased in size. This tendency can be utilized to greatly reduce the calculation load by interpolating, through linear approximation, points at which correction data have already been obtained and which are in the vicinity of image data to be corrected. Details of this interpolation will be given when discrete adjusted data interpolator is described.

If this idea is applied for all of the node positions, correction data can be calculated for image data having data sizes of 0, 64, 128, and 192 at all of the node positions.

Such discrete image data for which correction data have been calculated are called image data reference values.

In this example, the voltage drop amount at four time points, time slot=0, 64, 128, and 192, is calculated by applying the degeneracy model for each of the four points. Therefore, correction data can be obtained also for four image data reference values, namely, image data of 0, 64, 128, and 192.

Preferably, voltage drop calculation by the degeneracy model is conducted at short intervals to track a change of voltage drop with time more closely and make the approximation computation more accurate, although the number of discrete image data reference values is increased.

In fact, the present inventors have conducted calculations for every 16 time slots between Time Slot 0 and Time Slot 255 (in other words, an image data reference value is set for every 16 units of image data size) and have obtained preferable results. In FIGS. 14A to 14C, 15A to 15C and 16A to 16C, the calculations are conducted at only four points, time slot=0, 64, 128, 192, because it simplifies the drawings.

If the calculations are to be made at short intervals, FORMULA 6 to FORMULA 11, or FORMULA 12 to FORMULA 22 are modified based on the same idea.

The same results as those in FIG. 13A are obtained by using the above method in discrete computation of correction data for image data having data sizes of 0, 64, 128, and 192 at the position of each node for data inputted.

(Method of Interpolating Discrete Adjusted Data)

The correction data obtained by discrete computation are discrete data calculated for the respective node positions and are not correction data for an arbitrary horizontal position (column-directional wiring number). Also, the data are correction data for image data having preset image data reference values at the node positions, and not correction data according to the actual size of image data.

Here, correction data according to the size of input image data in each column-directional wiring is calculated by interpolating the correction data obtained through discrete computation.

FIG. 13B is a diagram showing a method of calculating correction data for image data at a position x that is placed between Node n and Node n+1.

The premise is that the correction data have already been obtained by discrete computation for Node n at a position of Xn and for Node n+1 at a position of Xn+1.

The image data Data takes a value between image data reference values Dk and Dk+1 that are image data for which correction data have already been obtained by discrete computation.

Discrete correction data for the reference value of the k-th image data of the node n is denoted by CData[k][n]. Then correction data CA of a pulse width Dk at the position x can be obtained by linear approximation using the values of CData[k][n] and CData[k][n+1]. The calculation is shown in FORMULA 23 of Mathematical Expression 28.

[Mathematical Expression 28]

$$CA = \frac{(Xn+1-x)\times CData[k][n] + (x-Xn)\times CData[k][n+1]}{Xn+1-Xn} \quad \text{(FORMULA 23)}$$

Xn and Xn+1 represent horizontal display positions of Node n and Node (n+1), respectively, and are constant numbers set when the blocks described above are determined.

Correction data CB for image data Dk+1 at the position x is calculated by FORMULA 24 of Mathematical Expression 29.

[Mathematical Expression 29]

$$CB = \frac{(Xn+1-x)\times CData[k+1][n] + (x-Xn)\times CData[k+1][n+1]}{Xn+1-Xn} \quad \text{(FORMULA 24)}$$

The correction data CD for the image data Data at the position x can be obtained by linear approximation of correction data CA and CB. This calculation is expressed by FORMULA 25 of Mathematical Expression 30.

[Mathematical Expression 30]

$$CD = \frac{CA\times(Dk+1-Data) + CB\times(Data-Dk)}{Dk+1-Dk} \quad \text{(FORMULA 25)}$$

As described above, correction data suited to the actual position and image data size can easily be calculated from discrete correction data by using the method shown in FORMULA 23 to FORMULA 25.

Correction data thus calculated is added to image data to correct the image data, and pulse width modulation is conducted in accordance with the image data after the correction (adjusted image data). Then the influence of voltage drop on a display image, which has been a problem in prior art, can be reduced and the image quality can be improved.

By introducing approximation such as degeneracy described in the above, the calculation load is lightened to make it possible to use a very small hardware. Therefore the present invention can solve the long-standing problem of the size of hardware for correction and is very advantageous.

It has now become clear that the problem of luminance lowering due to voltage drop of a scanning wiring can be solved by the above correction method. However, there are some points that have to be taken notice of in manufacturing a circuit for carrying out the correction.

A digital circuit is limited in data width (bit number) that the circuit can handle. Generally, the data width is determined taking into consideration cost of hardware and the like.

An increase in size of adjusted image data due to addition of correction data may cause a problem called overflow. The overflow is a problem in which bit turn back takes place and a disturbance in image such as inversion of display image is generated when correction data is simply added to image data and the resultant adjusted image data exceeds the data width a pulse width modulator (modulator 8) can handle.

Accordingly, in this embodiment, the maximum value of adjusted image data is calculated in advance and a pulse width modulator having a bit width accommodated to the maximum value is employed.

However, correction made by extending the drive time while keeping it under the maximum drive time that is determined by the established horizontal scanning period (horizontal scanning period determined by an image signal inputted) lowers the luminance and reduces the brightness of the overall display image.

This embodiment therefore allots for each frame the scanning period (selection period) of each scanning wiring in accordance with the maximum value of adjusted image data which is obtained for each horizontal scanning line (scanning wiring) as described above.

(Explanations of Overall System and Functions of Components)

Described next is hardware of image display apparatus with a built-in adjusted data calculator.

Figure 17:
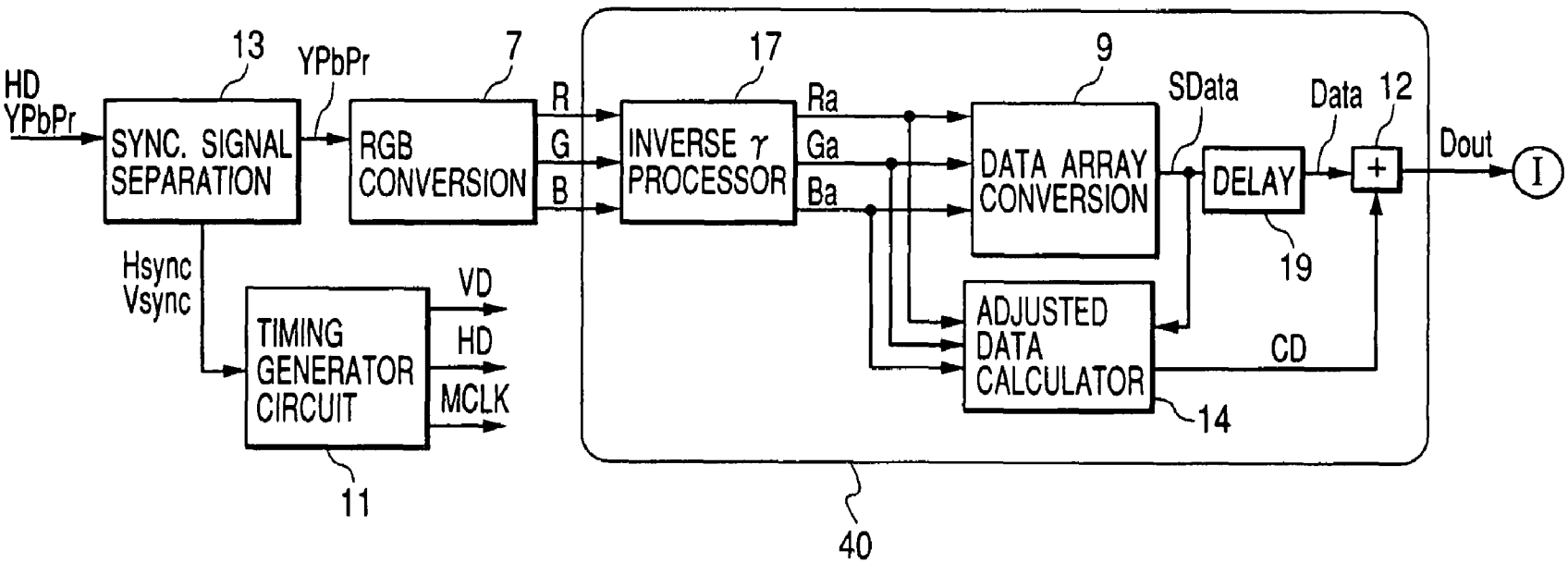
FIG. 17 is a block diagram showing an outline of an image signal processing circuit of the display apparatus used in the present invention.
Figure 18:
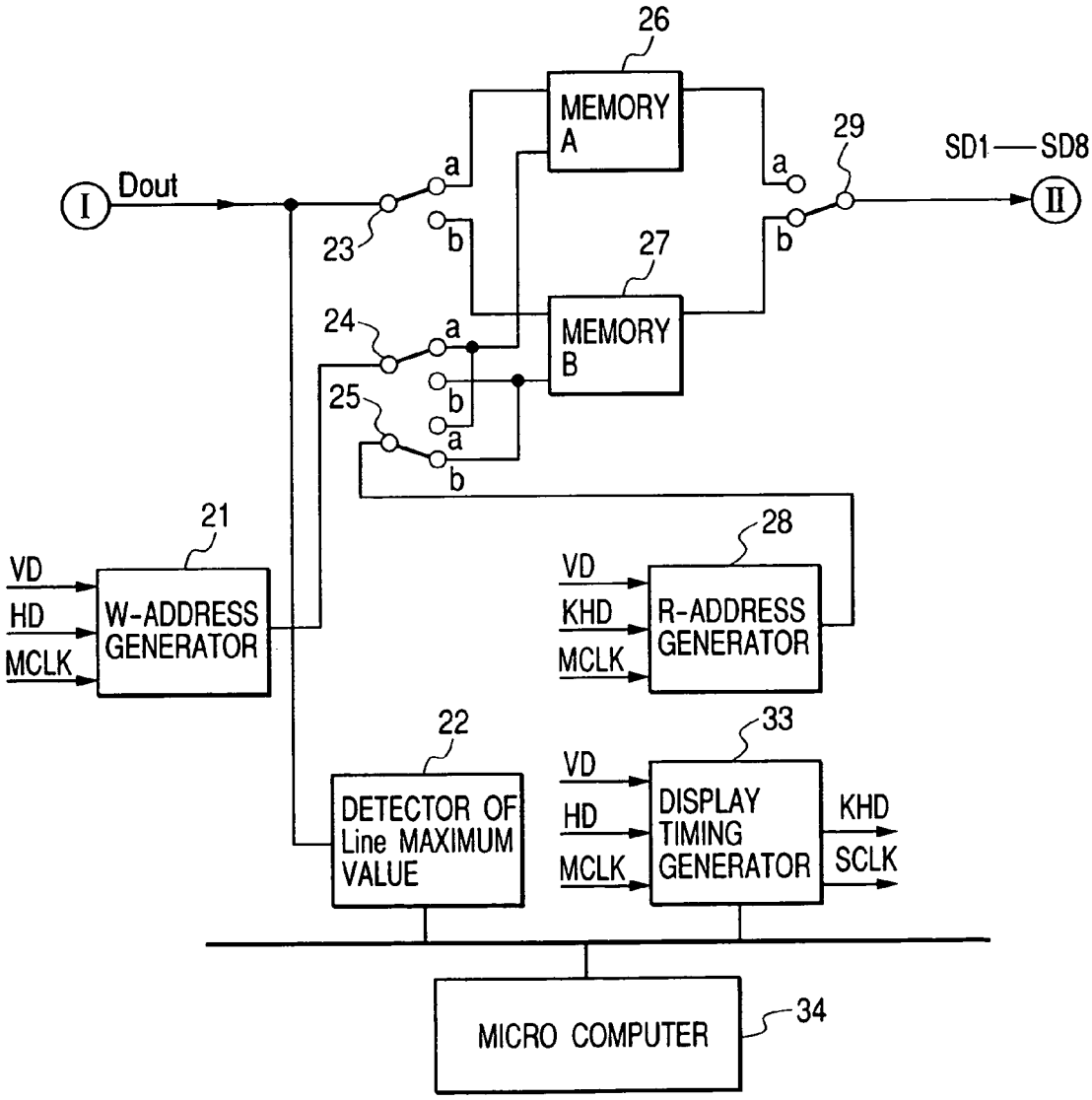
FIG. 18 is a block diagram showing an outline of a drive control circuit of a display apparatus according to an embodiment of the present invention.
Figure 19:
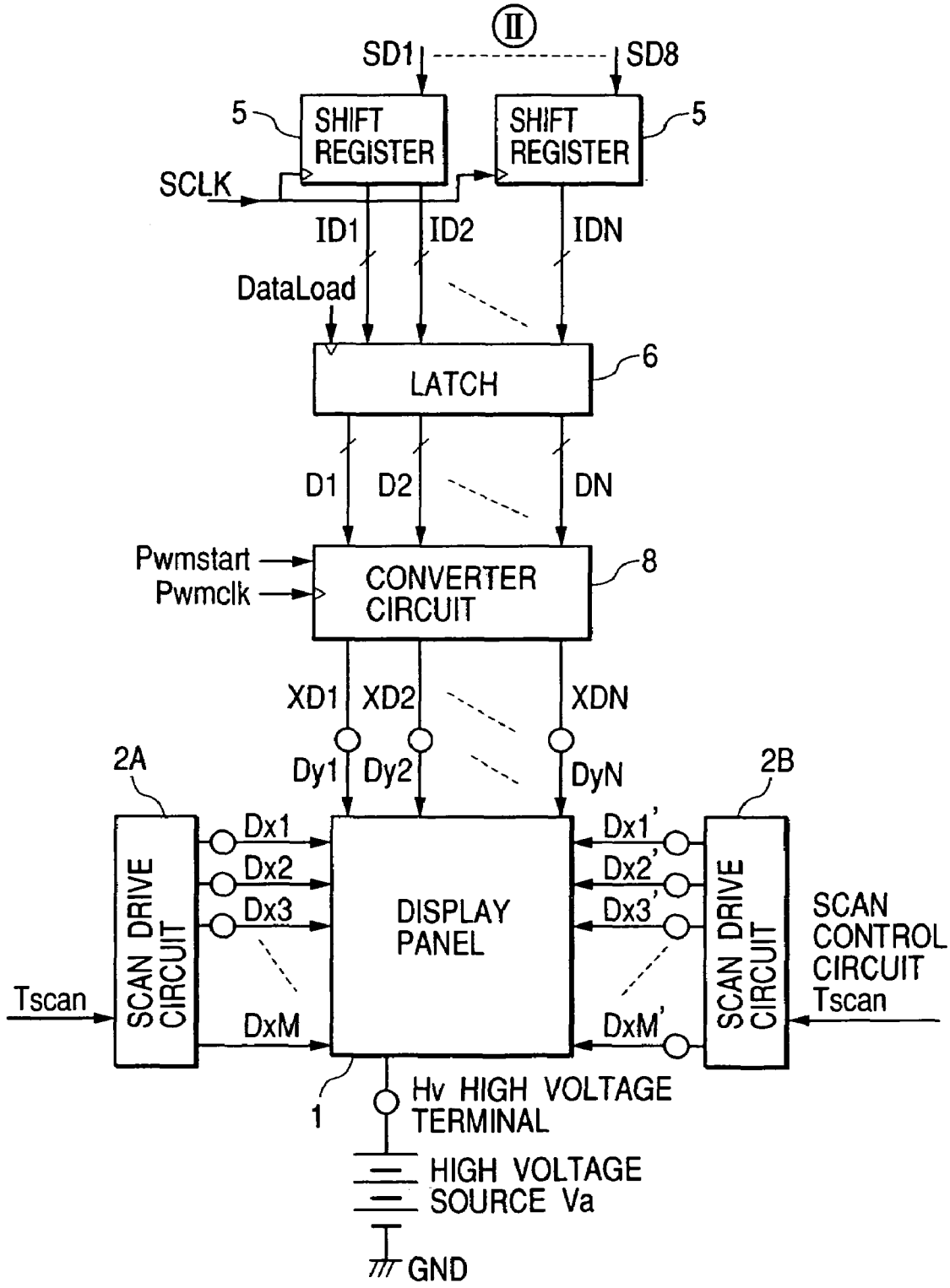
FIG. 19 is a block diagram showing an outline of a display apparatus according to an embodiment of the present invention.

FIGS. 17, 18, and 19 are block diagrams showing an outline of circuit structures of the hardware. FIG. 17 shows a signal processing circuit for inputting an image signal and correcting the image signal inputted. FIG. 18 shows a drive control circuit for determining the selection period of a scanning wiring, namely, a horizontal scanning period. FIG. 19 shows a display panel, a scan drive circuit, and a modulation drive circuit, as well as components related thereto. An output Dout of a circuit shown in FIG. 17 is inputted to a circuit shown in FIG. 18. Outputs SD1 to SD8 of circuits shown in FIG. 18 are inputted to circuits shown in FIG. 19.

In FIG. 17, reference symbol 13 denotes a sync. signal separation circuit for separating an inputted image signal into an image signal and a sync. signal, and 11 denotes a timing generator circuit for generating timing signals of the respective components in response to the sync. signal separated by the sync. signal separation circuit 13. Denoted by 7 is an RGB converter for converting the luminance and color difference signal (YPbPr) separated by the sync. signal separation circuit 13 into signals of three primary colors (RGB).

An image output of computer and the like is inputted as parallel three primary color signals (RGB). In this case, the RGB converter 7 is not necessary.

17 denotes an inverse γ processor for performing inverse γ conversion on RGB signals. 9 represents a data array conversion unit for converting RGB parallel signals into serial signals. 14 is an adjusted data calculator for calculating correction data to compensate voltage drop of a scanning wiring based on inputted image data. 19 is a delay circuit, and 12 denotes an adder for correcting image data using the correction data calculated by the adjusted data calculator 14.

In FIG. 17, R, G, and B represent RGB parallel input image data. Ra, Ga, and Ba represent RGB parallel image data after receiving inverse γ conversion processing. SData is serial image data obtained through parallel-serial conversion by the data array conversion unit 9. Data represent delayed serial image data. CD represents correction data calculated by the adjusted data calculator 14. Dout represents image data adjusted by adding the correction data CD to the serial image data Data in the adder 12 (adjusted image data).

Figure 26:
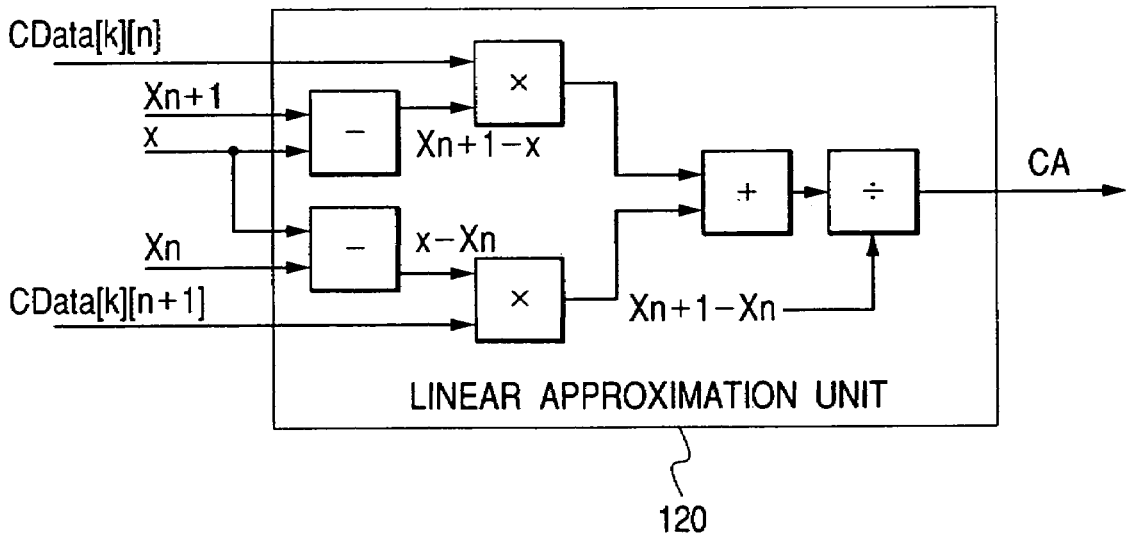
FIG. 26 is a block diagram showing the structure of a linear approximation unit of the adjusted data interpolation unit.
Figure 27:
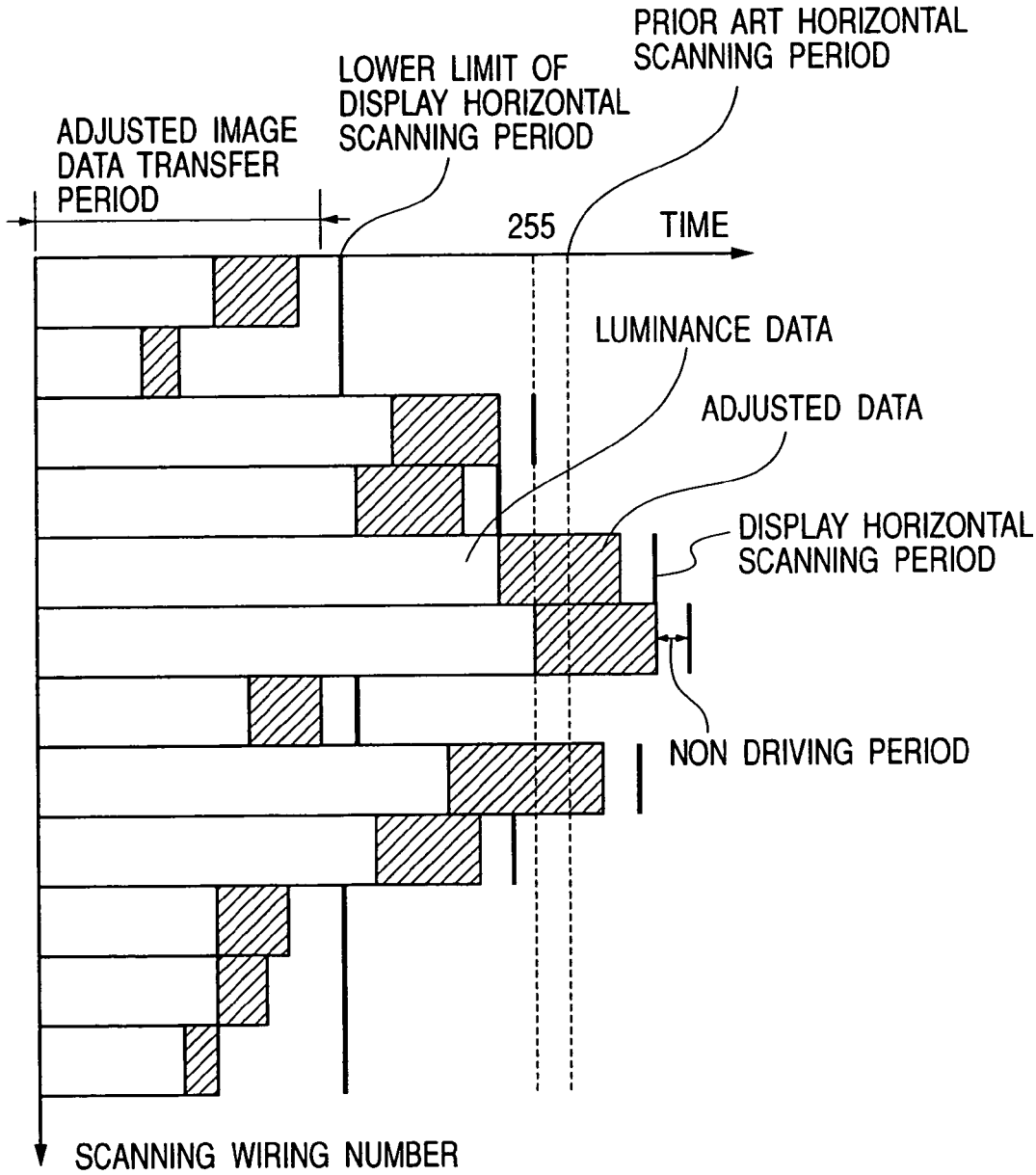
FIG. 27 is a schematic diagram illustrating a method of controlling a horizontal scanning period in accordance with an embodiment of the present invention.

In FIGS. 18, 26 and 27 respectively denote a memory A and memory B which are frame memories for storing adjusted image data temporarily. 21 denotes a W address generator for generating address signals to be written in the memories A and B. 28 is an R address generator for generating address signals to be read out of the memories A and B. 23, 24, 25, and 29 are switches for properly switching input and output of the memories A and B.

Denoted by 22 in FIG. 18 is a detector of line maximum value for detecting the maximum value of adjusted image data for each horizontal scanning line (scanning wiring). 34 denotes a microcomputer for computing the scanning period of each horizontal scanning line (scanning wiring) in accordance with the maximum value of adjusted image data which is detected by the detector 22 of line maximum value. 33 represents a display timing generator for generating display timing signals following computation results of the microcomputer 34.

In FIG. 19, reference symbol 1 denotes a display panel as the one shown in FIGS. 1A, 1B, 1C, 1D, 1E and 1F. Dx1 to D×M and Dx1' to D×M' represent voltage supply terminals of scanning wirings of the display panel. Dy1 to DyN represent voltage supply terminals of modulation wirings of the display panel. Hv represents a high voltage supply terminal for applying an acceleration voltage between a face plate and a rear plate. Va represents a high voltage source. 2A and 2B are scan drive circuits for supplying scanning signals to the scanning wirings.

Denoted by 5 are eight shift registers to which outputs SD1 to SD8 from the memory A 26 and memory B 27 are respectively inputted. 6 denotes a latch circuit for one line of image data. 8 denotes a pulse width modulator circuit for outputting to each modulation wiring of the display panel 1 a modulation signal (voltage pulse) having the pulse width modulated in accordance with adjusted image data. The shift registers 5, the latch circuit 6, and the modulator circuit 8 constitute a modulation drive circuit.

(Sync. Signal Separation Circuit, Timing Generator Circuit)

The display apparatus of this embodiment can display an image using television signals such as NTSC, PAL, SECAM, and HDTV and any computer outputs including VGA.

FIG. 17 shows an example in which HDTV signals of 720*p* are inputted.

An input image signal 720*p* has a frame frequency of 60 Hz and a horizontal frequency of 45 kHz. This means that the number of scanning lines is 750 in total and 720 lines out of them are effective scanning lines.

First, the sync. signal separation circuit 13 separates sync. signals Vsync and Hsync from the inputted image signal of 720*p*. The vertical synchronization signal Vsync and horizontal synchronization signal obtained by sync. separation are supplied to the timing generator circuit 11, whereas the image signal after the sync. separation is supplied to the RGB converter 7. The RGB converter circuit 7 has therein the converter circuit for converting luminance and color difference signals YPbPr into three primary color signals RGB, as well as a low pass filter and A/D converter that are not shown in FIG. 17. The RGB converter 7 converts signals YPbPr into digital RGB signals and supplies the signals to the inverse γ processor 17.

The timing generator circuit 11 has a PLL circuit built in and generates timing signals synchronized with sync. signals of various image sources, thereby generating operation timing signals for the components of the display apparatus.

Examples of timing signals generated by the timing generator circuit 11 include a sampling clock MCLK having a given sampling frequency, a timing signal HD for horizontal scanning, and a timing signal VD for vertical scanning.

In this embodiment, the number of sample clocks in one horizontal scanning period (1H) is set to 1648 and 1280 pixels out of them are effective pixels. Accordingly, the sampling clock frequency MCLK is generated by the PLL circuit at a dividing ratio of 1:1648 to a horizontal synchronization signal to obtain a sampling frequency of 74.16 MHz.

(Inverse γ Processor)

CRTs have a light emission characteristic of about 2.2-th power to an input (hereinafter referred to as inverse γ characteristic).

Taking into account of this characteristic of CRTs, an input image signal is generally converted in accordance with a 0.45th power γ characteristic so that a linear light emission characteristic is obtained when displayed on CRTs.

On the other hand, the display panel of this embodiment has almost linear light emission characteristic with respect to the length of application period when modulation is made by controlling the application period of drive voltage. Therefore the display panel needs to convert an input image signal in accordance with the inverse γ characteristic (hereinafter referred to as inverse γ conversion.

Figure 20:
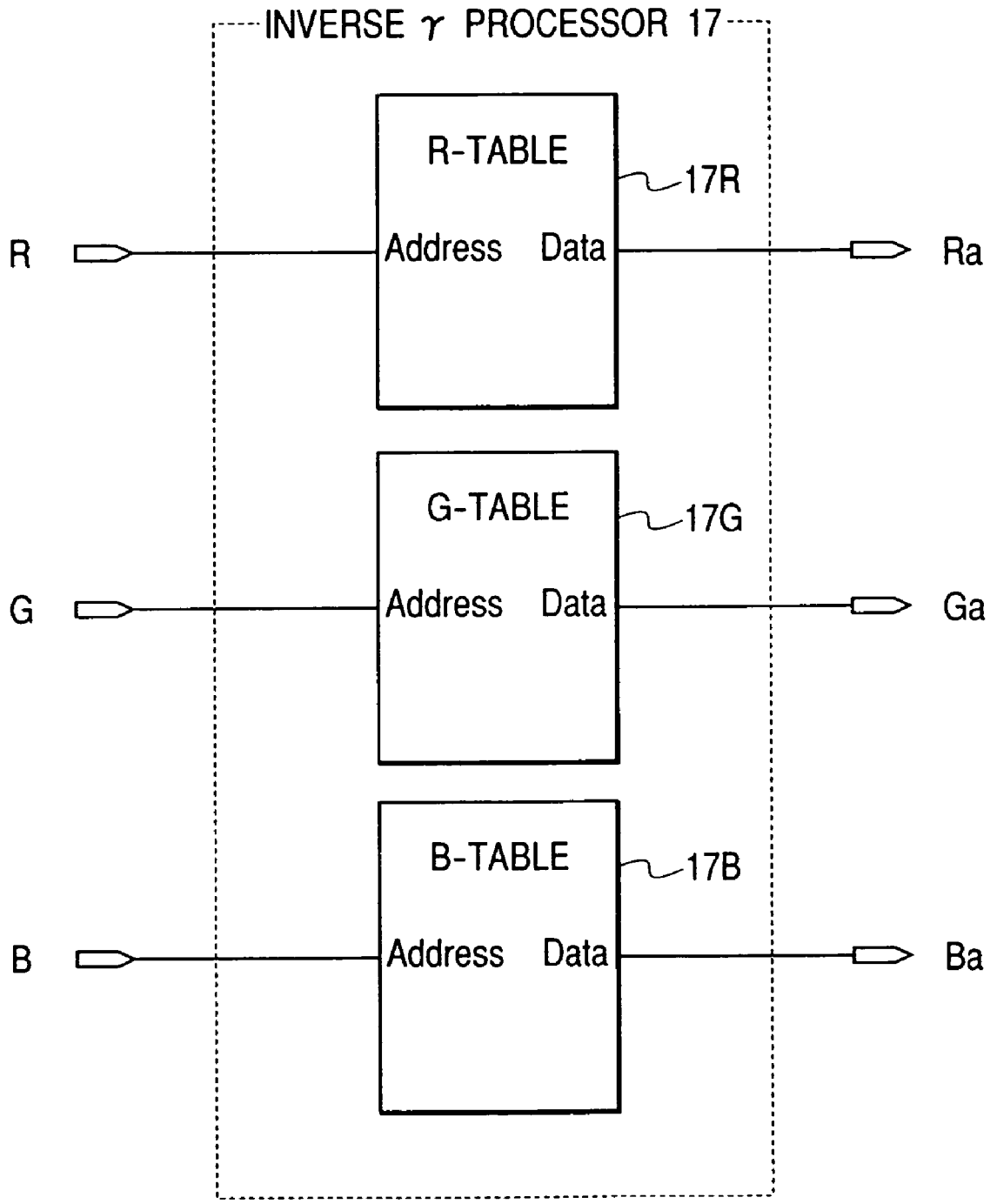
FIG. 20 is a block diagram showing the structure of an inverse γ processor.

FIG. 20 is a block diagram showing the structure of the inverse γ processor 17 for conducting inverse γ conversion on an input image signal.

The inverse γ processor 17 of this embodiment is composed of memories for the above inverse γ conversion processing.

As shown in FIGS. 17 and 20, image signals R, G, and B each have a bit number of 8 and each of image signals Ra, Ga, and Ba that are outputs of the inverse γ processor 17 similarly has a bit number of 8. The inverse γ processor 17 provides a memory with address set to 8-bit and data set to 8-bit for each of R, G, and B colors.

Figure 21A:
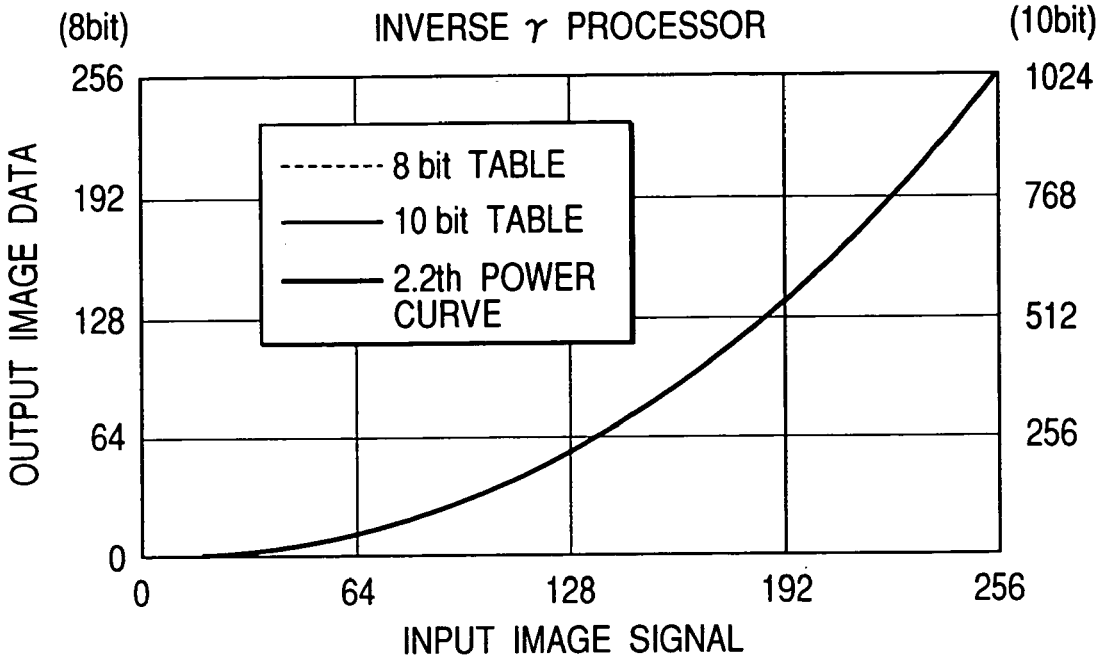
FIGS. 21A and 21B are diagrams showing an input/output characteristic of the inverse γ processor.
Figure 21B:
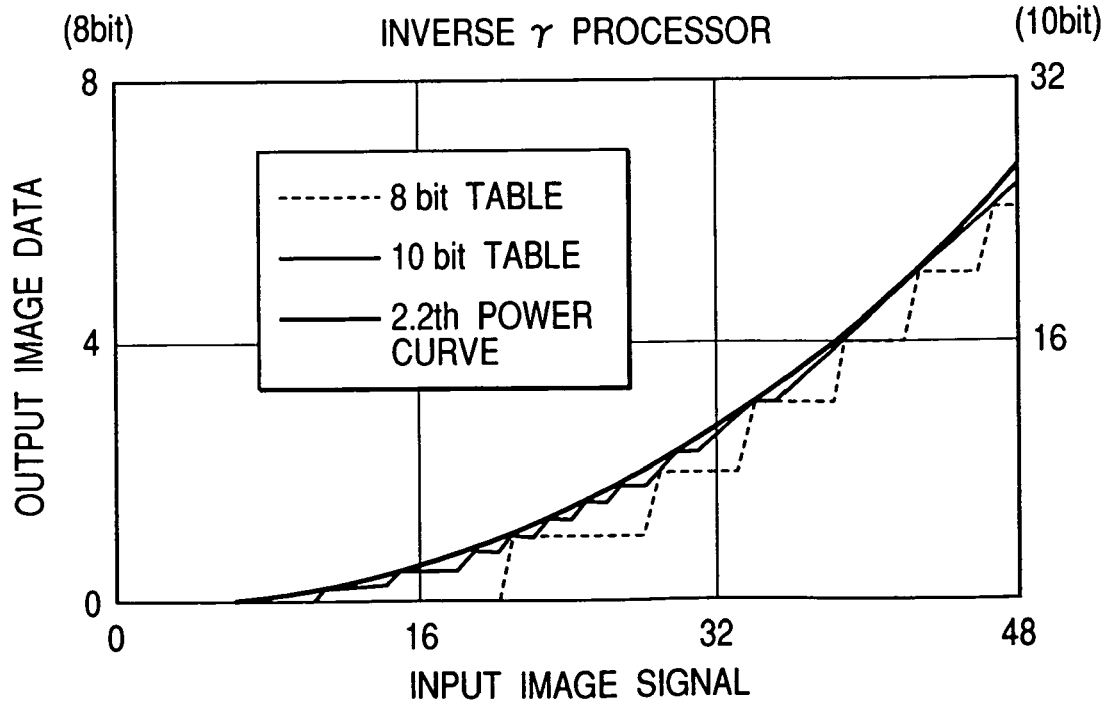

Each of the memories store their respective inverse γ characteristics shown in FIGS. 21A and 21B as an R-table 17R, G-table 17G, and B-table 17B. FIG. 21A shows data in the tables 17R, 17G, and 17B of when the input image signal is 0 to 255. FIG. 21B is an enlarged graph showing data of when the input image data is 0 to 48.

The inverse γ processor 17 is composed of memories with 8-bit input and 8-bit output in this embodiment. However, the inverse γ processor may be composed of memories with, for example, 8-bit input and 10-bit output to raise the conversion accuracy of inverse γ processing. In this case, the memories may store tables of the input/output characteristics shown in FIGS. 21A and 21B for 8-bit input and 10-bit output. In FIGS. 21A and 21B, the left axis of ordinate shows the scale for the curve of the 8-bit table whereas the right axis of ordinate shows the scale for the curve of the 10-bit table in order to make it easier to compare the 8-bit table with the 10-bit table.

(Data Array Conversion Unit)

Figure 22:
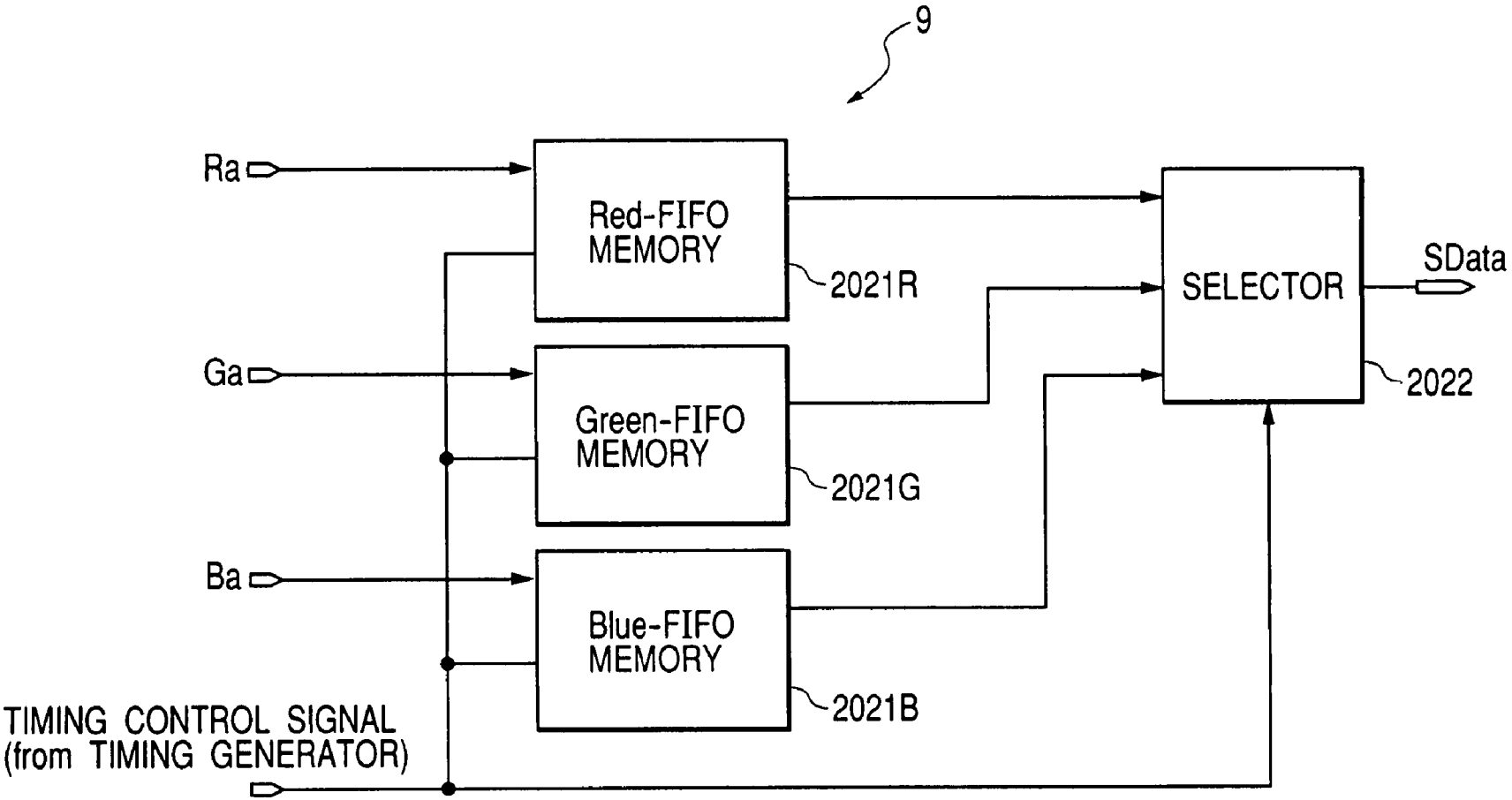
FIG. 22 is a block diagram showing the structure of a data array conversion unit.

The data array conversion unit 9 is a circuit for parallel/serial conversion of RGB parallel image signals Ra, Ga, and Ba in accordance with the pixel array of the display panel 1. As shown in FIG. 22, the data array conversion unit 9 is composed of FIFO (First In First Out) memories 2021R, 2021G, and 2021B provided for the respective colors of RGB, and a selector 2022.

Though not shown in FIG. 22, each FIFO memory has two horizontal pixel number word memories, one for odd-numbered lines and the other for even-numbered lines. When image data of an odd-numbered row is inputted, the data is written in the FIFO for odd-numbered lines whereas image data stored in the preceding horizontal scanning period is read out of the FIFO memory for even-numbered lines. When image data of an even-numbered row is inputted, the data is written in the FIFO for even-numbered lines whereas image data stored in the preceding horizontal scanning period is read out of the FIFO memory for odd-numbered lines.

Data read out of an FIFO memory receives parallel/serial conversion in the selector 2022 in accordance with the pixel array of the display panel, and are outputted as RGB serial image data SData. Although details are omitted, the selector operates in response to a timing control signal from the timing generator circuit 4.

(Adjusted Data Calculator)

Figure 23:
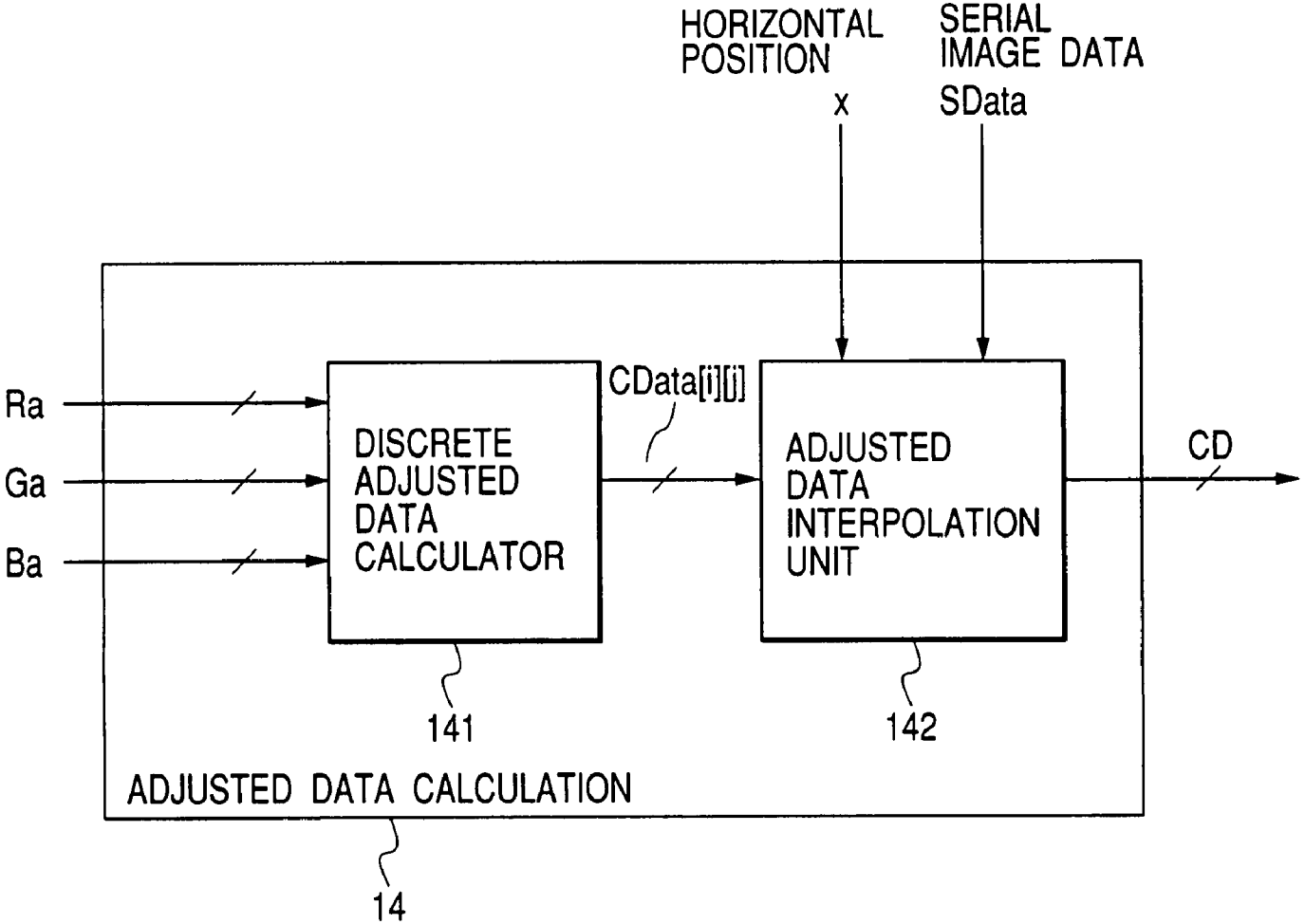
FIG. 23 is a block diagram showing the structure of adjusted data calculator.

The adjusted data calculator 14 is a circuit for calculating voltage drop correction data by the correction data calculating method described above. The adjusted data calculator is composed of two blocks, namely, a discrete adjusted data calculator 141 and an adjusted data interpolation unit 142 as shown in FIG. 23.

The discrete adjusted data calculator 141 is a measure for discrete computation of correction data from voltage drop amount that is calculated from an image signal inputted. The calculator 141 carries out discrete computation of correction data by introducing the concept of the degeneracy model described above in order to lighten the calculation load and reduce hardware in size.

The correction data obtained by discrete computation is interpolated by the adjusted data interpolation unit 142, and correction data CD suited to the size of image data and the horizontal display position x thereof is calculated.

(Discrete Adjusted Data Calculator)

Figures 24A, 24B:
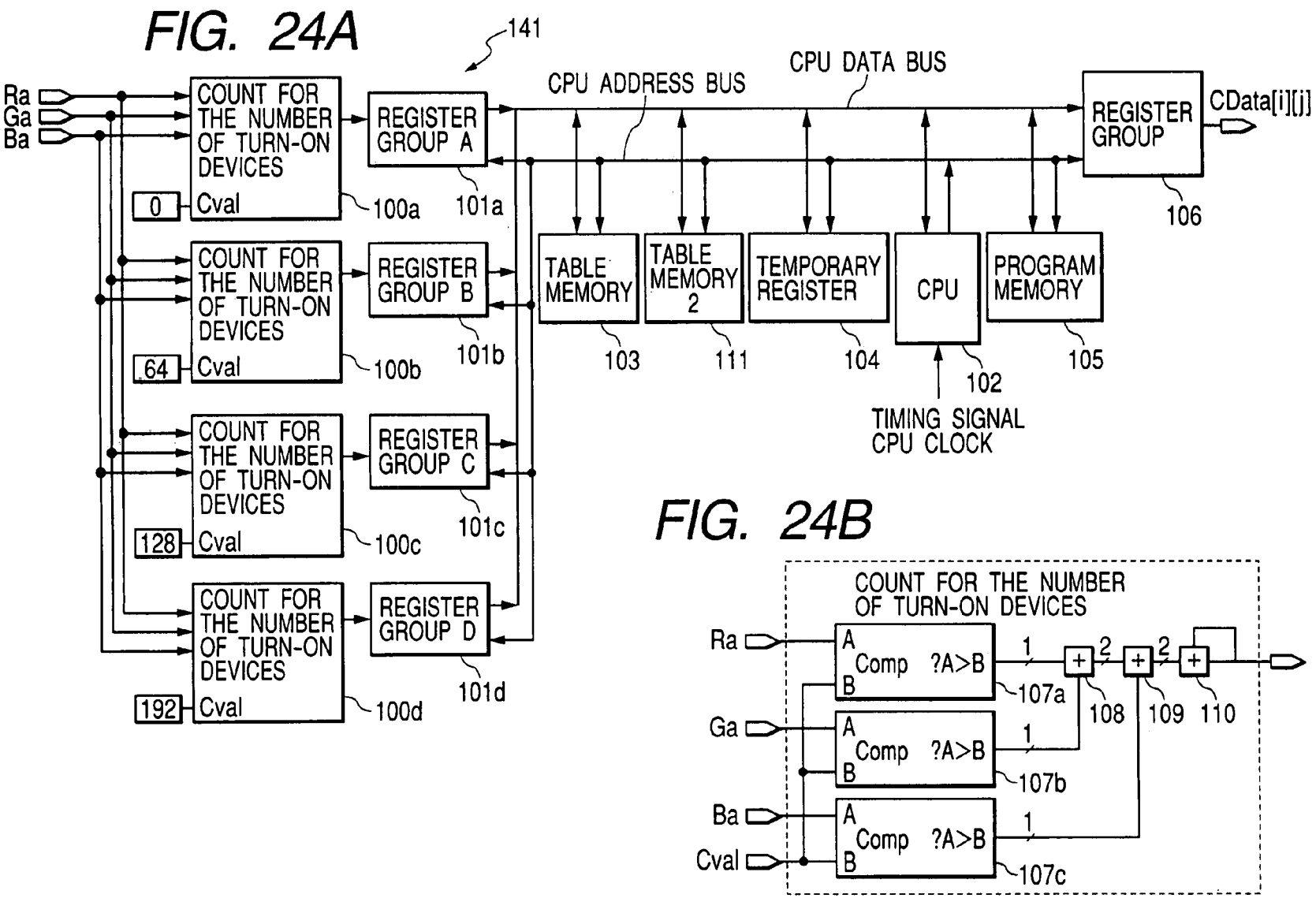
FIGS. 24A and 24B are block diagrams showing the structure of a discrete adjusted data calculator.

FIGS. 24A and 24B are block diagrams showing an outline of the circuit structure of the discrete adjusted data calculator 141 of this embodiment for calculating discrete correction data.

The discrete adjusted data calculator 141 divides image data into blocks and calculates the sample statistic (the number of turned-on devices) for each block as will be described below. The calculator 141 also has a function as a voltage drop amount calculator for calculating a change in amount of voltage drop with time at the position of each node from the sample statistic. Another function of the calculator 141 is to convert the voltage drop amount at each time point into the luminance of emitted light. Still another function of the calculator 141 is to calculate the total luminance of emitted light by integrating the luminance of emitted light in the time direction. The calculator 141 also serves as a measure for obtaining, from those calculations, correction data to image data reference values at discrete reference points.

In FIG. 24A, reference symbols 100*a* to 100*d* denote counters for the number of turned-on devices, and 101*a* to 101*d* denote register groups for storing the number of turned-on devices at each time point for each block. 102 is a CPU. 103 denotes a table memory for storing the parameter aij expressed by FORMULA 2 and FORMULA 3. 104 represents a temporary register for storing calculation results temporarily. 105 is a program memory in which programs of the CPU are stored. 110 denotes a table memory in which conversion data for converting voltage drop amount into emission current amount are stored. Denoted by 106 is a register group for storing calculation results of the discrete correction data described above.

The counters 100*a* to 100*d* for the number of turned-on devices are each composed of a comparator and adder as the ones shown in FIG. 24B, and other components. Parallel image signals Ra, Ga, and Ba are inputted to comparators 107*a*, 107*b*, and 107*c*, respectively, to be compared with the value of Cval sequentially. Cval corresponds to the above-described image data reference value set with respect to image data.

The comparators 107*a* to 107*c* compare Cval with image data to output High when the image data is larger and Low when the image data is smaller.

Outputs of the comparators 107*a* to 107*c* are summed up in adders 108 and 109. An adder 110 further adds up the sum for each block, and the addition result of each block is stored as the number of turned-on devices in the register groups 101*a* to 101*d*.

The counters 100*a* to 100*d* for the number of turned-on devices receive 0, 64, 128, and 192 as the comparison value Cval of the comparators. Then the counter 100*a* for the number of turned-on-devices counts the number of image data that are larger than 0 among the inputted image data and stores the total obtained for each block in the register 101*a*.

Similarly, the counter 100*b* for the number of turned-on devices counts the number of image data that are larger than 64 among the inputted image data and stores the total obtained for each block in the register 10*b*.

Similarly, the counter 100*c* for the number of turned-on devices counts the number of image data that are larger than 128 among the inputted image data and stores the total obtained for each block in the register 101*c*.

Similarly, the counter 100*d* for the number of turned-on devices counts the number of image data that are larger than 192 among the inputted image data and stores the total obtained for each block in the register 101*d*.

After the number of turned-on devices is counted for each block at each time point, the CPU 102 reads the parameter aij stored in the table memory 103 as needed and calculates voltage drop amount following FORMULA 2 to FORMULA 5. The CPU 102 stores the calculation results in the temporary register 104.

In this example, the CPU 102 is provided with a function of calculating sum of products to carry out the calculation of FORMULA 2 smoothly.

Instead of calculating sum of products in the CPU 102 for FORMULA 2, for example, FORMULA 2 may be calculated by using a memory in which results of calculating sum of products are stored in advance. In this case, the number of turned-on devices in each block is inputted and the memory stores in advance the voltage drop amount at each node position for every conceivable input pattern.

At the same time the calculation of voltage drop amount is completed, the CPU 102 reads out of the temporary register 104 the voltage drop amount stored for each block at each time point and converts the voltage drop amount consulting the table memory 2 (110) into the amount of emission current. Then the CPU 102 obtains discrete correction data following FORMULA 6 to FORMULA 11 or FORMULA 12 to FORMULA 22.

The obtained discrete correction data is stored in the register group 106.

(Adjusted Data Interpolation Unit)

Figure 25:
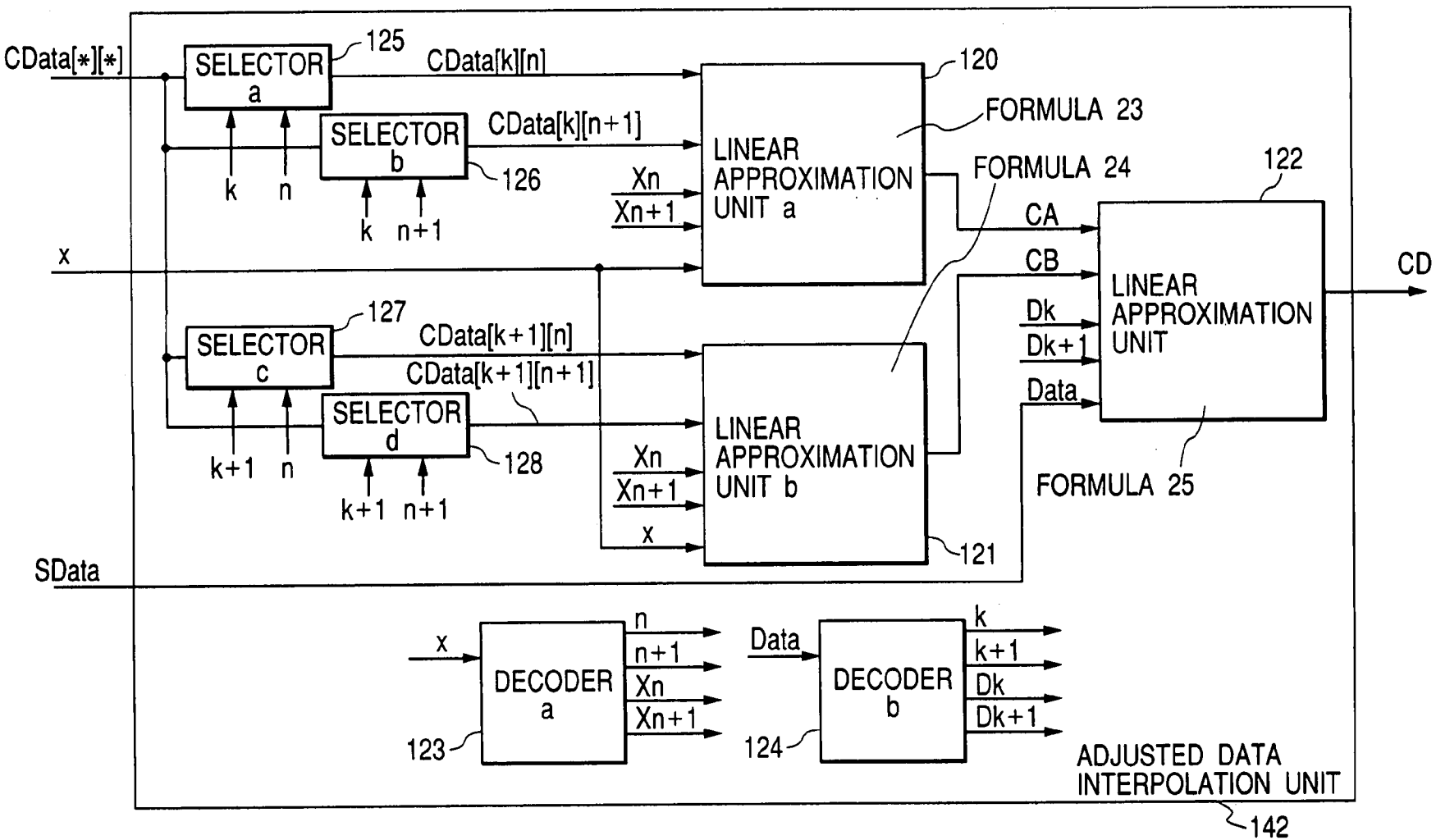
FIG. 25 is a block diagram showing the structure of an adjusted data interpolation unit.

FIG. 25 is a diagram illustrating a detailed structure of the adjusted data interpolation unit 142 shown in FIG. 23.

The adjusted data interpolation unit 142 is a measure for calculating correction data suited to a position at which image data is displayed (horizontal position) and to the size of the image data. The unit 142 interpolates correction data obtained by discrete computation to calculate correction data that is suited to the display position (horizontal position) of image data and to the size of the image data.

In FIG. 25, reference symbol 123 denotes a decoder for determining the node numbers n and n+1 of discrete correction data used in interpolation from the display position (horizontal position) x of image data. Denoted by 124 is a decoder for determining k and k+1 of FORMULA 23 to FORMULA 25 from the size of image data.

Selectors 125 to 128 are selectors for selecting discrete correction data and supplying the selected data to linear approximation units.

The linear approximation units are denoted by 120 to 122 and respectively conduct linear approximation of FORMULA 23 to FORMULA 25.

FIG. 26 shows an example of the structure of the linear approximation unit 120. In general, a linear approximation unit can be composed of a subtracter, a multiplier, an adder, a divider, and the like as the operators of FORMULA 23 to FORMULA 25 show. The linear approximation units 121 and 122 have the same structure that the linear approximation unit 120 has.

However, it is desirable if the number of column-directional wirings between nodes for calculating discrete correction data is power of 2 and the interval between image data reference values for calculating discrete correction data (namely, a time interval for calculating voltage drop) is power of 2 because it makes the structure of hardware simple. If the number and interval thereof are both set to power of 2, (Xn+1)−Xn takes a value of power of 2 in the divider shown in FIG. 26 and therefore the division can be carried out by bit shift.

If (Xn+1)−Xn is a fixed value of power of 2, the divider can be omitted by outputting addition results of the adder after shifting the addition results by multiplier of power function.

The interval between nodes and interval between image data for calculating discrete correction data may be set to power of 2 in other locations, too. This makes it possible to manufacture the decoders 123 and 124 more easily and to replace the calculation in the subtracter of FIG. 26 with a simpler bit calculation.

(Delay Circuit 19)

The image data SData rearranged by the data array conversion unit 9 as shown in FIG. 17 is inputted to the adjusted data calculator 14 and the delay circuit 19. The adjusted data interpolation unit of the adjusted data calculator 14 calculates correction data CD in accordance with the horizontal position information x from the timing control circuit and the value of the image data SData.

The delay circuit 19 is provided to absorb time spent to calculate correction data. When correction data is added to image data in the adder 12, the delay circuit 19 delays signals so that the correction data is accurately added to its intended image data. The delay circuit 19 can be built from a flip-flop circuit.

(Adder 12)

The adder 12 is a measure for adding correction data CD from the adjusted data calculator 14 to image data Data. The image data Data is corrected through the addition and outputted as adjusted image data Dout to the memory A 26 or memory B 27 (see FIGS. 17 and 18).

(About Control of Horizontal Scanning Period)

In conventional display apparatus, the same length of display horizontal scanning period is uniformly allotted to all scanning wirings based on the length of one horizontal scanning period which is determined by a horizontal synchronization signal included in an input image signal.

On the other hand, this embodiment allots varying scanning periods to scanning wirings in accordance with the maximum value of adjusted image data. This embodiment is thus successful in meeting both of conflicting demands of correcting voltage drop in scanning wirings with high accuracy and preventing lowering in luminance of display image.

In reality, a viewer hardly finds strangeness in a displayed image when the display scanning period varies between scanning wirings.

In addition, it is not efficient to scan all scanning wirings using the same horizontal scanning period as in prior art when signals used are image signals of natural images such as TV signals because it is not so often for natural images to include data large enough to cause overflow after correction and the maximum value of adjusted image data fairly fluctuates from one horizontal scanning line to another horizontal scanning line.

Accordingly, employing the driving method of this embodiment does not cause display problems. On the contrary, the driving method can prevent lowering in luminance by using display horizontal scanning periods set in accordance with the maximum value of the pulse width of modulation signals associated with scanning wirings to scan the scanning wirings.

FIG. 27 is a schematic diagram illustrating horizontal scanning periods used in this embodiment. The axis of ordinate of the graph of FIG. 27 shows horizontal scanning wirings. The number of horizontal scanning wirings in the example shown in FIG. 27 is set to twelve in order to simplify the explanation. The axis of abscissa of the graph shows time (pulse width). The image data width is set to 8-bit for easier understanding and how correction data is added to luminance data is clearly shown in the drawing.

In the bar graph of FIG. 27, bars respectively representing the horizontal scanning wirings indicate the maximum modulation signal pulse width, namely, the maximum adjusted image data in pixels on the horizontal scanning wirings they represent. A white rectangular portion of a bar shows one line of input image data (luminance data) of the horizontal scanning wiring the bar represents, and a hatched rectangular portion of the bar shows correction data for the input image data.

As shown in FIG. 27, the maximum value of adjusted image data varies from one horizontal scanning wiring to another. Therefore it is conceivable that different display scanning periods are allotted to different horizontal scanning wirings so that the maximum value of adjusted image data of a scanning wiring is contained within a display scanning period allotted to the scanning wiring, instead of uniformly allotting the same scanning period to all scanning wirings. If the sum of display horizontal scanning periods individually allotted to the respective horizontal scanning wirings is equal to or less than the length of one frame display period, one frame of image can be displayed within the length of one frame period. In other words, one frame of image can be displayed within the length of one frame period if the average of the display horizontal scanning periods is equal to the conventional horizontal scanning period (255 plus blanking period, in FIG. 27). An animated image can also be displayed smoothly since the difference between the length of one frame display and the length of one frame of inputted image is small.

The display frame period does not necessarily match the one frame period of input image and therefore the display frame period may be shortened or prolonged a little. In this case, the sum of N frames of display horizontal scanning periods allotted individually to the respective horizontal scanning periods should be equal to or less than the N frame periods of inputted image data. (N is a natural number equal to or more than 2.)

The display horizontal scanning periods allotted in this way are indicated by bold lines in the graph. If switching between scanning wirings coincides with driving a modulation wiring, the drive waveform in the display panel is disturbed and excessive voltage may be applied to the devices. Therefore it is desirable to set display horizontal scanning periods allowing a given amount of margin (a non-driving period of modulation wirings) to the maximum value of adjusted image data. It is also desirable to set the lower limit to display horizontal scanning periods as shown in FIG. 27 to secure the time for transferring adjusted image data to the modulation drive circuit (time for shifting data to the shift register 5) and the like.

If a display panel has 720×1280×3 (RGB) surface conduction electron-emitting devices, the device current is set to about 0.1 mA, and the scanning wiring resistance is set to about 5 Ω, the maximum value of adjusted image data obtained by correcting image data of 8-bit width (max: 255) is about 350. Accordingly, the bit width of a pulse width modulator is set to 9-bit.

(Detector of Line Maximum Value, Scanning Period Calculation Processing in Microcomputer)

Adjusted image data Dout outputted from the adder 12 is inputted to the detector 22 of line maximum value (FIG. 18). The detector 22 of line maximum value detects the maximum value out of one line of adjusted image data, and this detection processing handles data of pixels on one horizontal scanning wiring at a time.

Figure 28:
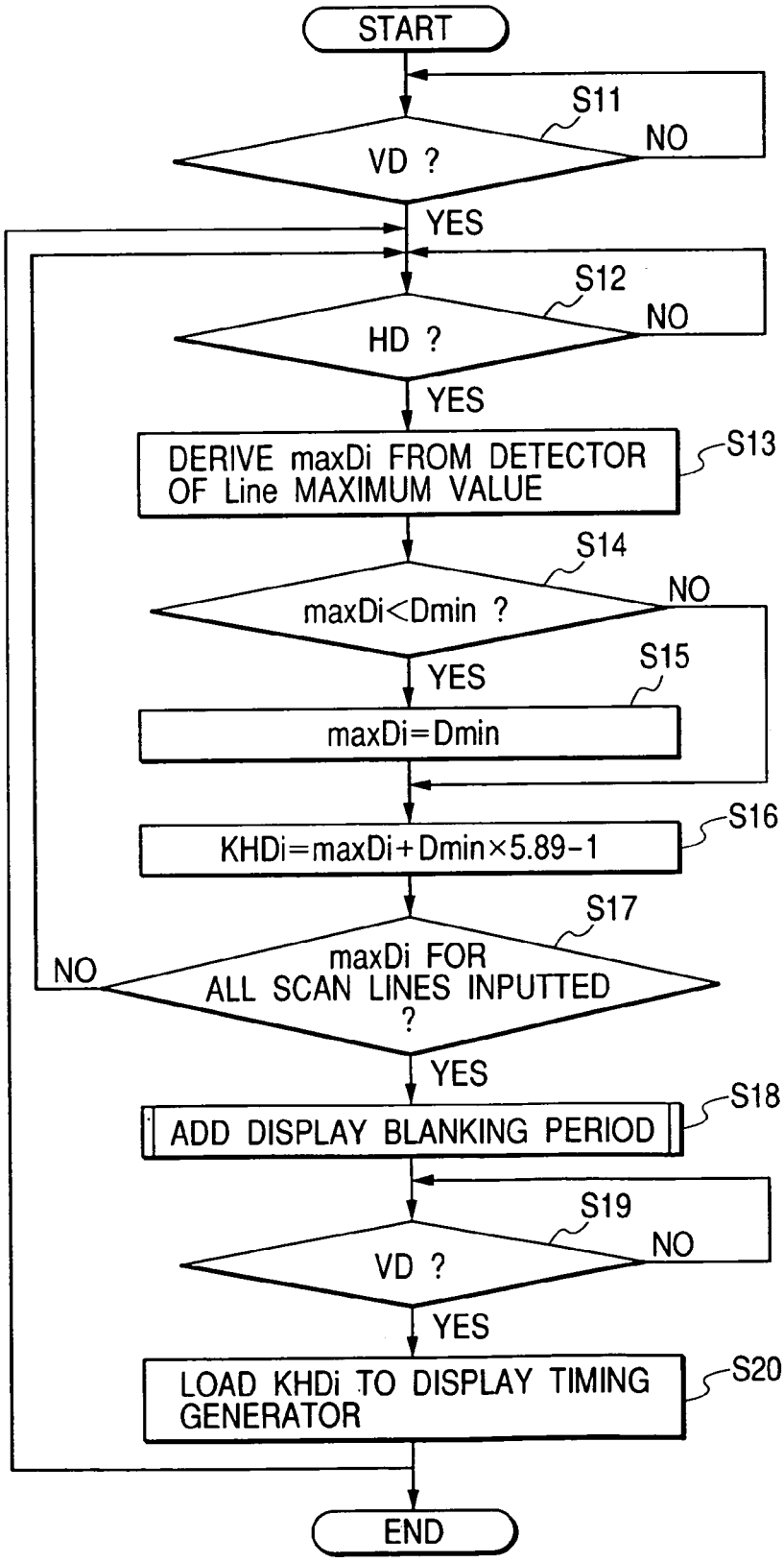
FIG. 28 is an arithmetic processing flow chart for calculating a horizontal scanning period in accordance with an embodiment of the present invention.

Following the flow chart of FIG. 28, the microcomputer 34 calculates the scanning period of each scanning wiring from the maximum value of adjusted image data which has been detected by the detector 22 of line maximum value.

The microcomputer 34 loops and is on standby until it receives a vertical synchronization signal VD (Step S11). After it receives the vertical synchronization signal VD, the microcomputer loops and is on standby until it receives a horizontal synchronization signal HD (Step S12). In response to the horizontal synchronization signal HD, the microcomputer starts one line of processing.

First, the microcomputer 34 receives the maximum value maxDi (i is the line number) of adjusted image data of the horizontal scanning wiring of interest from the detector 22 of line maximum value (Step S13). The value maxDi is obtained by converting the value of adjusted image data into clock number (Pwmclk number) for pulse width modulation.

The maximum value maxDi of adjusted image data of the horizontal scanning wiring of interest, which is obtained in Step S13, is compared with Dmin (Step S14). If maxDi is smaller than Dmin, maxDi is changed so as to reach Dmin (Step S15). If maxDi is equal to or larger than Dmin, maxDi is not changed.

Dmin is the value (Pwmclk) of image data that can be displayed in the minimum display scanning period (KHDmin) when taking into consideration the time required to transfer data to the modulation drive circuit and non-driving period which are described in the above.

In this embodiment, a shift clock SCLK of the shift register 5 is obtained by dividing MCLK in half (details will be described later), and outputs of the memory A 26 and memory B 27 are transferred to the shift register 5 in eight layers. Therefore, a shift time for transferring one line of data is 1280 pieces×3 (RGB)/8 layers=480 clocks (SCLK number). In addition to the shift time, 40 clocks will be needed for other processing. Accordingly, 520 clocks (SCLK number) are secured as the minimum display scanning period (KHDmin) (it may also be referred to as minimum display horizontal scanning period in the following description).

The 520 clock length is 0.63 times the horizontal scanning period of an input image ((520/1648)×1/2).

In this embodiment, the clock Pwmclk for pulse width modulation is obtained by phase lock of the horizontal synchronization signal of input image signal (720P) as follows.

The clock number of one horizontal scanning period (1H) of the clock Pwmclk for pulse width modulation is set to 280 in this embodiment. In a conventional driving method, the pulse width is modulated within a length of 256 clocks out of the 280 clocks and the remaining 24 clocks are allotted to a drive time in a scan circuit (non-driving period: 1.9 μsec.) and the like.

Therefore the frequency of Pwmclk is generated by the PLL circuit at a dividing ratio of 1:280 to a horizontal synchronization signal through phase lock to obtain a frequency of 12.6 MHz.

A non-drive time has to be included in the display horizontal scanning period. A desirable non-drive time of modulation wirings is about 2 μsec. Since the cycle of Pwmclk in this embodiment is about 79 n sec., 24 clocks (Pwmclk number) are secured as the non-drive time (the non-drive time is 1.9 μsec.). Accordingly, the value Dmin of image data that can be displayed within the minimum horizontal scanning period (KHDmin) is 280×0.63−24=153 clocks (Pwmclk number).

Then the length of 177 (=280×0.63) clocks (KHDmin) has to be allotted as the minimum display scanning period even when the maximum value maxDi of one line of adjusted image data is smaller than 153 (Dmin).

The steps S14 and S15 are to secure the minimum display horizontal scanning period (KHDmin). In Steps S14 and S15, the maximum value maxDi of adjusted image data of the horizontal scanning line of interest is compared to Dmin and, if maxDi is smaller than Dmin, maxDi is substituted with Dmin in order to secure the minimum display horizontal scanning period (KHDmin) that is the lower limit of display horizontal scanning period.

In Step S16, a display horizontal scanning period (KHDi) is calculated.

The display horizontal scanning period (KHDi) is calculated by MCLK unit from maxDi that is calculated by Pwmclk unit. Specifically, maxDi of Pwmclk unit is multiplied by 5.89 (=1648/280) since the ratio of clock number of horizontal scanning period that is determined by the frequency of a horizontal synchronization signal of an input image signal is Pwmclk:MCLK=280:1648.

For reference, the length of one horizontal scanning period according to the inputted image signal 720*p* is 1648/2=824 clocks (SCLK).

When the processing is thus finished up through Step S16 in accordance with the maximum value maxDi of adjusted image data of the i-th line, whether or not the i-th line is the final line of the image data, namely, whether inputting maxDi of all the scanning wirings to calculate upDi is finished or not is judged (Step S17). If it is judged that the final line has not been reached yet, the processing of Steps S12 to S16 are repeated to calculate the display horizontal scanning period (KHDi) for every scanning wiring while making sure that each display horizontal scanning period meets the minimum display horizontal scanning period (KHDmin).

In Step S18, adjustment is made on the horizontal scanning period of each scanning wiring so that the sum of horizontal scanning wirings of all the scanning wirings is contained within a given length of time. This given length of time corresponds to the frame frequency (60 Hz) of the input image signal 720*p*.

When the horizontal scanning period of each scanning wiring is simply allotted so as to include the maximum value maxDi of adjusted image data which is detected by the detector 22 of line maximum value, sometimes the sum of scanning periods falls short of one frame period of the input image signal.

The display horizontal scanning period (KHDi) thus calculated is added up in Step S18 to obtain the sum of display horizontal scanning periods, which is compared with the length of one frame of the input image signal. If the sum falls short of the length of one frame of the input image signal, the shortage is compensated by a display blanking period to match the display frame period with the frame period of the input image. Added as the display blanking period is, for example, the minimum display horizontal scanning period (KHDmin) (addition of KHD721, KHD722 . . . ).

After calculation of the display horizontal scanning period KHDi is finished for each scanning line, the microcomputer loops until it receives a vertical synchronization signal VD (Step S19).

After the microcomputer receives the vertical synchronization signal VD and confirms completion of one frame, and before the next frame is started, the display timing generator 33 is loaded with the display horizontal scanning period KHDi of each scanning line (Step S20).

Figure 30:
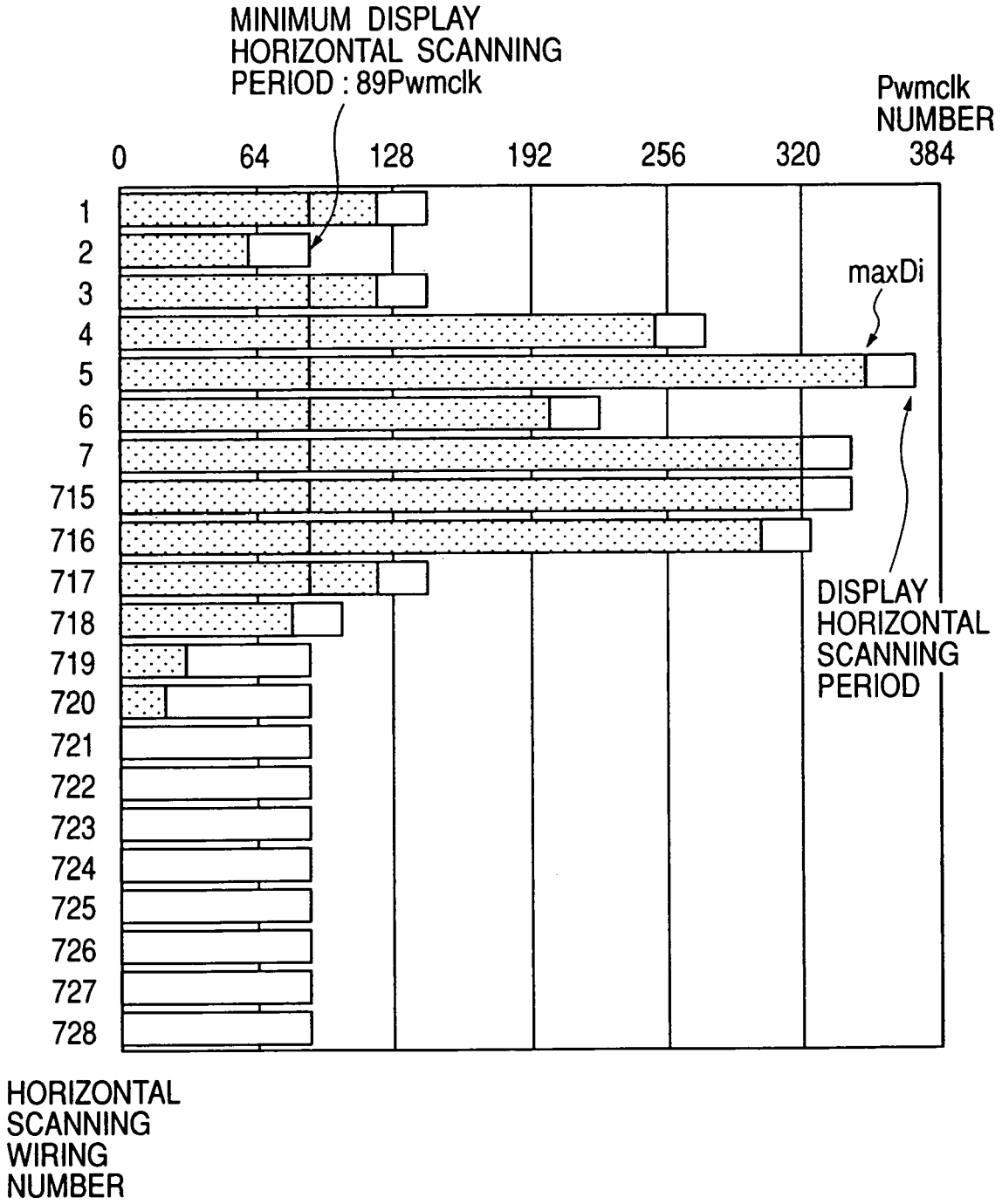
FIG. 30 is a graph showing an example of a scanning period for each scanning wiring which is obtained by the arithmetic processing of FIG. 28.

An example of the display scanning period KHDi calculated through the above processing for each horizontal scanning line is shown in a table of FIG. 29 and in a graph of FIG. 30.

In this embodiment, the microcomputer 34 may be omitted if the CPU 102 of the discrete adjusted data calculator carries out the processing of the microcomputer 34.

The sample clock number (MCLK number) of one horizontal scanning period is set to 1648 in this embodiment, and therefore the MCLK number of one frame is 750×1648=1236000 clocks. The Pwmclk number is (280/1648) times the MCLK number, namely, 210000 clocks.

As shown in the table of FIG. 29, the length of 1H (display horizontal scanning period) is longer one of two values: one is the value obtained by adding 24 clocks (Pwmclk) that is a non-drive time to the maximum value maxDi of one line of adjusted image data and the other value is the minimum display horizontal scanning period corresponding to the shift time plus a time required for other processing, namely 89 clocks (Pwmclk number).

For instance, the value obtained by adding non-drive time to maxDi, 120, is larger than the minimum display horizontal scanning period (KHDmin), 89, in the first line, and therefore the display horizontal scanning period is 144 clocks (Pwmclk number). In the second line, the value obtained by adding non-drive time to maxDi, 60, is smaller than the minimum display horizontal scanning period (KHDmin), 89, and therefore the display horizontal scanning period is 89 clocks (Pwmclk number).

The table of FIG. 29 is graphed in FIG. 30. The graph shows that a longer display horizontal scanning period is allotted to a line whose adjusted image data has a larger maximum value, and that the minimum display horizontal scanning period (KHDmin), 89 clocks, is secured even for the line whose adjusted image data has a smaller maximum value than any other lines.

In each of Lines 721 to 728, a display blanking period is added to reach the minimum display horizontal scanning period (KHDmin). It is also preferable if the display blanking period varies depending on the maximum value (maxDi) of adjusted image data of a horizontal scanning wiring.

As shown in FIG. 18, this embodiment has two frame memories (the memory A 26 and memory B 27) each of which can store one frame of adjusted image data so that one frame of adjusted image data are temporarily stored during the above calculation processing of horizontal scanning periods.

With the two frame periods, data can be read out of one frame memory (for example, the memory A 26) while data is written in the other frame memory (the memory B 27). Specifically, the contact points of the switch 23, 24, 25, and 29 are set to a, a, b, and b, respectively, in odd-numbered frames whereas they are set to b, b, a, and a in even-numbered frames.

Adjusted image data Dout outputted from the adder 12 is written in the memory A 26 when it is an odd-numbered frame and in the memory B 26 when it is an even-numbered frame as a writing address signal generated from the W address generator 21 indicates. The W address generator 21 determines a writing address signal from a horizontal synchronization signal HD and generates the writing address signal in sync with MCLK.

The adjusted image data written in the memory A 26 or memory B 27 is read out as a reading address signal generated by the R address generator 28 indicates. The R address generator 28 determines reading timing of line data of each horizontal scanning line in accordance with the scanning period KHDi (i is the horizontal line number, i=0, 1, 2 . . . ) calculated for individual scanning line as described above, not the horizontal synchronization signal HD included in the input image signal.

The data reading timing signal, namely, a display timing signal KHD is generated in the display timing generator 33 that is described next.

(Display Timing Generator)

Figure 31:
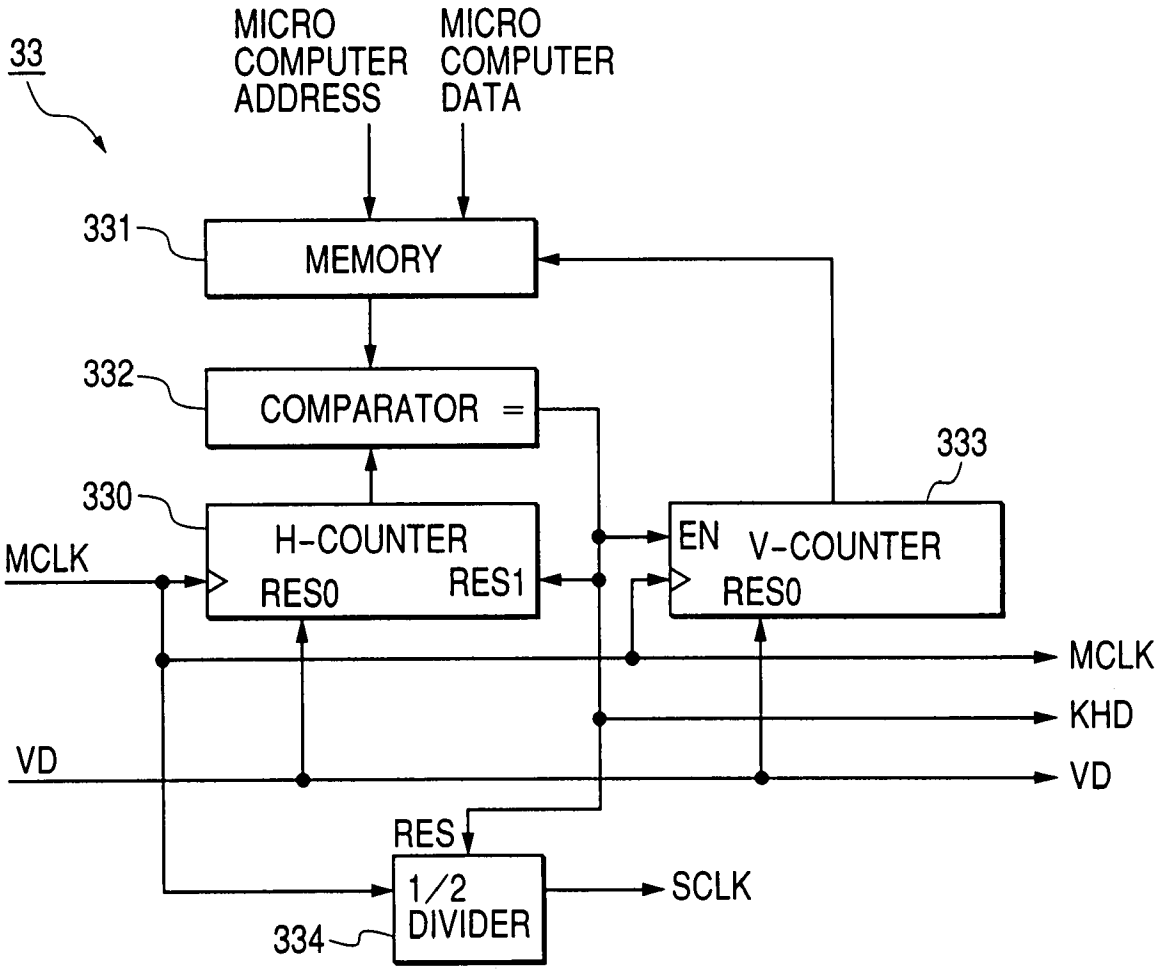
FIG. 31 is a block diagram showing the structure of a display timing generator.

FIG. 31 is a block diagram schematically showing the circuit structure of the display timing generator 33.

As shown in FIG. 31, the display timing generator 33 is composed of an H-counter 330, a memory 331, a comparator 332, a V-counter 333, and a ½ divider 334.

The H-counter 330 counts MCLK and outputs the obtained counter value to the comparator 332. The counter value of the H-counter 330 is reset in response to input of a vertical synchronization signal VD or an output of the comparator 332.

The memory 331 is a storing measure that is loaded with the horizontal scanning period KHDi of each horizontal scanning line by the microcomputer 34. The memory 331 stores the display horizontal scanning period KHD1 of the first horizontal scanning line at Address 0, and stores the display horizontal scanning period KHD2 of the second horizontal scanning line at Address 1. In this way, the display horizontal scanning period KHDi of the i-th horizontal scanning line is stored at Address (i−1) and the memory 331 stores all the display horizontal scanning periods in order. Upon receiving Address i from the V-counter 333, the memory 331 outputs the display horizontal scanning period KHDi to the comparator 332.

The comparator 332 compares the value inputted from the H-counter 330 (MCLK count) with the value inputted from the memory 331 (display horizontal scanning period KHDi), and outputs a signal only when the two values match. This output signal is inputted to the H-counter 330, the V-counter 333, and the ½ divider 334.

The V-counter 333 counts output signals of the comparator 332 and outputs the obtained counter value to the memory 331. The counter value of the V-counter 333 is reset in response to input of a vertical synchronization signal VD.

The ½ divider 334 divides MCLK in half and generates operation clock SCLK of the shift register 5. The ½ divider 334 is reset in response to an output signal of the comparator 332.

The thus structured display timing generator operates as follows.

First, the memory 331 is loaded with the display horizontal scanning period KHDi of each horizontal scanning line by the microcomputer 34 before the next frame is started (before a vertical synchronization signal VD is inputted). Upon receiving the vertical synchronization signal VD, counter values of the H-counter 330 and V-counter 333 are reset to start processing of one frame.

The V-counter 333 outputs a counter value 0 to the memory 331 in sync with MCLK. In response to the counter value, the memory 331 outputs the display horizontal scanning period KHD1 of the first line to the comparator 332. On the other hand, the H-counter 330 counts MCLK and outputs the obtained counter value N to the comparator 332.

The comparator 332 outputs a signal if the counter value N of the H-counter 330 matches the display horizontal scanning period KHD1. The display horizontal scanning period KHD1 is expressed in MCLK number and the comparison by the comparator 332 is made in sync with MCLK. Therefore the output signal of the comparator 332 serves as a display timing signal KHD that indicates the end of the first line (or the start of the second line).

As the display timing signal KHD is outputted, the counter value of the H-counter 330 is reset and the counter value of the V-counter 333 is incremented. Accordingly, after that, the V-counter 333 outputs a counter value 1 to the memory 331 and the memory 331 outputs the display horizontal scanning period KHD2 of the second line to the comparator 332. The H-counter 330 again starts counting MCLK from 0 and, when the counter value matches KHD2 as described above, the comparator 332 outputs a display timing signal KHD (a signal that indicates the end of second line or the start of the third line).

This processing is repeated for every line in one frame to generate a display timing signal KHD having an MCLK number according to a display horizontal scanning period KHDi for each line.

The display timing signal KHD thus generated is inputted to the R address generator 28. The R address generator 28 generates a reading address signal as the display timing signal KHD indicates and outputs the address signal through the switch 25 to the memory from which data is to be read.

The total number of lines when data is read from the memory A 26 or memory B 27 is desirably equal to or more than the number of effective scanning wirings, namely, 720 lines. More desirably, the total number is set to about 725 to 750 allowing a margin of timing design (needless to say, when the total number of lines when data is read is smaller, the display horizontal scanning period allotted to one line is prolonged and the luminance can be raised). In this embodiment, the reading line number in a frame is 728. The display timing signal KHD in this embodiment is generated such that the total Pwmclk number of one frame is constant (so that the total Pwmclk number does not vary among frames).

(Shift Register, Latch Circuit)

The memory A 26 and the memory B 27 output one line of adjusted image data in eight layers. The eight layers of adjusted image data SD1 to SD8 are outputted in parallel. The shift register 5 is composed of eight shift registers, each of which receives one of the eight layers of adjusted image data SD1 to SD8 (see FIGS. 18 and 19).

With this structure, the time required to transfer data from the memory A 26 and memory B 27 to the shift register 5 (shift time) can be shortened. The minimum display horizontal scanning period (KHDmin) in the above scanning period calculating processing is accordingly shortened to increase the degree of freedom in allotting display horizontal scanning periods to the scanning lines. The same effect can be obtained without dividing outputs of the memories into layers. In this case, the frame memories output one output and only one shift register is used to make the time required to read data of the frame memories shorter than the time required to write data in the frame memories.

In the shift register 5, adjusted image data SD1 to SD8 serially inputted receive serial/parallel conversion and converted into parallel image data ID1 to IDN each associated with one of modulation wirings. The parallel data are outputted to the latch circuit 6. The latch circuit 6 latches the data from the shift register 5 in response to a timing signal Dataload immediately before one horizontal scanning period is started. Outputs of the latch circuit 6 are supplied as parallel image data D1 to DN to the modulation circuit 8.

In this embodiment, the image data ID1 to IDN and D1 to DN are each 9-bit image data.

The operation timing of the shift register 5 is determined by the shift clock SCLK sent from the above display timing generator 33.

(Details of Modulation Circuit)

The parallel image data D1 to DN, which are outputs of the latch circuit 6, are supplied to the modulation circuit 8.

Figure 32:
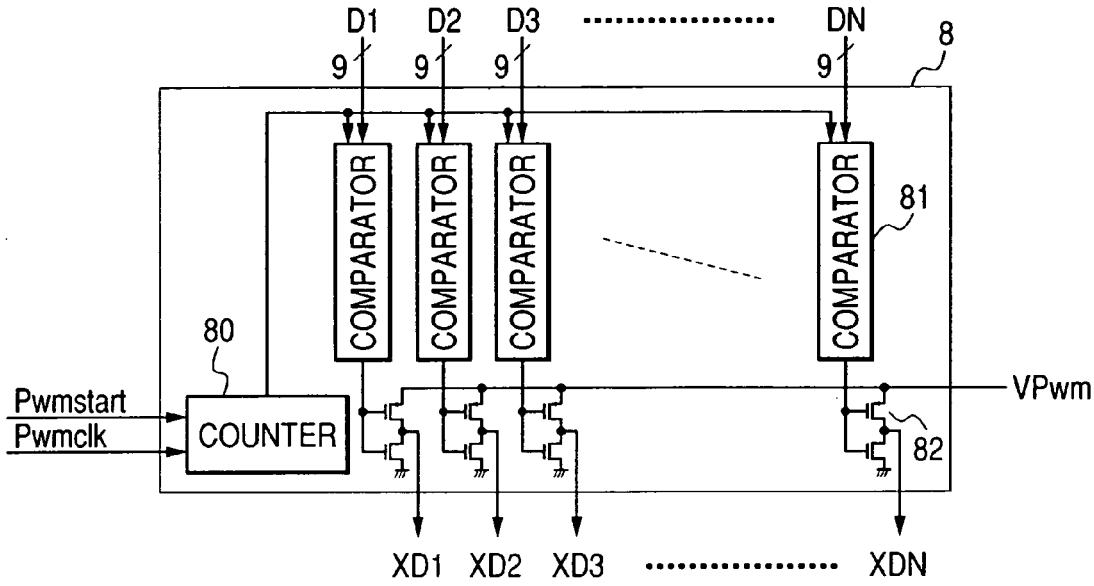
FIG. 32 is a block diagram showing the structure of a modulation circuit used in the present invention.

As shown in FIG. 32, the modulation circuit 8 is a pulse width modulation circuit (PWM circuit) having a PWM counter 80, a comparator 81, and a switch 82 such as an FET. The comparator 81 and the switch 82 are provided for each modulation wiring. The modulation circuit 8 applies, to the modulation wirings, modulation signals (voltage pulses) that are subjected to pulse width modulation in accordance with the adjusted image data D1 to DN supplied from the latch circuit 6.

Figure 33:
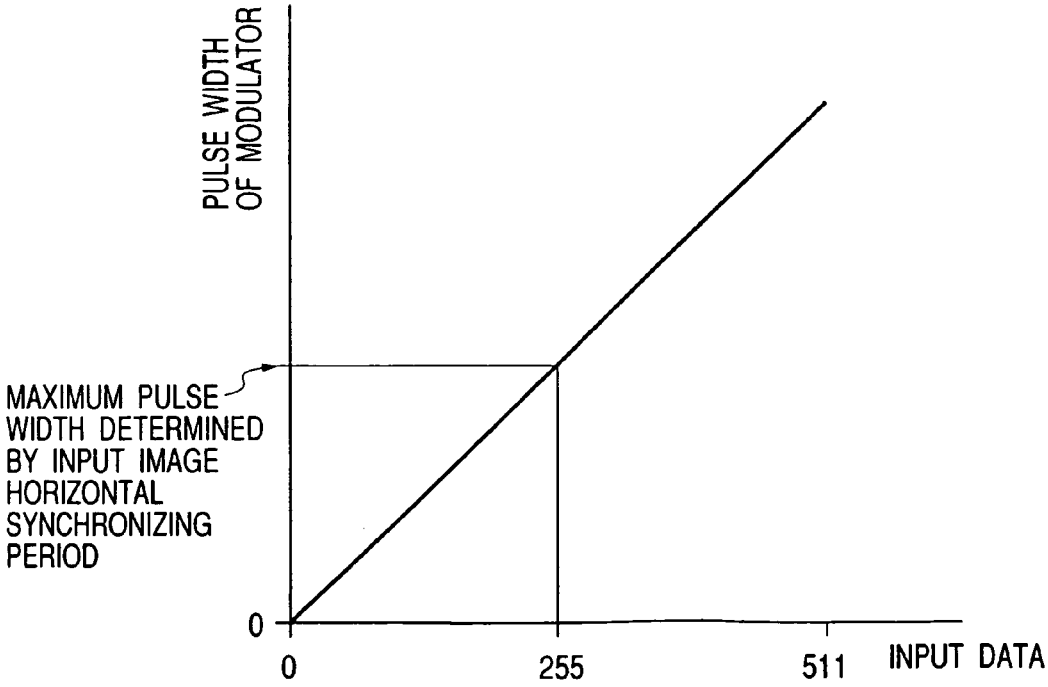
FIG. 33 is a diagram showing a relation between image data and the output pulse width of the modulator.

The relation between the image data D1 to DN and the output pulse width of the modulation circuit 8 is a linear relation as shown in FIG. 33.

Figure 34:
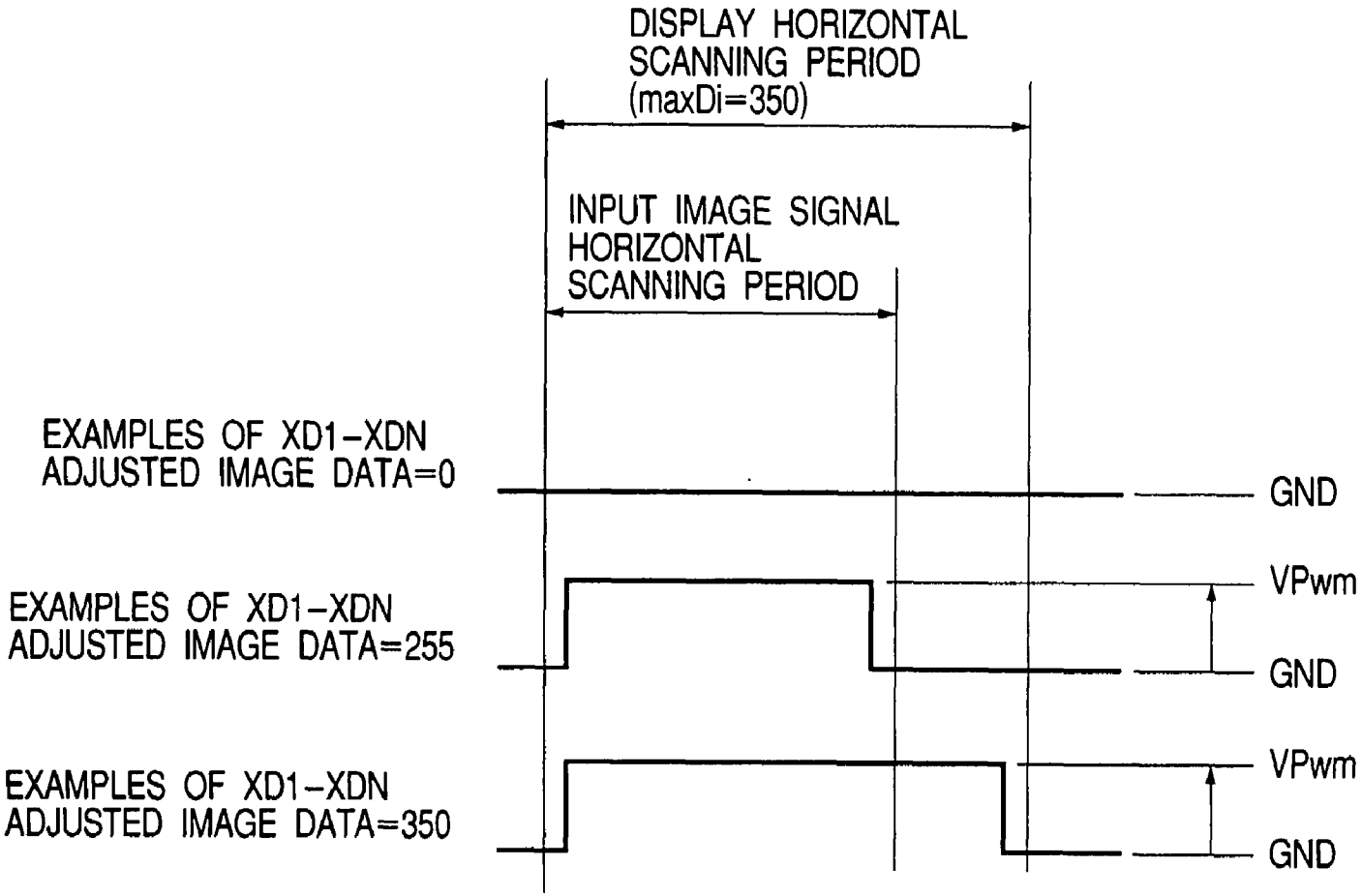
FIG. 34 is a schematic diagram showing an example of output waveform of a modulation signal used in the present invention.

FIG. 34 shows three examples of output waveform of a modulation signal that is outputted from the modulation circuit 8.

In FIG. 34, the waveform in the upper example is of when input data to the modulation circuit 8 is 0, the waveform in the middle example is of when input data to the modulation circuit 8 is 255 (this is a value obtained by subtracting a non-drive time from a horizontal scanning period of an input image signal, and is the maximum value as a horizontal scanning period in a conventional driving method), and the waveform in the lower example is of when input data to the modulation circuit 8 is 350.

It is clear in FIG. 34 that the output signal is longer than the horizontal scanning period of the input image signal when input data to the modulation circuit 8 is 350.

In FIG. 32, D1 to DN are adjusted image data which are supplied from the latch circuit 6 and which are associated with the first to N-th modulation wirings. Pwmstart is a synchronization clear signal of the PWM counter, and Pwmclk is a clock of the PWM counter. XD1 to XDN represent outputs of the first to N-th columns (N=1280×3) of the modulation circuit 8.

As one horizontal scanning period is started, the latch circuit 6 latches image data and transfers the data to the modulation circuit 8 at the same time.

The PWM counter 80 starts counting in response to Pwmstart and Pwmclk.

The comparator 81 provided for each column compares the count of the PWM counter with image data of each column. When the count of the PWM counter is larger than the image data, the comparator 81 outputs High and, in other periods, outputs Low.

The output of the comparator 81 is connected to a gate of a switch which is provided for each column and which is composed of a CMOS inverter. During the period in which the output of the comparator is Low, a pMOS transistor on the upper side of FIG. 32 (the VPWM side) is turned ON whereas an nMOS transistor on the lower side (the GND side) is turned OFF to connect the modulation wiring to a reference voltage source that gives a voltage VPWM.

On the other hand, during the period in which the output of the comparator is High, the pMOS transistor on the upper side of FIG. 32 is turned OFF whereas the nMOS transistor on the lower side is turned ON to connect the modulation wiring to a reference voltage source that gives a GND electric potential. The components of the modulation circuit 8 operate as described above, thereby giving pulse width modulation signals outputted from the modulation circuit 8 a waveform that makes rising of pulses synchronized as shown in FIG. 34.

Though not particularly shown in the drawing, Dataload and Pwmstart described above are synchronized with the display timing signal KHD.

(Scan Drive Circuit)

Figure 35:
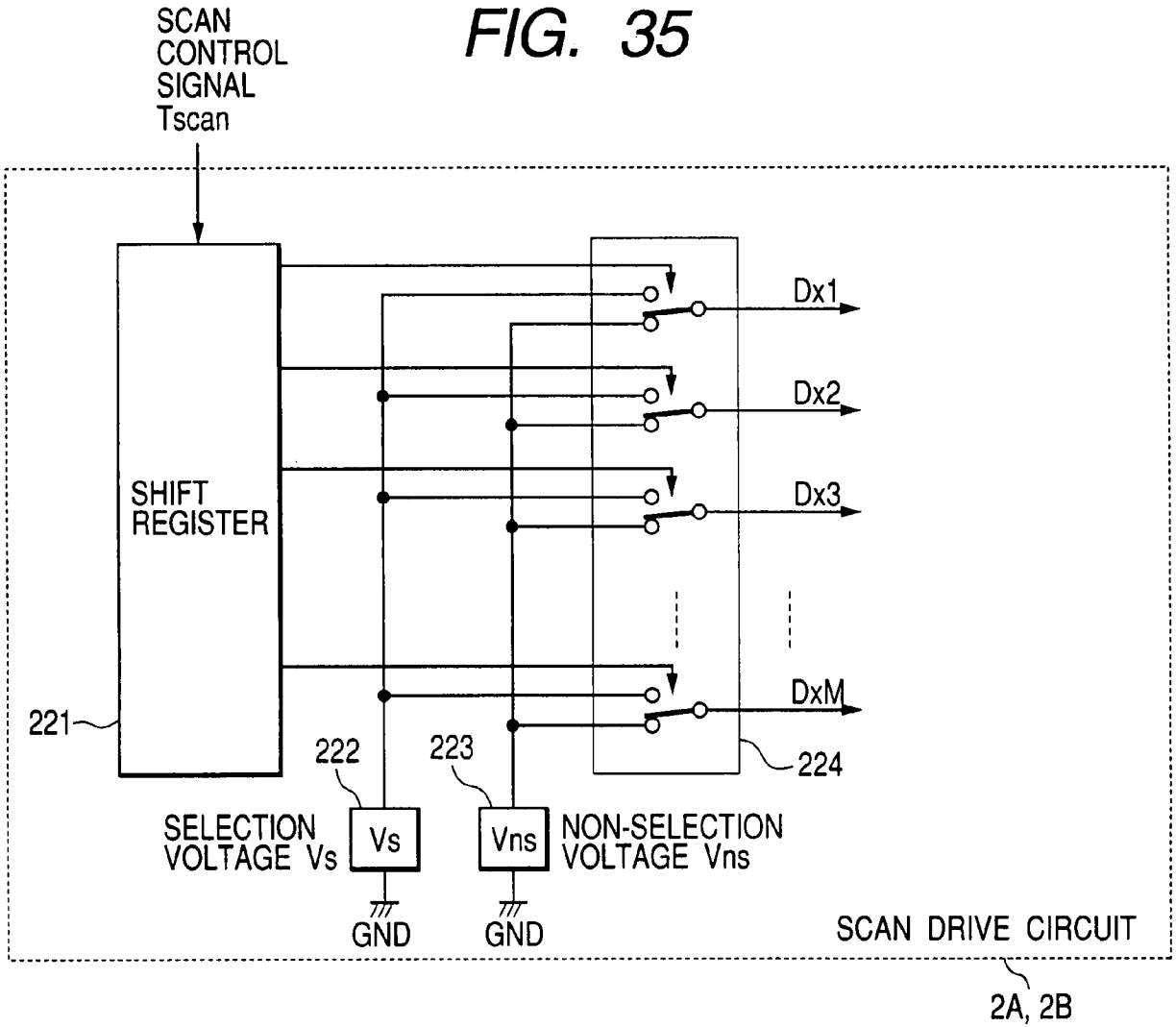
FIG. 35 is a block diagram showing the structure of a scan drive circuit of the display apparatus used in the present invention.

Scan drive circuits 2A and 2B are circuits that selectively output a selection voltage Vs or non-selection voltage Vns supplied from a reference voltage source 222 or 223 to connection terminals Dx1 to D×M in order to scan and select the wirings of the display panel one row at a time in one horizontal scanning period (see FIG. 35).

The scan drive circuits 2A and 2B select one scanning wiring in one horizontal scanning period and then stops selecting the scanning wiring to select another scanning wiring in the next horizontal scanning period. The switching between scanning wirings is made in sync with a scan control signal Tscan. In this way the scan drive circuits 2A and 2B finish scan selection driving of all the scanning wirings within one frame period, here, within one vertical scanning period.

The scan control signal Tscan is a signal synchronized with the display timing signal KHD generated by the display timing generator 33 for each scanning wiring. The display timing signal KHD may serve as the scan control signal Tscan.

As shown in FIG. 35, the scan drive circuits 2A and 2B are each composed of M switch arrays 224, a shift register 221, and others. The switches are preferably composed of bipolar transistors or FETs.

In order to reduce voltage drop in a scanning wiring, the scan drive circuits are preferably connected to both ends of the scanning wirings of the display panel 1 as shown in FIG. 19 so that the scanning wirings are driven from both ends. In this case, it is preferable to employ a circuit structure that allows the output terminals to output scan signals in reverse order so that one chip integrated circuit is easily mounted to each end. This circuit structure can readily be designed by using a bi-directional shift register.

When the thus structured display apparatus displays an image, voltage drop in a scanning wiring, which has been a problem in prior art, can be corrected and degradation of display image caused by voltage drop can be avoided.

The apparatus obtains correction data through discrete computation and data between two points for which discrete calculation has been made is obtained by interpolation. Therefore correction data is calculated easily by a very simple hardware, which constitutes a superior effect of the apparatus.

Furthermore, the apparatus is capable of both correcting voltage drop in a scanning wiring and displaying an image at a luminance of when the resistance of the scanning wiring is 0 Ω (displaying at a luminance higher than the luminance of when voltage drop is caused by the scanning wiring resistance).

Embodiment 2

In Embodiment 1, display horizontal scanning periods are allotted by display scanning period calculation processing to the respective lines such that each display horizontal scanning period contains the maximum value maxDi of adjusted image data detected by the detector 22 of line maximum value as described above. This makes it possible to correct voltage drop of a scanning wiring and at the same time display an image without lowering the luminance. However, depending on the image to be displayed, the total length of the horizontal scanning periods which is the sum of one frame of allotted display horizontal scanning periods exceeds one frame period of input image. This embodiment deals with this problem and improves Embodiment 1.

The difference between Embodiment 1 and this embodiment is that, when a display horizontal scanning period is simply allotted to a scanning line so as to contain the maximum value maxDi of adjusted image data for the scanning line, and the total length of similarly allotted horizontal scanning periods is expected to exceed one frame period of input image, each display horizontal scanning period and adjusted image data are adjusted to contain the total length within one frame period.

The overview of a display panel of image display apparatus according to this embodiment is the same as the overview of the display panel of Embodiment 1. Electric connections of the display panel, characteristics of surface conduction electron-emitting device, a method of driving the display panel, and other points of this embodiment that are common to Embodiment 1 are identical with Embodiment 1.

Figure 36:
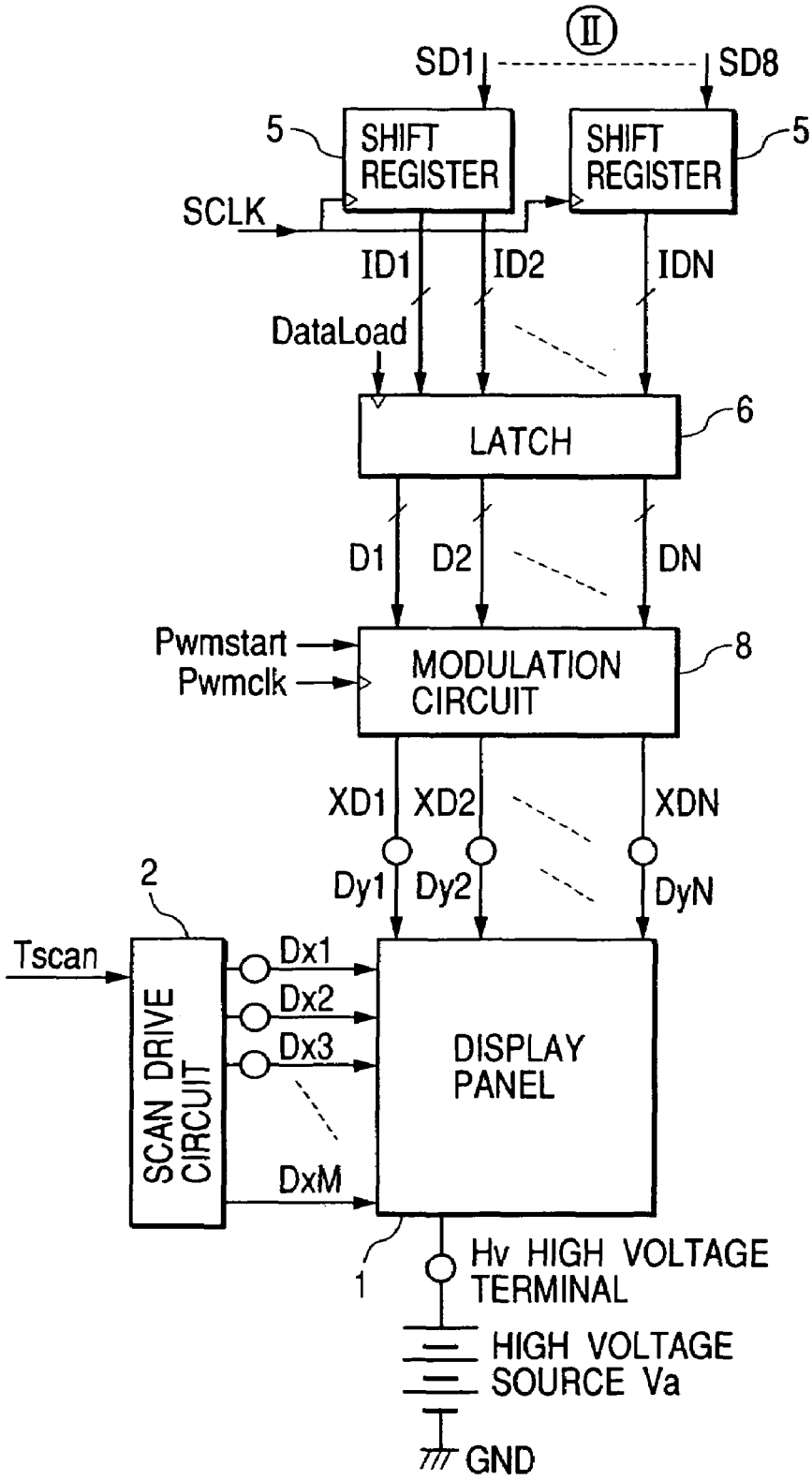
FIG. 36 is a block diagram showing an outline of a display apparatus according to Embodiment 2 of the present invention.

The explanation here takes as an example a one-side scanning structure shown in FIG. 36, which is employed to lower the price of display apparatus.

A digital circuit is limited in data width (bit number) that the circuit can handle. Generally, the data width is determined taking into consideration cost of hardware and the like. Particularly, with a structure in which the pulse width is modulated in accordance with adjusted image data as in this embodiment, the pulse width has to be modulated such that it is contained in one horizontal scanning period and therefore an increase in data width by correction, namely, an increase in number of gradation may demand faster operation clock of the modulation circuit. This may increase unnecessary radiation and power consumption, but the operation clock can be slowed by reducing the data width inputted to the pulse width modulator using the dither method as the need arises.

On the other hand, an increase in size of adjusted image data can cause a problem called overflow. The overflow is a problem in which bit turn back takes place and a display image is inverted or disturbed in other ways when correction data is simply added to image data and the resultant adjusted image data exceeds the data width a pulse width modulator can handle.

Accordingly, in this embodiment, the maximum value of adjusted image data is calculated in advance and a pulse width modulator having a bit width accommodated to the maximum value is employed.

Then each display horizontal scanning period and adjusted image data are adjusted such that the total length of display horizontal scanning periods does not exceed one frame period of input image signal.

(Explanations of Overall System and Functions of Components)

A description is given on a signal processing circuit hardware of the image display apparatus of this embodiment which has an adjusted data calculator built in.

Figure 37:
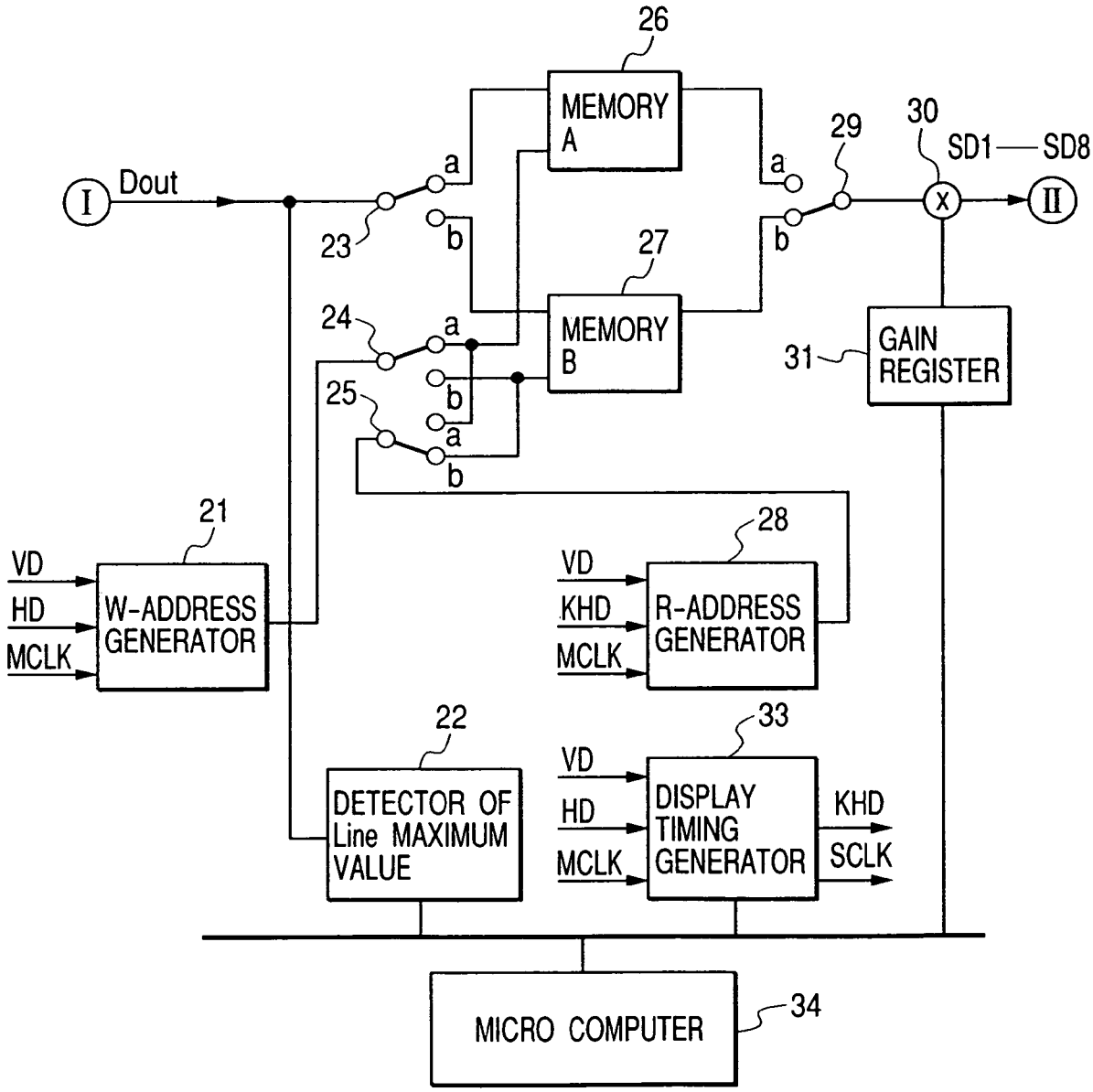
FIG. 37 is a block diagram showing an outline of a drive control circuit of the display apparatus according to Embodiment 2 of the present invention.

FIG. 37 is a block diagram showing an outline of the circuit structure. Shown in FIG. 37 is a circuit for determining the scanning period of a scanning wiring. An input (I) of the circuit shown in FIG. 37 corresponds to the output of the circuit shown in FIG. 17. An output (II) of the circuit shown in FIG. 37 is inputted as an input (II) to the circuit shown in FIG. 36. The basic structure of this circuit is identical with the one in FIG. 18.

Denoted by 31 is a gain register that is an image data adjusting measure for making adjustment on adjusted image data upon receiving calculation results of the microcomputer 34.

The structure of the display apparatus of this embodiment will be described in detail below with reference to FIGS. 17, 37, and 36.

(Sync. Signal Separation Circuit, Timing Generator Circuit and Inverse γ Processor)

The description of the sync. signal separation circuit, timing generator circuit and inverse γ processor of Embodiment 1 applies to those of this embodiment.

(Data Array Converter)

The description of the data array converter of Embodiment 1 applies to that of this embodiment.

(Adjusted Data Calculator)

The description of the adjusted data calculator of Embodiment 1 applies to that of this embodiment.

(Discrete Adjusted Data Calculator)

The description of the discrete adjusted data calculator of Embodiment 1 applies to that of this embodiment.

(Adjusted Data Interpolation Unit)

The description of the adjusted data interpolation unit of Embodiment 1 applies to that of this embodiment.

(Delay Circuit)

The description of the delay circuit of Embodiment 1 applies to that of this embodiment.

(Adder 12)

The description of adder 12 of Embodiment 1 applies to the adder 12 of this embodiment.

(About Control of Horizontal Scanning Period)

In the structure which is shown in FIG. 36 and which has actually been examined, the number of surface conduction electron-emitting devices is set to 720×1280×3 (RGB), the device current is set to about 0.5 mA, and the scanning wiring resistance is set to about 5 Ω. Then the maximum value of adjusted image data obtained by correcting image data of 8-bit width (max: 255) is about 1000. Accordingly, the bit width of a pulse width modulator is set to 10 bit. Alternatively, the bit width of the pulse width modulator is set to conventional 8-bit and less significant 2 bits are expressed in gradation using the dither method or the like.

(Detector of Line Maximum Value, Horizontal Scanning Period Calculation Processing in Microcomputer)

Adjusted image data Dout outputted from the adder 12 is inputted to the detector 22 of line maximum value (see FIG. 37). The detector 22 of line maximum value detects the maximum value out of one line of adjusted image data, and this detection processing handles data of one line at a time.

Figure 38:
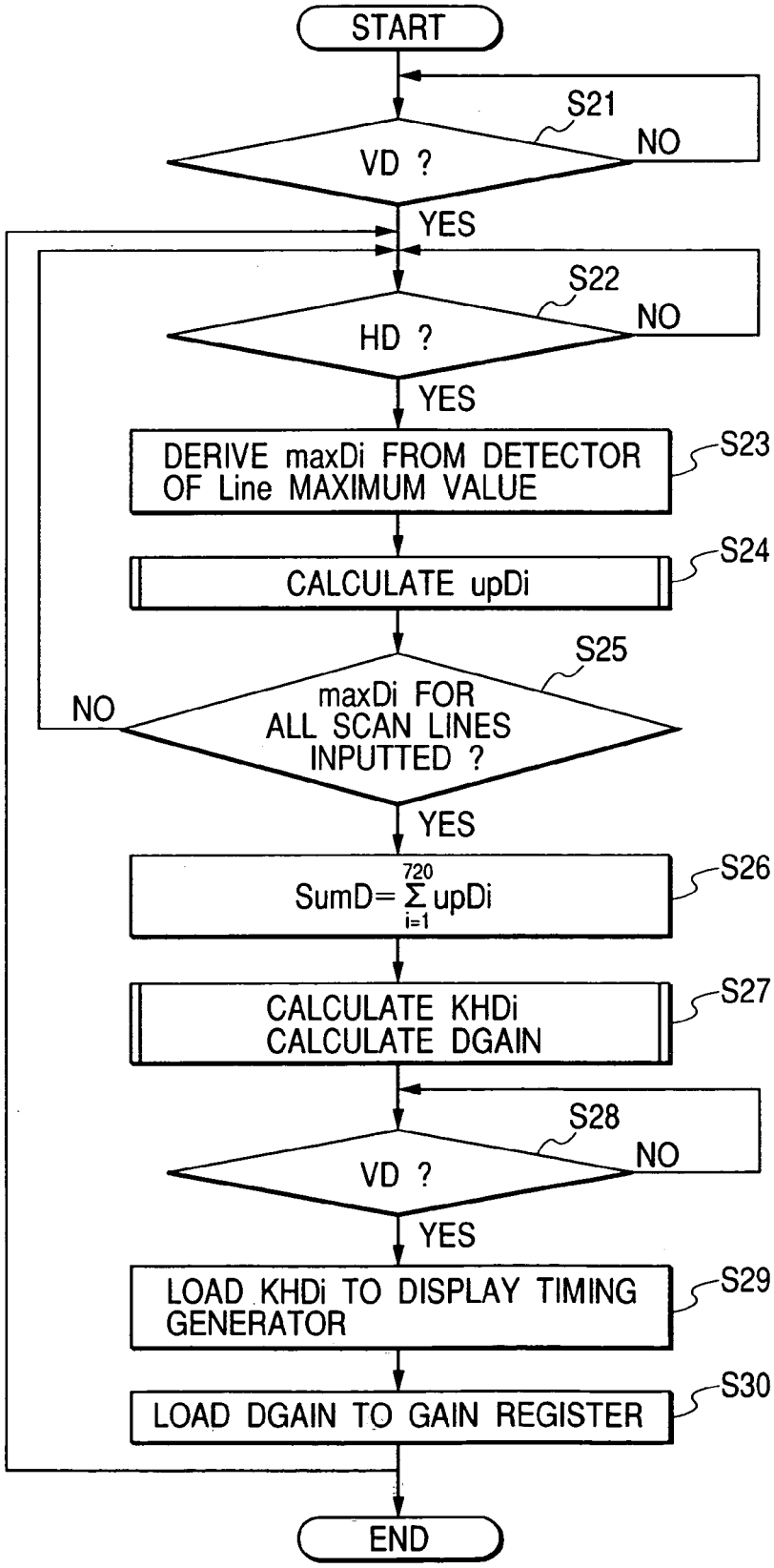
FIG. 38 is an arithmetic processing flow chart for calculating a horizontal scanning period in accordance with Embodiment 2 of the present invention.

Following a flow chart of FIG. 38, the microcomputer 34 calculates the scanning period of each scanning wiring from the maximum value of adjusted image data which has been detected by the detector 22 of line maximum value.

The microcomputer 34 loops and is on standby until it receives a vertical synchronization signal VD (Step S21). After receiving the vertical synchronization signal VD, the microcomputer loops and is on standby until it receives a horizontal synchronization signal HD (Step S22). In response to the horizontal synchronization signal HD, the microcomputer starts one line of processing.

First, the microcomputer 34 receives the maximum value maxDi (i is the line number) of adjusted image data of the horizontal scanning wiring of interest from the detector 22 of line maximum value (Step S23) to calculate upDi (Step S24). The value maxDi is obtained by converting the value of adjusted image data into clock number (Pwmclk number) for pulse width modulation.

Figure 39:
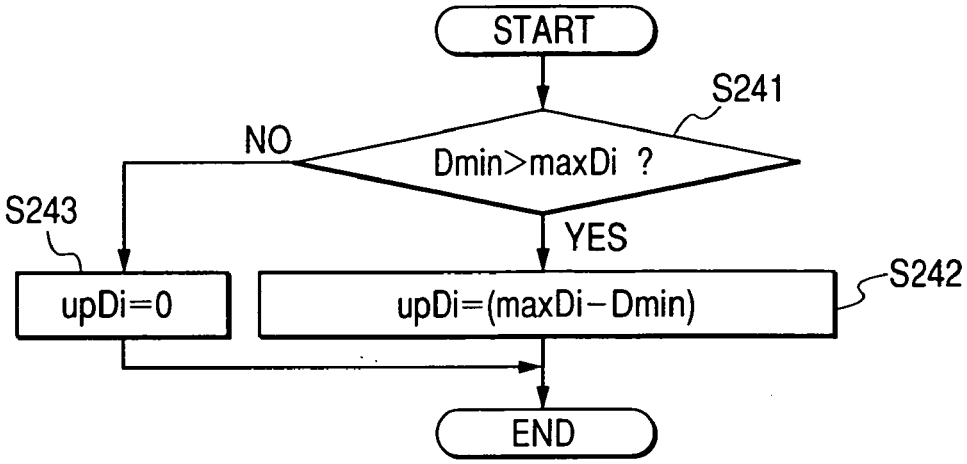
FIG. 39 is a partial flow chart of arithmetic processing according to Embodiment 2 of the present invention.

The calculation of upDi follows a flow chart of FIG. 39. The maximum value maxDi of adjusted image data of the horizontal scanning wiring of interest, which is obtained in Step S23, is compared with Dmin (Step S241). If maxDi is larger than Dmin, the difference (maxDi−Dmin) is set as upDi (Step S242). If maxDi is equal to or smaller than Dmin, 0 is set as upDi (Step S243).

Dmin is the value (Pwmclk number) of image data that can be displayed in the minimum display horizontal scanning period (KHDmin) when taking into consideration the time required to transfer data to the modulation drive circuit and non-drive time which are described in the above.

In this embodiment, a shift clock SCLK of the shift register 5 is obtained by dividing MCLK in half (details will be described later), and outputs of the memory A 26 and memory B 27 are transferred to the shift register 5 in eight layers. Therefore, a shift time for transferring one line of data is 1280 pieces×3 (RGB)/8 layers=480 clocks (SCLK number). In addition to the shift time, 40 clocks will be needed for other processing. Accordingly, 520 clocks (SCLK number) are secured as the minimum display horizontal scanning period (KHDmin) (it may also be referred to as minimum display horizontal scanning period in the following description). The clock Pwmclk for pulse width modulation and the shift clock SCLK have the same frequency in this embodiment.

A non-drive time has to be included in the display horizontal scanning period. A desirable non-drive time of modulation wirings is about 2 μsec. Since the cycle of Pwmclk in this embodiment is about 27 n sec., 74 clocks (Pwmclk number) are secured as the non-drive time. Accordingly, the value Dmin of image data that can be displayed within the minimum horizontal scanning period (KHDmin) is 520−74=446 clocks (Pwmclk number). Then the length of 520 clocks (Pwmclk number) (KHDmin) has to be allotted as the minimum display scanning period even when the maximum value maxDi of one line of adjusted image data is smaller than 446 (Dmin).

The calculations in the flow chart of FIG. 39 are to secure the minimum display horizontal scanning period (KHDmin). The value upDi calculated here shows how much larger the maximum value maxDi of adjusted image data of the horizontal scanning line of interest is than Dmin (when maxDi is smaller than Dmin, upDi is set to 0).

For reference, the length of one horizontal scanning period according to the inputted image signal 720*p* is 1648/2=824 clocks (Pwmclk number).

When calculating upDi from the maximum value maxDi of adjusted image data of the i-th line is finished, whether or not the i-th line is the final line of the image data, namely, whether inputting maxDi of all the scanning wirings to calculate upDi is finished or not is judged (Step S25). If it is judged that the final line has not been reached yet, the processing of Steps S22 to S25 are repeated until upDi is calculated for every scanning line. Then the processing is advanced to the next step.

In Steps S26 and S27, adjustment is made on the horizontal scanning period of each scanning wiring so that the sum of horizontal scanning wirings of all the scanning wirings is contained within a given amount of time. The given amount of time here refers to one frame period of an input image signal and, specifically, corresponds to the frame frequency (60 Hz) of the input image signal 720*p*.

When the horizontal scanning period of each scanning wiring is simply allotted so as to include the maximum value maxDi of adjusted image data which is detected by the detector 22 of line maximum value, sometimes the sum of horizontal scanning periods exceeds one frame period of the input image signal. In that case, gain adjustment is made on the horizontal scanning period of each scanning line so that the horizontal scanning periods in total are contained within one vertical scanning period (within one frame period). Note that the gain adjustment is made on upDi since the minimum display horizontal scanning period (KHDmin) has to be secured for each scanning line as described above.

First, the sum SumD of upDi for all of the scanning lines (720 lines) is calculated in step S26. Then using SumD, the gain calculation and calculation of the scanning period for each scanning line are carried out (Step S27).

Figure 40:
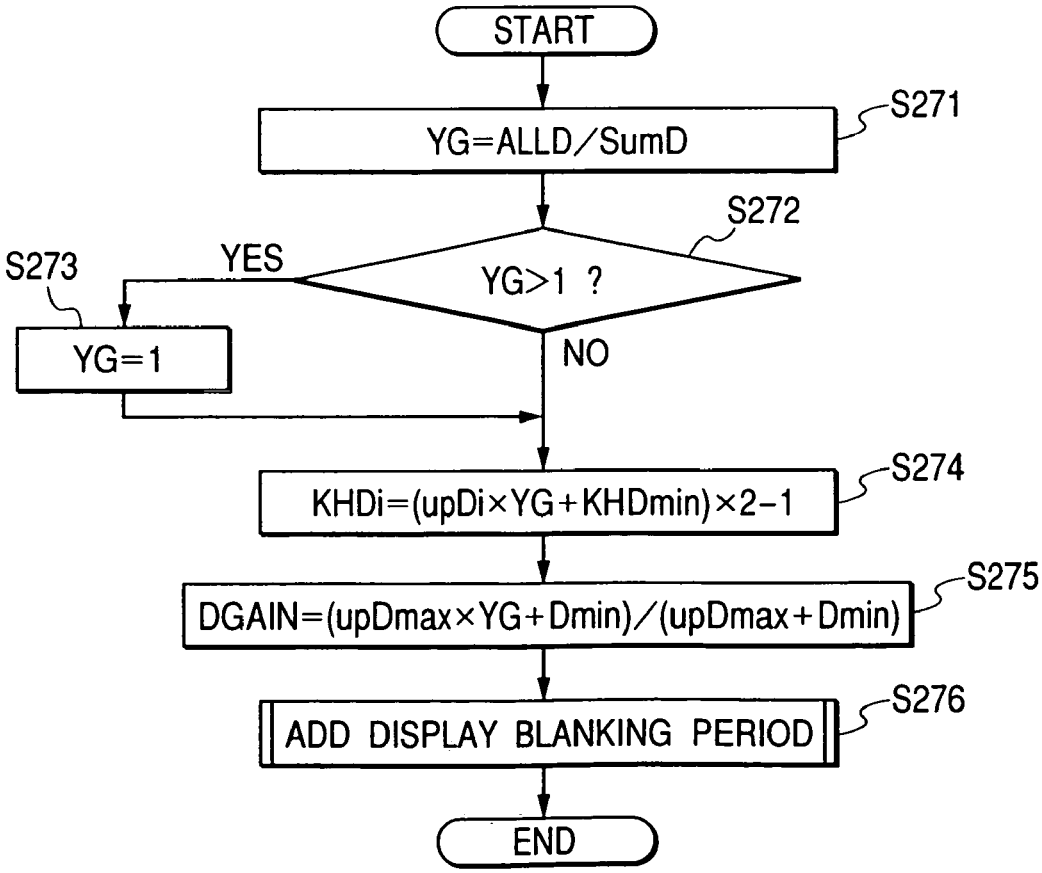
FIG. 40 is a partial flow chart of arithmetic processing according to Embodiment 2 of the present invention.

The gain calculation and calculation of the scanning period for each scanning line follow a flow chart of FIG. 40.

In the flow chart, Steps S271 to S276 are for processing to determine a gain YG from upDi of each scanning line. The gain YG is a multiplier factor for uniform multiplication of adjusted image data in the frame.

In Step S271, ALLD is divided by SumD to obtain YG. ALLD is a value obtained by subtracting the minimal display periods (KHDmin) of all the scanning wirings from the Pwmclk number corresponding to the maximum length of modulation signal driving time that can be allotted when one frame period is distributed among all scanning wirings so that driving every scanning wiring is completed within one frame period. Since the number of effective scanning lines of the input image signal 720*p* is 720 whereas the total number of scanning lines is 750, ALLD=750×((1648/2)−KHDmin)=228000 clocks (Psmclk number).

When the thus calculated YG is larger than 1 (Step S272), YG is reset to 1 (Step S273). A SumD smaller than ALLD means that the total length of horizontal scanning periods does not exceed one frame period of input image when display horizontal scanning periods are simply allotted to the scanning lines so as to contain the maximum value maxDi of adjusted image data which has been detected by the detector 22 of line maximum value. Accordingly, gain adjustment is not necessary.

If the gain YG is smaller than 1, the obtained gain YG is used to adjust the display scanning period KHDi (i is the horizontal line number, i=0, 1, 2 . . . ) (Step S274), and a multiplier factor (DGAIN) for the adjusted image data is obtained so that the image data falls within the adjusted display scanning period KHDi (Step S275). Specifically, the display scanning period (KHDi) is calculated by a formula KHDi=(upDi×YG+KHDmin)×2−1.

The gain DGAIN for the adjusted image data is calculated as follows:

$$DGAIN=(upDmax\times YG+Dmin)/(upDmax+Dmin)$$

wherein upDmax represents the maximum upDi value in the frame. The horizontal scanning period KHDi is measured by MCLK number and therefore is doubled. Here, upDi is measured by Pwmclk number.

The thus calculated display horizontal scanning period (KHDi) is added to similarly calculated display horizontal scanning periods of the rest of the scanning lines to obtain the sum and to compare the sum with one frame period of an input image signal in Step S276. If the sum falls short of the length of one frame of the input image signal, the shortage is compensated by a display blanking period to match the display frame period with the frame period of the input image. Added as the display blanking period is, for example, the minimum display horizontal scanning period (KHDmin) (addition of KHD721, KHD722 . . . ).

After calculation of the gain DGAIN and display scanning period KHDi for each scanning line are finished, (the processing returns to the flow chart of FIG. 38 and) the microcomputer loops until it receives a vertical synchronization signal VD (Step S28).

After the microcomputer receives the vertical synchronization signal VD and confirms completion of one frame, and before the next frame is started, the display timing generator 33 is loaded with the display horizontal scanning period KHDi of each scanning line (Step S29) and a gain register 31 is loaded with the gain DGAIN (Step S30).

Figure 42:
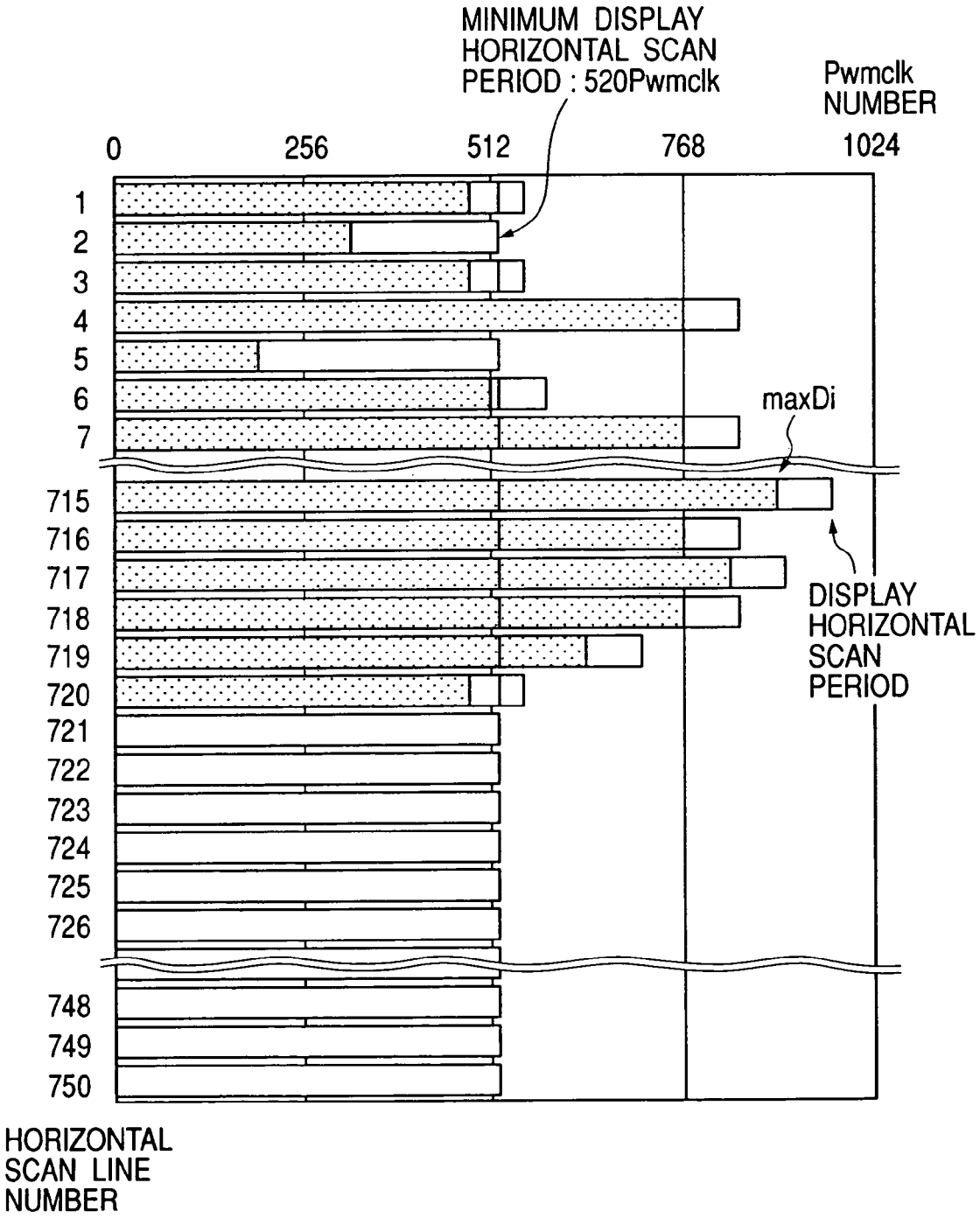
FIG. 42 is a graph showing an example of a scanning period for each scanning wiring which is obtained by the scanning period arithmetic processing according to Embodiment 2 of the present invention.

An example of the display horizontal scanning period KHDi calculated through the above processing for each horizontal scanning line is shown in FIGS. 41 and 42.

In this embodiment, the microcomputer 34 may be omitted if the CPU 102 of the discrete adjusted data calculator carries out the processing of the microcomputer 34.

The sample clock number (MCLK number) of one horizontal scanning period is set to 1648 in this embodiment, and therefore the MCLK number of one frame is 750×1648=1236000 clocks (the Pwmclk number is half the MCLK number, namely, 618000 clocks.

As shown in a table of FIG. 41, the length of one horizontal scanning period is a longer one of two values: one is the value obtained by adding 74 clocks (Pwmclk number) that is a non-drive time to the maximum value maxDi of one line of adjusted image data and the other value is the minimum display horizontal scanning period corresponding to the image data transfer time (shift time) plus a time required for other processing, namely, 520 clocks (Pwmclk number).

For instance, the value obtained by adding non-drive time to maxDi, 554, is larger than the minimum display horizontal scanning period (KHDmin), 520, in the first line, and therefore the display horizontal scanning period is 554 clocks (Pwmclk number). In the second line, the value obtained by adding non-drive time to maxDi, 394, is smaller than the minimum display horizontal scanning period (KHDmin), 520, and therefore the display horizontal scanning period is 520 clocks (Pwmclk number).

The table of FIG. 41 is graphed in FIG. 42. The graph shows that a longer display horizontal scanning period is allotted to a line whose adjusted image data has a larger maximum value, and that the minimum display horizontal scanning period (KHDmin), 520 clocks, is secured even for the line whose adjusted image data has a smaller maximum value than any other lines.

In each of Lines 721 to 750, a display blanking period is added to reach the minimum display horizontal scanning period (KHDmin). The display blanking period varies depending on the maximum value (maxDi) of adjusted image data for a horizontal scanning wiring.

The two frame memories (the memory A 26 and memory B 27) are controlled in the same way as the frame memories of Embodiment 1 are controlled. When YG is smaller than 1, values of KHDi and DGAIN are obtained following the flow described above. The length of display horizontal scanning period is thus determined.

(Display Timing Generator)

The display timing generator 33 of this embodiment is identical with the display timing generator 33 (FIG. 31) of Embodiment 1.

A display timing signal KHD having an MCLK number according to the display scanning period KHDi is generated for every line included in one frame in the manner similar to Embodiment 1.

The display timing signal KHD thus generated is inputted to the R address generator 28. The R address generator 28 generates a reading address signal as the display timing signal KHD indicates and outputs the address signal through the switch 25 to the memory from which data is to be read.

The total number of lines when data is read from the memory A 26 or memory B 27 is desirably equal to or more than the number of effective scanning lines, namely, 720 lines. More desirably, the total number is set to about 730 to 750 allowing a margin of timing design. Needless to say, when the total number of lines when data is read is smaller, the display scanning period allotted to one line is prolonged and the luminance can be raised. In this embodiment, the reading line number in one frame is set to 730. The display timing signal KHD in this embodiment is generated such that the total Pwmclk number of one frame is constant and does not vary from one frame to another frame. In this case, ALLD=730(1648/2−KHDmin)+20(1648/2).

(Gain Register)

As shown in FIG. 37, adjusted image data Dout temporarily stored in the memory A 26 or memory B 27 is outputted to the shift register 5 as a reading address signal of the R address generator 28 indicates.

At this point, the gain register 31 multiplies the adjusted image data Dout by the gain DGAIN supplied from the microcomputer 34 frame by frame.

As described above, the adjusted image data is multiplied by the gain DGAIN to adjust the image data. In this way the pulse width is prevented from exceeding a given display horizontal scanning period when the pulse width is modulated in the modulation circuit 8.

(Shift Register, Latch Circuit)

The structures and operations of the shift register and latch circuit are basically the same as those described in Embodiment 1.

However, image data ID1 to IDN and D1 to DN here are 10-bit image data instead of 9-bit data.

(Details of Modulation Circuit)

Figure 43:
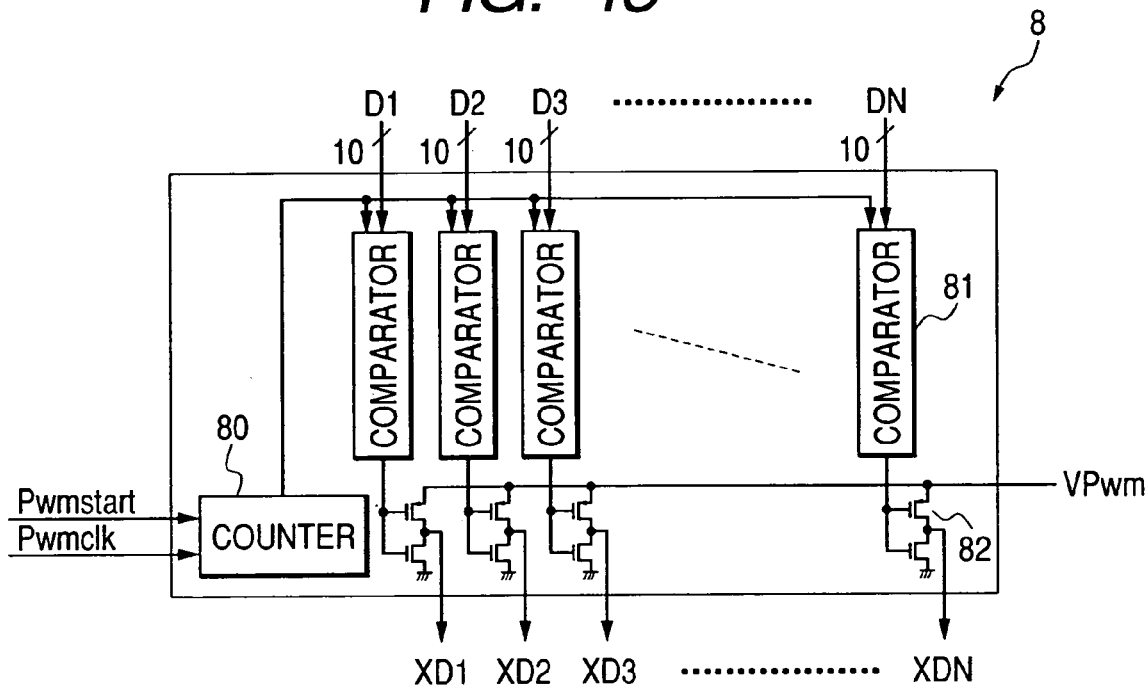
FIG. 43 is a block diagram showing the structure of a modulation circuit used in the present invention.

The parallel image data D1 to DN, which are outputs of the latch circuit 6, are supplied to the modulation circuit 8 shown in FIG. 43. The modulation circuit 8 has the same basic structure as the modulation circuit of Embodiment 1.

Figure 44:
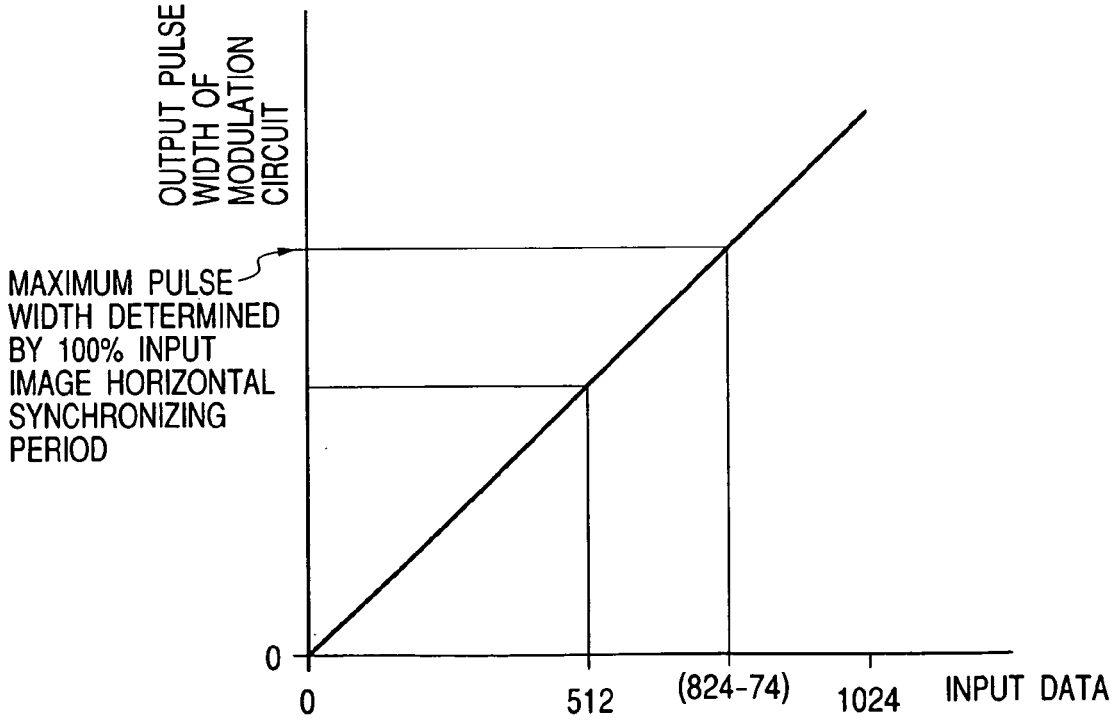
FIG. 44 is an explanatory diagram showing a relation between image data and the output pulse width of the modulator.

The relation between D1 to DN that are 10-bit image data and the output pulse width of the modulation circuit 8 is a linear relation as shown in FIG. 44.

Figure 45:
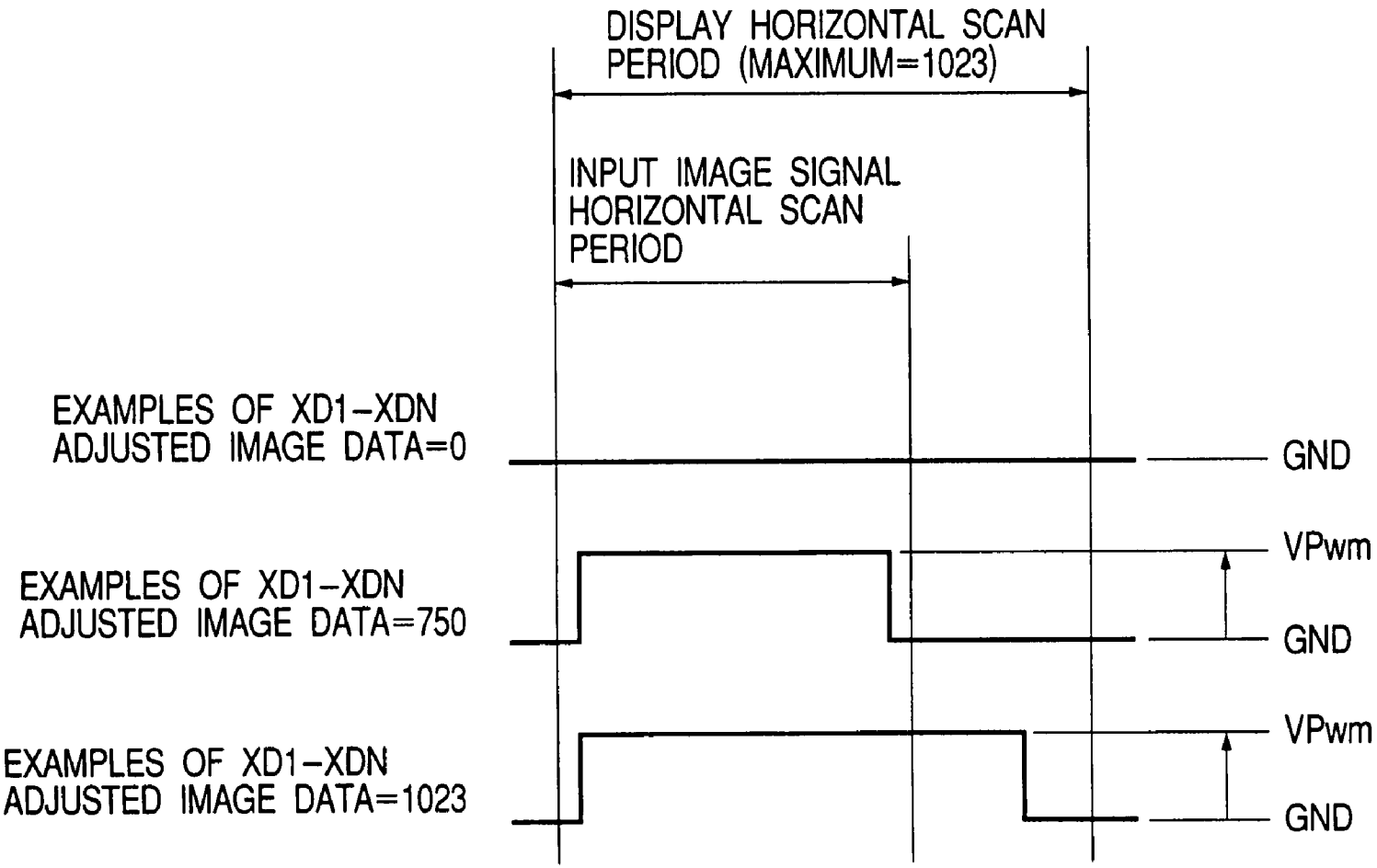
FIG. 45 is a schematic diagram showing an example of output waveform of a modulation signal used in the present invention.

FIG. 45 shows three examples of output waveform of the modulator. In FIG. 45, the waveform in the upper example is of when input data to the modulation circuit 8 is 0, the waveform in the middle example is of when input data to the modulation circuit is 750 (this is a value obtained by subtracting a non-drive time from a horizontal scanning period of an input image signal, and is the maximum value as a horizontal scanning period in prior art), and the waveform in the lower example is of when input data to the modulation circuit 8 is 1023. When input data to the modulation circuit 8 is 1023, the period in which a modulation signal is outputted (pulse duration) is longer than the horizontal scanning period of the input image signal.

(Scan Drive Circuit)

The structure and operation of the scan drive circuit 2 of this embodiment are identical with those in Embodiment 1.

In order to reduce voltage drop in a scanning wiring lengthened as a display is increased in size, the scanning wiring is preferably driven from both ends as shown in Embodiment 1. To drive a scanning wiring from both ends, two sets of scan drive circuits are connected to both ends of the scanning wirings of the display panel 1.

According to this embodiment, voltage drop in a scanning wiring can be corrected and degradation of display image caused by voltage drop can be avoided. In addition, correction data is obtained through discrete computation and data between two points for which discrete calculation has been made is obtained by interpolation. Therefore correction data is calculated very easily, and with a very simple hardware.

Similar to Embodiment 1, this embodiment is capable of both correcting voltage drop in a scanning wiring and displaying an image at an enhanced luminance by suitably allotting a display horizontal scanning period to each scanning wiring in accordance with the maximum value of adjusted image data.

Moreover, image data are multiplied by the gain YG while securing the minimum display horizontal scanning period KHDmin to adjust horizontal scanning periods, and the adjusted image data are multiplied by the gain DGAIN to adjust the adjusted image data. Therefore this embodiment makes it possible to display an image without lowering image quality even when the sum of display horizontal scanning periods of one frame of adjusted image data exceeds a given amount of time.

Embodiment 3

Described next is Embodiment 3 of the present invention.

The difference between this embodiment and Embodiment 2 is that the two take different approaches to a situation in which a display horizontal scanning period is simply allotted to a scanning line so as to contain the maximum value maxDi of adjusted image data of pixels on each scanning line, and the total length of similarly allotted horizontal scanning periods exceeds one frame period of an input image signal. The rest of Embodiment 3 is identical with Embodiment 2.

In Embodiment 2, the display horizontal scanning period KHDi is adjusted by the gain YG and the adjusted image data is multiplied by the gain DGAIN so that the maximum pulse width of a modulation signal associated with the display horizontal scanning period KHDi is contained within the adjusted display horizontal scanning period KHDi. Then the pulse width is modulated to generate a modulation signal.

In this embodiment, the pulse width is modulated after the adjusted image data is limited by a limiter so that a modulation signal associated with the display horizontal scanning period KHDi is contained within the display horizontal scanning period KHDI adjusted by the gain YG.

(Explanations of Overall System and Functions of Components)

A description is given on hardware of the display apparatus of this embodiment which has an adjusted data calculator built in.

Figure 46:
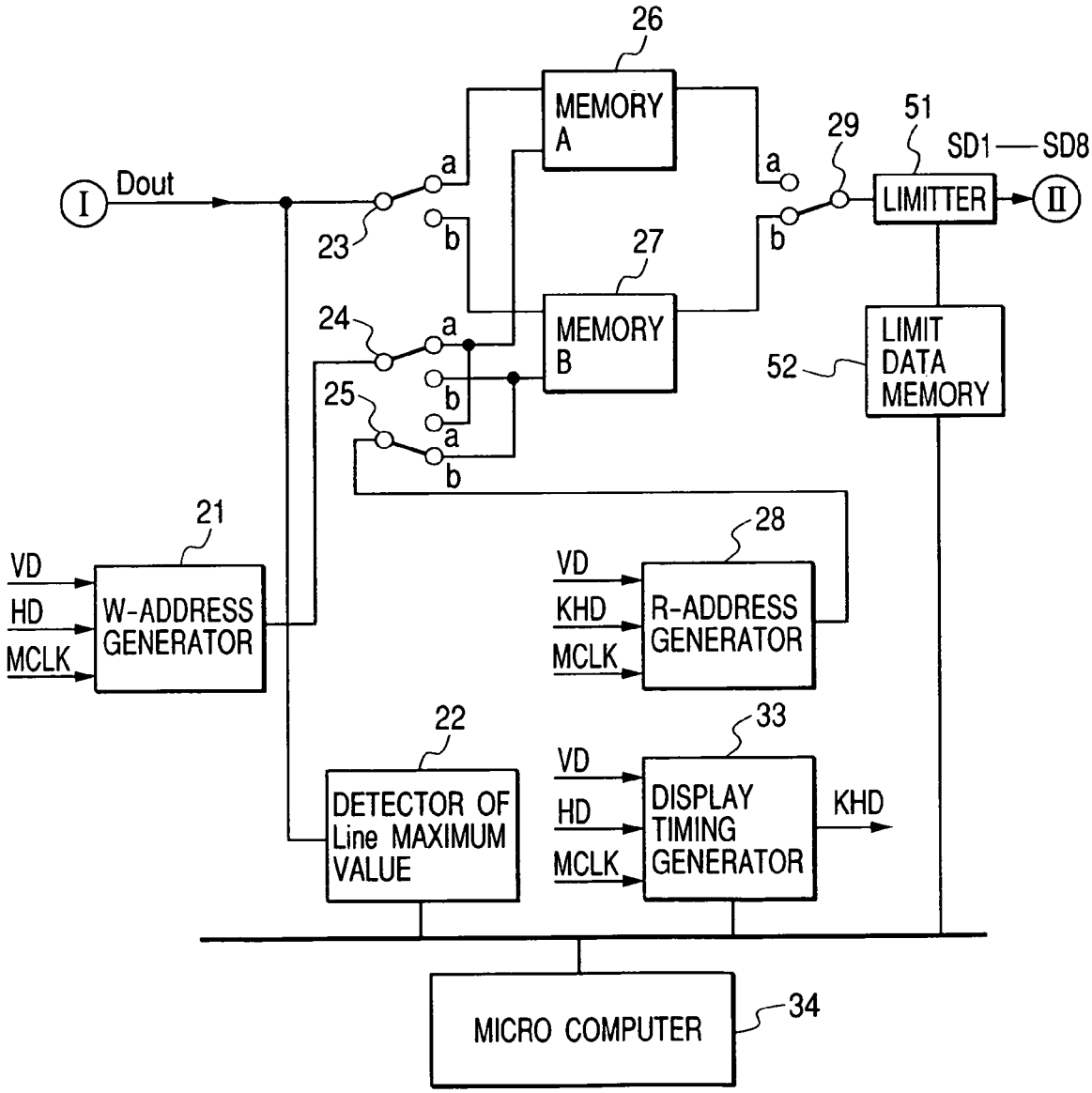
FIG. 46 is a block diagram showing an outline of a drive control circuit of a display apparatus according to Embodiment 3 of the present invention.

FIG. 46 is a block diagram showing an outline of the circuit structure according to this embodiment. Circuits for inputting image signals and for correcting image data are identical with those of Embodiments 1 and 2 shown in FIG. 17. A display panel, scan drive circuit, and modulation drive circuit of this embodiment are similar to the ones in Embodiment 2.

(Operation of Limiter)

The main difference between Embodiment 3 and Embodiment 2 is that Embodiment 3 has a limiter 51 and limit data memory 52 shown in FIG. 46.

The limit data memory 52 stores a limit data value (LimDi) for the i-th scanning wiring described later. The limit data memory outputs a limit data value (LimDi) stored for a selected scanning wiring to the limiter 51. The limiter 51 outputs the limit data value (LimDi) outputted from the limit data memory 52 instead of adjusted image data if the adjusted image data is equal to or larger than the limit data value (LimDi).

In the second embodiment, the adjusted image data is contained within the display scanning period KHDi by multiplying the adjusted image data by the gain DGAIN. In this embodiment, the same effect is obtained by outputting from the limiter 51 a limit data value (LimDi) instead of adjusted image data when the adjusted image data is equal to or larger than the limit data value (LimDi).

(About Control of Scanning Period)

Similar to Embodiment 2, this embodiment suitably allots scanning periods to the respective scanning wiring in accordance with the maximum value of adjusted image data.

(Detector of Line Maximum Value, Horizontal Scanning Period Calculation Processing in Microcomputer)

Adjusted image data Dout outputted from the adder 12 of FIG. 17 is inputted to the detector 22 of line maximum value (see FIG. 46). As in Embodiment 2, the detector 22 detects the maximum value out of one line of adjusted image data, and this detection processing handles data of one line at a time.

Figure 47:
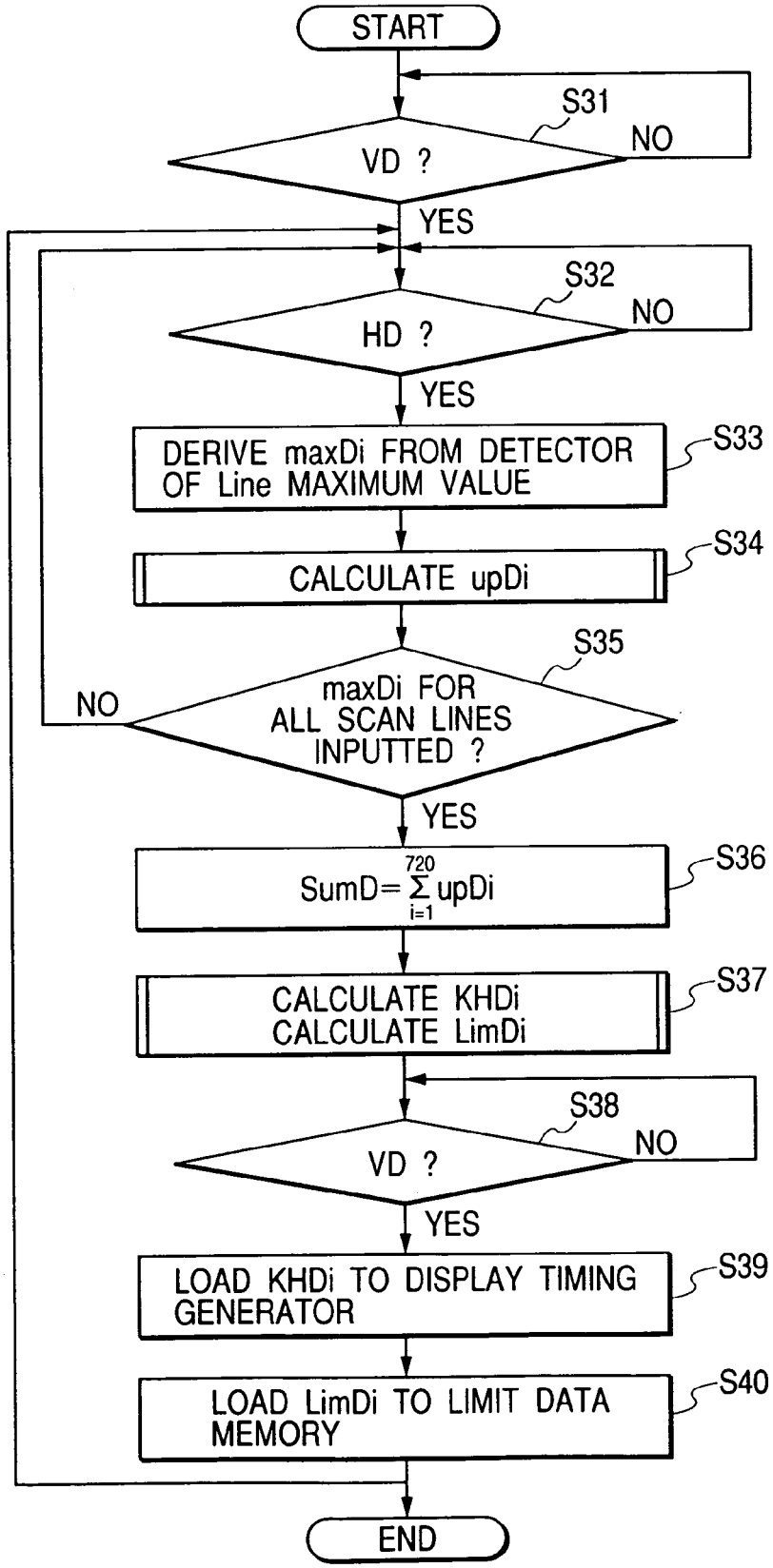
FIG. 47 is an arithmetic processing flow chart for calculating a scanning period in accordance with Embodiment 3 of the present invention.

Following a flow chart of FIG. 47, the microcomputer 34 calculates the scanning period of each scanning wiring from the maximum value of adjusted image data which has been detected by the detector 22 of line maximum value.

In FIG. 47, Steps S31 to S36 are for the same operations as the operations of Steps S21 to S26 in the flow chart (FIG. 38) of Embodiment 2. Also, the processing shown in the flow chart of FIG. 39 is conducted in Step S34.

Figure 48:
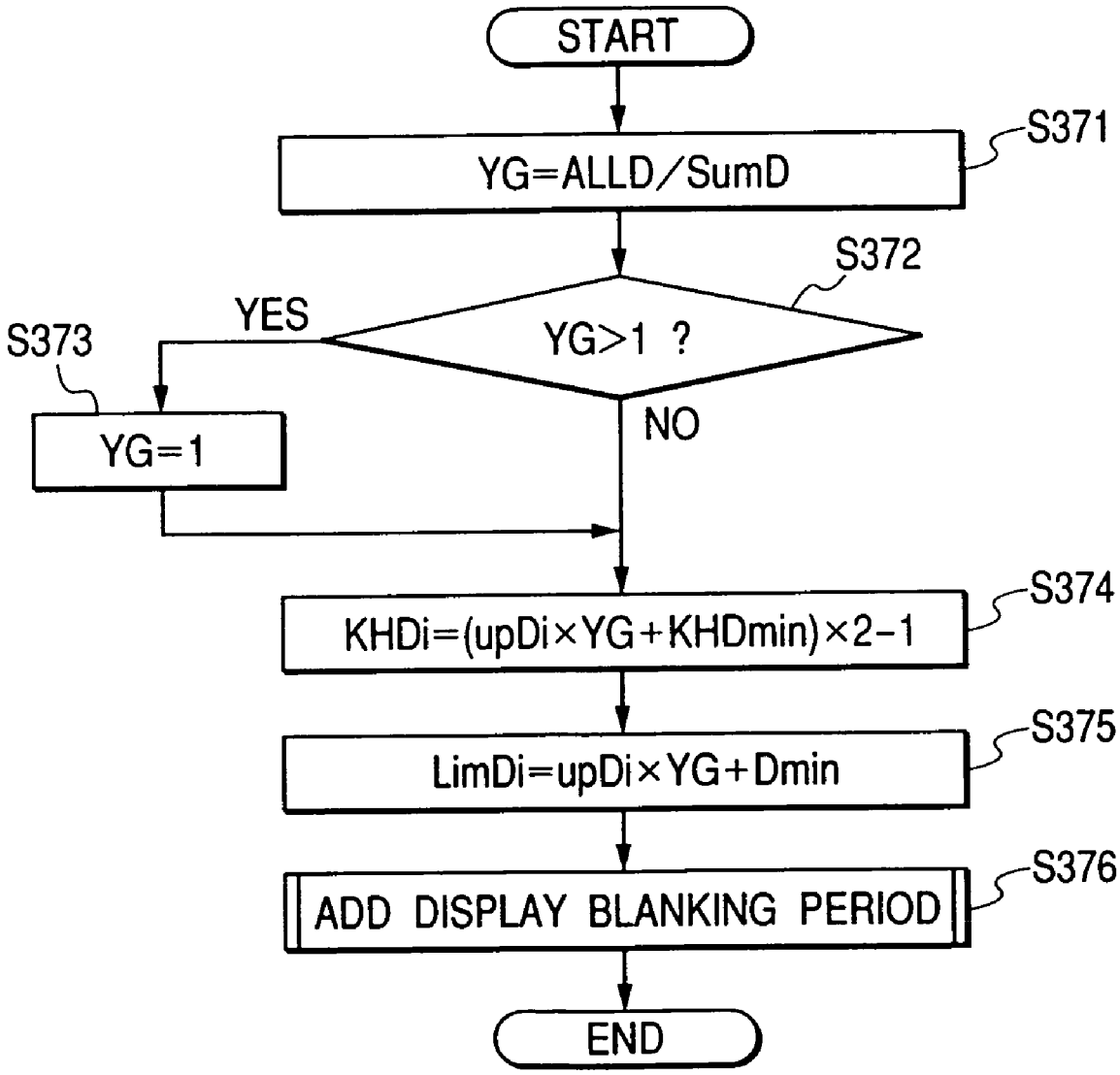
FIG. 48 is a partial flow chart of arithmetic processing according to Embodiment 3 of the present invention.

From values of upDi and the sum of upDi, namely, SumD that have been obtained in the process up through Step S36, the display horizontal scanning period (KHDi) is calculated for each scanning wiring as well as the limit data value (LimDi) for determining the maximum adjusted image data value for each scanning wiring (Step S37). The calculations follow a flow chart of FIG. 48.

In the flow chart, the gain YG that is a multiplier factor for uniform multiplication of upDi of all the scanning lines in the frame is determined in Steps S371 to S373.

First, ALLD is divided by SumD to obtain YG similar to Embodiment 2. In the case where the input image signal is 720*p*, ALLD=750×((1648/2)−KHDmin)=228000 clocks (Psmclk number).

When the thus calculated YG is larger than 1 (Step S372), YG is reset to 1 (Step S373).

If YG is smaller than 1, the obtained gain YG is used to adjust the display scanning period KHDi (Step S374), and a limit data value (LimDi) for the adjusted image data is obtained so that the image data falls within the adjusted display scanning period KHDi. (Step S375.) Specifically, the display horizontal scanning period (KHDi) is calculated by a formula KHDi=(upDi×YG+KHDmin)×2−1. The limit data value (LimDi) for the adjusted image data is calculated as follows:

$$\mathrm{Lim}Di=\mathrm{up}Di\times YG+D\mathrm{min}$$

The horizontal scanning period KHDi is measured by MCLK number and therefore is doubled. This is because upDi is measured by Pwmclk number.

The thus calculated display horizontal scanning period (KHDi) is added to similarly calculated display horizontal scanning periods of the rest of the scanning lines to obtain the sum and to compare the sum with one frame period of an input image signal in Step S376. If the sum falls short of the length of one frame of the input image, the shortage is compensated by a display blanking period to match the display frame period with the frame period of the input image. Added as the display blanking period is, for example, the minimum display horizontal scanning period (KHDmin) (addition of KHD721, KHD722 . . . ).

After calculation of the limit data value LimDi and display horizontal scanning period KHDi for each scanning line are finished, the microcomputer loops until it receives a vertical synchronization signal VD (Step S38).

After the microcomputer receives the vertical synchronization signal VD and confirms completion of one frame, and before the next frame is started, the display timing generator 33 is loaded with the scanning period KHDi of each scanning line (Step S39) and a limit data memory 52 is loaded with the limit data value LimDi (Step S40).

In this embodiment, the microcomputer 34 may be omitted if the CPU 102 of the discrete adjusted data calculator carries out the processing of the microcomputer 34.

(Limit Data Memory, Limiter)

Adjusted image data Dout temporarily stored in the memory A 26 or memory B 27 are outputted to the shift register 5 as a reading address signal of the R address generator 28 indicates (see FIG. 46).

At this point, the limit data memory 52 limits the value of the adjusted image data Dout in accordance with the limit value LimDi supplied from the microcomputer 34.

In this calculation processing, the gain adjustment is made on the scanning period of each line as described above if the horizontal scanning period is allotted to each line so as to include the maximum value maxDi of adjusted image data which has been detected by the detector 22 of line maximum value and the sum of horizontal scanning periods exceeds one frame period.

Accordingly, if the display scanning period KHDi has been adjusted by multiplying the data with a gain YG smaller than 1, the adjusted image data needs to be limited. Adjusted image data that has to be limited is such data that creates, in accordance with the adjustment made on the horizontal scanning period by the gain YG, a modulation signal having a pulse width equal to or longer than a time period obtained by subtracting a non-drive period from a display horizontal scanning period. In other words, adjusted image data equal to or larger than the limit data value LimDi calculated for each scanning wiring and stored in the limit data memory 52 is limited by the limiter 51.

To elaborate, the limit data memory 52 outputs LimD1 in response to data of the first scanning wiring, LimD2 in response to data of the second scanning wiring, and LimDi in response to data of the i-th scanning wiring. This is achieved by, for example, an address counter (not shown in the drawing) using KHD signals. The limiter 51 outputs the limit data value (LimDi) outputted from the limit data memory 52 instead of adjusted image data if the adjusted image data is equal to or larger than the limit data value (LimDi). This is to prevent a pulse width from exceeding a selection period of a horizontal scanning period after the pulse width is modulated by the modulation circuit 8.

With this structure, correcting voltage drop in a scanning wiring and displaying an image at an enhanced luminance can both be attained in this embodiment.

Moreover, a high quality image can be displayed by controlling one frame using a limiter for adjusted image data.

Embodiment 4

Embodiment 4 of the present invention will be described next.

The difference between this embodiment and Embodiment 3 is scanning period calculation processing in a microcomputer.

When a display horizontal scanning period is simply allotted to a scanning line so as to contain the maximum value maxDi of adjusted image data for the scanning wiring, and the total length of similarly allotted horizontal scanning periods is expected to exceed one frame period of the input image signal, the display horizontal scanning periods are controlled by adapting the horizontal scanning period calculation processing in the microcomputer to this situation. The rest of Embodiment 4 is identical with Embodiment 3.

In Embodiment 3, the display horizontal scanning period is multiplied by the gain YG to adjust the display horizontal scanning period KHDi. Then adjusted image data is limited by the limiter so that the maximum pulse duration of a modulation signal for the i-th scanning wiring is equal to or smaller than the display horizontal scanning period KHDi after the pulse width modulation.

On the other hand, this embodiment chooses a method of limiting a display horizontal scanning period that exceeds a given reference length in order to prevent the sum of scanning periods from exceeding one frame period of an input image signal when the horizontal scanning periods of the scanning wirings are simply allotted so as to contain the maximum values maxDi of the adjusted image data of the scanning wirings.

(Explanations of Overall System and Functions of Components)

The circuit structure of the image display apparatus according to this embodiment, which has an adjusted data calculator built in, is the same as the circuit structure shown in Embodiment 3 (FIGS. 17, 36, and 46).

The difference between this embodiment and Embodiment 3 lies in the following processing contents.

(Detector of Line Maximum Value, Calculation Processing in Microcomputer)

Adjusted image data Dout outputted from the adder 12 of FIG. 17 is inputted to the detector 22 of line maximum value (see FIG. 46). As in Embodiment 2, the detector 22 of line maximum value detects the maximum value out of one line of adjusted image data, and this detection processing handles data of one line at a time.

Following a flow chart of FIG. 47, the microcomputer 34 calculates the scanning period of each scanning wiring from the maximum value of adjusted image data which has been detected by the detector 22 of line maximum value.

In FIG. 47, the operation of this embodiment is the same as that of Embodiment 3 except Step S37. This embodiment differs from Embodiment 3 only in contents of processing in Step S37.

From values of upDi and the sum of upDi, namely, SumD that have been obtained in the process up through Step S36 of FIG. 47, the display horizontal scanning period (KHDi) is calculated for each scanning wiring as well as the limit value data for determining the maximum adjusted image data value for each scanning wiring (Step S37). The calculations follow a flow chart of FIG. 49.

Figure 49:
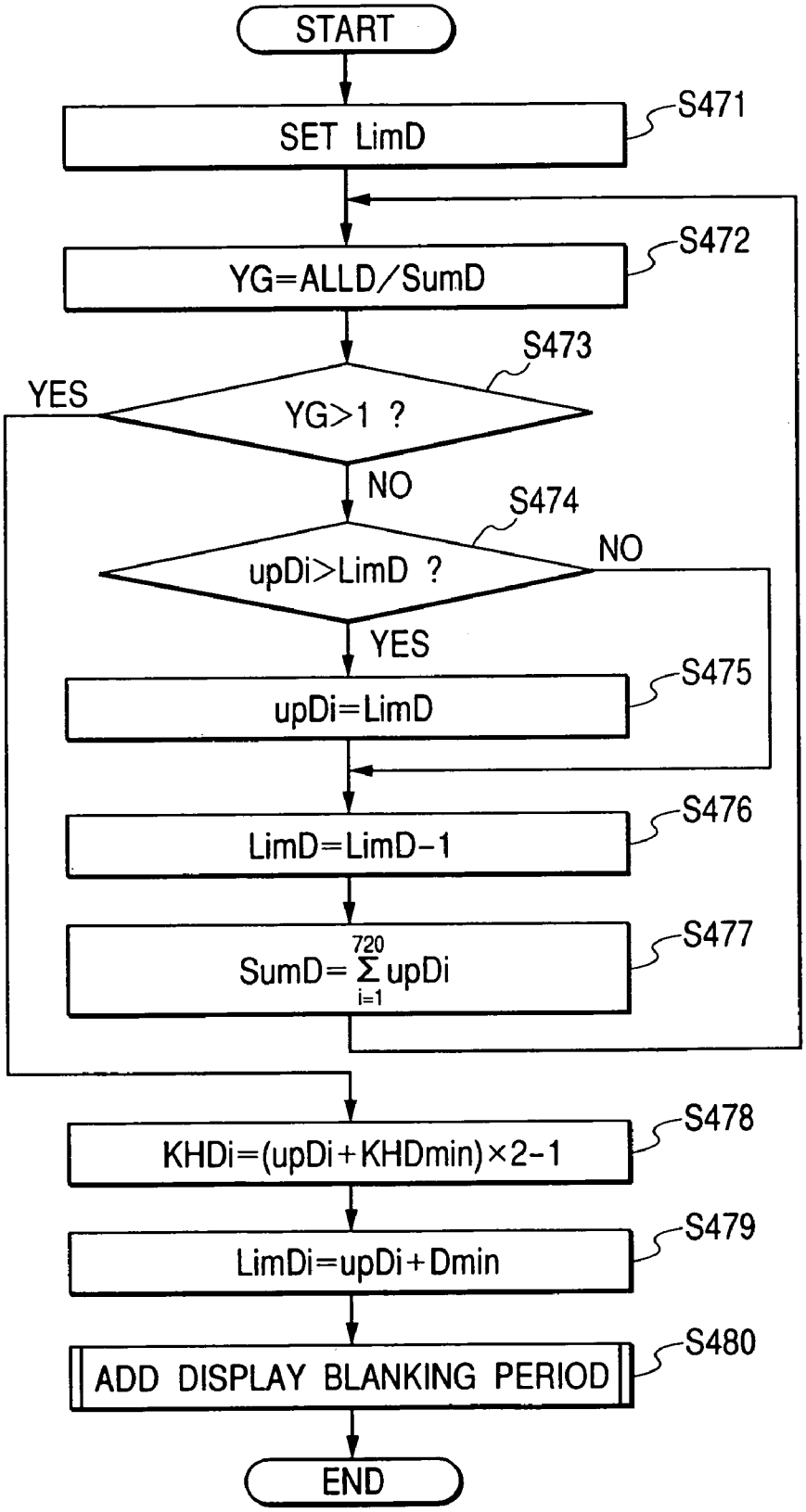
FIG. 49 is a partial flow chart of arithmetic processing according to Embodiment 4 of the present invention.

In the flow chart of FIG. 49, upDi of every scanning line in the frame receives uniform limitation and then limitation is put on the adjusted image data associated with the scanning wirings.

First, LimD is set in Step S471. The value of LimD is equal to or larger than the value obtained by subtracting Dmin from the maximum value adjusted image data can take, namely, the value obtained by subtracting the adjusted image data value Dmin corresponding to the minimum display scanning period KHDmin from the maximum value of adjusted image data when every one of image data inputted to the scanning wirings are at their maximum. Next, YG is obtained by dividing ALLD by SumD in Step S472 similar to Embodiment 3.

If the thus calculated YG is larger than 1 (Step S473), the processing moves on to the next step (Step S478).

If YG is smaller than 1, the display horizontal scanning period KHDi is adjusted as described below.

UpDi for all of the scanning wirings are compared to LimD (Step S474). When UpDi is larger than LimD, the procedure is advanced to Step S475 where UpDi is substituted with LimD. Therefore, the resultant UpDi is limited to a value that does not exceed LimD.

In Step S476, 1 is subtracted from the value of LimD. SumD is newly calculated in the next step of Step S477.

Then the procedure returns to Step S472 where YG is calculated. In Step S473, YG is compared to 1. If YG is smaller than 1, Steps S474 to 477 are repeated until YG becomes larger than 1.

UpDi is reduced through repeated limitation until YG becomes larger than 1, namely, the sum of display horizontal scanning periods no longer exceeds one frame period of an input image signal.

As YG becomes larger than 1, the processing moves on to Step S478. In Step S478, the display horizontal scanning period KHDi is determined from the limited upDi.

Specifically, the display horizontal scanning period (KHDi) is calculated as follows:

$$KHDi=(\mathrm{up}Di+KHD\mathrm{min})\times 2-1$$

KHDi is obtained by adding upDi that is adjusted in accordance with the above flow (the value obtained by subtracting adjusted image data that corresponds to the minimum display horizontal scanning period from the adjusted image data and then limiting the subtraction result) to the minimum display scanning period (KHDmin).

The horizontal scanning period KHDi is measured by MCLK number and therefore is doubled.

In the next step S479, the limit data value (LimDi) for adjusted image data is calculated to make the duration of a signal subjected to pulse width modulation by the modulation circuit 8 start and end within the adjusted display horizontal scanning period KHDi. LimDi is obtained by a formula LimDi=upDi+Dmin.

The thus calculated display horizontal scanning period (KHDi) is added to similarly calculated display horizontal scanning periods of the rest of the scanning lines to obtain the sum and to compare the sum with one frame period of an input image signal in Step S480. If the sum falls short of the length of one frame of the input image signal, the shortage is compensated by a display blanking period to match the display frame period with the frame period of the input image. Added as the display blanking period is, for example, the minimum display horizontal scanning period (KHDmin) (KHD721, KHD722 . . . KHD 730).

After calculation of the limit data value LimDi and calculation of display horizontal scanning period KHDi for each scanning line are finished, the microcomputer loops until it receives a vertical synchronization signal VD (see Step S38 of FIG. 47).

After the microcomputer receives the vertical synchronization signal VD and confirms completion of one frame, and before the next frame is started, the display timing generator 33 is loaded with the display horizontal scanning period KHDi of each scanning line (Step S39) and the limit data memory 52 is loaded with the limit data value LimDi (Step S40).

In this embodiment, the microcomputer 34 may be omitted if the CPU 102 of the discrete adjusted data calculator carries out the processing of the microcomputer 34.

(Limit Data Memory, Limiter)

Adjusted image data Dout temporarily stored in the memory A 26 or memory B 27 is outputted to the shift register 5 as a reading address signal of the R address generator 28 indicates.

At this point, the limit data memory 52 limits the value of the adjusted image data Dout in accordance with the limit data value LimDi supplied from the microcomputer 34.

To elaborate, the limit data memory 52 outputs LimD1 in response to data of the first scanning wiring, LimD2 in response to data of the second scanning wiring, and LimDi in response to data of the i-th scanning wiring. These outputs can be produced by count by a counter not shown in the drawings. The limiter 51 outputs the limit data value (LimDi) outputted from the limit data memory 52 instead of adjusted image data if the adjusted image data is equal to or larger than the limit data value (LimDi).

With this structure, correcting voltage drop in a scanning wiring and displaying an image at an enhanced luminance can both be attained in this embodiment.

When the sum of display horizontal scanning periods of one frame is expected to exceed a give amount of time, for example, one frame period of an input image signal, the display horizontal scanning periods are limited starting with one having a longer period so that the sum of display horizontal scanning periods of one frame is contained within a given amount of time. Then adjusted image data is limited to avoid exceeding the set display horizontal scanning period. A high quality image thus can be displayed.

According to Embodiments 1 through 4 of the present invention, horizontal scanning periods are suitably allotted to the respective scanning wirings in accordance with the maximum values of adjusted image data. Therefore an image can be displayed at high luminance while correcting voltage drop in a scanning wiring accurately without causing lowering in luminance of the entire display image.

Furthermore, the sum of display horizontal scanning periods in one frame can be prevented from exceeding a given amount of time by adjusting the horizontal scanning periods and adjusted image data.

Embodiments 1 to 4 show examples in which a large amount of current flows in a scanning wiring and voltage drop of a scanning wiring is corrected. In an FED where almost no voltage drop takes place in a scanning wiring, the voltage drop correction unit 40 of Embodiments 1 to 4 in FIG. 17 may be composed simply of the inverse γ processor 17, the data array converter 9, and a multiplier for multiplying an output of the array converter 9 by a coefficient equal to or larger than 1 to output the result.

Similar to Embodiments 1 to 4 where the voltage drop correction unit 40 generates adjusted image data larger than input image data, the multiplier outputs data larger than input image data by multiplying an output of the array converter 9 by a coefficient equal to or larger than 1. Then the scanning period is determined in accordance with the pulse width of a modulation signal, thereby increasing the luminance in accordance with the coefficient equal to or larger than 1.

An embodiment described below is a mode for determining modulation signals and scan selection signals in accordance with selection periods of horizontal scanning periods that are set in advance such that at least two scanning wirings have different selection periods in one frame period.

Embodiment 5

Figure 50:
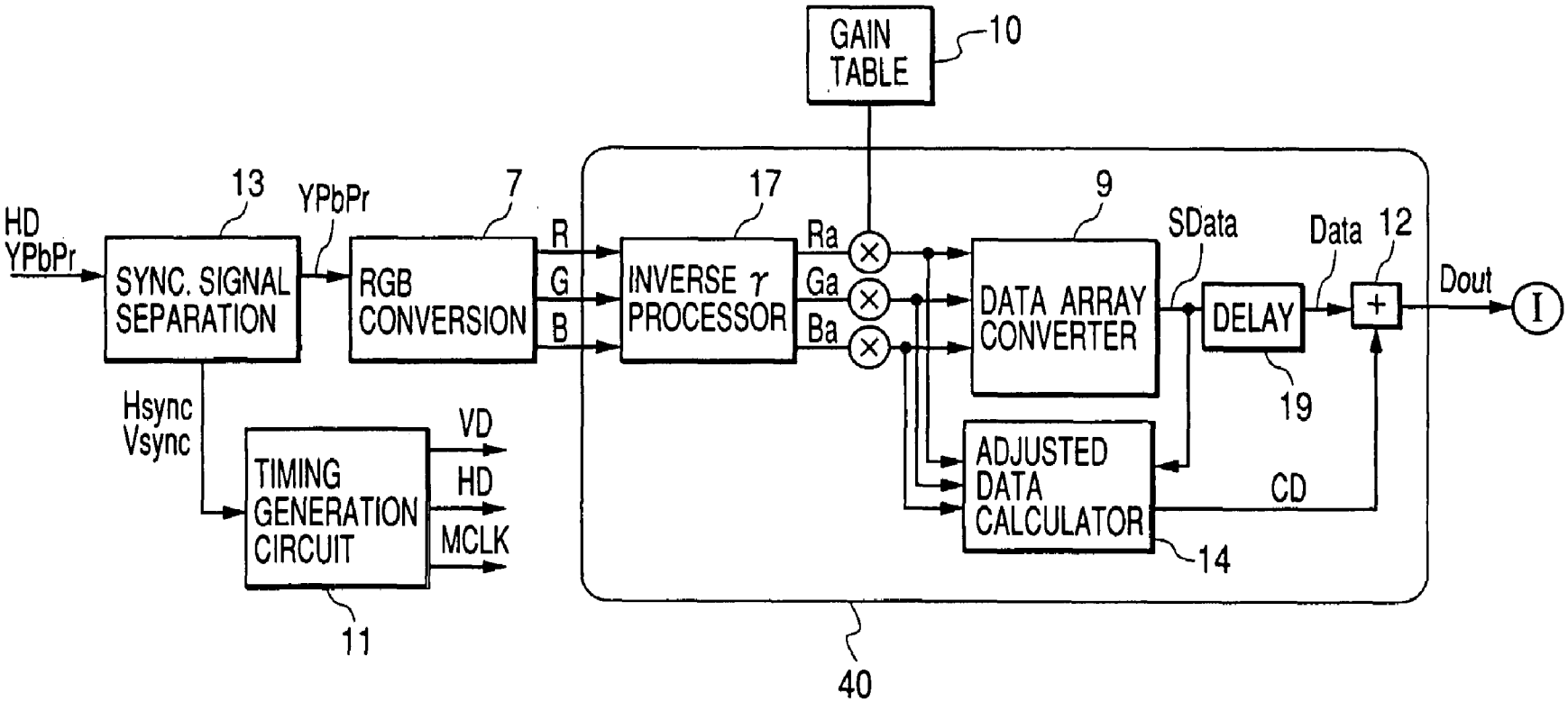
FIG. 50 is a block diagram showing an outline of a drive control circuit of a display apparatus according to Embodiment 5 of the present invention.
Figure 51:
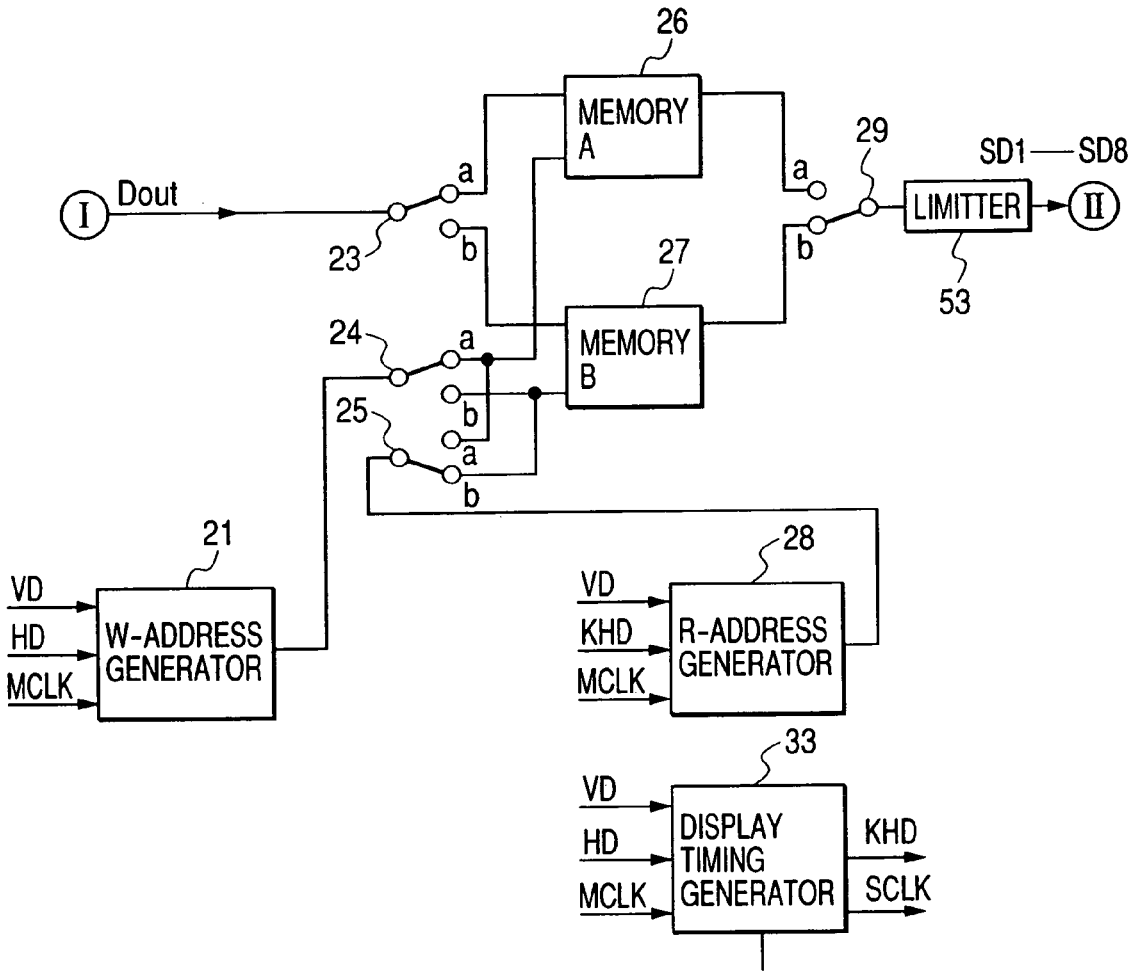
FIG. 51 is a block diagram showing an outline of a drive control circuit of the display apparatus according to Embodiment 5 of the present invention.

FIGS. 50 and 51 are block diagrams showing a part of drive control apparatus according to this embodiment.

In FIG. 50, a gain table-10 is provided and a gain value stored in the gain table 10 is multiplied by parallel three primary color signals Ra, Rb, and Rc sent from an inverse γ processor 17.

In FIG. 51, a limiter 53 is provided to put a given limitation to an output of a memory A 26 or memory B 27.

(Gain Table)

The gain table 10 of FIG. 50 is a circuit for storing a gain that is a multiplier factor for multiplication of image signals Ra, Ga, and Ba outputted from the inverse γ processor 17. The gain is not a fixed value but is set to different values in accordance with the address of a scanning wiring. Details thereof will be described later.

(Memory A, Memory B)

The memory A 26 and memory B 27 operate in the same way as the memories in the above embodiments do.

Figure 52:
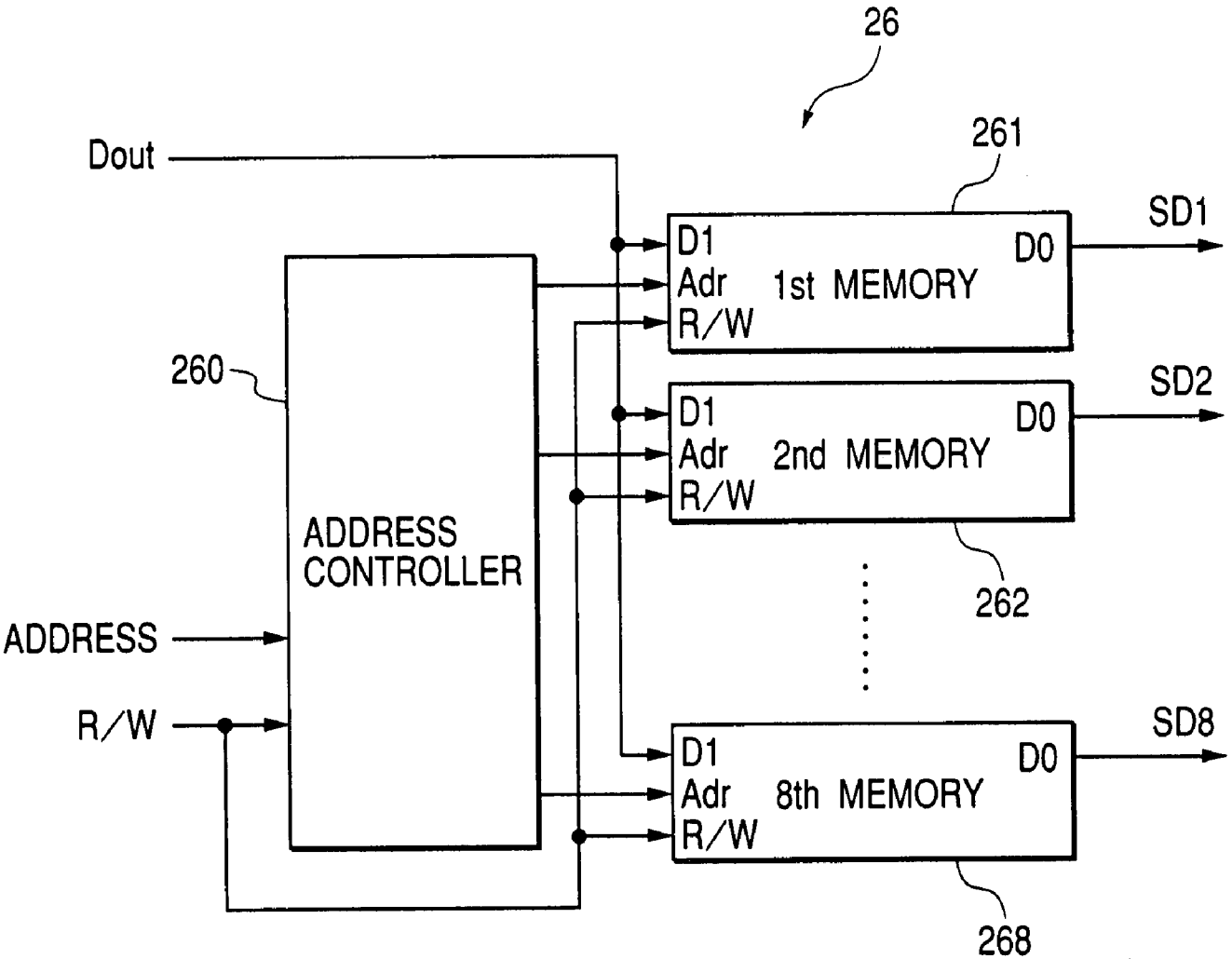
FIG. 52 is a block diagram showing the structure of a frame memory.

FIG. 52 is a block diagram schematically showing the circuit structure of the memory A 26 used in the present invention. The memory B 27 has the same circuit structure. As shown in FIG. 52, the memory A 26 is composed of an address controller 260 and eight bank memories, namely, a first memory 261 to eighth memory 268.

The address controller 260 controls the address of the first memory 261 to eighth memory 268 in accordance with a writing address signal generated by a W address generator 21 or a reading address signal generated by an R address generator 28.

The first memory 261 to eighth memory 268 each have a memory capacity large enough to store ⅛ of adjusted image data of one frame. If an input image signal is 720*p*, the number of effective pixels in the horizontal direction is 1280, and one line of data is 3×1280=3840 since 3 data consisting of R, G, and B are provided for each pixel. Accordingly, the first memory 261 to eighth memory 268 each can store 3840/8=480 data as horizontal-directional data. Each memory can store data of all the scanning wirings, namely, 750 lines as vertical-directional data.

Adjusted image data Dout outputted from an adder 12 is written in the memory A 26 when it is an odd-numbered frame and in the memory B 27 when it is an even-numbered frame as a writing address signal generated by the W address generator 21 indicates.

At this point, the address controller 260 brings one of the bank memories, first memory 261 to eighth memory 268, to which data is to be written to an enable state (no enable line is shown in the drawing) in accordance with Hbank address (a description on Hbank address will be given later) included in the writing address signal. Receiving an address signal that sets V address to significant address and H address to less significant address, the address controller controls the address of the first memory 261 to eighth memory 268 simultaneously.

The adjusted image data written in the memory A 26 or memory B 27 is read as a reading address signal generated by the R address generator 28 indicates.

The address controller 260 at this point brings all of the bank memories, the first memory 261 to eighth memory 268, to an enable state and controls the first memory 261 to eighth memory 268 simultaneously upon receiving an address signal that sets V address to significant address and H address to less significant address. Data SD1 to SD8 are respectively read out of the bank memories in parallel.

The R address generator 28 determines timing of reading line data of each horizontal scanning line in accordance with a display timing signal KHD generated by the display timing generator 33, instead of a horizontal synchronization signal HD included in an input image signal. How the display timing signal KHD is generated will be described later.

In this embodiment, the memory A 26 and memory B 27 are each composed of a plurality of bank memories as described above so as to output one line of adjusted image data in eight layers. Therefore the time required to transfer data from the memory A 26 and memory B 27 to the shift register 5 (shift time) can be shortened. The same effect can be obtained without dividing outputs of the memories into layers. In this case, the frame memories output one output and only one shift register is used to make the time required to read data of the frame memories shorter than the time required to write data in the frame memories.

(W Address Generator)

Figure 53:
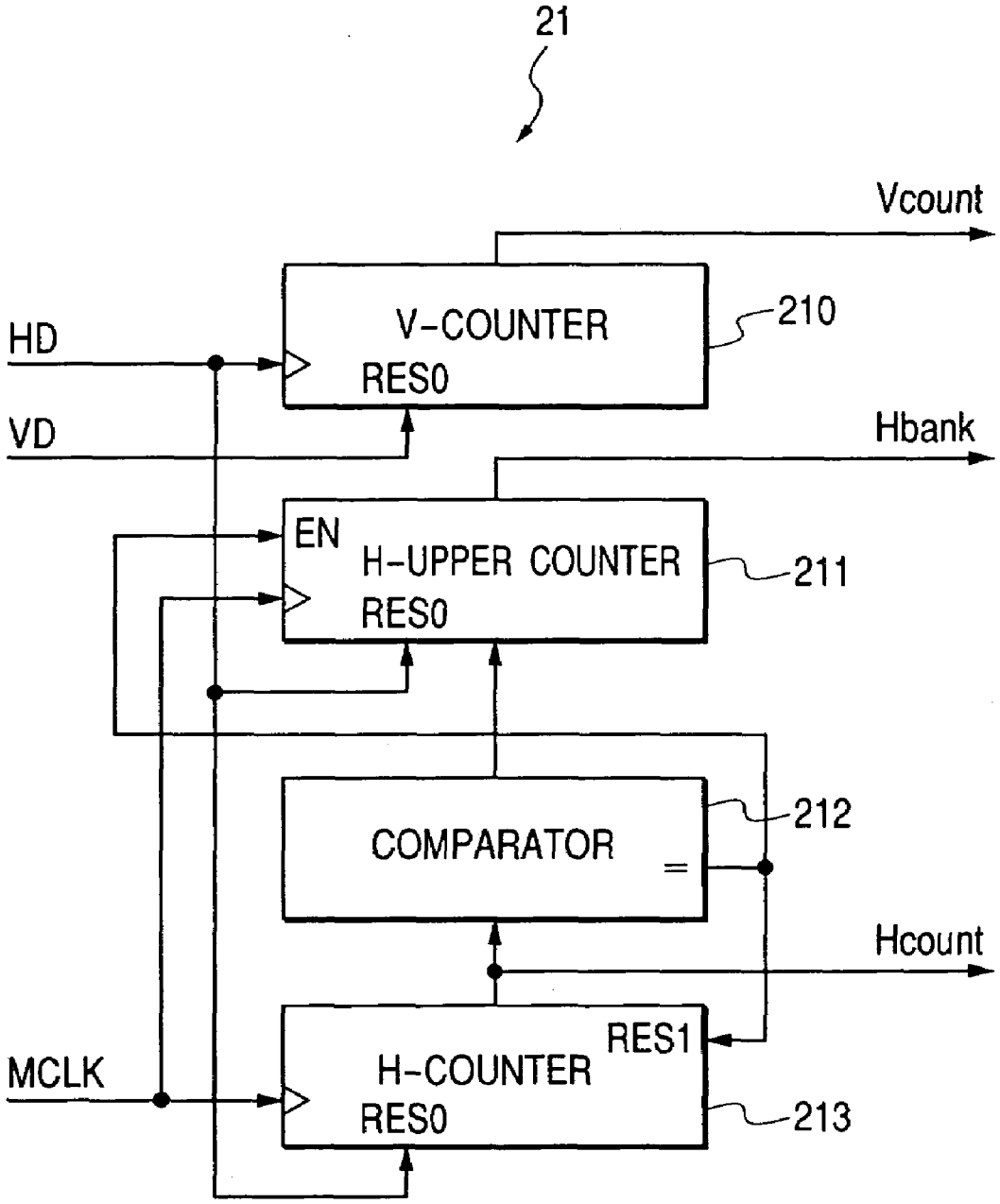
FIG. 53 is a block diagram showing the structure of a W address generator.

FIG. 53 is a block diagram schematically showing the circuit structure of the W address generator 21. As shown in FIG. 53, the W address generator 21 is composed of a V-counter 210, an H-upper counter 211, a comparator 212, and an H-counter 213.

The V-counter 210 is a counter for generating and outputting address Vcount that specifies address in the vertical direction (scanning wiring number). The V-counter 210 is reset by a vertical synchronization signal VD, and counts horizontal synchronization signals HD to output the count. When an input signal is 720*p*, the number of scanning wirings in the vertical direction is 750 and therefore a counter of 10-bit width is used.

The H-counter 213 is a counter for outputting address Hcount that specifies address in the horizontal direction (data number in one line). The H-counter 213 is reset by a horizontal synchronization signal HD, and counts MCLK to output the count. Since the number of horizontal-directional data stored in one bank memory is 480 as described above, a counter of 9-bit width is used. An output of the H-counter 213 is also inputted to the comparator 212.

The H-upper counter 211 is a counter for outputting Hbank that specifies a bank memory in which adjusted image data Dout is to be written. The H-upper counter 211 is reset by a horizontal synchronization signal HD, and counts MCLK if MCLK is inputted while a signal is inputted to an EN terminal. Since the memory A 26 and memory B 27 each have eight banks, a counter of 3-bit width is used as the H-upper counter 211.

The comparator 212 compares a value stored in advance with the count inputted from the H-counter 213 and, if the two match, outputs a signal. The output of the comparator 212 is connected to a reset terminal RES1 of the H-counter 213 and to the EN terminal of the H-upper counter 211. The comparator 212 stores "479" as a value corresponding to the number of horizontal-directional data (480) of one layer (one bank) of the memory A 26 and memory B 27.

In the above structure, as processing of one frame is started, the V-counter 210 is first reset by a vertical synchronization signal VD. Then the H-counter 213 and the H-upper counter 211 are reset by a horizontal synchronization signal HD. The H-counter 213 counts MCLK and outputs the count as Hcount.

The count outputted from the H-counter 213 is also inputted to the comparator 212, where the count is compared with the stored value, 479. When the count of the H-counter 213 reaches 479, the comparator 212 outputs a signal and the count of the H-counter 213 is again reset to 0. On the other hand, the signal is also inputted to the EN terminal of the H-upper counter 211, which counts the next MCLK to output the count as Hbank.

The H-counter 213 therefore repeatedly counts up to 0 to 479. The H-upper counter 211 increments the value of Hbank one by one for each of 480 data to change a writing bank.

After processing of one horizontal line is completed, the V-counter 210 counts horizontal synchronization signals HD and outputs the count as Vcount. The H-upper counter 211 and the H-counter 213 are reset by a horizontal synchronization signal HD. Subsequently, the same processing is repeated to process the next horizontal scanning line.

(R Address Generator)

Figure 54:
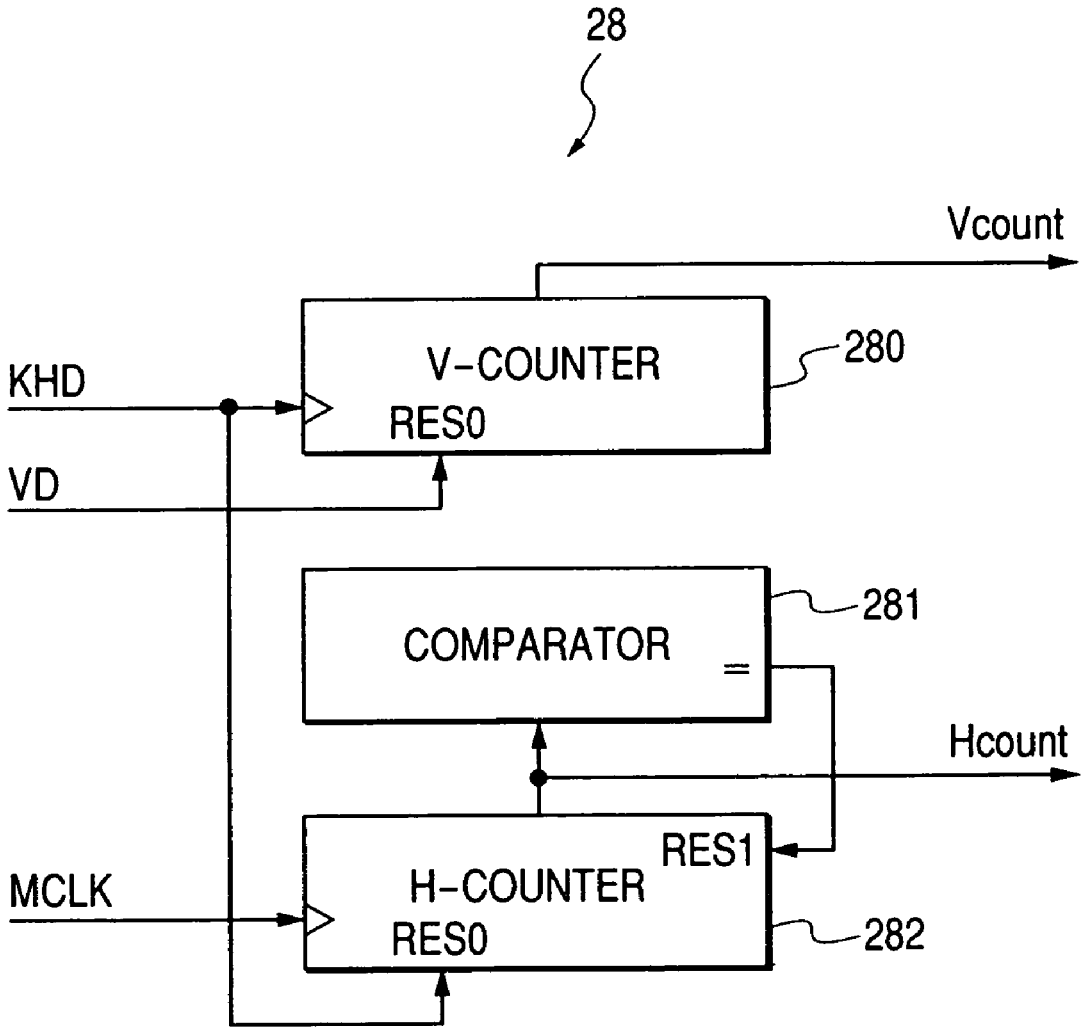
FIG. 54 is a block diagram showing the structure of an R address generator.

FIG. 54 is a block diagram schematically showing the circuit structure of the R address generator 28. As shown in FIG. 54, the R address generator 28 is composed of a V-counter 280, a comparator 281, and an H-counter 282.

The V-counter 280 is a counter for generating and outputting address Vcount that specifies address in the vertical direction (scanning wiring number). The V-counter is reset by a vertical synchronization signal VD, and counts display timing signals KHD generated in the display timing generator 33 to output the count. When an input signal is 720*p*, the number of scanning wirings in the vertical direction is 750 and therefore a counter of 10-bit width is used.

The H-counter 282 is a counter for outputting address Hcount that specifies address in the horizontal direction (data number in one line). The H-counter 282 is reset by the display timing signals KHD generated in the display timing generator 33, and counts MCLK to output the count. Since the number of horizontal-directional data stored in one bank memory is 480 as described above, a counter of 9-bit width is used. An output of the H-counter 282 is also inputted to the comparator 281.

The comparator 281 compares a value stored in advance with the count inputted from the H-counter 282 and, if the two match, outputs a signal. The output of the comparator 281 is connected to a reset terminal RES1 of the H-counter 282. The comparator 281 stores "479" as a value corresponding to the number of horizontal-directional data (480) of one layer (one bank) of the memory A 26 and memory B 27.

In the above structure, as processing of one frame is started, the V-counter 280 is first reset by a vertical synchronization signal VD. Then the H-counter 282 is reset by the display timing signals KHD. The H-counter 282 counts MCLK and outputs the count as Hcount.

The count outputted from the H-counter 282 is also inputted to the comparator 281, where the count is compared with the stored value, 479. When the count of the H-counter 282 reaches 479, the comparator 281 outputs a signal and the count of the H-counter 282 is again reset to 0. The H-counter 282 therefore repeatedly counts up to 0 to 479.

After processing of one horizontal line is completed, the V-counter 280 counts the display timing signals KHD and outputs the count as Vcount. The H-counter 282 is reset by the display timing signals KHD. Subsequently, the same processing is repeated to process the next horizontal scanning line.

Described next is a method of generating the display timing signal KHD, namely, a method of controlling a horizontal scanning period.

(About Control of Horizontal Scanning Period)

In this embodiment, the horizontal scanning period of each scanning wiring is not a fixed value. A longer scanning period is allotted to a scanning wiring that requires a relatively high luminance, and a shorter scanning period is allotted to a scanning wiring that does not require high luminance.

Figure 55:
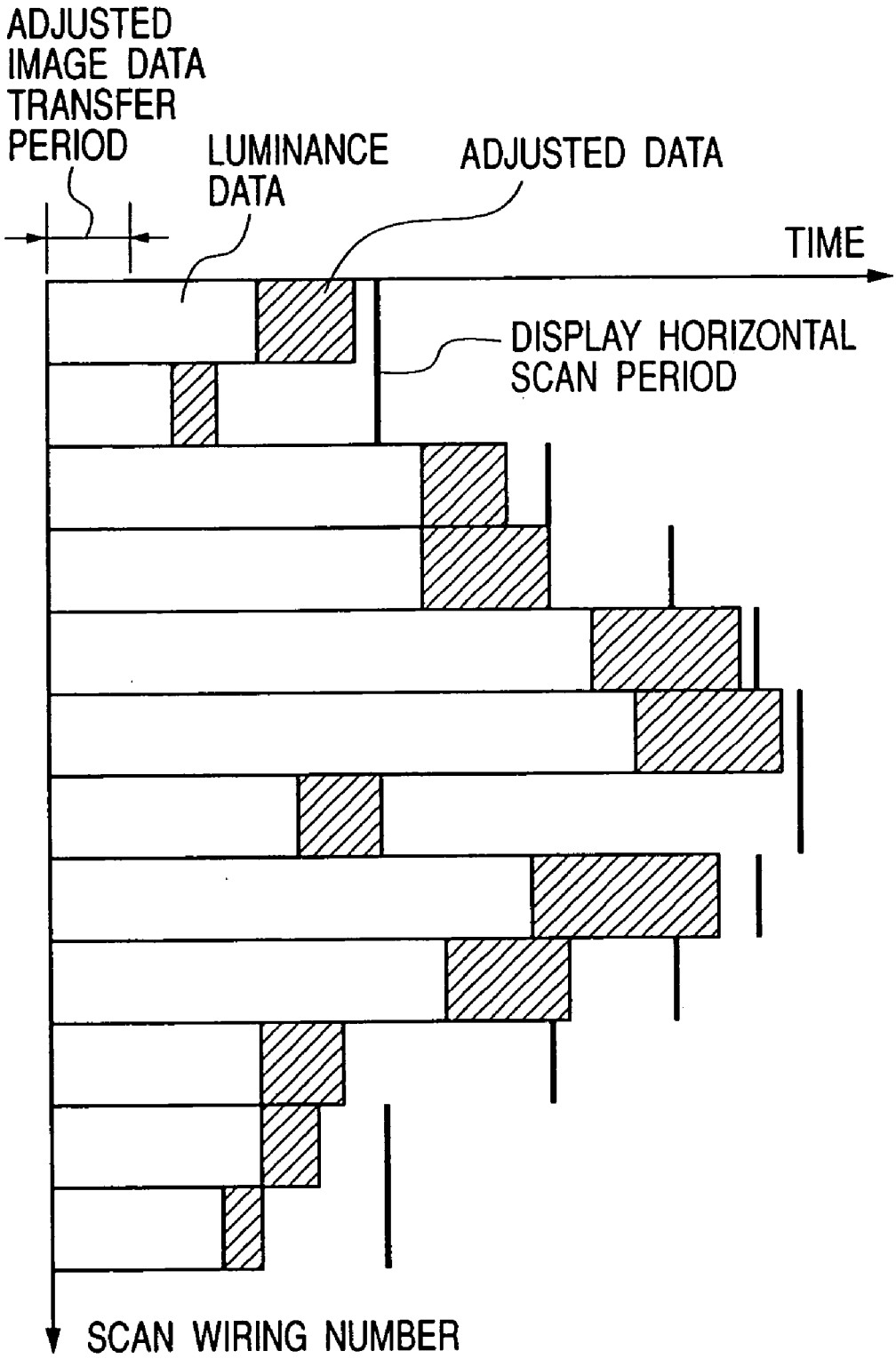
FIG. 55 is a schematic diagram illustrating a horizontal scanning period control employed in the present invention.

FIG. 55 is a schematic diagram showing an example of horizontal scanning periods of pixels on a plurality of scanning wirings. In the graph of FIG. 55, the axis of ordinate shows horizontal scanning lines (scanning wirings). The number of horizontal scanning wirings in FIG. 55 is set to twelve in order to simplify the explanation. The axis of abscissa of the graph shows time (pulse width).

In the bar graph of FIG. 55, bars respectively representing the horizontal scanning lines indicate adjusted image data of the horizontal scanning lines they represent. A white rectangular portion of a bar shows input image data (luminance data) inputted to a pixel on the horizontal scanning line the bar represents, and a hatched rectangular portion of the bar shows correction data for the input image data. Longitudinal lines (solid lines) to the right of the bars indicate display horizontal scanning periods of the respective horizontal scanning lines.

As shown in FIG. 55, of the twelve scanning wirings, one in the middle has a display scanning period different from the display scanning period of scanning wirings at the top and bottom. Here, pixels on a horizontal scanning line at the center of the screen have the longest horizontal scanning period. The display horizontal scanning period is shortened as the distance from the center is increased, and pixels on the scanning lines at the top and bottom of the screen have the shortest display horizontal scanning period. The bars representing the display horizontal scanning periods of the respective horizontal scanning lines form a convex pattern protruding rightward in FIG. 55.

A given gain conversion is performed for each scanning wiring on adjusted image data of the respective horizontal scanning lines so that the maximum values of adjusted image data are contained within the respective display horizontal scanning periods set as described above. This means that the gain conversion follows suit and the gain is the largest for pixels on a horizontal scanning line at the center of the screen. The gain becomes smaller as the distance from the center is increased and the gain for pixels on scanning wirings at the top and bottom of the screen is the smallest.

If the sum of display horizontal scanning periods individually allotted to the horizontal scanning wirings is equal to or less than one frame period of an input image signal, one frame of images can be displayed within the length of one frame period. In other words, one frame of images can be displayed within the length of one frame period if the average of the display horizontal scanning periods is equal to the horizontal scanning period obtained from a horizontal synchronization signal of the input image signal. In addition, a viewer rarely finds strangeness in a displayed image when the scanning lines have different levels of luminance as in FIG. 55 because the human eye generally does not pick up a gradual luminance change from the center of the screen toward the edges of the screen.

When the display frame period is varied slightly, the sum of several frames of display horizontal scanning periods allotted individually to the horizontal scanning lines should be equal to or less than the length of the several frames of the image signals inputted.

Next, a more detailed description will be given on the control of display horizontal scanning periods.

If a display panel has 720×1280×3 (RGB) surface conduction electron-emitting devices, the device current is set to about 0.1 mA, and the scanning wiring resistance is set to about 5 Ω, the maximum value of adjusted image data obtained by correcting image data of 8-bit width (max: 255) is about 350. Accordingly, the bit width of a pulse width modulator is set to 9-bit.

(Display Timing Generator)

Figure 56:
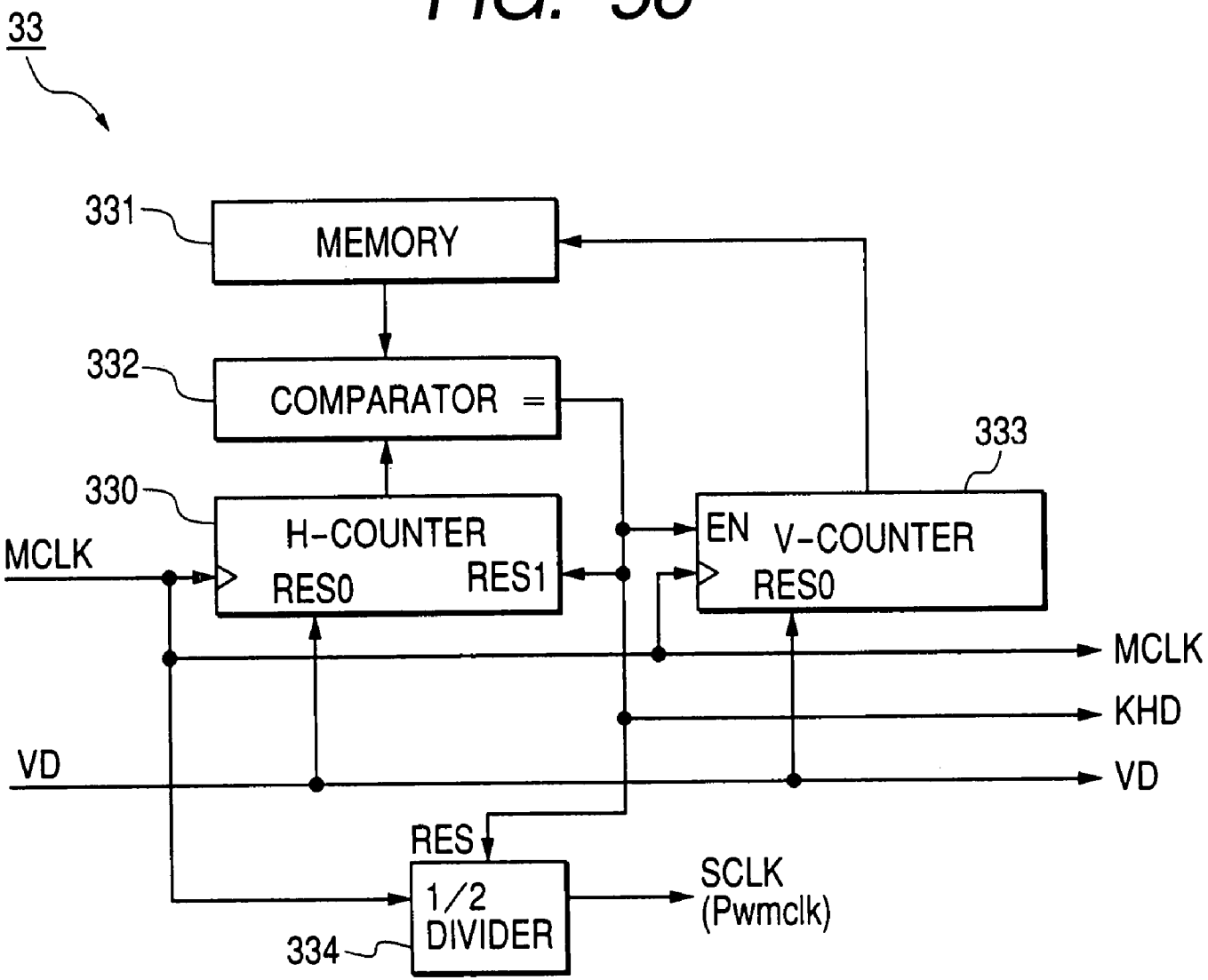
FIG. 56 is a block diagram showing the structure of a display timing generator.

FIG. 56 is a block diagram schematically showing the circuit structure of the display timing generator 33. The difference between this structure and the structure shown in FIG. 31 lies in control of a memory 331 and data stored in the memory.

In the memory 331, the number of MCLK of each horizontal scanning line (1H MCLK number) is stored in advance in order to set the display horizontal scanning period of pixels on each scanning wiring. The memory 331 stores a value obtained by subtracting 1 from the MCLK number of the first horizontal scanning line (1H MCLK number−1) at Address 0, and stores a value obtained by subtracting 1 from the MCLK number of the second horizontal scanning line at Address 1. A value obtained by subtracting 1 from the MCLK number of the i-th horizontal scanning period is stored at Address (i−1), and the value (1H MCLK number−1) is stored in this way for each of the rest of the horizontal scanning lines. Upon receiving Address i from the V-counter 333, the memory 331 outputs the MCLK number at the address i to the comparator 332.

The comparator 332 compares the value inputted from the H-counter 330 (MCLK count) with the value inputted from the memory 331, namely, the preset MCLK number of each horizontal scanning line, and outputs a signal only when the two match.

The thus structured display timing generator 33 generates a display timing signal KHD as follows.

First, a vertical synchronization signal VD is inputted to reset the count of the H-counter 330 and V-counter 333 and start processing of one frame.

In sync with MCLK, the V-counter 333 outputs a counter value of 0 to the memory 331, which, upon receiving the count, outputs the MCLK number of the first horizontal scanning line, actually, "1H MCLK number−1", to the comparator 332. On the other hand, the H-counter 330 counts MCLK and outputs the counter value N to the comparator 332.

When the counter value N of the H-counter 330 matches the MCLK number, the comparator 332 outputs a signal. The comparison processing here is in sync with MCLK. Therefore the output signal of the comparator 332 serves as a display timing signal KHD that indicates the end of the first line (or the start of the second line).

As the display timing signal KHD is outputted, the counter value of the H-counter 330 is reset and the counter value of the V-counter 333 is incremented. Accordingly, after that, the V-counter 333 outputs a counter value 1 to the memory 331 and the memory 331 outputs the MCLK number (actually, 1H MCLK number−1) of the second horizontal scanning line to the comparator 332. The H-counter 330 again starts counting MCLK from 0 and, when the counter value matches the MCLK number of the second horizontal scanning line, the comparator 332 outputs a display timing signal KHD (a signal that indicates the end of second line or the start of the third line).

This processing is repeated for every line in one frame to generate a display timing signal KHD having a MCLK number according to the MCLK number that is stored in the memory 331 in advance for each horizontal scanning line.

The display timing signal KHD thus generated is inputted to the R address generator 28. As described above, the R address generator 28 generates a reading address signal in response to the display timing signal KHD and outputs the address signal through the switch 25 to the memory from which data is to be read.

The total number of lines when data is read from the memory A 26 or memory B 27 is desirably equal to or more than the number of effective scanning wirings, namely, 720 lines. More desirably, the total number is set to 725 to 750, even more desirably, 730 to 749, allowing a margin of timing design.

Figure 57:
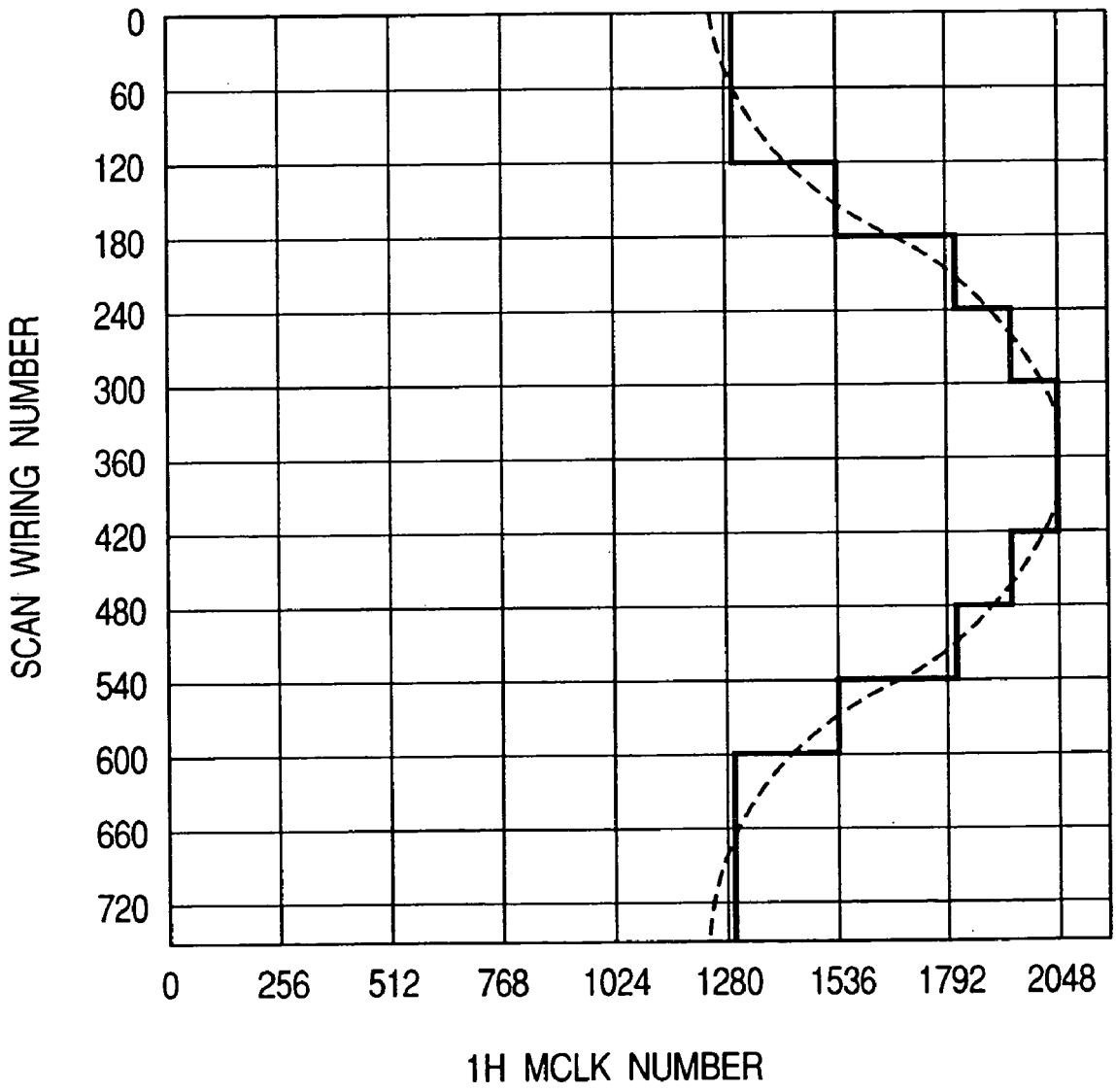
FIG. 57 is an explanatory diagram showing an example of a display timing signal used in the present invention.
Figures 58, 59:
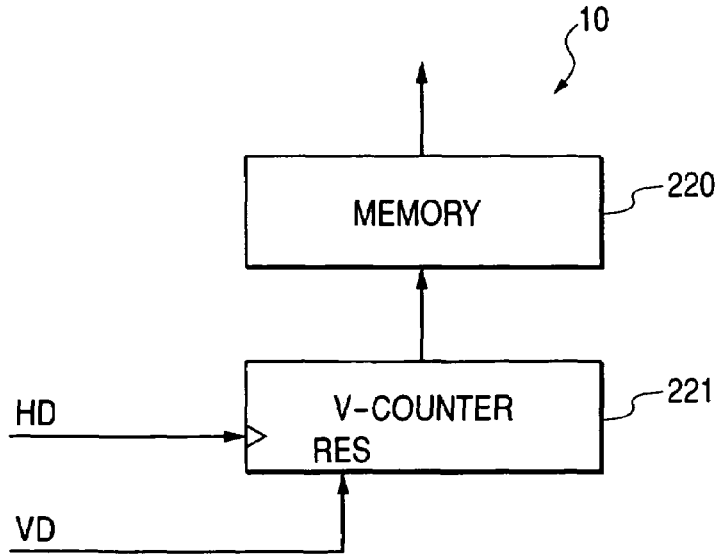
FIG. 58 is a table showing an example of the display timing signal.
FIG. 59 is a block diagram showing the structure of a gain table.

FIGS. 57 and 58 show an example in which the H-counter 330 and the V-counter 333 are reset by a vertical synchronization signal VD during processing of the 744-th line. The solid line in FIG. 57 is a graph of the table of the 1H MCLK number stored in the memory 331 for each horizontal scanning line. FIG. 58 is a table showing the 1H MCLK number, SCLK number (Pwmclk number), and MAXpwm number for each horizontal scanning line.

As shown in the drawings, the memory 331 stores a table in which a horizontal scanning line nearer to the center of the screen has a larger MCLK number and a horizontal scanning line nearer to the top or bottom of the screen has a smaller 1H MCLK number. As a result, the display horizontal scanning periods of the respective horizontal scanning periods form a convex pattern, and are shorter at the top and bottom of the screen and are longer around the center.

In the table used here, the 1H MCLK number is changed stepwise for every 60 lines. It is also preferable to use a table in which each horizontal scanning line has different 1H MCLK number so as to form a smooth convex pattern as the one indicated by the dotted line in FIG. 57. The curve in this case is, for example, one expressed by a quadratic expression or Gaussian curve.

An input image signal is 720*p* and the sample clock number (MCLK number) of one horizontal scanning period is set to 1648 in this embodiment. Therefore the MCLK number of one frame is 750×1648=1236000 clocks. When the MCLK number is set for each horizontal scanning line as shown in FIGS. 57 and 58, the total MCLK number of the first line to 743rd line is 1235344 clocks and the total MCLK number of the first line to 744th line is 1236672 clocks. Accordingly, the H-counter 330 and the V-counter 333 are reset by a vertical synchronization signal VD during processing of the 744th horizontal scanning line.

The MAXpwm is the maximum value adjusted image data can take, specifically, a value obtained by converting the maximum value into clock number (Pwmclk number) for pulse width modulation.

The display timing of each horizontal scanning line is determined by a display timing signal KHD. If switching between horizontal scanning lines coincides with driving (rising and falling) of vertical modulation lines, the drive waveform in the display panel is disturbed and excessive voltage may be applied to the display devices. Therefore allotting the entire period corresponding to the 1H MCLK number to the PWM drive time has to be avoided.

In this embodiment, the cycle of MCLK is about 13.5 n sec. and the cycle of Pwmclk is about 27 n sec. Since 2 μsec. or so is sufficient as a non-drive time for switching between scanning wirings, 74 Pwmclk is set as a period in which the devices are not driven.

Accordingly, the MAXpwm number is a value obtained by subtracting 74 from the Pwmclk number that is determined by the display timing signal KHD. The table of FIG. 58 shows the MAXpwm number obtained.

(Gain Table)

FIG. 59 is a block diagram schematically showing the circuit structure of a gain table 10.

As shown in FIG. 59, the gain table 10 is composed of a memory 220 and a V-counter 221.

The memory 220 is a memory measure for storing a data table in which a scanning wiring number is associated with a gain (GAIN). The data stored in the memory 220 serves as a parameter for determining a modulation signal in accordance with the set horizontal scanning period.

As processing of one frame is started, the V-counter 221 is first reset by a vertical synchronization signal VD (the count is set to 0). Then the V-counter 221 counts horizontal synchronization signals HD to output the count. The output of the V-counter 221 is connected to the address of the memory 220, and the memory 220 outputs a gain (GAIN) in accordance with the count inputted from the V-counter 221. The memory 220 stores a table that causes the memory 220 to output the gain for the first line when the count is 0.

The gain GAIN set for each horizontal scanning line is determined from the maximum data value DataMAX of adjusted image data and MAXpwm obtained as described above for each horizontal scanning line by the inequality below.

$$GAIN \leqq MAXpwm/DataMAX$$

DataMAX here is the value of adjusted image data obtained by the voltage drop amount correction processing described above when the circuit receives such image data that makes every input data to one horizontal scanning line the maximum value ("255" if the image data is 8-bit data). In other words, voltage drops is at maximum and the adjusted image data takes the maximum value when this image data is inputted. The gain GAIN is set such that the adjusted image data of this case (DataMAX) does not exceed MAXpwm.

Figure 60:
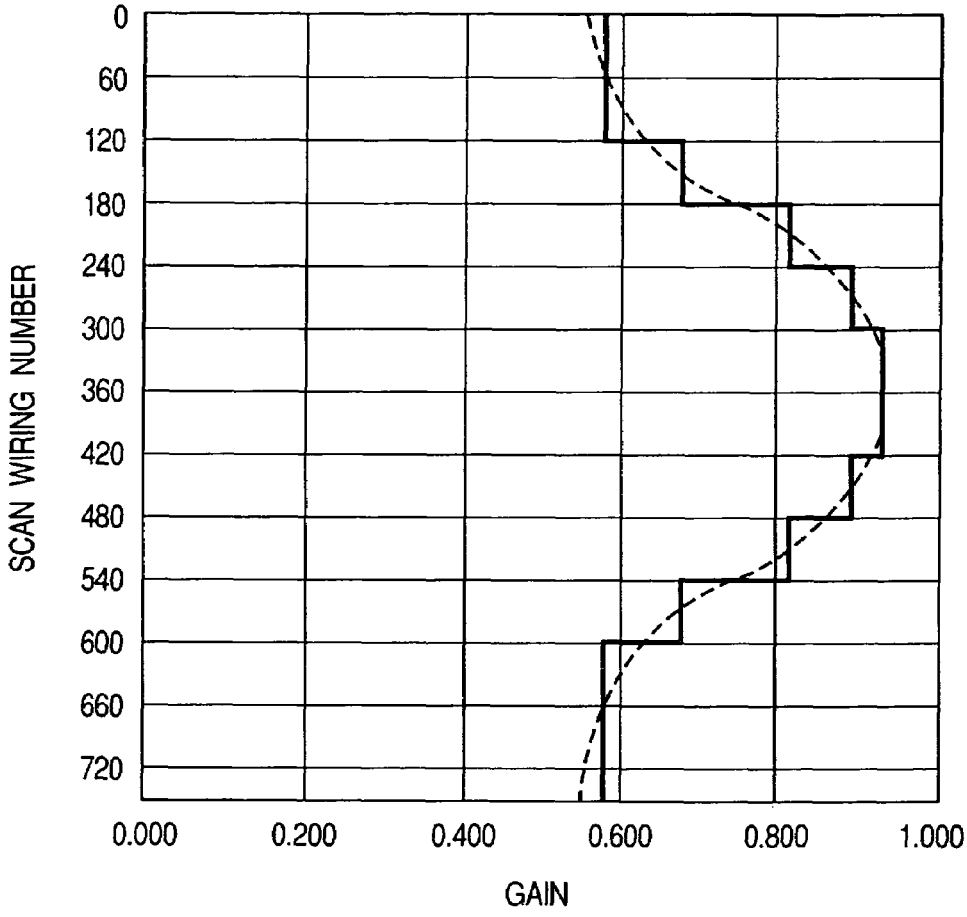
FIG. 60 is an explanatory diagram showing an example of the gain table used in the present invention.

FIGS. 60 and 61 show an example of gain table. The solid line in FIG. 60 is a graph of the table which is stored in the memory 220 and which contains the gain (GAIN) set for each horizontal scanning line. FIG. 61 is identical with the table of FIG. 58 except that the gain (GAIN) is added to FIG. 61.

As shown in the drawings, the memory 220 stores a table in which a horizontal scanning line nearer to the center of the screen has a larger gain and a horizontal scanning line nearer to the top or bottom of the screen has a smaller gain. As a result, adjusted image data receives a gain conversion that forms a convex pattern in the graph in accordance with the display horizontal scanning period of the horizontal scanning line. Therefore adjusted image data for a horizontal scanning line nearer to the top or bottom of the screen is set to a smaller value and is contained within the display horizontal scanning period.

In the gain table used here, the gain is changed stepwise for every 60 lines. It is more desirable to use a gain table in which each horizontal scanning line has different gain so as to form a smooth convex pattern as the one indicated by the dotted line in FIG. 60. The curve in this case is, for example, one expressed by a quadratic expression or Gaussian curve. If the horizontal scanning periods are changed stepwise and the gain table has gains that form a smooth convex pattern, the display luminance change is smooth and no strangeness is felt in the image displayed.

(Limiter)

Adjusted image data SD1 to SD8 read out of the memory A 26 or memory B 27 in response to the display timing signal KHD that is generated in the display timing generator 33 are inputted to the limiter 53 of FIG. 51.

The limiter 53 is a circuit for putting limitation to make the adjusted image data SD1 to SD8 equal to or less than MAXpwm when the adjusted image data SD1 to SD8 exceed MAXpwm. Since different horizontal scanning lines have different MAXpwm values here, the limiter 53 has a limit value that varies among horizontal scanning lines.

The adjusted image data SD1 to SD8 outputted from the limiter 53 are inputted to separate shift registers 5.

(Shift Register, Latch Circuit)

The descriptions on the shift register and latch circuit of the above embodiments apply to the shift register and latch circuit of this embodiment.

In this embodiment, the image data ID1 to IDN and D1 to DN are each 9-bit image data.

The operation timing of the shift registers 5 is determined by a shift clock SCLK sent from the above display timing generator 33.

(Operation Timing of the Respective Components)

Figures 62, 62A:
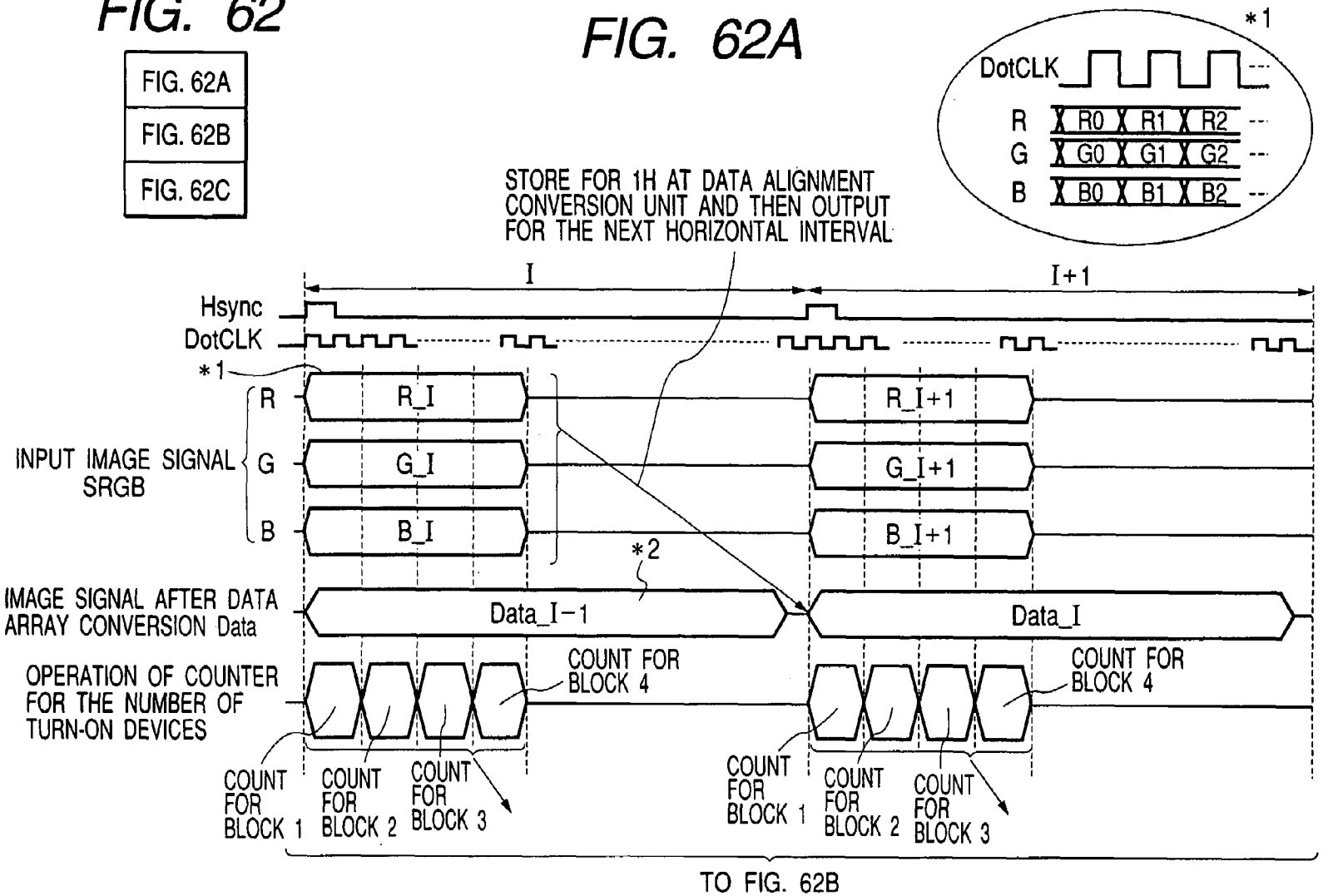
FIG. 62 is comprised of FIGS. 62A, 62B and 62C showing timing charts for the respective components of the display apparatus according to Embodiment 5 of the present invention.
Figure 62B:
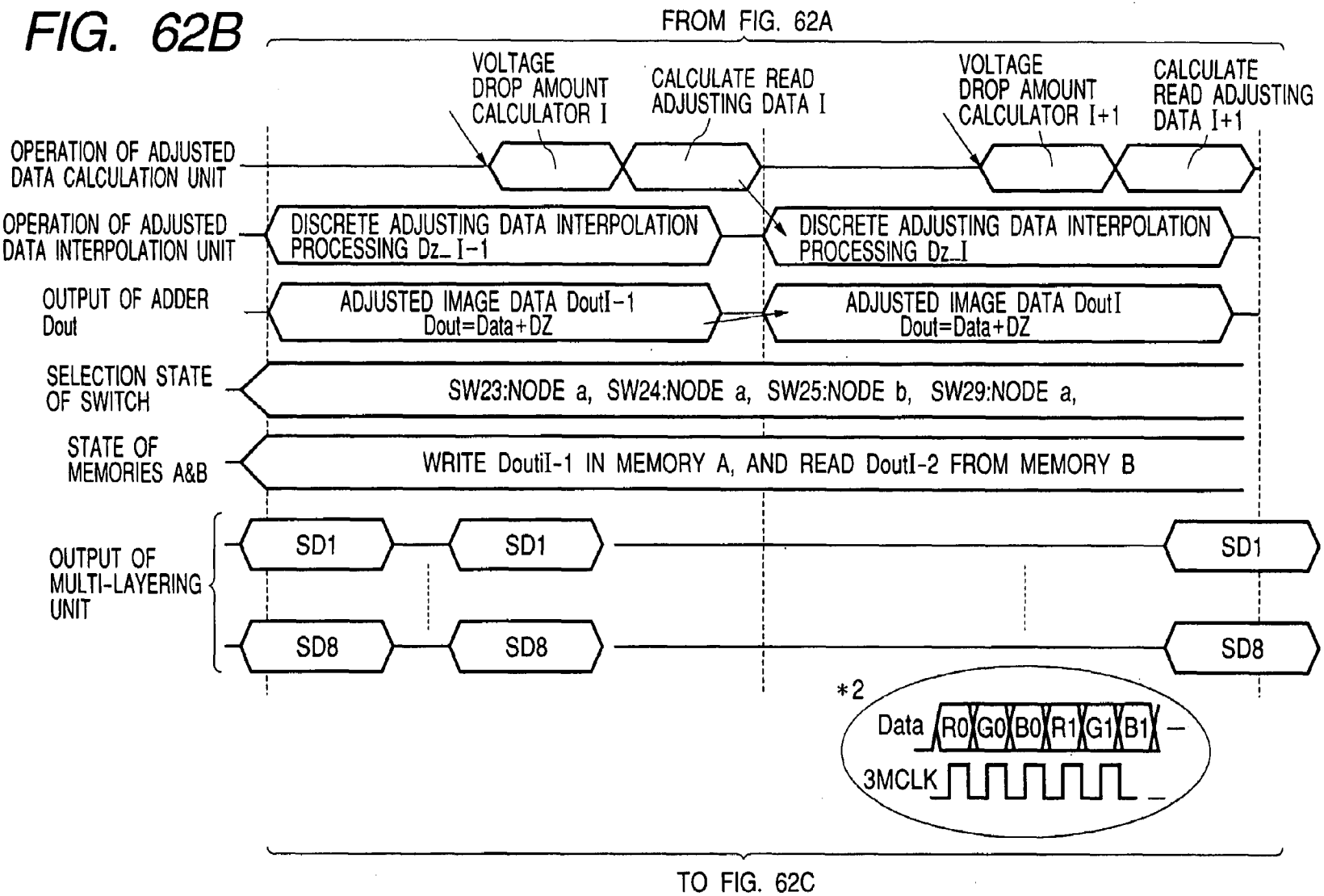
Figure 62C:
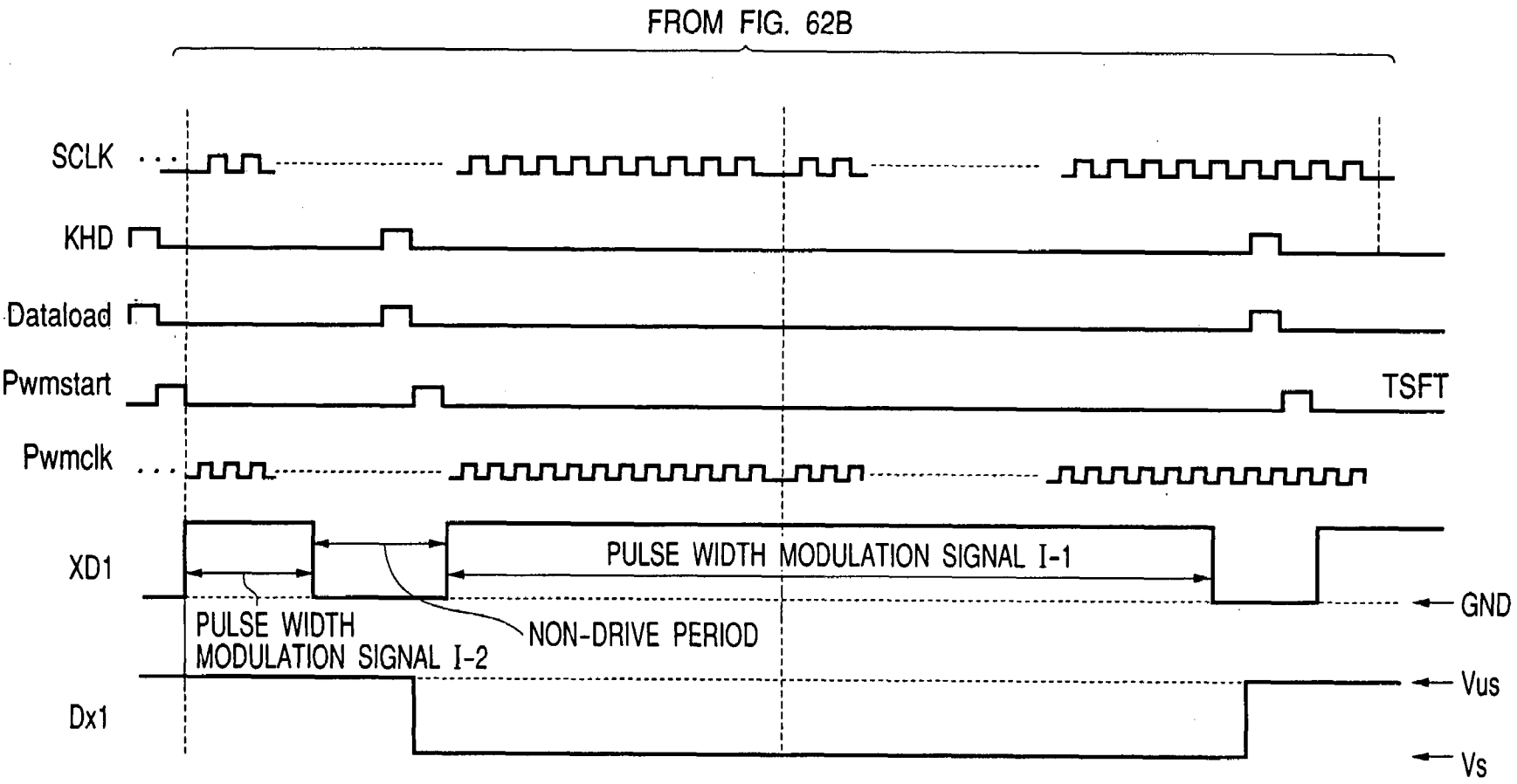
Figure 63:
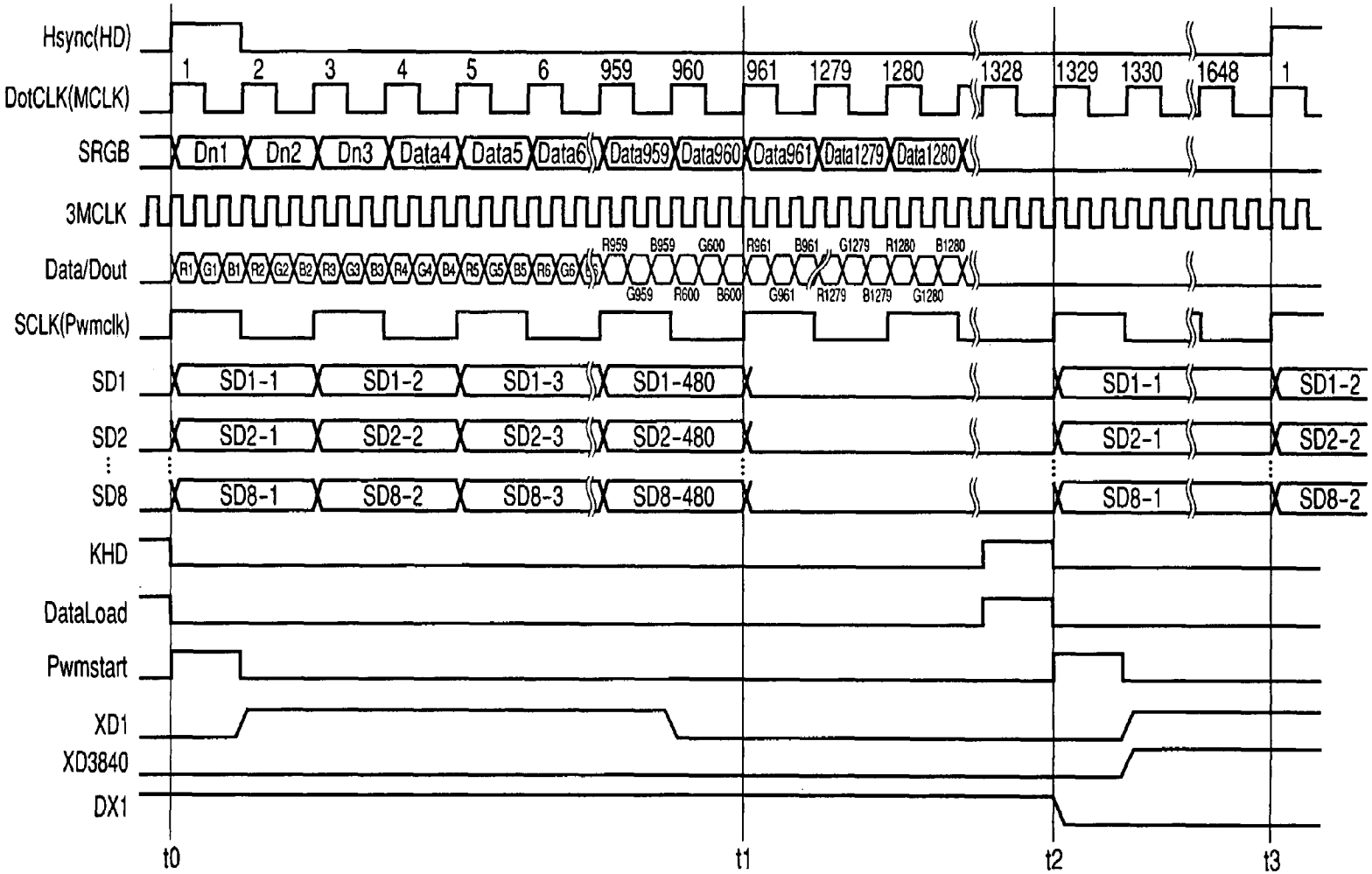
FIG. 63 is a timing chart showing operation timing for the respective components of the display apparatus.

FIGS. 62 and 63 are timing charts showing operation timing of the respective components. FIG. 63 is an enlarged timing chart obtained by partially enlarging FIGS. 62A, 62B and 62C.

In FIGS. 62A, 62B, 62C and 63, Hsync (HD) represents a horizontal synchronization signal, and DotCLK (MCLK) represents a sampling clock created from a horizontal synchronization signal Hsync by a PLL circuit of a timing generator circuit 4. SRGB represents parallel digital image data for R, G, and B sent from a converter circuit 7. 3MCLK is a clock used in data array conversion of parallel data for R, G, and B to convert the parallel data into serial data, and has a frequency 3 times higher than the frequency of DotCLK (MCLK). Data represents image data after data array conversion. Dout represents adjusted image data. SD1 to SD8 represent adjusted image data outputted from the memory A 26 or memory B 27 after being multi-layered. SCLK represents a shift clock for transferring the adjusted image data SD1 to SD8 to the shift registers 5. Dataload represents a load pulse for latching data to a latch circuit 6. Pwmstart represents a start signal for the pulse width modulation described above. A modulation signal XD1 is a pulse width modulation signal supplied to a modulation wiring 1. Dx1 is an example of electric potential supplied to a scanning wiring from a scan drive circuit 2.

KHD is an example of display timing signal for operating a scan drive circuit and a modulation drive circuit in accordance with a display horizontal scanning period determined.

As one horizontal scanning period is started, digital image data R, G, and B are transferred from an input switching circuit. In the drawings, image data inputted during a horizontal scanning period I are denoted by R_I, G_I, and B_I. The image data R_I, G_I, and B_I are multiplied by a gain supplied from the gain table 10. These image data are accumulated in a data array conversion circuit 9 during one horizontal scanning period, and are outputted as digital image data Data_I in a horizontal scanning period I+1 in accordance with a pixel arrangement of the display panel.

R_I, G_I, and B_I are inputted to an adjusted data calculator in the horizontal scanning period I. The adjusted data calculator counts the number of turned-on devices described above and, upon finishing counting, calculates the voltage drop amount.

The calculation of voltage drop amount is followed by calculation of discrete correction data, and the calculation results are stored in a register.

Moving on to the scanning period I+1, an adjusted data interpolator interpolates the discrete correction data to calculate correction data in sync with output of the image data Data_I of the preceding horizontal scanning period from the data array converter. The correction data after interpolation immediately receives gradation number conversion in a gradation number converter 15, and is supplied to an adder 12.

In the adder 12, the image data Data is added and then correction data CDz is added to obtain adjusted image data Dout, which is transferred to a multi-layering unit (the memory A or B). In the drawing, contact points of switches 23, 24, 25, and 29 are set to a, a, b, and a, respectively, and therefore Dout is written in the memory A 26. At this point, Dout of the preceding frame is read out of the memory B 27.

The adjusted image data SD1 to SD8 sent from the memory B 27 in eight layers receive limit processing in a limiter 31, and are transferred to the shift registers 5.

The eight shift registers 5 respectively store the adjusted image data SD1 to SD8 (SD1 to SD8 together make image data of one horizontal scanning period) in response to SCLK, and conduct serial/parallel conversion to output parallel image data ID1 to IDN to the latch circuit 6. The latch circuit 6 latches the parallel image data ID1 to IDN sent from the shift registers 5. This latch operation coincides with rising of Dataload, which is in sync with a display timing signal KHD. The latched image data D1 to DN are transferred to the pulse width modulation circuit 8.

The pulse width modulation circuit 8 outputs a pulse width modulation signal having a pulse width according to the latched image data. In this embodiment, display control of each horizontal scanning line is based on a display timing signal KHD instead of a horizontal synchronization signal HD. Accordingly, a pulse width modulation signal I−1 is sometimes longer than one horizontal scanning period as shown in the drawing.

In this way, voltage drop in a scanning wiring can be corrected and degradation of display image caused by voltage drop can be avoided.

In addition, correction data is obtained through discrete computation and data between two points for which discrete calculation has been made is obtained by interpolation. Therefore correction data can be calculated very easily, and with a very simple hardware.

Furthermore, this embodiment is capable of both correcting voltage drop in a scanning wiring and displaying an image at a luminance of when the resistance of the scanning wiring is 0 Ω (displaying at a luminance higher than the luminance of when voltage drop is caused by the scanning wiring resistance) by suitably allotting display scanning periods to the respective scanning wirings.

Embodiment 6

Figure 64:
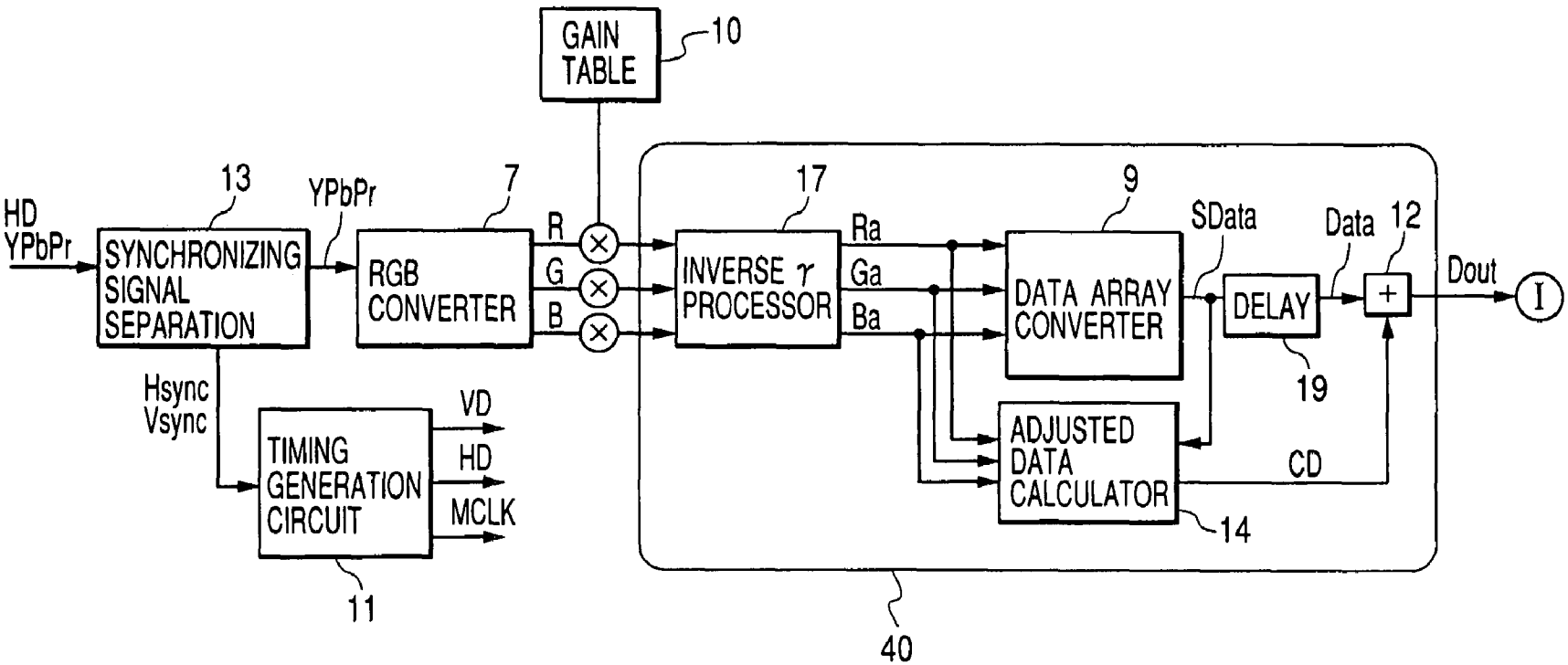
FIG. 64 is a block diagram showing an outline of a signal processing circuit of a display apparatus according to Embodiment 6 of the present invention.

FIG. 64 shows Embodiment 6 of the present invention. In Embodiment 5, RGB parallel image data Ra, Ga, and Ba subjected to reverse γ conversion processing in the reverse γ processor 17 are multiplied by gains. In this embodiment, image data R, G, and B are multiplied by gains before reverse γ conversion processing. The rest of this embodiment regarding the structure and operation is identical with Embodiment 5.

A gain table 10 is a circuit for multiplying image signals R, G, and B outputted from an RGB converter 7 by given gains. The gain is not a fixed value but is set to different values in accordance with the scanning wiring number of the image signal.

Specifically, the gain table 10 has a table in which a scanning wiring number is associated with a gain (GAIN) similar to Embodiment 5. This table is set such that a horizontal scanning line nearer to the center of the screen has a larger gain and a horizontal scanning line nearer to the top or bottom of the screen has a smaller gain. As a result, adjusted image data receives a gain conversion that forms a convex pattern in the graph in accordance with the display horizontal scanning period of the horizontal scanning line. Therefore adjusted image data for a horizontal scanning line nearer to the top or bottom of the screen is set to a smaller value and is contained within the display horizontal scanning period.

However, it is preferable to set a rather larger gain compared to Embodiment 5 since image data R, G, and B before reverse γ conversion processing are non-linear.

This structure can provide the same effect as the one obtained in Embodiment 5.

Embodiment 7

Figure 65:
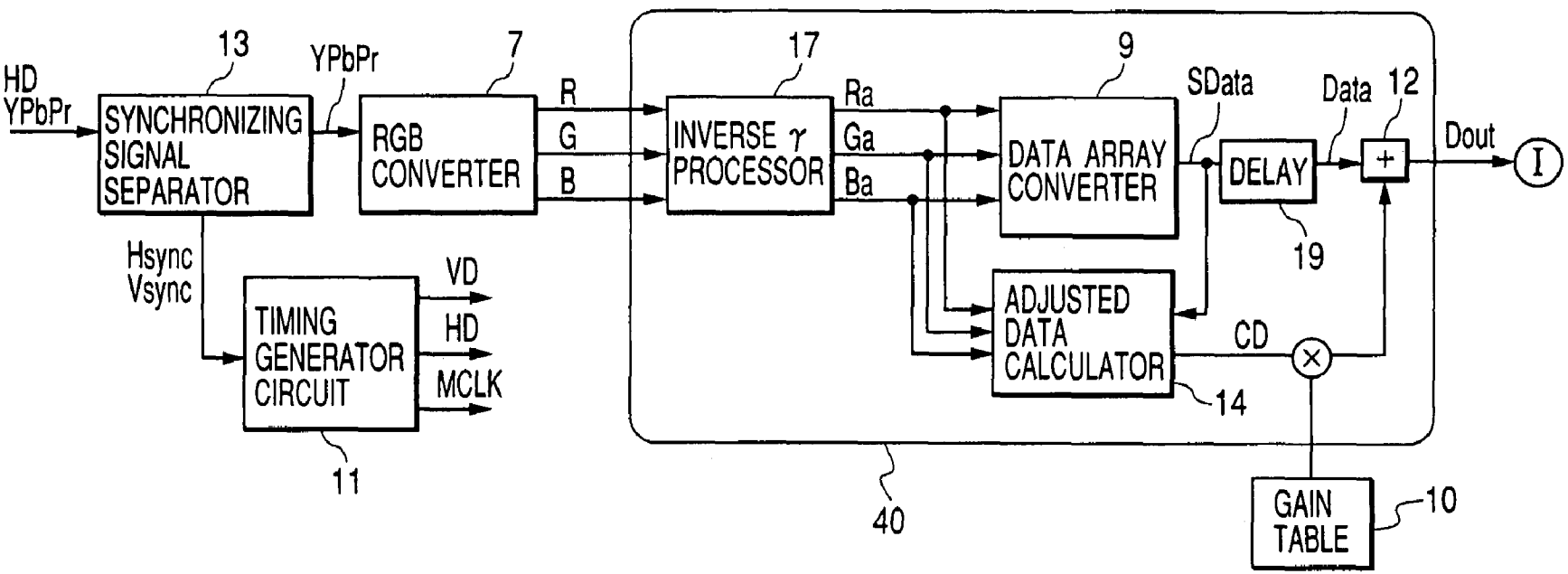
FIG. 65 is a block diagram showing an outline of a signal processing circuit of a display apparatus according to Embodiment 7 of the present invention.

FIG. 65 shows Embodiment 7 of the present invention. In Embodiment 5, image data are multiplied by gains. In this embodiment, correction data for correcting image data is multiplied by gains. The rest of this embodiment regarding the structure and operation is identical with Embodiment 5.

A gain table 10 is a circuit for multiplying the correction data CD outputted from the adjusted data calculator 14 by given gains. The gain is not a fixed value but is set to different values in accordance with the scanning wiring number of the image signal.

Specifically, the gain table 10 has a table in which a scanning wiring number is associated with a gain (GAIN) similar to Embodiment 5. This table is set such that a horizontal scanning line nearer to the center of the screen has a larger gain and a horizontal scanning line nearer to the top or bottom of the screen has a smaller gain. As a result, the correction data CD receives a gain conversion that forms a convex pattern in the graph. Therefore correction data for a horizontal scanning line nearer to the top or bottom of the screen is set to a smaller value.

Therefore adjusted image data Dout, which is obtained by adding correction data after gain conversion to image data Data outputted from a delay circuit 19, for a horizontal scanning line nearer to the top or bottom of the screen is limited to a smaller value and is contained within the display horizontal scanning period.

This structure can provide the same effect as the one obtained in Embodiment 5.

Embodiment 8

Figure 66:
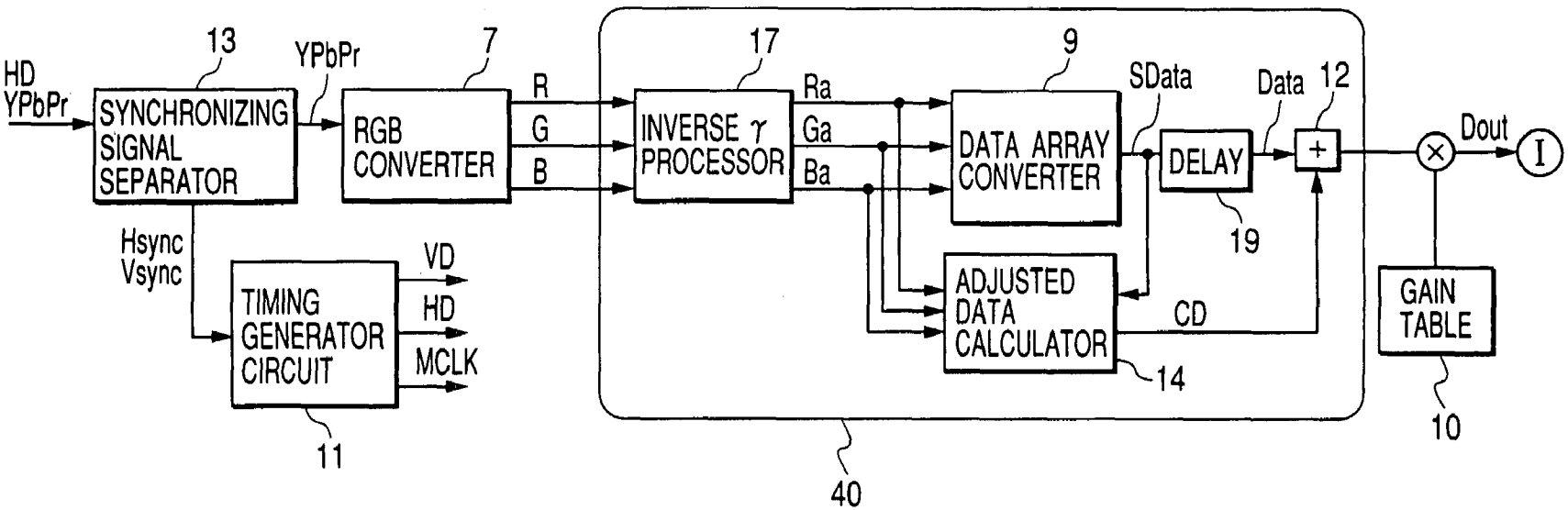
FIG. 66 is a block diagram showing an outline of a signal processing circuit of a display apparatus according to Embodiment 8 of the present invention.

FIG. 66 shows Embodiment 8 of the present invention. In Embodiment 5, image data are multiplied by gains. In this embodiment, adjusted image data after the correction is multiplied by gains. The rest of this embodiment regarding the structure and operation is identical with Embodiment 5.

A gain table 10 is a circuit for multiplying adjusted image data Dout outputted from the adder 12 by given gains. The gain is not a fixed value but is set to different values in accordance with the scanning wiring number of the image signal.

Specifically, the gain table 10 has a table in which a scanning wiring number is associated with a gain (GAIN) similar to Embodiment 5. This table is set such that a horizontal scanning line nearer to the center of the screen has a larger gain and a horizontal scanning line nearer to the top or bottom of the screen has a smaller gain. As a result, adjusted image data Dout receives a gain conversion that forms a convex pattern in the graph in accordance with the display horizontal scanning period of the horizontal scanning line. Therefore adjusted image data for a horizontal scanning line nearer to the top or bottom of the screen is set to a smaller value and is contained within the display horizontal scanning period.

This structure can provide the same effect as the one obtained in Embodiment 5.

Embodiment 9

In the above embodiments, a gain table in which a scanning wiring number is associated with gain (GAIN) is used to perform convex pattern gain conversion on image data, correction data, or adjusted image data in accordance with the display scanning period. It is also preferable to use a limiter instead of the gain table.

In this case, the limit value of the limiter is not fixed but varies depending on the scanning wiring number. For instance, the limit value is set such that a horizontal scanning line nearer to the center of the screen has a larger limit value and a horizontal scanning line nearer to the top or bottom of the screen has a smaller limit value. Then adjusted image data for a horizontal scanning line nearer to the top or bottom of the screen is limited to a smaller value in accordance with the display horizontal scanning period of the horizontal scanning line, and is contained within the display horizontal scanning period.

Figure 67:
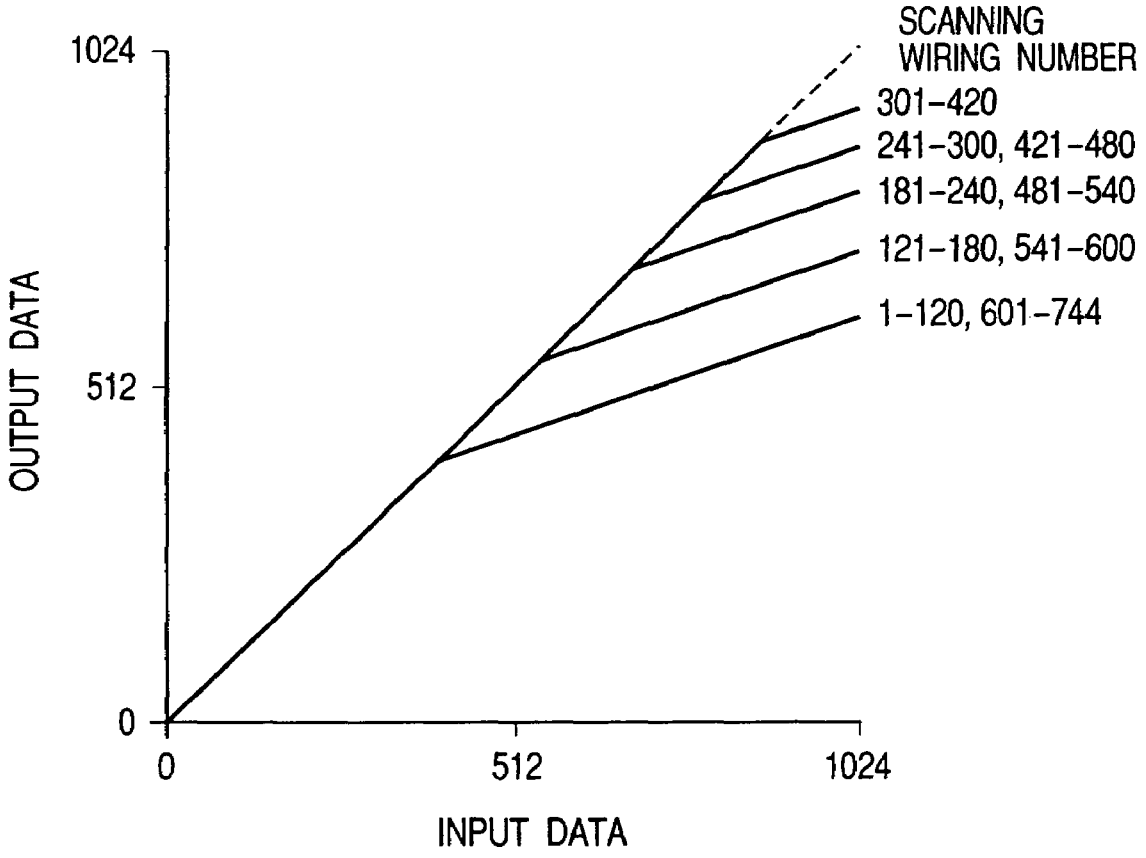
FIG. 67 is an explanatory diagram showing a characteristic of a limiter used in Embodiment 9 of the present invention.

It is more desirable if the limiter has a limiter characteristic as the one shown in FIG. 67. If the limiter has this characteristic to make the limit value change gently in accordance with the value of input data, then a high quality display image can be obtained without degrading tone reproduction of image data. The limiter may have other characteristics than the one shown in FIG. 67 as long as the gradient becomes gentler at some point. Accordingly, the gradient and the point at which the gradient is changed can be set to suit individual cases.

As described above, display apparatus according to Embodiments 5 through 9 can display a high quality image while correcting voltage drop in a scanning wiring accurately without causing lowering in luminance of the entire display image.

The drive control method of the present invention which is described in the above can be carried out by an integrated circuit that is integrated into one chip with an image signal processing circuit and the like. In this case, a frame memory may be excluded from the integration. The drive control method for this case is preferably soft IP of RTL such as VHDL that can be logically synthesized with other IP cores as an IP core (design property).

Alternatively, the drive control method of the present invention may be carried out as a program loaded and executed in a microcomputer.

Embodiments 5, 6, 8, and 9 show examples in which a large amount of current flows in a scanning wiring and voltage drop of a scanning wiring is corrected. In an FED where almost no voltage drop takes place in a scanning wiring, the voltage drop correction unit 40 of Embodiments 5, 6, 8, and 9 in FIGS. 50, 64, and 66 may be composed simply of the inverse γ processor 17, the data array converter 9, and a multiplier for multiplying an output of the array converter 9 by a coefficient equal to or larger than 1 to output the result.

Similar to Embodiments 5, 6, 8, and 9 where the voltage drop correction unit 40 generates adjusted image data larger than input image data, the multiplier outputs data larger than input image data by multiplying an output of the array converter 9 by a coefficient equal to or larger than 1. Then the scanning period is determined in accordance with the pulse width of a modulation signal, thereby increasing the luminance in accordance with the coefficient equal to or larger than 1.

If data in the gain table 10 is multiplied by the coefficient equal to or larger than 1 in advance, the multiplier for multiplying an output of the array converter 9 to output the result can be omitted from this structure.

An embodiment described below is a display apparatus comprised of:

a display having a plurality of display devices wired with a plurality of row-directional wirings and a plurality of column-directional wirings to form a matrix pattern;

a scan drive circuit for applying a scan selection signal to one of the plural row-directional wirings for horizontal scan, and switching from one selection row-directional wiring from another for vertical scan;

a modulation drive circuit for inputting a modulation signal according to image data to the respective column-directional wirings; and a frame memory capable of storing at least one frame of image data inputted, and the display apparatus further comprises a controller for controlling the scan drive circuit and the modulation drive circuit following an operation timing calculated in accordance with inputted image data such that the selection period is set long for a row-directional wiring corresponding to a portion of large image data level whereas the selection period is set short for a row-directional wiring corresponding to a portion of small image data level.

It is also preferable if the controller has a multiplication measure for multiplying the image data by a calculated coefficient to create new image data following the operation timing, and the modulation drive circuit drives the column-directional wirings in accordance with the new image data.

It is also preferable if the modulation drive circuit is a pulse width modulation circuit for counting reference clocks (PCLK) with a pulse width according to image data to drive the column-directional wirings, and the controller has an oscillator for generating the reference clocks (PCLK) with a cycle according to a calculated coefficient following the operation timing.

It is also preferable if the apparatus further comprises a detector of row maximum value for detecting the maximum value of the luminance level of input image data for each row, and the operation timing is calculated in accordance with an output of the detector of row maximum value.

It is also preferable if the apparatus further comprises a detector of row maximum value for detecting the maximum value of the luminance level for each row and a detector of column maximum value for detecting the maximum value of the luminance level for each column, and the operation timing is calculated in accordance with an output of the detector of row maximum value and with an output of the detector of column maximum value.

It is also preferable if the controller is provided with: a memory reference measure for reference and rewriting of image data accumulated in the frame memory; and an image signal rewriting measure for multiplying the image data by a calculated coefficient to generate new image data following the operation timing and replace the content of the frame memory with the new image data through rewriting, and the modulation drive circuit drives the column-directional wirings in accordance with the new image data.

It is also preferable if the controller calculates for each row the maximum value of image data read by the frame memory and determines the coefficient in accordance with the maximum value obtained.

It is also preferable if the controller calculates for each row the maximum value of image data read by the frame memory as well as the maximum value of image data read by the frame memory for each column and determines the coefficient in accordance with the maximum values obtained.

It is also preferable if an upper limit value is set for the coefficient that is a multiplier factor in multiplication of the image data.

In the case where the number of the row-directional wirings is set to m, the number of the column-directional wirings is set to n, the value of each pixel of the image data is given as L(x, y), the upper limit value of the coefficient that is a multiplier factor in multiplication of the image data is given as Al, the lower limit of the maximum value of the image data in each row or column is given as Lmin, and a horizontal scanning period of an image signal inputted is given as Th, the controller obtains maximum values LHm(1) to LHm (m) of image data level for the respective rows by an expression $$LHm(y)=\mathrm{MAX}\{L(1, y) \text{ to } L(n, y), Lmin\}$$

the controller obtains an average value LHa of LHm by an expression $$LHa=\Sigma\{LHm(1) \text{ to } LHM(m)\}/m$$

the controller obtains a horizontal image data level coefficient Ah by an expression $$Ah=1/LHa$$

the controller obtains maximum values LVm(1) to LVm (n) of image data level for the respective columns by an expression $$LVm(x)=\mathrm{MAX}\{L(x, 1) \text{ to } L(x, m), Lmin\}$$

the controller obtains an average value LVa of LVm by an expression $$LVa=\Sigma\{LVm(1) \text{ to } LVm(n)\}/n$$

the controller obtains a vertical image data level coefficient Av by an expression $$Av=1/LVa$$

the controller obtains an image data level coefficient Am from minimum values of the respective image data level coefficients by an expression $$Am=\mathrm{MIN}\{Ah, Av, Al\}$$

and the controller rewrites and replaces the value of every pixel with a value multiplied by the image data level coefficient Am. Then it is also preferable if the controller further obtains horizontal scanning periods Thi(1) to Thi(m) to be allotted to the respective scanning wirings by an expression $$Thi(y)=Th\cdot LHm(y)/LHa$$

According to this method, an image can be displayed without lowering the image quality when the image displayed is a bright straight rod rotating within the screen against dark background.

In the case where the number of the row-directional wirings is set to m, the number of the column-directional wirings is set to n, each pixel of the image data is given as L(x, y), the upper limit of the coefficient that is a multiplier factor in multiplication of the image data is given as Al, and the lower limit value of the maximum value of the image data in each row or column is given as Lmin, the controller obtains maximum values LHm(1) to LHm (m) of image data level for the respective rows by an expression $$LHm(y)=\mathrm{MAX}\{L(1, y) \text{ to } L(n, y), Lmin\}$$

the controller obtains an average value LHa of LHm by an expression $$LHa=\Sigma\{LHm(1) \text{ to } LHM(m)\}/m$$

the controller obtains a horizontal image data level coefficient Ah by an expression $$Ah=1/LHa$$

the controller obtains an image data level coefficient Am from minimum values of the respective image data level coefficients by an expression $$Am=\mathrm{MIN}\{Ah, Al\}$$

and the controller rewrites and replaces the value of every pixel with a value multiplied by the image data level coefficient Am. Then it is also preferable if the controller further obtains horizontal scanning periods Thi(1) to Thi(m) to be allotted to the respective scanning wirings by an expression $$Thi(y)=Th\cdot LHm(y)/LHa$$

It is also preferable if a one-chip integrated circuit, or a plurality of integrated circuit chips carry out some or all of functions of the controller provided in the above image display apparatus. Specifically, the integration includes or excludes the frame memory and therefore it is also preferable if this drive control method is soft IP of RTL such as VHDL that can be logically synthesized with other IP cores as an IP core.

It is also preferable if the controller of the above image display apparatus is an image display program.

In this case, it is also preferable if the image display program is stored in a recording medium that can be read by a computer.

Embodiment 10

Figure 68:
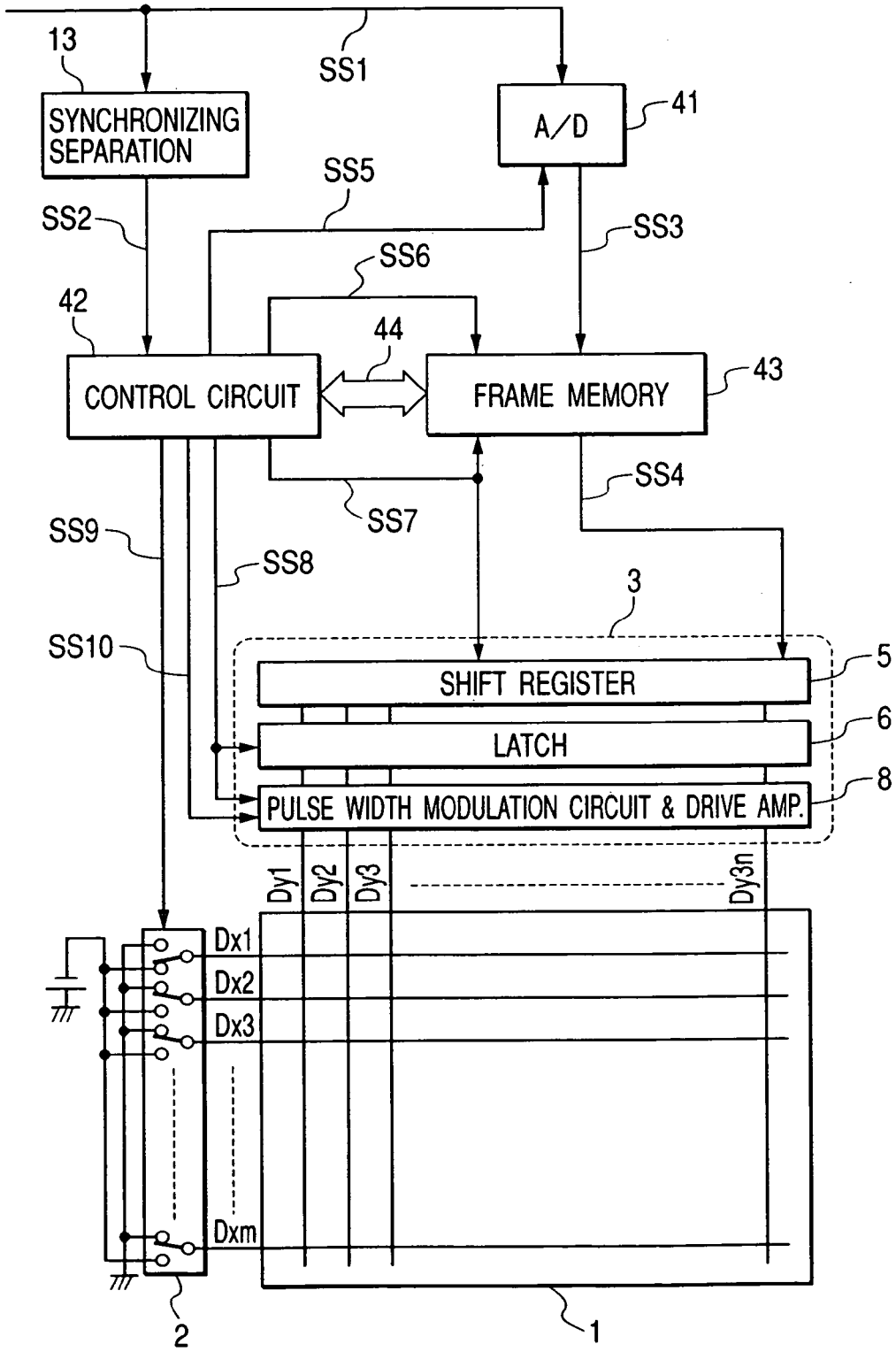
FIG. 68 is a block diagram showing an outline of a display apparatus according to Embodiment 10 of the present invention.

FIG. 68 shows a schematic structure of display apparatus according to Embodiment 10 of the present invention.

Denoted by 1 is a display panel serving as an image display unit. In the display panel, scanning wirings Dx1 to Dxm that are row-directional wirings and modulation wirings Dy1 to Dy3*n* that are column-directional wirings are arranged to form a matrix pattern. A not-shown display device is placed in each of the intersections of the wirings and the display panel has m rows×3n columns of display devices.

Pixels composed of these display devices are arranged such that a sequence of red pixel, green pixel, and blue pixel are repeated in the row direction. One red pixel, one green pixel, and one blue pixel, three pixels in total, together make a full color unit pixel. Accordingly, the display panel 1 has a matrix of m rows×n columns for each color and is provided with m×n full color unit pixels.

Reference symbol 2 denotes a scan drive circuit as a scan drive measure. 3 denotes a modulation drive circuit as a modulation drive measure. The modulation drive circuit 3 is composed of a shift register 5, a latch circuit 6, and a modulation circuit 8 for modulation such as pulse width modulation and voltage amplitude modulation. The modulation circuit 8 may have a drive amplifier at its output stage.

Denoted by 13 is a synchronizing separation-circuit. 41 denotes an AD converter. 42 represents a control circuit composed of a microcomputer, a logic circuit, or the like. 43 denotes a frame memory for accumulating one frame of image signals. 44 denotes a memory bass for enabling the control circuit 42 to read the content of the frame memory 43.

SS1 represents an analog image signal inputted to the apparatus. SS2 is a synchronization signal separated from the analog image signal SS1. SS3 represents a digital image signal (image data) to be written in the frame memory 43. SS4 represents an image signal (image data) read out of the frame memory 43.

SS5 represents a conversion timing signal to be supplied to the AD converter 41. SS6 represents a writing timing signal for writing in a frame memory 7. SS7 represents a reading timing signal for reading out of the frame memory 7.

SS8 represents a modulation control signal for controlling the operation of the modulation drive circuit 3. SS9 is a scan control signal for controlling the operation of the scan drive circuit 2. SS10 is a PWM clock to serve as an operation reference of a modulation circuit 15.

A synchronization signal SS2 extracted by a synchronizing separation circuit 4 from an analog image signal SS1 that has been inputted to the apparatus is inputted to the control circuit 42. A horizontal scanning period of the synchronization signal SS2 extracted here is referred to as Th.

The control circuit 42 generates various control signals SS6 to SS9 from the synchronization signal SS2. The control circuit also reads and writes the content of the frame memory 43 through the memory bass 44.

The AD converter 41 receives the analog image signal SS1 following a conversion timing signal SS5 and converts the analog signal into a digital signal to output a digital image signal SS3 that is to be written in the frame memory.

The frame memory 43 has a capacitance large enough to store one frame of digital image signals. The frame memory receives the digital image signal SS3 following a writing timing signal SS6, accumulates one frame of digital image signals, and outputs a digital image signal SS4 following a reading timing signal SS7.

The image data level of each color of pixels of one frame of image signals accumulated in the frame memory 43, namely, values corresponding to luminance levels of the image signals inputted are hereinafter referred to as Lr(1, 1) to Lr(n, m), Lg(1, 1) to Lg(n, m), and Lb(1, 1) to Lb(n, m).

In the description below, it is assumed that the image data level is normalized to 0 to 1 when the data is converted by the AD converter 41.

Figure 69:
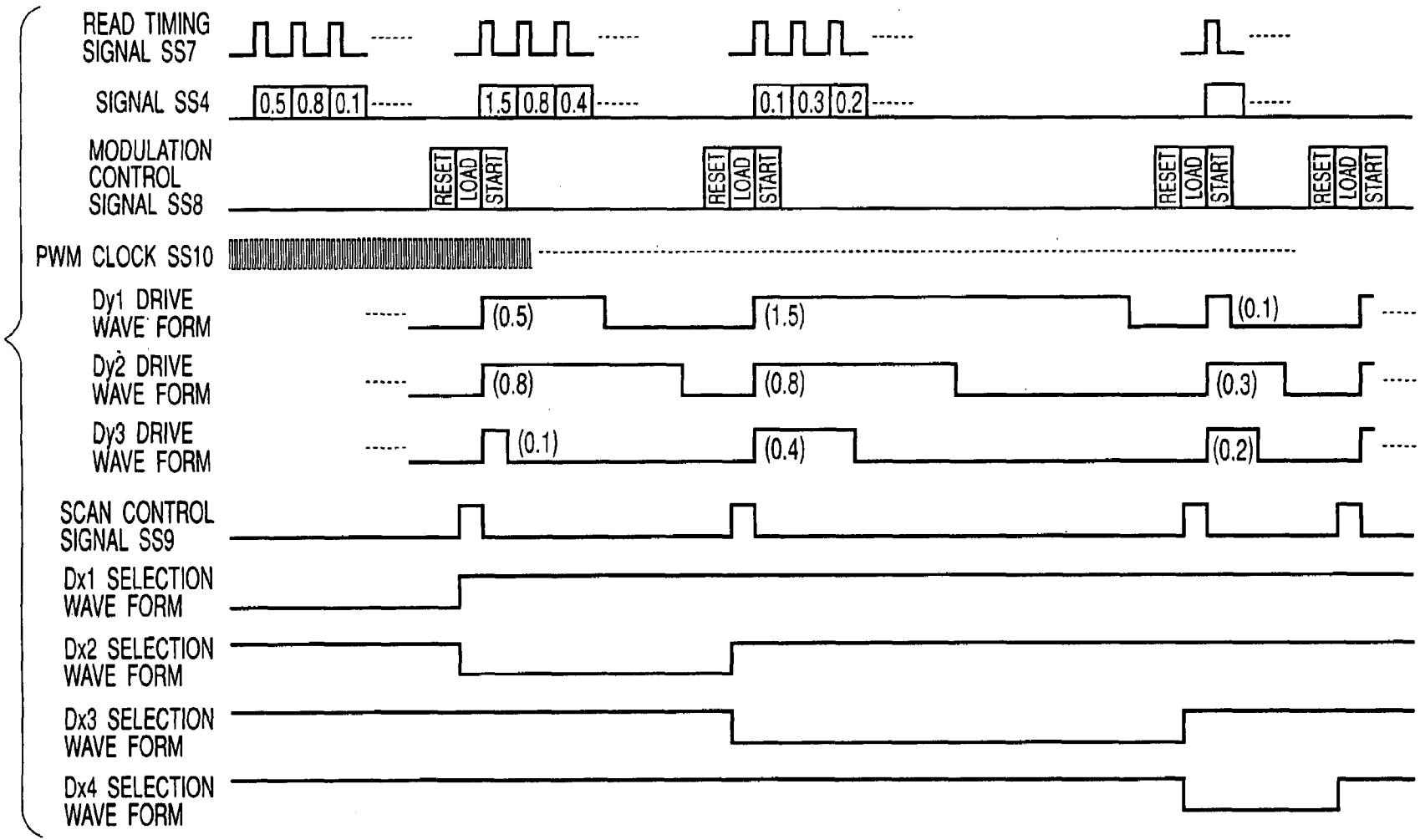
FIG. 69 is a timing chart for the respective components of the display apparatus according to Embodiment 10 of the present invention.

Operations of the scan drive circuit 2 and modulation drive circuit 3 to drive the display panel 1 will be described. A timing chart thereof is shown in FIG. 69.

The control circuit generates a timing signal (scan control signal) SS9 for determining the display horizontal scanning period and a reading timing signal SS7, as well as a modulation control signal SS8 and a PWM clock SS10.

The scan drive circuit 2 drives the display panel 1 by selecting the scanning wirings of the display panel 1 in order in accordance with the scan control signal SS9. The selection period of a scanning wiring is not fixed, and the scanning wirings can be driven at a desired length and interval using a scan control signal SS9.

The modulation circuit 3 inputs the digital image signal SS4 in order to the shift register 5 in sync with the reading timing signal SS7. The image data are held in the latch circuit 6 in response to a LOAD signal of the modulation control signal SS8. With a START signal of the modulation control signal SS8, the shift register outputs a modulation signal that has a pulse width according to the image data held in the latch 6 and has a given voltage amplitude to a modulation wiring of the display panel 1 while using the PWM clock SS10 as reference. The display panel 1 is thus driven by the modulation signal.

The modulation circuit 8 outputs a modulation signal for a period of time equal to the horizontal scanning period Th when the image signal SS4 is of level 1. A signal of levels 0 to 2 can be inputted as the image signal SS4, and a modulation signal is kept outputted during a period corresponding to 2Th if the image signal SS4 is of level 2.

This mechanism can be obtained by using as the modulation circuit 8 a counter capable of dealing with an image signal SS4 of level 0 to level 2 and by forcibly resetting the counter for each scanning wiring using a RESET signal of the modulation control signal SS8.

Next, a method of determining the timing of scan control signal SS9 outputted from the control circuit 42 will be described. The flow of this processing is shown in FIG. 70.

In the following description, Al represents an image data level coefficient limit value. This is a ratio of the maximum value of the signal SS3 outputted from the AD converter and the maximum value of the signal SS4 that can be inputted to the modulation drive circuit 3. Here, Al is 2.

Lmin represents a minimum image data level. This is a value obtained by converting a time required to input one line of image signals SS4 to the modulation drive circuit 3 into an image signal level. Lmin is used to prevent a phenomenon in which a horizontal scanning period becomes too short and the next scan is started before one line of image signals SS4 are inputted to the modulation drive circuit 3.

Figure 70:
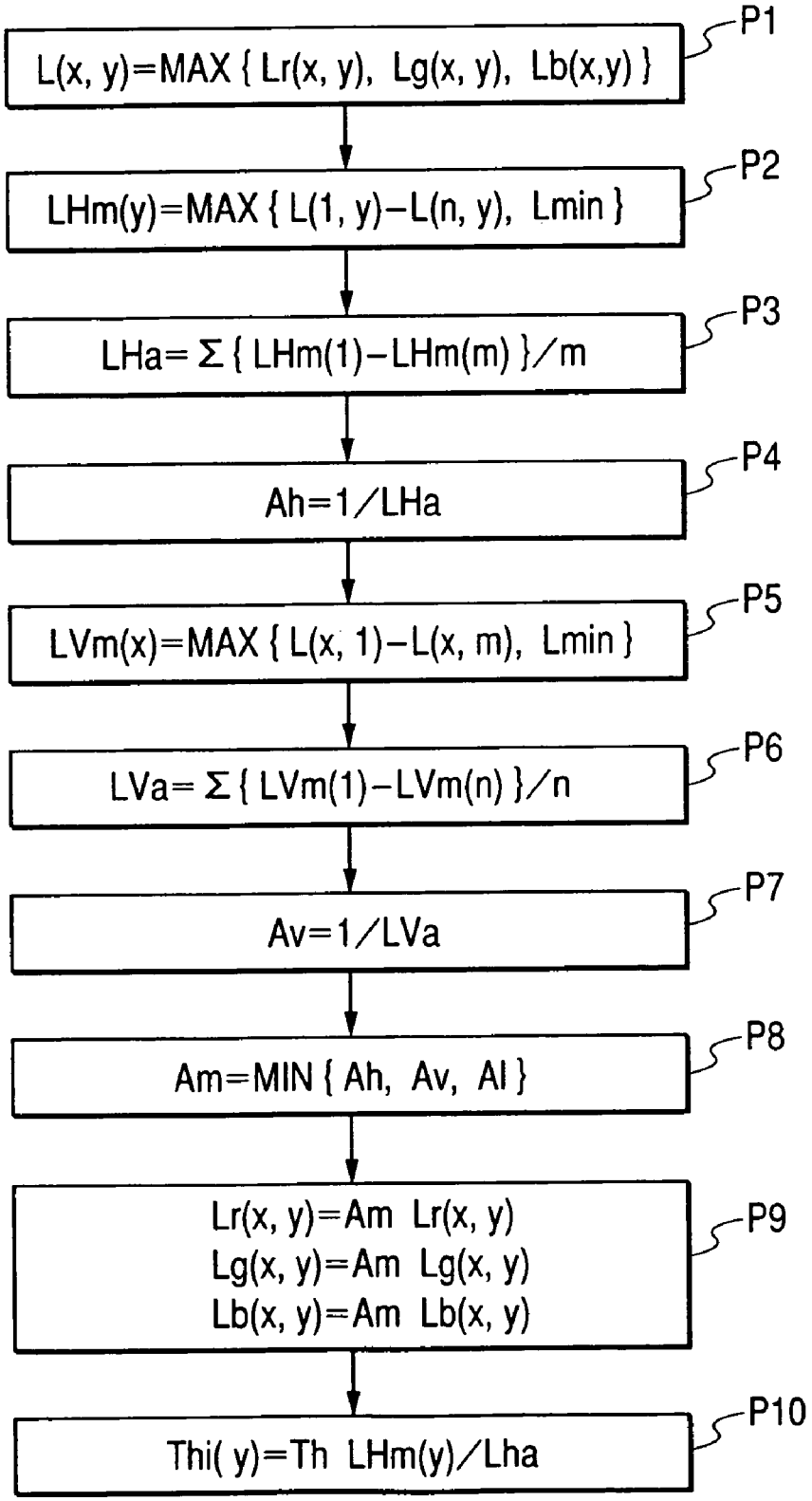
FIG. 70 is a flow chart of arithmetic processing.

In FIG. 70, maximum values L(1, 1) to L(n, m) of the image data level of the respective pixels are obtained in Step P1 by an expression $$L(x, y)=\mathrm{MAX}\{Lr(x, y), Lg(x, y), Lb(x, y)\}$$

Maximum values LHm(1) to LHm(m) of the image data level of the respective rows are obtained in Step P2 by an expression $$LHm(y)=\mathrm{MAX}\{L(1, y) \text{ to } L(n, y), Lmin\}$$

An average value LHa of LHm is obtained in Step P3 by an expression $$LHa=\Sigma\{LHm(1) \text{ to } LHM(m)\}/m$$

A horizontal image data level coefficient Ah is obtained in Step P4 by an expression $$Ah=1/LHa$$

Maximum values LVm(1) to LVm(n) of image data level for the respective columns are obtained in Step P5 by an expression $$LVm(x)=\mathrm{MAX}\{L(x, 1) \text{ to } L(x, m), Lmin\}$$

An average value LVa of LVm is obtained in Step P6 by an expression $$LVa=\Sigma\{LVm(1) \text{ to } LHM(m)\}/n$$

A vertical image data level coefficient Av is obtained in Step P7 by an expression $$Av=1/LVa$$

An image data level coefficient Am from minimum values of the respective image data level coefficients is obtained in Step P8 by an expression $$Am=\mathrm{MIN}\{Ah, Av, Al\}$$

The multiplier rewrites and replaces the value of every pixel with a value multiplied by the image data level coefficient Am in Step P9 by an expression $$Lr(x, y)=Am\cdot Lr(x, y)$$

$$Lg(x, y)=Am\cdot Lg(x, y)$$

$$Lb(x, y)=Am\cdot Lb(x, y)$$

Horizontal scanning periods Thi(1) to Thi(m) to be allotted to the respective scanning wirings are obtained in Step P10 by an expression $$Thi(y)=Th\cdot LHm(y)/LHa$$

wherein Th is a horizontal scanning period of an image signal inputted.

Since the image data level coefficient limit value Al is provided, the sum of calculated horizontal scanning periods Thi(1) to Thi(m) is shorter than one frame period in some cases. However, the shortage can be adjusted by extending the vertical blanking period, and therefore no particular consideration is put on the matter in this step.

The sum of horizontal scanning periods Thi(1) to Thi(m) to be allotted to the respective scanning wirings is m·Th, which is a given value. This means that the horizontal scanning periods Thi to be allotted to the respective scanning wirings are calculated without changing the sum of the horizontal scanning periods of image signals inputted. An upper limit value may be set for the selection period distributed among scanning wirings without changing the sum of the horizontal scanning periods of image signals inputted.

As described above, the horizontal scanning periods Thi to be allotted to the respective scanning wirings are calculated to control the scan drive circuit 2 and the modulation drive circuit 3 following the timing based on the obtained Thi. This makes it possible to adjust the luminance automatically so that an overall bright image is displayed with normal brightness and a partially bright image or an overall dark image is displayed more brightly. In other words, the selection period of each scanning line is adjusted in accordance with an image inputted, so that pixels on a scanning wiring line of a bright part of the image emit light for a longer period and pixels on a scanning wiring line of a dark part of the image emit light for a shorter period. As a result, the length of one frame period is effectively utilized to bring the image display apparatus to its fullest capacity. It is thus possible to provide display apparatus having high peak luminance.

Embodiment 11

In Embodiment 10, calculation of the vertical image data level coefficient Av may be omitted.

In this case, the calculations in Steps P5 to P7 are omitted and the calculation in Step P8 is modified to Am=MIN{Ah, Al}. The rest of this embodiment regarding the apparatus structure and calculation steps is the same as Embodiment 10.

Figure 71:
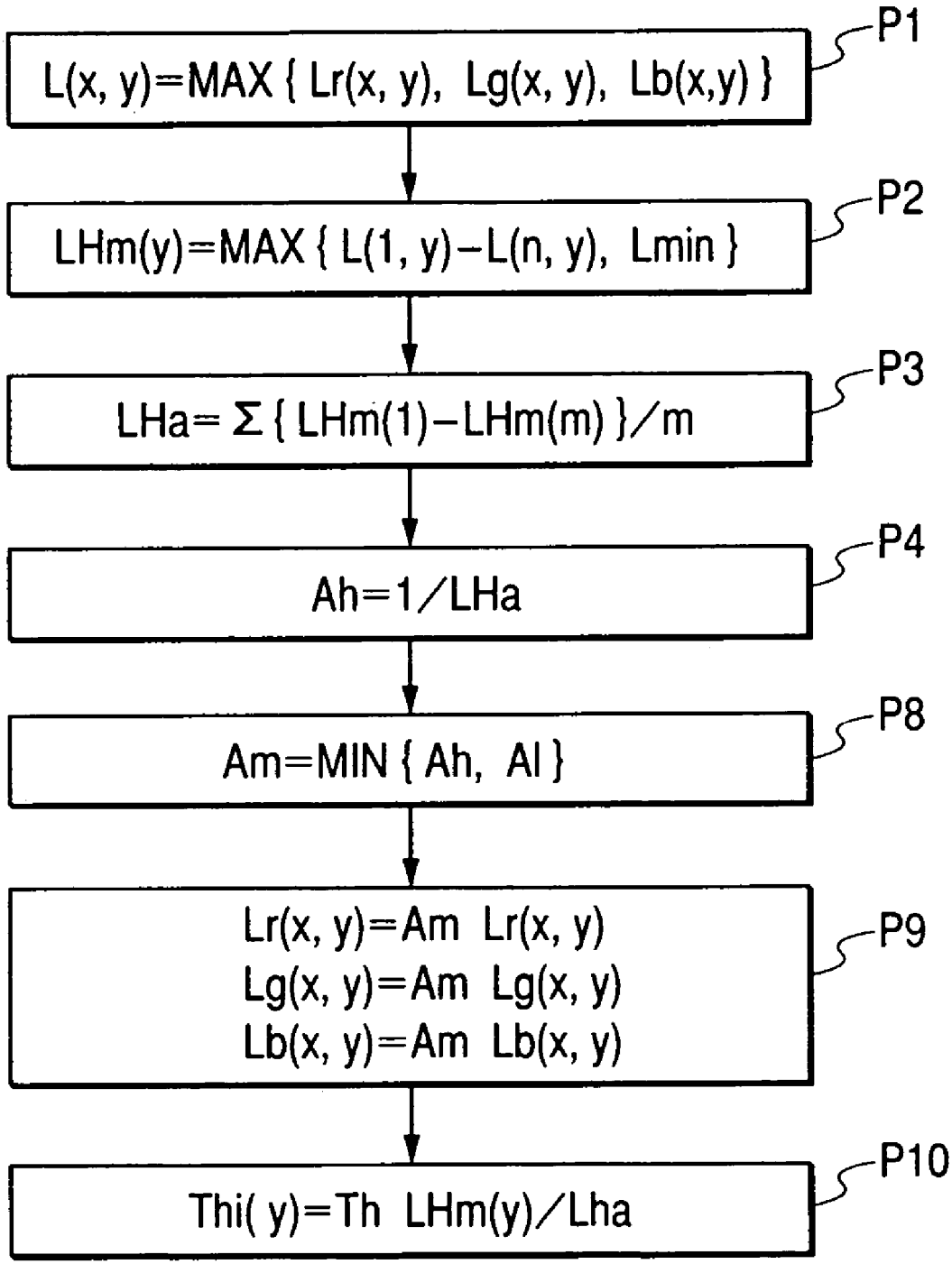
FIG. 71 is an arithmetic processing flow chart according to Embodiment 11 of the present invention.

FIG. 71 is a flow chart of calculations in this embodiment.

When this embodiment is employed, a luminance change tends to become unstable as the input image is switched from one to another. However, this embodiment has less calculation load and therefore is effective when the importance is put on cost of the apparatus.

Embodiment 12

If some of calculation steps carried out by the control circuit 42 in Embodiment 10 are conducted by hardware, the structure of Embodiment 10 can be employed with almost no modification.

Figure 72:
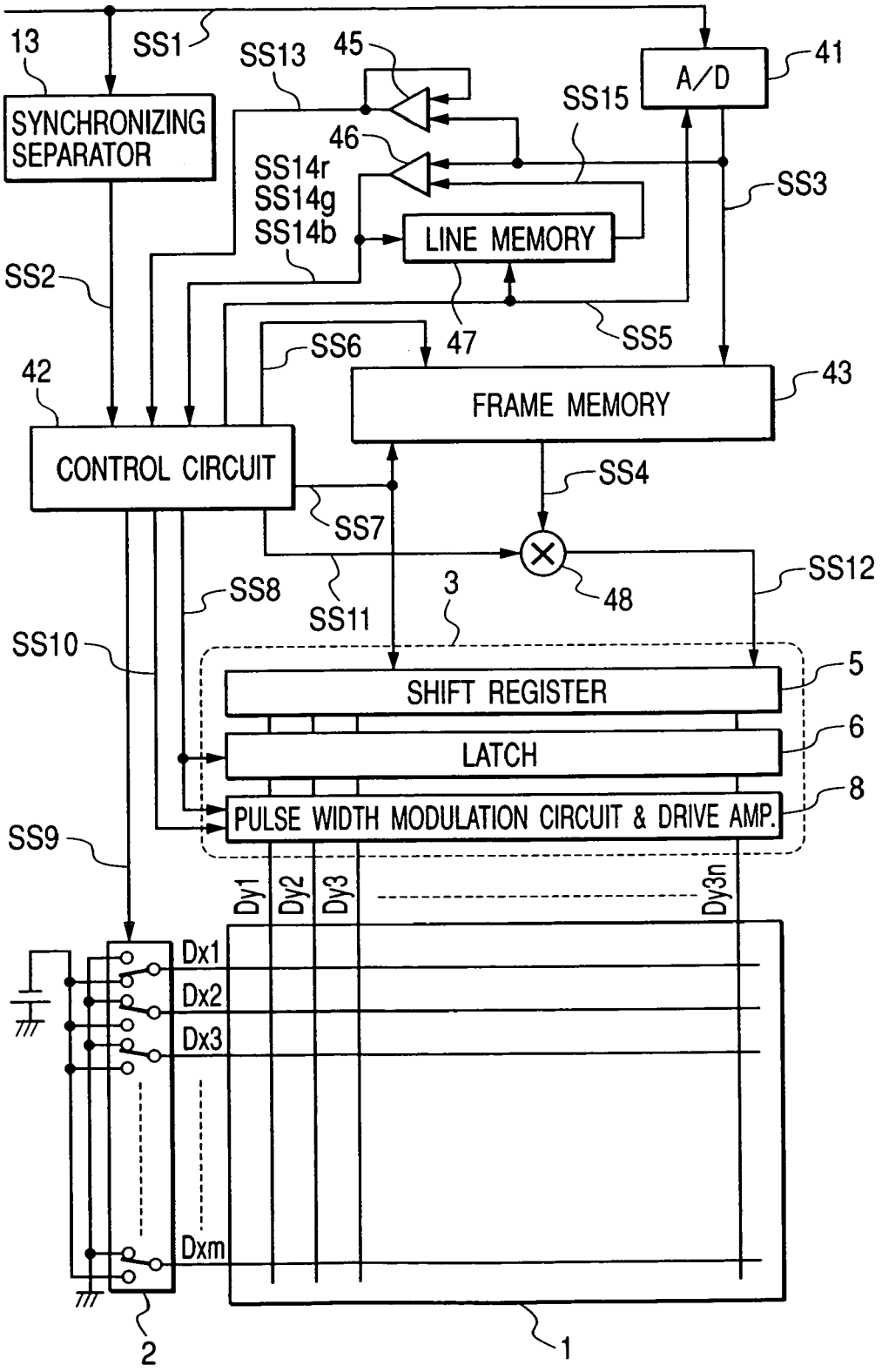
FIG. 72 is a block diagram showing an outline of a display apparatus according to Embodiment 12 of the present invention.

FIG. 72 shows the structure of image display apparatus according to Embodiment 12.

Denoted by 45 and 46 are comparators, which compare two input signals and output a larger one of the two. 47 denotes a line memory built from a shift register capable of storing one scanning line of data of an image signal. 48 is a multiplier as an image signal rewriting measure. Here, the comparators 45 and 46 and the line memory 47 constitute a memory reference measure. At least the comparators 45 and 46, the line memory 47, and the multiplier 48 are integrated into integrated circuit chips or a one-chip integrated circuit.

A writing signal SS3 and an output of the comparator 45 are inputted to the comparator 45. The comparator 45 obtains a horizontal maximum value SS13 that is the maximum value of the signal SS3 for each scanning line by receiving a not-shown clear signal for each scanning line.

The comparator 46 receives the signal SS3 and an output of the line memory 47. An output of the comparator 46 is inputted to the line memory 47. The line memory 47 shifts the content by one in sync with a conversion timing signal S5. The content of the line memory is cleared for every frame by a not-shown clear signal. In this way vertical maximum values S14*r*, S14*g*, and S14*b* can be obtained for the respective R, G, and B.

The image signal rewriting measure 12 outputs the result of multiplying a reading signal SS4 by a multiplication constant SS11 as a display image signal.

Calculation steps in the control circuit 42 follow the flow obtained by modifying the flow of FIG. 70 as described below.

First, Step P1 is omitted.

In Step P2, maximum values LHm(1) to LHm(m) of image data level of the respective rows are obtained by an expression $$LHm(y)=\mathrm{MAX}\{SS13, Lmin\}$$

In Step P5, maximum values LVm(1) to LVm(n) of image data level of the respective rows are obtained by an expression $$LVm(x)=\mathrm{MAX}\{(SS14r, SS14g, SS14b), Lmin\}$$

In Step P9, the flow is modified to "Output Am value as multiplication constant SS11".

The rest of this embodiment regarding the apparatus structure and calculation steps is the same as Embodiment 10.

Figure 73:
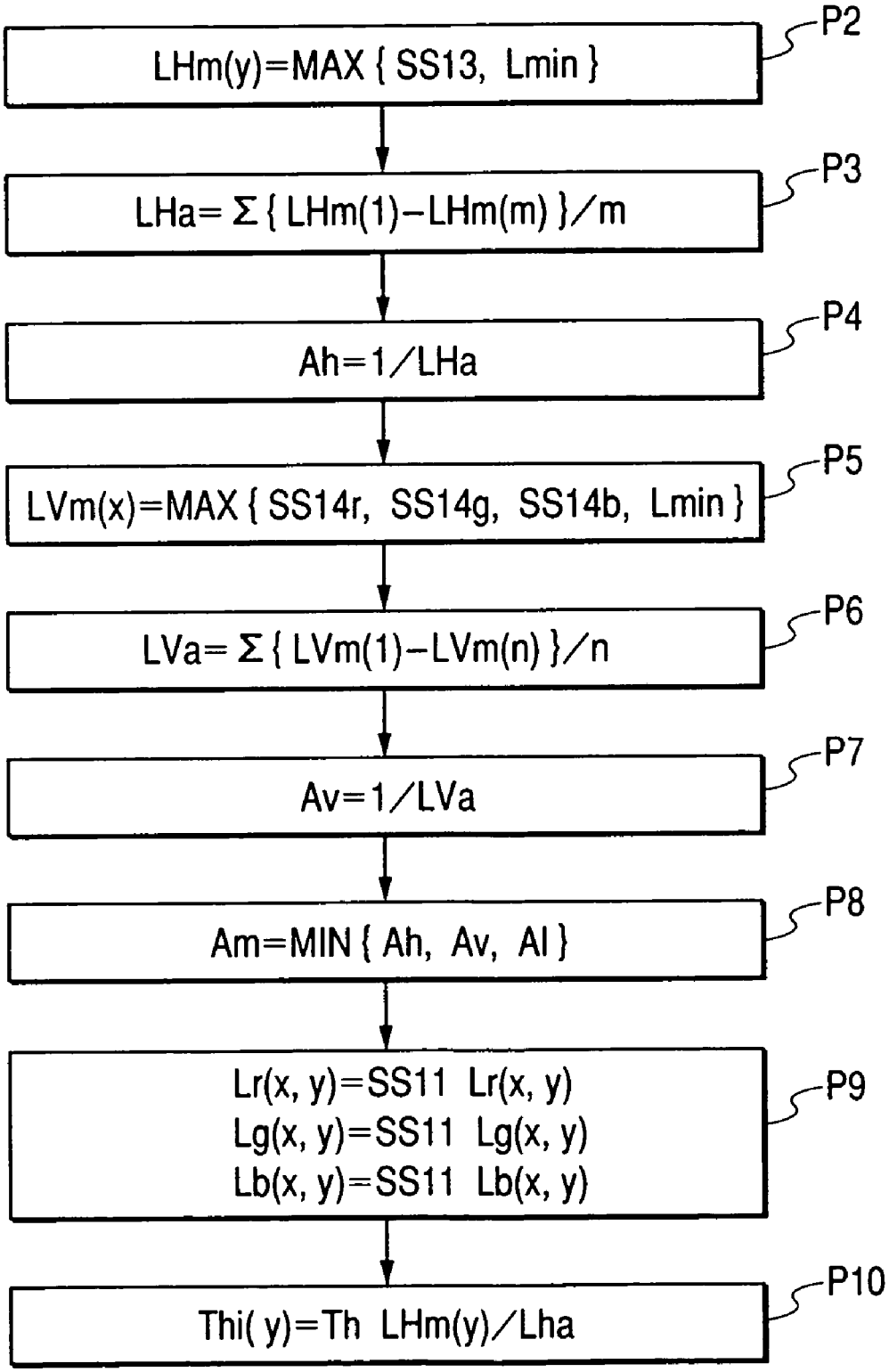
FIG. 73 is a flow chart of arithmetic processing.

The flow of calculations in this embodiment is shown in FIG. 73.

By employing this embodiment, calculation load in the control circuit 42 can be reduced greatly. This embodiment is effective when a general-purpose microcomputer with slow calculation speed has to be used as the control circuit 42 in display apparatus having a large number of pixels.

Embodiment 13

The effect of Embodiment 12 can be obtained without using the image signal rewriting measure 12 if the PWM clock SS10 supplied to the modulation circuit 8 is changed.

In order to change the PWM clock SS10, an oscillation circuit having PPL, for example, as an oscillator is used.

Figure 74:
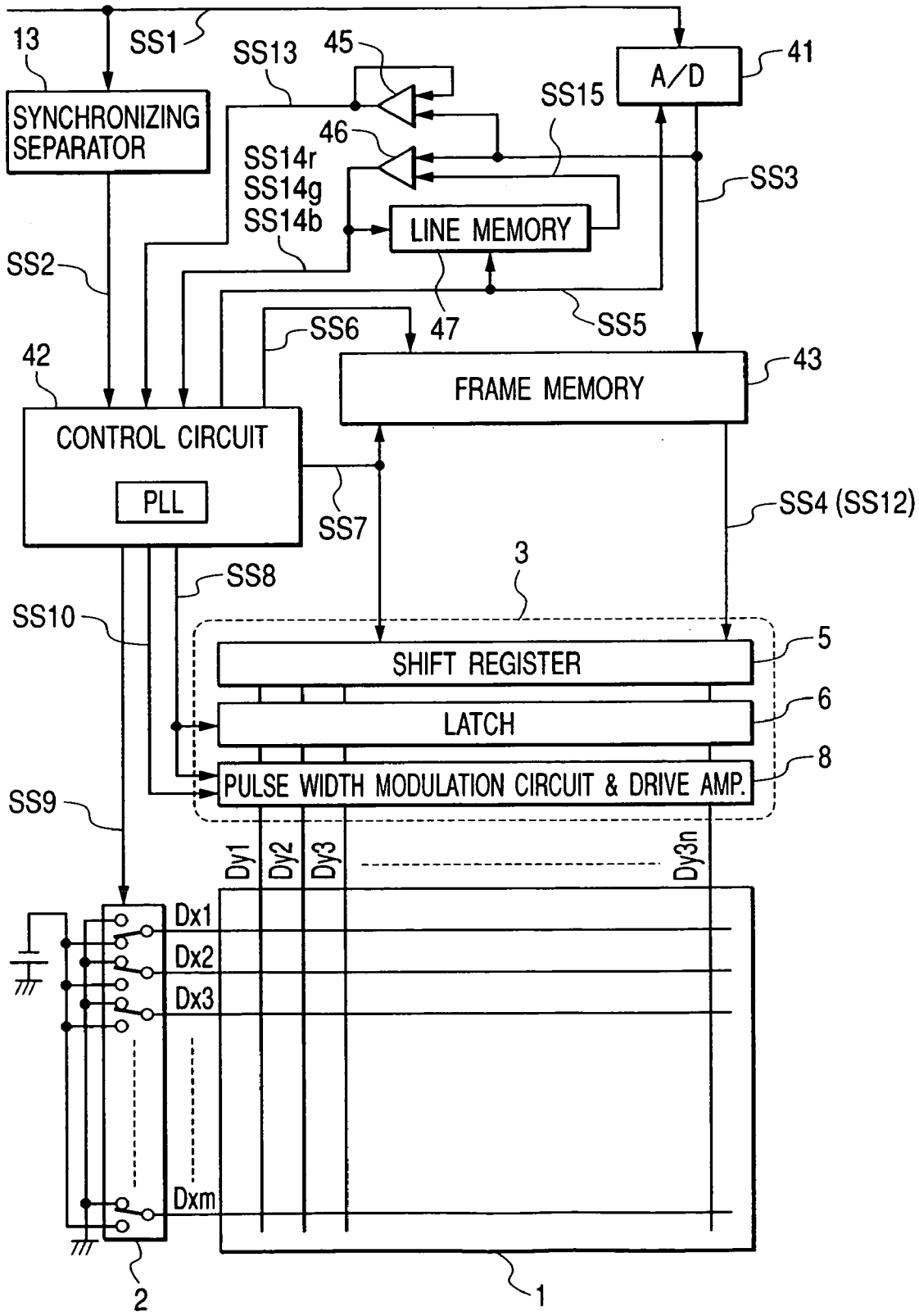
FIG. 74 is a block diagram showing an outline of a display apparatus according to Embodiment 13 of the present invention.

The structure of the display apparatus of this embodiment is shown in FIG. 74.

Figure 75:
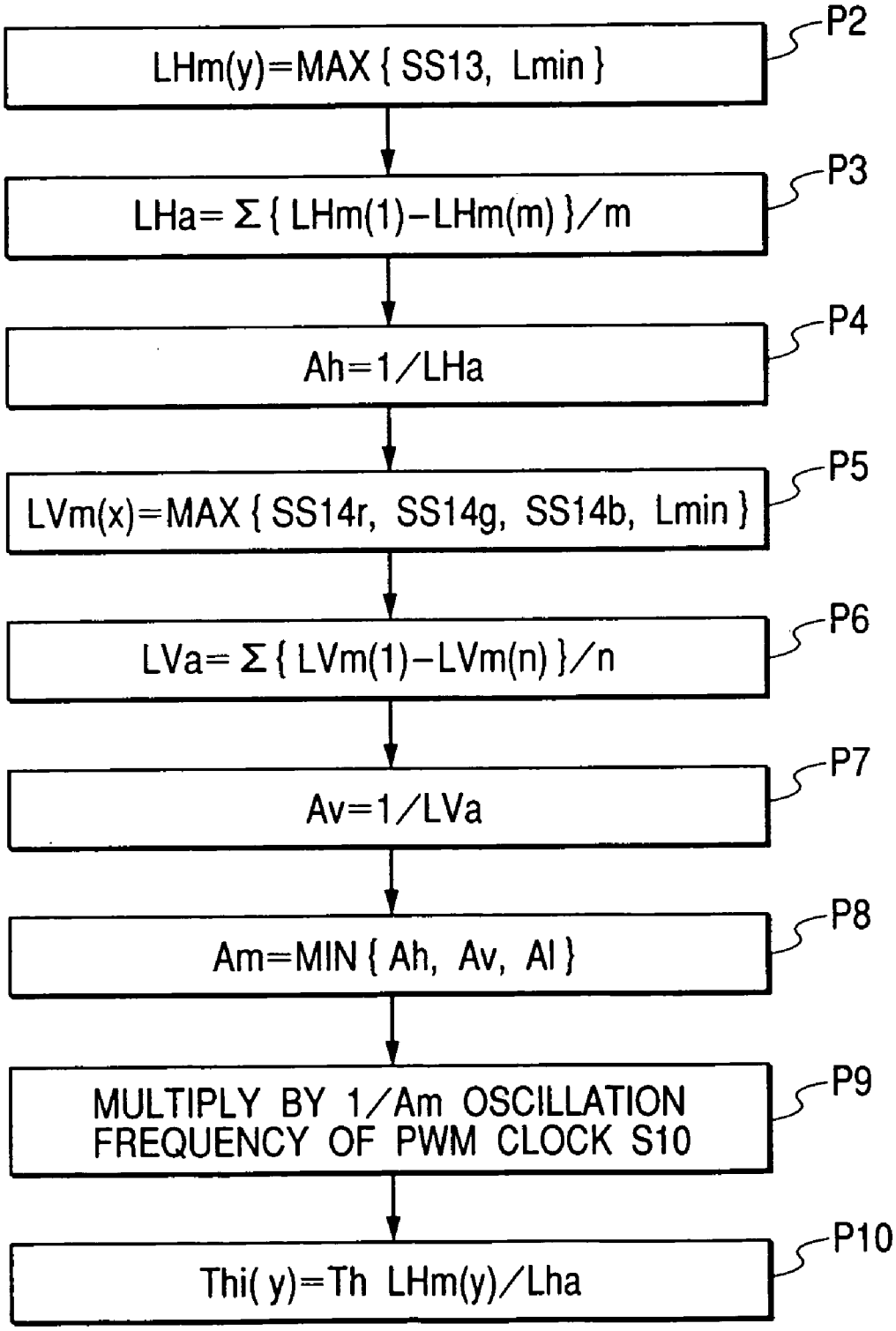
FIG. 75 is a flow chart of arithmetic processing.

FIG. 75 is a flow chart of calculations in this embodiment. This calculation flow is obtained by modifying Step P9 in the processing flow of FIG. 73. As a result of modification, Step P9 is now read as "Control oscillation circuit of not-shown PWM clock SS10 in controller 42 to multiply oscillation frequency of PWM clock SS10 1/Am times".

This changes the operation speed of the pulse width modulation circuit to change the length of light emission period of a selected pixel. As a result, the overall brightness of the screen is changed.

This structure omits an image signal rewriting measure and uses the reading signal SS4 as it is for the display signal SS12. The rest of this embodiment regarding the apparatus structure and calculation steps is the same as Embodiment 12.

According to Embodiments 10 through 13 of the present invention, a quality display image with high luminance can be obtained by utilizing the scanning period effectively.

In addition, the luminance can be adjusted such that an overall bright image is displayed with normal brightness and a partially bright image or overall dark image is displayed more brightly. Since this is a similar effect to ABL (automatic brightness limit circuit), the drive control method according to this embodiment may be employed as a control method for ABL.

It is also preferable to use in Embodiment 2 a clock signal PWMCLK having an oscillation frequency of 1/DGAIN instead of multiplying data by DGAIN. This method is free from the fear of reduction in gradation number.

As described in detail above, the present invention can provide a good quality image by increasing the peak luminance of an image to be displayed. Also, the present invention obtains a good quality image by not allowing an idle period.

What is claimed is:

1. A display driving method for driving a display with a plurality of scanning wirings and a plurality of modulation wirings, comprising:

a step of supplying a scan selection signal to a scanning wiring selected out of the plural scanning wirings for each horizontal scanning period; and a step of supplying a modulation signal modulated in accordance with image data to the plural modulation wirings for each horizontal scanning period, wherein the selection period of the scan selection signal supplied to one scanning wiring is different from the selection period of the selection signal supplied to another scanning wiring in a vertical scanning period, and the selection period of the scan selection signal supplied to the scanning wiring in a horizontal scan period is determined so as to have a length according to a maximum duration of modulation signals supplied to the modulation wirings in the horizontal scanning period.

2. A driving method according to claim 1, wherein the selection period of the scan selection signal supplied to the scanning wiring is set and the duration of a modulation signal supplied to the modulation wirings in a horizontal scanning period is determined in accordance with the set selection period.

3. A driving method according to claim 2, wherein the image data receives gain adjustment at a magnification set in accordance with each horizontal scanning period, and then is supplied to a modulation drive circuit.

4. A driving method according to claim 1, wherein a horizontal scanning period is set, and the selection period of the scan selection signal supplied to the scanning wiring in the horizontal scanning period as well as the duration of a modulation signal supplied to the modulation wirings in the horizontal scanning period are determined in accordance with the set horizontal scanning period.

5. A drive control method according to claim 4, wherein the horizontal scanning period is determined in accordance with the maximum image data and average image data of pixels of each row.

6. A drive control method according to claim 4, wherein image data is corrected in accordance with at least the maximum image data of each row or column, and image data stored in the memory is replaced by the adjusted image data.

7. A driving method according to claim 1, wherein the selection period of the scan selection signal supplied to a scanning wiring is determined in accordance with the maximum value of display luminance or adjusted image data of pixels on the selected scanning wirings.

8. A driving method according to claim 1, wherein an upper limit value or lower limit value, or both, are set for a horizontal scanning period and the horizontal scanning period is changed within a variable range set by the limit value(s).

9. A driving method according to claim 1, wherein the frame scanning period of a display image, which is determined by the sum of the horizontal scanning periods, is kept constant at least for over several frame scanning periods.

10. A driving method according to claim 1, wherein a lower limit value is set for the horizontal scanning period and, when the maximum duration of a modulation signal supplied to the modulation wirings in the horizontal scanning period does not reach the lower limit value, a blanking period is added to the modulation signal.

11. A driving method according to claim 1, wherein a lower limit value is set for the horizontal scanning period and, when the selection period of the scan selection signal supplied in the horizontal scanning period does not reach the lower limit value, a blanking period is added to the scan selection signal.

12. A driving method according to claim 1, wherein an upper limit value is set for the horizontal scanning period and the duration of a modulation signal is determined such that the maximum duration of the modulation signal supplied to the modulation wirings in the horizontal scanning period does not exceed the upper limit value.

13. A driving method according to claim 12, wherein the upper limit value is a value obtained by subtracting a given blanking period from the horizontal scanning period.

14. A driving method according to claim 1, wherein the length of the horizontal scanning period is controlled with the clock number as reference.

15. A driving method according to claim 1, wherein the image data includes luminance data of an image signal inputted and at least the duration of the modulation signal is modulated in accordance with the luminance data.

16. A driving method according to claim 1, wherein the image data includes luminance data and correction data of an image signal inputted and at least the duration of the modulation signal is determined in accordance with the luminance data and with the correction data.

17. A driving method according to claim 16, wherein the correction data is correction data for compensating the difference between a desired luminance and display luminance.

18. A driving method according to claim 16, wherein the correction data is correction data for compensating a change in voltage applied to a display device due to voltage drop taking place in the scanning wiring.

19. A driving method according to claim 1, wherein a horizontal scanning period of a pixel on a scanning wiring at the center of a screen of a display apparatus is longer than at least a horizontal scanning period of a pixel on another scanning wiring around the top or bottom of the screen.

20. A driving method according to claim 1, wherein the horizontal scanning period is determined by changing the frequency of a clock signal.

21. A display apparatus comprising:

a display having a plurality of scanning wirings and a plurality of modulation wirings;

a scan drive circuit for supplying a scan selection signal to a scanning wiring selected out of the plural scanning wirings for each horizontal scanning period; and a modulation drive circuit for supplying a modulation signal modulated in accordance with image data to the plural modulation wirings for each horizontal scanning period, wherein the apparatus further comprises a drive control circuit for controlling the scan drive circuit such that the selection period of the scan selection signal supplied to one scanning wiring is different from the selection period of the selection signal supplied to another scanning wiring in a vertical scanning period, and the drive control circuit detects, from an inputted image signal, the maximum value of luminescence data in each horizontal scanning period, and sets the selection period of the scan selection signal in accordance with the said maximum value.

22. A display apparatus according to claim 21, wherein the drive control circuit detects from an image signal inputted the maximum value of adjusted image data obtained by correcting luminance data in each horizontal scanning period, and sets the selection period of the scan selection signal in accordance with the maximum value.

23. A display apparatus according to claim 21, wherein the drive control circuit determines the selection period of the scan selection signal and the duration of the modulation signal in accordance with a horizontal scanning period set within a variable range in which a horizontal scanning period is allowed to change.

24. A display apparatus according to claim 21, wherein the drive control circuit detects from an image signal inputted the maximum value of adjusted image data obtained by correcting luminance data in each horizontal scanning period, and sets the selection period of the scan selection signal in accordance with the maximum value, and wherein at least one horizontal scanning period is adjusted such that a vertical scanning period of a display image, which is determined by the sum of the horizontal scanning periods, reaches a given value.

25. A display apparatus according to claim 21, wherein the drive control circuit is provided with a frame memory for storing one frame of adjusted image data obtained from an inputted image signal by correcting luminance data in each horizontal scanning period in order to adjust horizontal scanning periods.

26. A display apparatus according to claim 25, wherein the frame memory has two frame memories and is controlled such that data is read out of one of the frame memories while data is written in the other.

27. A display apparatus according to claim 25, wherein adjusted image data of one horizontal scanning period are read out of the frame memory in layers in parallel, and the layers of adjusted image data are inputted to a plurality of shift registers provided for each layer.

28. A display apparatus according to claim 21, wherein the drive control circuit determines the selection period of the scan selection signal and the duration of the modulation signal in accordance with each of set horizontal scanning periods.

29. A display apparatus according to claim 21, wherein the vertical scanning period of a display image, which is determined by the sum of the horizontal scanning periods, is kept constant at least for over several vertical scanning periods.

30. A display apparatus according to claim 21, wherein the drive control circuit adjusts the image data in accordance with a set horizontal scanning period.

31. A display apparatus according to claim 30, wherein, after the image data is adjusted, the modulation drive circuit generates the modulation signal from the image data.

32. A display apparatus according to claim 21, wherein the display is a self-luminous display.

33. A display apparatus according to claim 21, wherein the display has a plurality of display devices including an electron-emitting device.

34. A drive control method for use in the display apparatus of claim 21, wherein a timing signal for determining the horizontal scanning period is generated.

35. A program for carrying out a drive control method of claim 34.

36. An integrated circuit for carrying out a drive control method of claim 34.

37. A design property for designing an integrated circuit to carry out a drive control method of claim 34.

38. Display apparatus according to claim 21, wherein the horizontal scanning period is determined by changing the frequency of a clock signal.

39. A drive control method according to claim 34, wherein the horizontal scanning period is determined by changing the frequency of a clock signal.

40. A display driving method for driving a display with a plurality of scanning wirings and a plurality of modulation wirings, comprising:

a step of supplying a scan selection signal to a scanning wiring selected out of the plural scanning wirings for each horizontal scanning period; and a step of supplying a modulation signal to the plural modulation wirings for each horizontal scanning period, wherein the modulation signal is pulse width modulated in accordance with image data, and wherein the selection period of the scan selection signal supplied to one scanning wiring is different from the selection period of the selection signal supplied to another scanning wiring in a vertical scanning period.

41. A display apparatus comprising:

a plurality of scanning wirings;

a plurality of modulation wirings;

a scan drive circuit for supplying a selection signal to a scanning wiring; and a modulation drive circuit for supplying modulation signals to modulation wirings, wherein a pulse width of the modulation signal is modulated in accordance with an image data, and, in a vertical scanning period, a length of period in which a selection signal is supplied to one scanning wiring is longer than a length of period in which a selection signal is supplied to another scanning wiring, and the length of period in which the selection signal is supplied to one scanning wiring is determined in accordance with the image data of pixels on said one scanning wiring and the length of period in which the selection signal is supplied to another scanning wiring is determined in accordance with the image data of pixels on said another scanning wiring.

42. A display apparatus according to claim 41, wherein the image data is luminous data.

* * * * *

UNITED STATES PATENT AND TRADEMARK OFFICE

CERTIFICATE OF CORRECTION

PATENT NO. : 7,292,236 B2
APPLICATION NO. : 11/141383
DATED : November 6, 2007
INVENTOR(S) : Naoto Abe et al.

It is certified that error appears in the above-identified patent and that said Letters Patent is hereby corrected as shown below:

SHEET 15:

Fig. 13B, "ADJUSED" should read --ADJUSTED--.

COLUMN 3:

Line 27, "reference;" should read --a reference.--.

COLUMN 4:

Line 42, "other;" should read --other.--.

COLUMN 6:

Line 31, "adjusted" should read --an adjusted--.

COLUMN 9:

Line 27, "in accordance with their luminance levels" should read --modulation signal Sx1, Sx2, or Sx3 is applied to one of the modulation wirings--;
Line 29, move the lines at col. 9, line 29 through 52, and insert in col. 10 between lines 7 and 8;
Line 51, delete "signal Sx1, Sx2, or Sx3 is applied to one of"; and
Line 52, delete "the modulation wirings".

COLUMN 10:

Line 7, "modulation" should read --in accordance with their luminance levels.--.

COLUMN 11:

Line 67, "on" should read --on a--.

COLUMN 12:

Line 24, "like other" should read --other like--.

COLUMN 14:

Line 14, "image" should read --images--.

UNITED STATES PATENT AND TRADEMARK OFFICE

CERTIFICATE OF CORRECTION

PATENT NO. : 7,292,236 B2
APPLICATION NO. : 11/141383
DATED : November 6, 2007
INVENTOR(S) : Naoto Abe et al.

It is certified that error appears in the above-identified patent and that said Letters Patent is hereby corrected as shown below:

COLUMN 17:

Line 10, “electron” should read --electrons--.

COLUMN 22:

Line 14, “a 43 dxrt/rr3” should read --a43=dxrt/rr3--; and
Line 32, “Ifi” should read --If i--.

COLUMN 25:

Line 9, “electron” should read --electrons--.

COLUMN 26:

Line 38, “amount” should read --amounts--; and
Line 55, “by” should be deleted.

COLUMN 36:

Line 23, “register 10b.” should read --register 101b.--.

COLUMN 45:

Line 47, “stops” should be --stop--.

COLUMN 53:

Line 25, “KHDI” should read --KHDi--.

COLUMN 54:

Line 33, “KHDi.” should read --KHDi--.

COLUMN 65:

Line 27, “is” should read --are--.

UNITED STATES PATENT AND TRADEMARK OFFICE

CERTIFICATE OF CORRECTION

PATENT NO. : 7,292,236 B2
APPLICATION NO. : 11/141383
DATED : November 6, 2007
INVENTOR(S) : Naoto Abe et al.

It is certified that error appears in the above-identified patent and that said Letters Patent is hereby corrected as shown below:

COLUMN 79:

Line 38, close up right margin;
Line 39, close up left margin; and
Line 40, close up left margin.

Signed and Sealed this

Twenty-third Day of September, 2008

JON W. DUDAS
*Director of the United States Patent and Trademark Office*